United States Patent [19]

Monte et al.

[11] Patent Number: 5,003,859

[45] Date of Patent: Apr. 2, 1991

[54] PERCUSSIVE ACTION MODULAR ELECTRONIC KEYBOARD

[75] Inventors: Charles Monte, 8519 Woodley Ave., Sepulueda, Calif. 91343; Paul J. White; Anne C. Graham, both of Los Angeles, Calif.

[73] Assignee: Charles Monte, Van Nuys, Calif.

[21] Appl. No.: 311,601

[22] Filed: Feb. 16, 1989

[51] Int. Cl.[5] ..... G10C 3/12

[52] U.S. Cl. ..... 84/423 R; 84/433

[58] Field of Search ..... 84/1.01, 1.09, 1.1, 84/1.27, 19–23, 236, 243, 258, 423 R, 433–436, DIG. 7, DIG. 17; 200/5 R, 5 A; 341/22, 27, 34

[56] References Cited

U.S. PATENT DOCUMENTS

| | | | |
|---|---|---|---|
| 4,102,233 | 7/1978 | Kern | 84/258 |
| 4,380,947 | 4/1983 | Nishimoto | 84/DIG. 17 |
| 4,679,477 | 7/1987 | Monte | 84/DIG. 7 |
| 4,704,931 | 11/1987 | Nagai et al. | 84/1.01 |

*Primary Examiner*—Stanley J. Witkowski

[57] ABSTRACT

An improved percussive action electronic keyboard for play as a musical instrument of the type having pivoted playing keys having camming surfaces distal from finger contact surfaces thereof, pivoted hammers having cam follower surfaces for following the playing key camming surfaces, hammer stop for stopping the swing of the hammer in response to depression of its associated key, includes an electronic sensor for generating an electrical signal for each key which is related in amplitude to the pressure with which the key is depressed during play of the keyboard, and a scanning keyboard state monitor connected to said sensor including a keyboard scanner for scanning each of the keys of the keyboard to determine if a key event has occurred, an amplitude comparator for determining when a key depression causes a said key depression signal amplitude to pass predetermined minimum and maximum amplitude threshold values, a scan counter for counting the number of scans occurring between the scans when the key depression amplitude signal passes between the minimum and maximum amplitude threshold values and a digital output for putting out the number of scans as a digital value. A programmed microprocessor is connected to receive the digital value scan count for a key and converts the scan count into a key velocity signal.

9 Claims, 39 Drawing Sheets

PERCUSSIVE ACTION MODULAR ELECTRONIC KEYBOARD

FIELD OF THE INVENTION

The present invention relates to a percussive action electronic musical instrument keyboard. More particularly, the present invention relates to a number of improvements in a percussive action silent electronic keyboard which aid its manufacturability, extend its adaptability to a wide variety of tactile playing conditions and responses, and provide extended programmability as a data source for digital musical generation.

RELATED PATENT

The present invention is directly related to U.S. Pat. No. 4,679,477, issued on July 14, 1987, for Percussive Action Silent Electronic Keyboard, the disclosure of which is incorporated by reference.

BACKGROUND OF THE INVENTION

While the concepts disclosed in the referenced U.S. Pat. No. 4,679,477 have proven to be most valuable and useful, the keyboard device described therein was essentially a pre-production, handmade prototype which was not readily adapted for mass production. Also, it lacked many useful features and adjustments which, when included in the keyboard, greatly extend its ease of manufacture, flexibility and usefulness as a source of programmable data for digital musical sound generation.

SUMMARY OF THE INVENTION WITH OBJECTS

A general object of the present invention is to provide a programmable, percussive action, electronic keyboard for musical sound generation which overcomes limitations and drawbacks of the prior art.

A specific object of the present invention is to provide a percussive keyboard action and electronic data entry device which is comprised of molded and formed elements which may be snap locked together and adjusted at the factory and by the user in order to provide the keyboard with a wide variety of tactile characteristics and responses to the player.

Another specific object of the present invention is to provide modular percussive action units including the keys, and hammer assemblies which may be formed into percussive action keyboards having a selectable number of playing keys.

One more specific object of the present invention is to provide a key and hammer assembly for a percussive action electronic keyboard which may be adjusted to simulate the tactile response ('kerchunk') of the action of an acoustical piano when the jack comes in contact with the regulation button thus pulling the jack out from under the hammer butt knuckle just before the hammer comes in contact with the string.

Yet another specific object of the present invention is to provide a hammer and flange assembly which includes at least one hammer bounce, vibration dampening mechanism and which maintains proper hammer alignment in the resting position.

A still further specific object of the present invention is to provide a hammer assembly with a slideable hammer weight, thereby enabling the hammer mass to be adjusted at the factory and by the player in the field.

One more specific object of the present invention is to provide a percussive action keyboard which enables player adjustment of the sensitivity and multiple dynamic velocity ranges of the keyboard.

One further specific object of the present invention is to provide a percussive action electronic keyboard with vastly improved and extended data entry and programmability capability including the playing keys as program data entry ports.

An improved percussive action electronic keyboard is provided for play as a musical instrument of the type having pivoted playing keys having camming surfaces distal from finger contact surfaces thereof, pivoted hammers having cam follower surfaces for following the playing key camming surfaces, a hammer stop for stopping the swing of the hammer in response to depression of its associated key, an electronic sensor for generating an electrical signal for each key which is related in amplitude to the pressure with which the key is depressed during play of the keyboard, and a scanning keyboard state monitoring circuit connected to the sensor including keyboard scanner for scanning each of the keys of the keyboard to determine if a key event has occurred, an amplitude comparator for determining when a key depression causes a key depression signal amplitude to pass predetermined minimum and maximum amplitude threshold values, a scan counter for counting the number of scans occurring between the scans when the key depression amplitude signal passes between the minimum and maximum amplitude threshold values and a digital output for putting out the number of scans as a digital value. A programmed microprocessor is connected to receive the digital value scan count for a key and converts the scan count into a key velocity signal. A keyboard setup memory is connected to the microprocessor for recording user provided setup parameters for operation of the keyboard; and, the microprocessor is programmed to operate the keyboard in accordance with the setup parameters recorded in the keyboard setup memory. A programmable output path is connected to the microprocessor for putting out the key velocity signal to music generation equipment via the programmable output path.

In one aspect of the present invention the keyboard has a performance mode during which the playing keys emulate play of the musical instrument and has an edit mode during which the playing keys act as data entry ports for entry of the setup parameters provided by the user.

In another aspect of the present invention a disk file subsystem is connected to the microprocessor for recording as disk files a plurality of different user provided setup parameters for operation of the keyboard.

In a further aspect of the present invention the scanning keyboard state monitoring circuit includes aftertouch, i.e. key pressure, determining circuitry for determining the pressure with which a key is depressed during play.

In one more aspect of the present invention the electronic sensor comprises force sensitive resistance material having an electrical resistance characteristic which is inversely related to the force with which the material is urged toward electrical conductors.

In yet another aspect of the present invention the electronic sensor comprises an XYZ force sensitive array.

In a still further aspect of the present invention the electronic sensor comprises a continuous film substrate carrying a force sensitive resistance coating on at least one side and at least one printed circuit substrate carrying arrays of interleaved conductors forming individual sense cells for each key of the keyboard facing the one side.

In one more aspect of the present invention a strip of elastomeric material is placed between the keys and the continuous film substrate.

In a still further aspect of the present invention individual sense cells are grouped into predetermined groups and the keyboard scanner includes a group select for individually enabling each group of the groups and the cells within each group are individually connected to plural scan buses, there being in number as many scan buses as there are cells within each group, so that by enabling a group and then by scanning each scan bus, each key of the keyboard may thereby be scanned in its turn.

In one more aspect of the present invention an action rail is provided for aligning the cam follower surfaces of the pivoted hammers relative to the camming surfaces of the playing keys, and each camming surface and cam follower surface has a first positional relationship which establishes a continuously following action arrangement and having a second positional relationship which establishes a discontinuous following action arrangement providing kerchunk. The action rail is adjustable to position the pivoted hammers between the first positional relationship and the second positional relationship.

In yet one more aspect of the present invention an action rail is provided for aligning the cam follower surfaces of the pivoted hammers relative to the camming surfaces of the playing keys, the action rail defining a longitudinal slot for receiving at least one preformed hammer flange in snap locking arrangement therein. At least one preformed hammer flange defines a plurality of hammer stations adapted to receive a hammer in snap locking arrangement therewith. Each of the pivoted hammers includes a journal adapted to snap lock into any one of the hammer stations of the hammer flange.

In one more aspect of the present invention each of pivoted hammers includes a tapered web region radially extending from the journal; and, each hammer station includes a pair of blades facing the tapered web region, the blades contacting the web when the hammer is located in a rest position and the blades moving out of contact with the web as the hammer moves toward the striking position.

In yet another aspect of the present invention the hammer flange includes an adjustable hammer locus adjustment screw, and each pivoted hammer includes a radially extending shelf adapted to contact the screw when the hammer is in a rest position, the screw enabling adjustment of the rest position of the pivoted hammer and further providing simultaneous hammer bounce dampening when the hammer is abruptly returned to resting position during play.

In still one more aspect of the present invention the hammer flange is formed of moldable material, the hammer locus adjustment screw is formed of a material which is dissimilar to the material of the hammer flange and the screw is integrally molded into the flange during the manufacturing process. The molding process permits the use of an optional length screw or for manufacture of a flange without screws.

In yet another aspect of the present invention the hammer flange includes an adjustable hammer locus adjustment screw, and each pivoted hammer includes a radially extending shelf adapted to contact the screw when the hammer is in a rest position, and each hammer has a leaf spring connected thereto by a bridle strap, the bridle strap including an end extension adapted to cover and thereby provide padding to the shelf for damping the contact between the adjustment screw and the shelf as the hammer returns to its rest position following actuation during play.

In still one more aspect of the present invention leaf springs are connected to each pivotal hammer by bridle straps and a leaf spring pivot rail mounts the leaf spring and enables common rotational and twist adjustment of all of the leaf spring means. Leaf spring pivot rail bushings enable the leaf spring pivot rail to be set at a predetermined distance relative to the pivoted hammers. The bridle strap is factory adjustable in length to accommodate the predetermined relative distance between the leaf spring and the pivoted hammer to which it is attached.

In still one more aspect of the present invention an improved hammer includes a hammer shank having a top rail with hammer weight holding and positioning structure; a hammer head is positioned at a free end of the hammer for engagement with the hammer stop; a hammer journal end with structure for mounting the hammer on a flange for pivoted action; and, a user and/or manufacturer adjustable hammer weight having engagement structure for engaging the hammer weight holding and positioning structure at a position selectable by the user or manufacturer; thereby setting the weight of the hammer.

Further objects, aspects, advantages and features of the present invention will be more fully understood and appreciated by consideration of the following detailed description of a preferred embodiment, presented in conjunction with the accompanying drawings.

BRIEF DESCRIPTION OF THE DRAWINGS

In the Drawings:

FIG. 1 is a side view in elevation of a hammer which snap-locks into the FIG. 8 hammer flange at one of the 12 hammer stations thereof.

FIG. 18 is a diagrammatic view in front elevation of the leaf spring pivot rail and the leaf spring relief bar of the FIG. 1 keyboard.

DETAILED DESCRIPTION OF A PREFERRED EMBODIMENT

Description of Keyboard Mechanism

Figure 1:
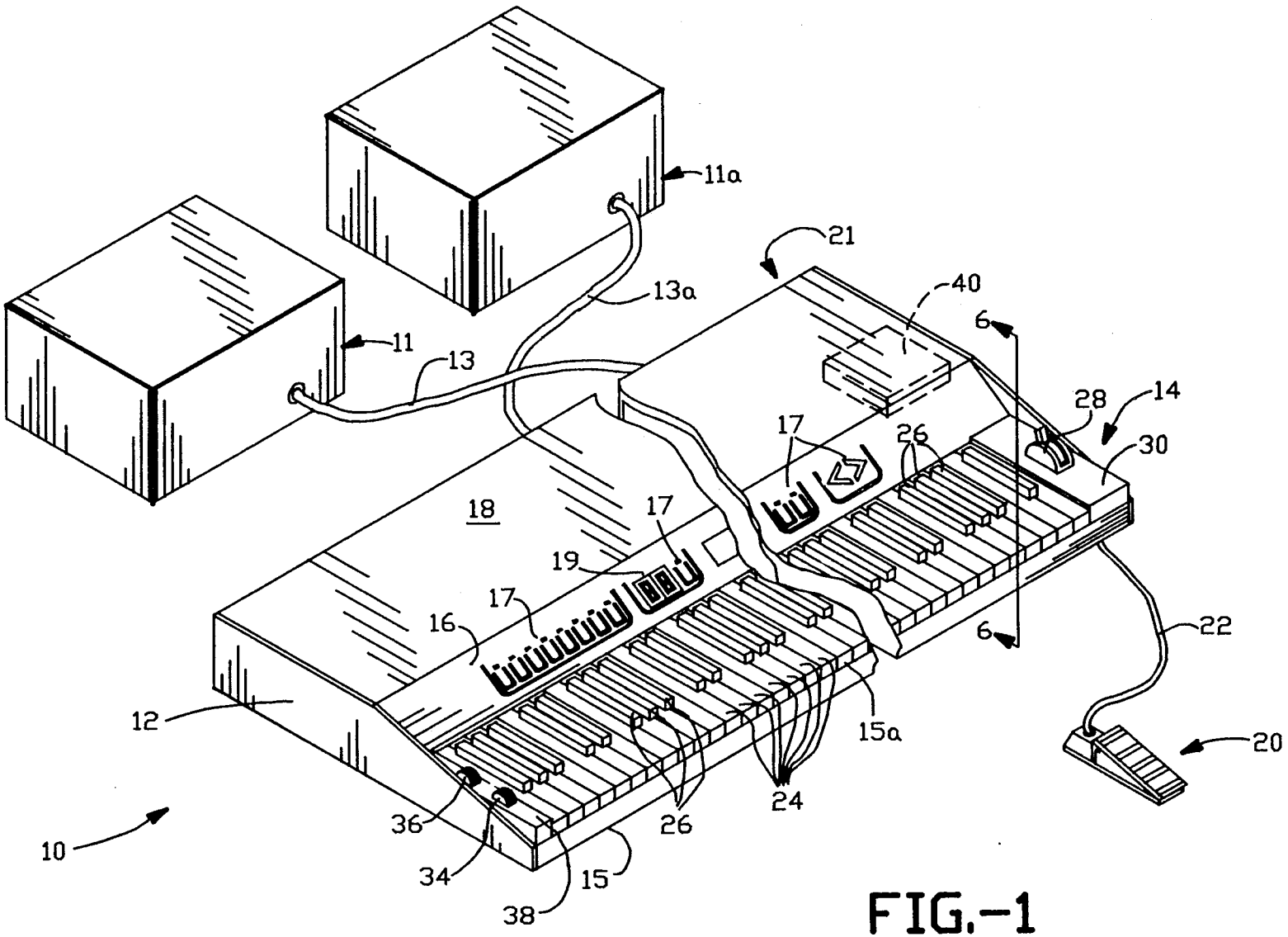
FIG. 1 is a diagrammatic view in perspective of an improved percussive action electronic keyboard shown connected by a cable to plural electronic musical sound generation devices, the keyboard incorporating the principles of the present invention.

As seen in FIG. 1, an improved percussive action electronic keyboard 10 includes a mounting base or substrate 15 to which a front panel 15*a*, a left side panel 12, a right side panel 14, and a rear panel 21 are secured. A front control panel 16 containing pressure sensitive input switches 17, digital readout displays 19 and a top cover 18 are both mounted between the side panels 12 and 14.

The keyboard 10 is connected to one or more electronic music generation devices 11, 11*a* via suitable connecting cables 13, 13*a* which plug into a jack panel at the rear of the keyboard 10. The music sound generation devices 11, 11*a* may be a single or multiple stacked musical synthesizer or sampled sound generators, or other such sound generation devices, and ultimately connects to loudspeaking equipment for sound reproduction (not shown). The connection cables 13 and 13*a* enable a standard interface connection, e.g. a musical instrument digital interface (MIDI) connection, to be established between the keyboard 10 and the electronic music sound generation devices 11 and 11*a*.

A variable adjustment foot pedal 20 is connected to the keyboard 10 via a connection cable 22. The footpedal provides an electrical signal which is related in magnitude or value to present pedal position and can be programmed to control multiple selected MIDI control function parameters such as volume, pan, portamento, and data entry. A foot switch (not shown) may also be attached by a suitable connection cable to the keyboard 10 to enable the player to have programmable control of multiple selected MIDI control function parameters such as damper, sustain, soft, sequencer, start, stop, and continue. The footswitch can also be selected to control multiple MIDI system—exclusive messages, thus communicating with exclusive control parameters indicative of different manufacturer's MIDI products. The keyboard 10 accommodates simultaneously up to three foot pedals 20 and up to three foot switches.

In addition, program advance library (PAL)/edit mode foot switch (not shown) is used to facilitate selection of edit operations and, when PAL switch 80 is selected on and in play mode, to easily advance through a preprogrammed sequence of global set ups entered into the PAL.

In the keyboard 10 shown in FIG. 1, eighty eight grand-piano-scaled wooden white keys 24, and black keys 26 are provided in conventional keyboard arrangement. While it is possible to include more playing keys, it is often useful to configure keyboards with fewer than 88 keys, and the components comprising the keyboard 10 are readily adaptable at the factory to the assembly of keyboards having fewer keys, as may be desired.

Figure 6:
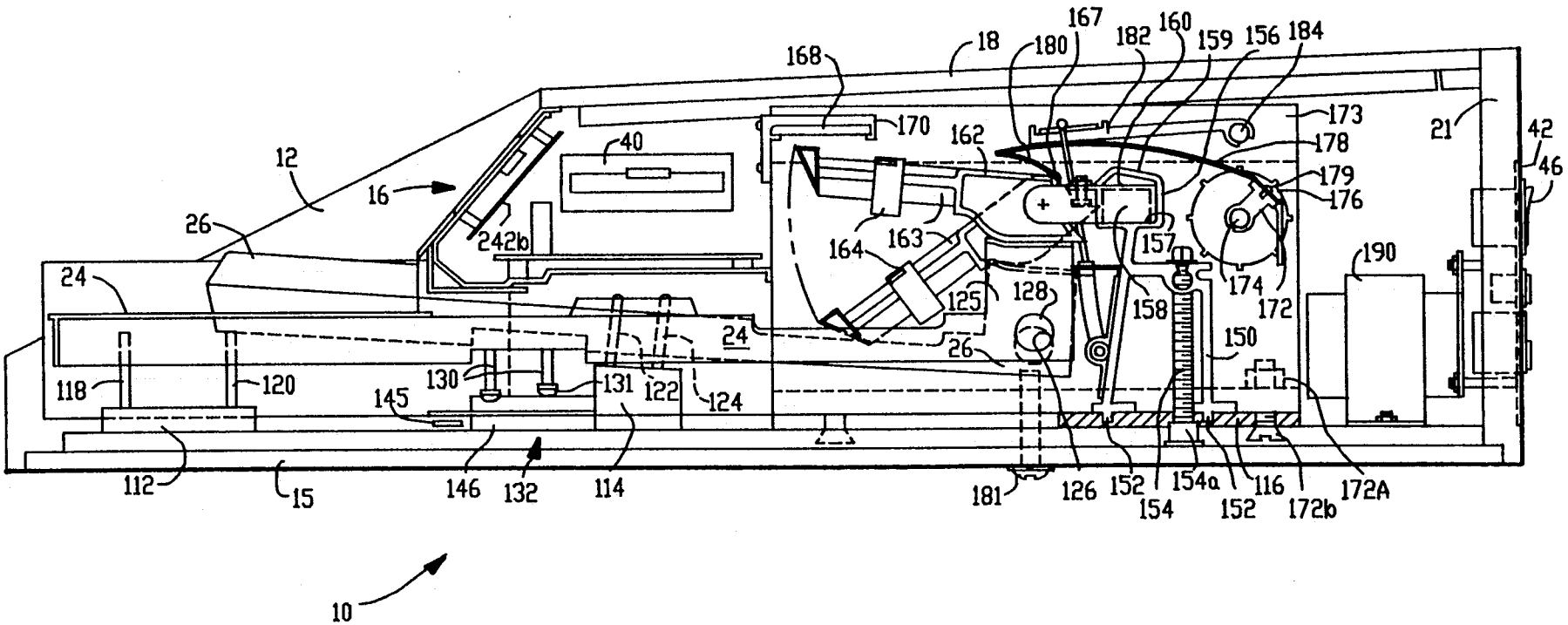
FIG. 6 is a somewhat diagrammatic right side section view in elevation of the FIG. 1 keyboard taken along the line 6—6 in FIG. 1.
Figure 18A:
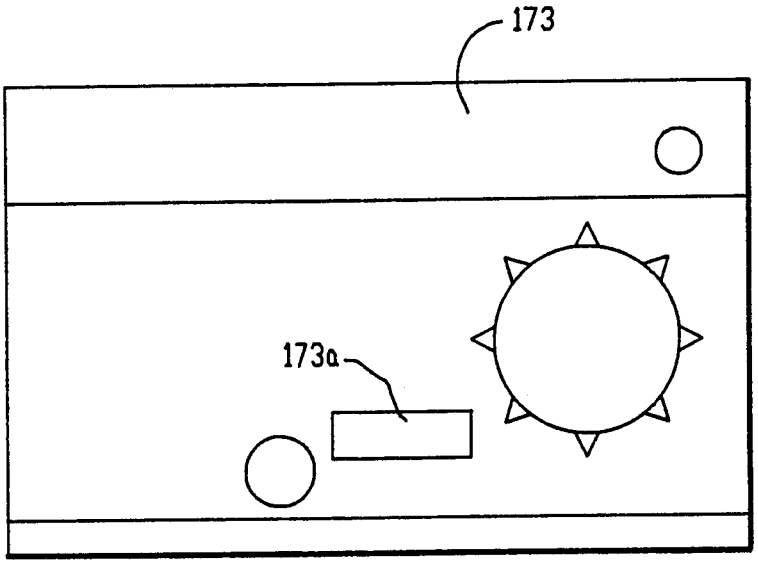
FIG. 18A is a front view of a portion of an end support block showing a slotted hole for connecting the end support block to the action rail.

A global mechanical action adjust wheel and lever 28 located in a right end raised portion 30 of the keyboard 10 connects to move a central wire relative to an outer shell of a coaxial control cable 32 (FIGS. 6 and 18*a*). The cable 32 connects to a leaf spring adjustment assembly which adjusts the preload tension simultaneously for all the leafsprings when the leafsprings contact all of the hammer assemblies during play.

Referring to FIG. 1, two controller wheels, a continuous movement wheel 34 and a continuous movement return to center wheel 36 are mounted within a left side raised portion 38 of the keyboard 10. The continuous movement controller wheel 34 provides an electrical signal which is related in magnitude or value to present position; and, when in play mode, is programmable to control multiple selected MIDI control functions. Wheel 34 will enable rapid, smooth and variable manipulative control of the selected parameters; and, when in edit mode, will provide rapid, smoothly variable selection of alpha/numeric data entry values for edit functions selected by the user. The continuous movement return to center wheel 36 is programmable to control pitch blending and multiple selected MIDI control functions; and, while enabling rapid, smoothly variable control, will return to a spring loaded center position and corresponding value.

A three and one half inch micro-floppy disk drive 40 is mounted in the keyboard 10 with disk access provided through the right side panel 14. The disk drive 40 enables an unlimited number and variety of keyboard setups, system exclusive MIDI sound patch libraries and system exclusive function control messages, user definable velocity scales, user definable controller reset messages, program advance libraries (PAL), any MIDI to disk recorded system exclusive file saved from any MIDI device through the keyboard 10, and software MIDI dump requests to be stored and retrieved, thereby greatly extending the flexibility of the keyboard 10.

Figure 2:
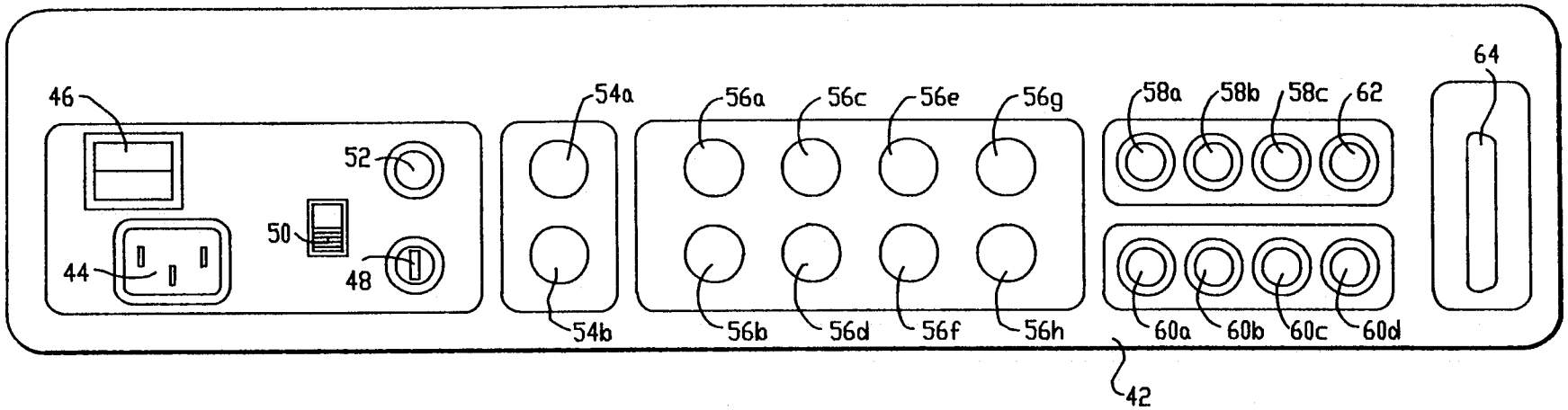
FIG. 2 is an enlarged diagrammatic view in elevation of a rear power switch and connection panel of the FIG. 1 keyboard.

Referring to FIG. 2, a rear panel 42 provides a jack 44 for primary power. A rocker switch 46 enables the user to apply primary power to the electronics circuitry within the keyboard 10. A fuse 48 protects the circuitry from overload. A switch 50 enables the user to select primary power level between 110 and 230 volts, so that the portable keyboard 10 may be used in foreign countries in which the primary wall power supply is 230 volts. A front panel lamp dimmer rheostat 52 enables adjustability of backlighting level at the front panel 16.

There are two MIDI input jacks 54*a* and 54*b*. These jacks enable MIDI signals to be received into the keyboard and processed therein. There are eight MIDI outport/processed thru port jacks 56*a*, 56*b*, 56*c*, 56*d*, 56*e*, 56*f*, 56*g* and 56*h*. These eight jacks enable eight simultaneous outputs to be transmitted by the keyboard 10 to external music generation devices 13, 13*a*, each output being programmably selected and configured within the keyboard 10. There are three MIDI assignable foot switch input jacks 58*a*, 58*b* and 58*c*; and there are four assignable foot pedal input jacks 60*a*, 60*b*, 60*c*, and 60*d*. PAL/ edit footswitch input jack 62 is also provided to enable the user to step through a programmable chain of e.g. 100 global routines merely by depressing the footswitch (not shown). An external disk drive connection jack 64 enables a second, externally mounted disk drive to be connected to the keyboard 10.

Figure 3:
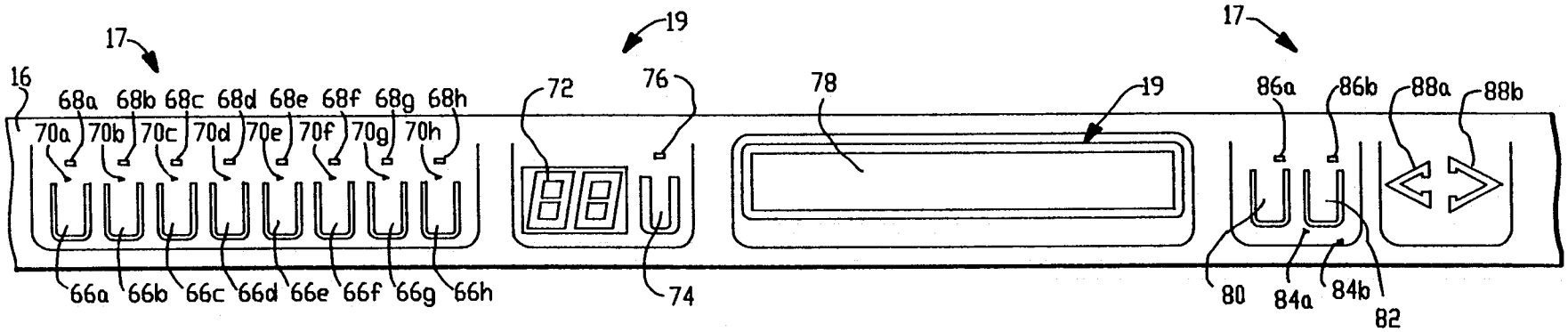
FIG. 3 is a diagrammatic view in elevation of the switch and display portion of the front control panel of the FIG. 1 keyboard.

FIG. 3 provides a further illustration of the control and display portion of the front panel 16. Within the array 17 of input switches at the front panel 16, eight MIDI operator switches 66*a*, 66*b*, 66*c*, 66*d*, 66*e*, 66*f*, 66*g* and 66*h* enable eight MIDI operator functions to be selected on or off for play for each global set up routine while in play mode, with each switch having a respective operator on/off indicator lamp 68*a*, 68*b*, 68*c*, 68*d*, 68*e*, 68*f*, 68*g* and 68*h*. Operator edit/compare indicator lamps 70*a*, 70*b*, 70*c*, 70*d*, 70*e*, 70*f*, 70*g* and 70*h* are respectively provided for each of the switches 66*a* through 66*h*. When operating in edit mode and when the edit lamp is not flashing, the lamps display which one of the eight operators have been selected for a 'page two' edit.

When in 'page two' operator edit mode and when a page two parameter has been changed and not saved into the global program set up by pressing write switch 74, when any one of the operator switches 66*a*, 66*b*, 66*c*, 66*d*, 66*e*, 66*f*, 66*g*, and 66*h* is pressed a second time, that respective operator will recall the original page two parameter values, prior to the newly edited parameters, and the corresponding operator edit mode indicator lamp will flash on and off. The previously selected and the newly selected function parameters will appear on the LCD upon each edit or compare selection.

When in play mode, continuous depression of the switch corresponding to the edited operator which was not written into the global program, will, in real time, result in rotation through three operator play mode states, the edited page two parameters, the previously unedited parameters, and the operator off selection; transmitting the unedited parameters or the edited parameters in the buffers simultaneously to selection. The third state is the operator off state which is an interval no transmission state.

The digital displays 19 include a two digit global set up routine display 72 and a two line 80 character LCD display 78. The display 72 indicates numerically from zero through 99 which one of an available one hundred global set up routines is presently available for selection. The display 72 is also used to display certain system errors. A write switch 74 and write activity indicator lamp 76 enable entire global set ups, individual page two operator edits and manufacturer diagnostic and calibration parameters to be written into an interval memory, as well as copy page two operator edits to be moved to other locations within the 100 program global library. The liquid crystal function display 78 enables up to 80 characters and spaces to be displayed at a time in order to display the selected global program name, or, momentarily to display an operator name when that operator switch is pressed in play mode. A user movable cursor indicates and points to parameter information relating to each selected global setup program, etc. PAL on-off switch 80 and an Edit selector switch 82 are also provided at the front panel 16. Indicator lamps 84*a* and 84*b* indicate whether Page One or Page Two has been selected; and indicator lamps 86*a* and 86*b* indicate whether PAL or EDIT mode has been selected. Data entry selector switches 88*a* and 88*b* enable the user to enter data incrementally or to enter 'yes' and 'no' responses during edit mode operation.

Figure 4:
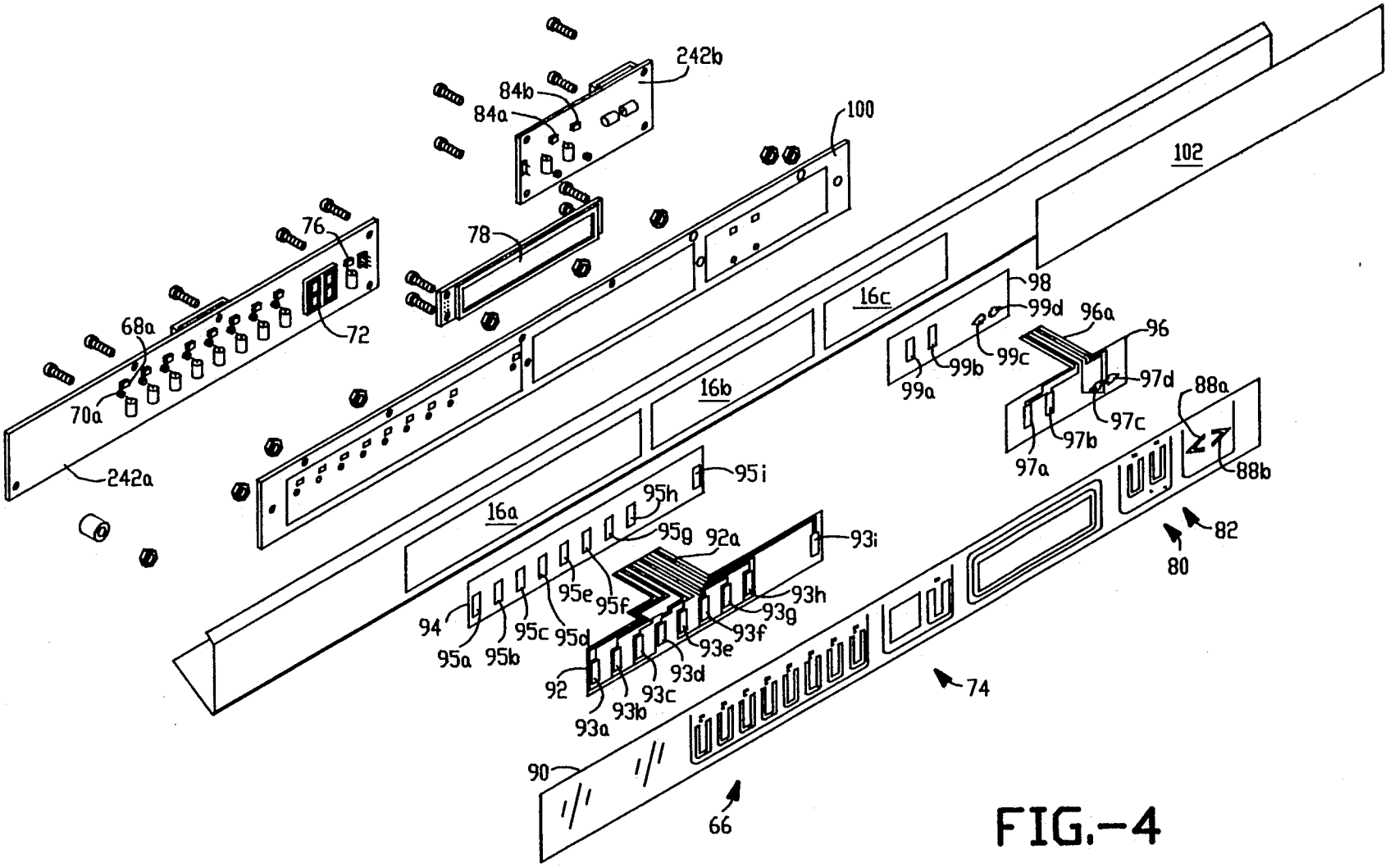
FIG. 4 is an exploded isometric view of the front panel assembly and electronics circuitry of the FIG. 1 keyboard.

FIG. 4 illustrates the sandwich construction of the switch portion of the front panel 16. A switch-indicia overlay 90 formed of transparent plastic flexible film material, such as Lexan (tm) is printed with the outlines of the switches 66, 74, 80, 82 and 88. A left contact array 92 is aligned in registration directly behind the switch 66 and 74 portion of the panel overlay 90. The left contact array is formed on a transparent plastic film substrate, such as Mylar (tm) or Ultem (tm), and it contains conductive trace arrays 93*a*, 93*b*, 93*c*, 93*d*, 93*e*, 93*f*, 93*g*, 93*h*, and 93*i* in respective alignment with the indicia on the overlay for the switches 66*a* through 66*h* and switch 74.

Connections for the arrays 93*a* through 93*i* are gathered into parallel traces which extend along a rearwardly extending connection portion 92*a* of the left contact array 92 and extends through a slot in a transparent lens 100 and to a connector on a printed circuit board 242*a* carrying decode latch circuitry and light emitting diodes 68, 70, 76. A transparent plastic film 94, such as Mylar or Ultem, includes rectangular deposits 95*a*, 95*b*, 95*c*, 95*d*, 95*e*, 95*f*, 95*g*, 95*h*, and 95*i* of force sensitive resistance (FSR) material.

Each FSR rectangle is aligned with and faces a corresponding interleaved trace array 93*a* through 93*h*. An FSR rectangle 95*i* is aligned with the array 93*i* for the switch 74. As pressure is applied to one of the switches 66, 74, that pressure causes the corresponding trace array 93 to come into contact pressure with the FSR material, resulting in a bridge conduction path between the interleaved fingers having a resistance inversely related to applied pressure.

A right contact array 96 includes trace arrays 97*a*, 97*b*, 97*c* and 97*d*; and a film 98 carries FSR deposits 99*a*, 99*b*, 99*c* and 99*d* which are shaped and aligned to register with the trace arrays 97*a* through 97*d*. Connections for the arrays 97 are gathered into parallel traces which extend along a rearwardly extending connection portion 96*a* of the right contact array 96 and through a slot in transparent lens 100 to a connector on the circuit board 242*b*.

The front panel 16 is formed of suitably bent sheet metal and it defines openings 16*a*, 16*b* and 16*c*. The opening 16*a* is for the left contact array 92 and its FSR film 94 and for the two digit global set up routine display; the opening 16*b* is for the liquid crystal display 78; and, the opening 16*c* is for the right contact array 96 and its FSR film 98. Rigid transparent lens 100 attaches to the backside of the panel 16 and provides a substrate or base to support the flexible arrays 92 and 96 and their respective FSR films 94 and 98. Lens 100 also provides a transparent base so that the indicator lamps 68, 70, 76, 84*a*, 84*b*, 86*a* and 86*b* that are located directly behind the lens 100 will back illuminate the graphic indicia 90. The LED digital global display 72 and LCD function display 78 are also located directly behind the lens 100.

A brand or logo decal 102 coated with a suitable pressure sensitive adhesive may be affixed to the front panel 16 at a right side segment thereof.

Figure 5:
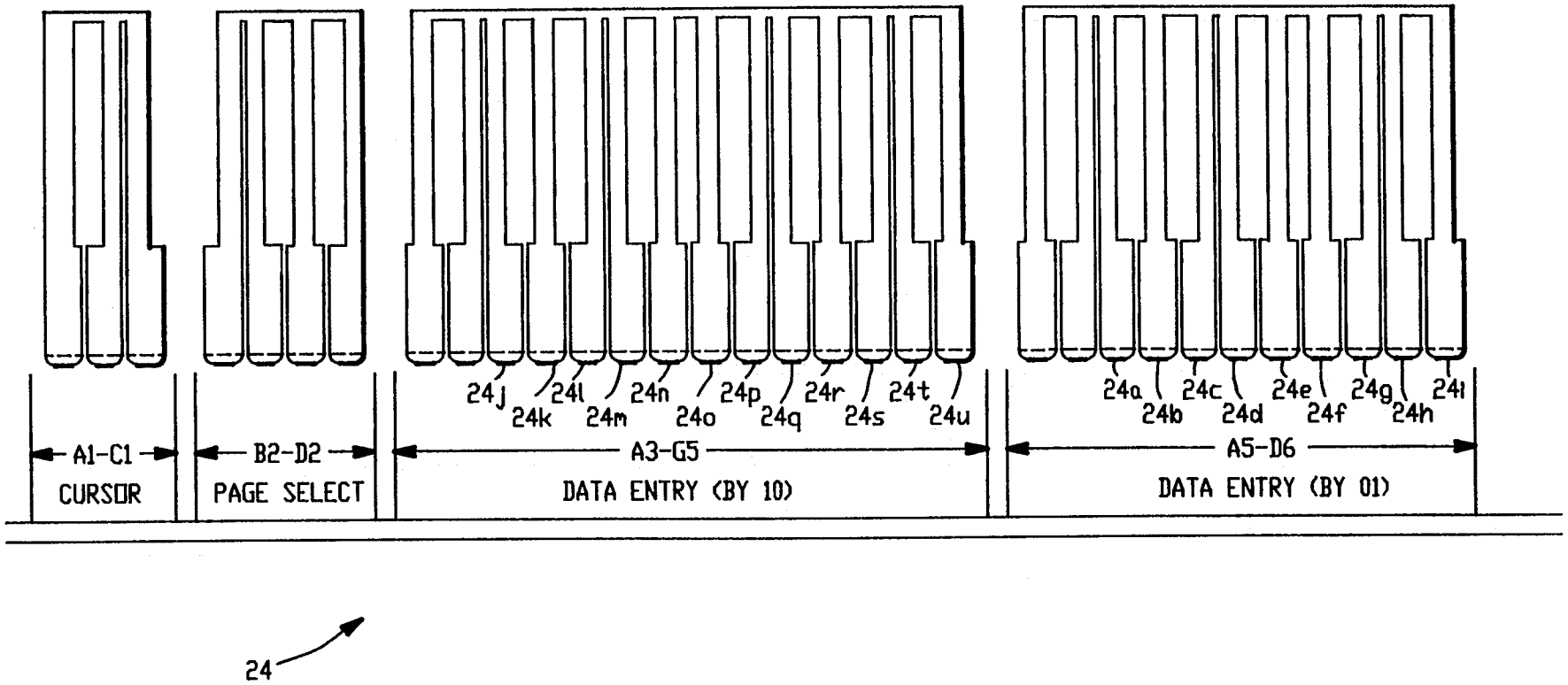
FIG. 5 is a diagrammatic plan view of the playing keys of the FIG. 1 keyboard illustrating indicia by which the keys may be switched to perform digital control and data entry functions.

FIG. 5 illustrates a pattern of graphical indicia affixed to, or printed or etched onto, the playing keys. When the keyboard 10 is operating in its edit mode as opposed to the performance mode, as selected by depression of the switch 82 or edit/PAL footswitch 62 when PAL switch 80 is selected off, some of the white keys 24 assume new roles. These roles are indicated by the overlay indicia illustrated in FIG. 5. For example one predetermined key moves the function display cursor to the left, while another key moves the cursor to the right. One key moves the cursor to its home or function select position. Three page access keys select whether the EDIT mode is page zero (utilities), page one (global functions) or page two (operator functions). A negative shift key enables a data input value assigned to data entry units keys 24*a* through 24*i* to have a negative or minus sign. Twelve decade keys 24*j* through 24*u* enable tens selection from zero to one hundred twenty, while the ten units keys 24*a* through 24*i* enable single digits to be entered. Thus, the number 39 would be entered by depressing the 30 tens key 24L and the 9 units key 24*i* at the same time or separately starting with a tens selection key etc. Alpha numeric and status data entry values and functions assigned to the white keys 24 allow for selection, additive accumulation, scrolling entry in negative value status, and left, right and home curser position selection. All key data entry and function page selection is accomplished in a configuration based on the 'C' major scale, a rudiment of musical keyboard familiarization and education. The keyboard 10 is capable of acting as a digital data input device in a manner which is easily learned by the keyboardist and which is somewhat analogous to musical play. No separate keypad or keyboard is required in order to enter system (global) and operator parameter configuration data.

Turning now to FIG. 6, the baseplate 15 supports a solid keyframe 110. A longitudinal front rail 112, a longitudinal balance rail 114 and a transversely adjustable, longitudinal back rail 116 are attached to and supported by the keyframe 110 and baseplate 15. The front rail 112 includes an array of guide pins, one for each key; there is a longitudinally aligned series 118 for the white keys 24 and a longitudinally aligned series 120 for the black keys 26. The balance rail 114 includes an array of balance pins, one for each key; there is a longitudinally aligned series 122 of balance pins for the white keys 24 and a similarly aligned series 124 balance pins for the black keys 26.

Each key 24, 26 includes a raised hammer-strike end portion 125 for adjustably striking or cam sliding a corresponding hammer assembly depending upon the factory adjusted position of the hammer locus adjustment screw 211. The end portion defines a cylindrical opening 126 in which a weight 128 is fit. The mass (thickness) of the weight 128 is selectable, and each weight 128 is selected and positioned to provide a desired counterbalance to its key, so that each key is naturally balanced to be in the upward position at the play area of the keyboard 10, irrespective of the position of the hammer assembly.

Each key includes an adjustable key sensor screw 130 which is threaded into an opening of the key just to the left of the balance pin 122 or 124, as seen in FIG. 6. Each key sensor screw 130 has a downwardly dependent, hemispherically shaped contact surface 131 which engages an XYZ percussive force sensor control panel assembly 132, depicted in FIG. 7.

Figure 7:
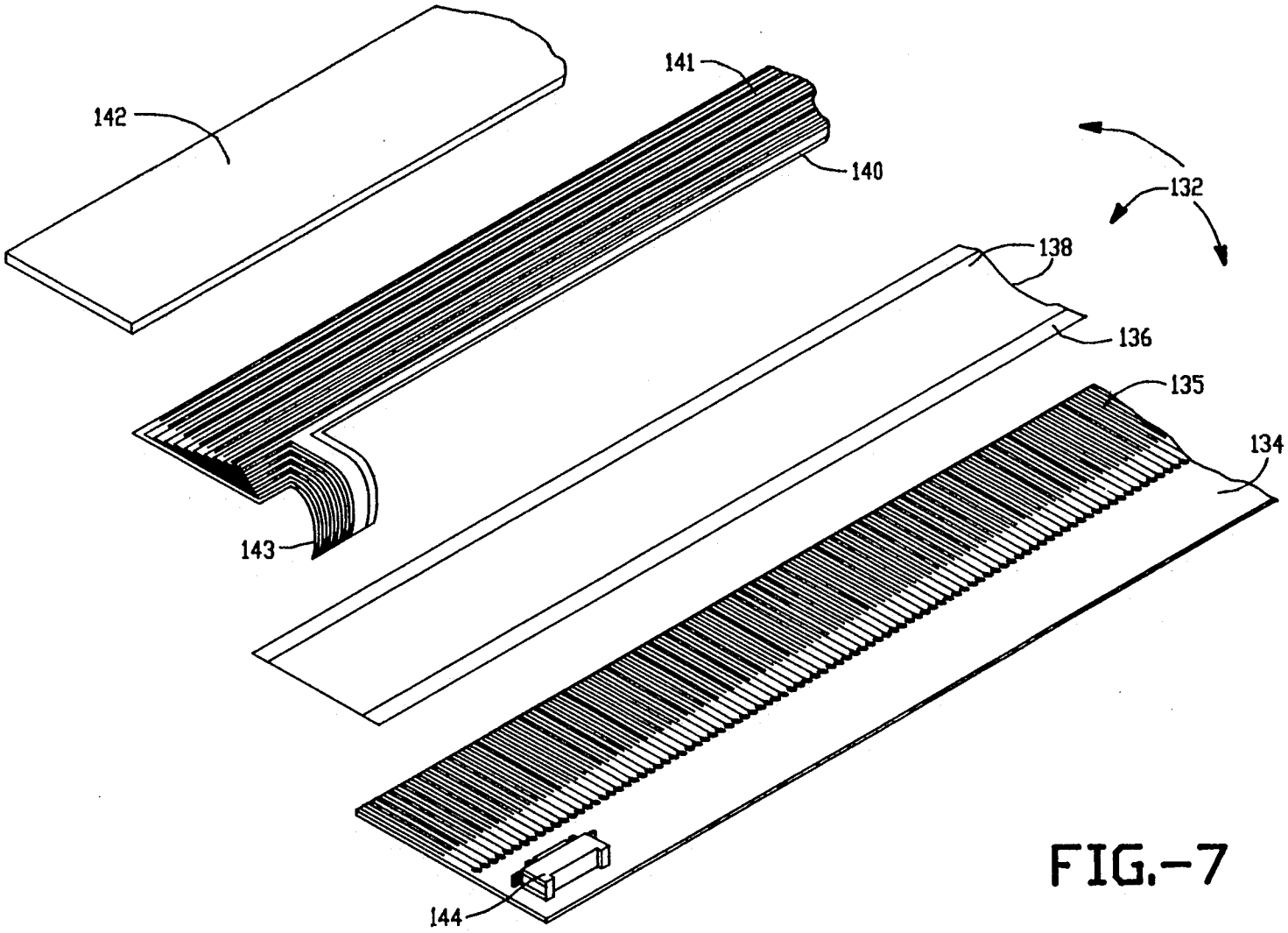
FIG. 7 is an exploded isometric view of an XYZ FSR key sensor assembly for use within the FIG. 1 keyboard with the right portion thereof broken off to save drawing room.

The FIG. 7 assembly 132 includes a printed circuit substrate 134 having an upwardly facing major surface defining an array of transverse interleaved sensor fingers 135. A thin, flexible film 136 has each of its major surfaces coated with a force sensitive resistance (FSR) ink coating 138. A thin, flexible film 140 supports an array of longitudinal interleaved sensor fingers 141 which downwardly face the upper FSR surface of the film 136. A longitudinal strip 142 of suitably elastomeric material, such as Poron (tm) or an equivalent, overlies the film 140. The hemispherical surface 131 of each screw 130 comes into contact with the top surface of the strip 142 and compresses it at the impact location against the longitudinal trace film 140, FSR film 136, and transverse trace PCB 134. The longitudinal traces of the film 140 are connected to decode circuitry 145 mounted to the underside of the circuit board substrate 134 via a thin film extension 143 of the film 140 which connects to a plug 144 mounted on the PCB 134. The entire laminar sensor assembly 132 is mounted upon a longitudinal sensor assembly support rail 146.

Figure 21:
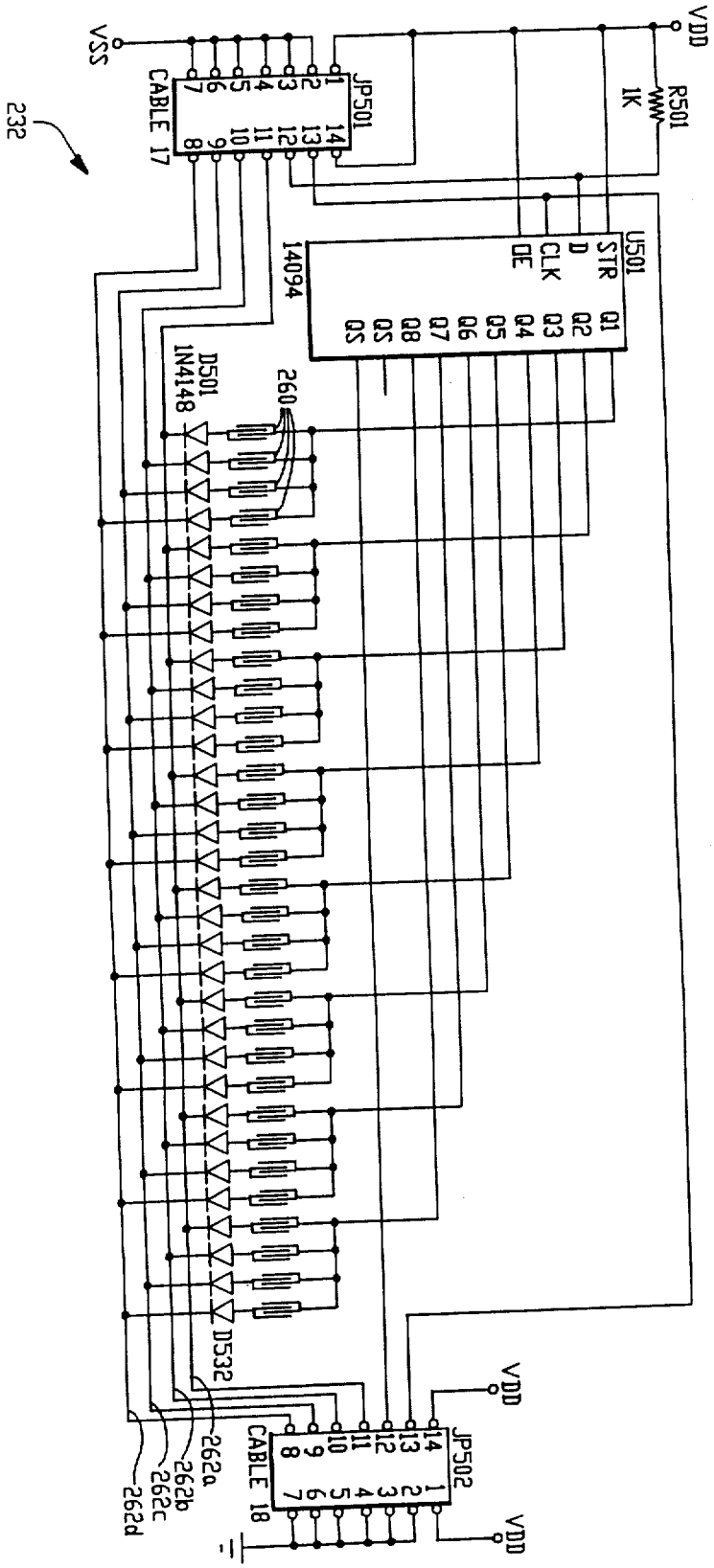
FIG. 21 is an electrical schematic and block diagram of one printed circuit substrate individual cell key sensor array for 32 playing keys. Several sensor arrays are employed in 88 key keyboards of the type shown in FIG. 1.

As a less expensive alternative to the XYZ sensor arrangement depicted in FIG. 7, a force sense resistance cell may be formed for each key, as depicted in the electrical schematic of FIG. 21. In this lower cost approach the individual interleaved conductors of each cell are formed on the printed circuit substrate 134' and the film 136' has a force sense resistance material coating only on the major surface thereof facing the traces of each cell of the substrate 134'. The longitudinal elastomeric strip 142 directly overlies the film 136'. One drawback of the use of dedicated force resistance cells is that conventional plastic keyboard assemblies having keyboards that are made of wood can have a broad and inconsistent tolerance for the center spacing of each key and in the area between each key. This inconsistent tolerance causes a plunger, or any key actuation means, to be somewhat misaligned with each cell causing each cell to have its own peculiar electrical characteristics which requires additional timely alignment and calibration adjustments during the manufacturing process.

Referring again to FIG. 6, a longitudinally extending, 'h' shaped action rail 150, preferably formed by extrusion of aluminum, includes at two lower ends two longitudinal keys 152 which seat in longitudinal keyways formed in the transversely positionable backrail 116. The action rail 150 (best shown in the FIG. 6A detail) is secured to the backrail 116 and solid keyframe 110 by several spaced apart action rail mounting bolts 154 and 'T' nuts **154*a*. At its apex 156 the action rail 150 defines a horizontal shelf 157 which aligns and supports banks of tandem arranged, twelve station hammer flanges 158**.

Seven twelve station hammer flanges 158 and one four station hammer flange (formed by simply cutting off one of the twelve station flanges at the four station point) provide a keyboard having 88 keys in conventional acoustic piano arrangement. The hammer flanges 158 are preferably molded of a suitable plastic material, such as Delrin (tm).

Figure 8:
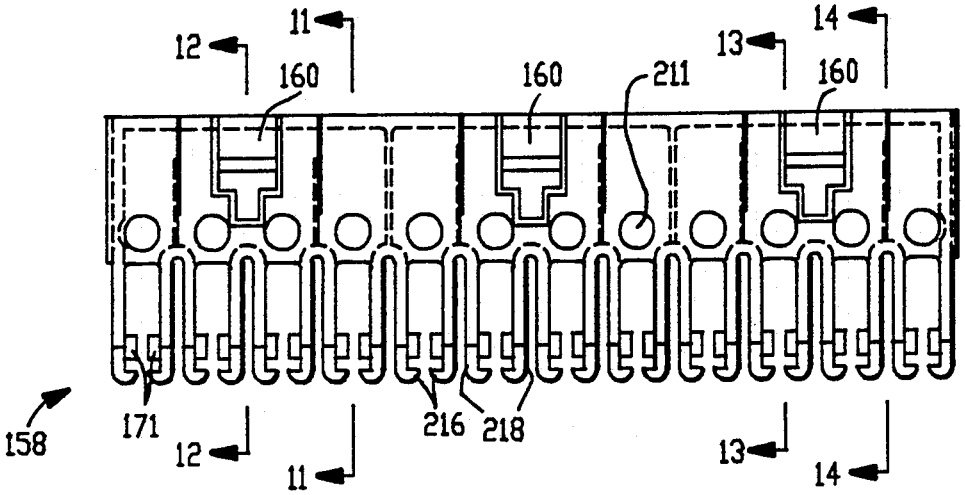
FIG. 8 is a top plan view of a snap-in modular hammer flange having 12 hammer stations which is included in the FIG. 1 keyboard.
Figure 9:
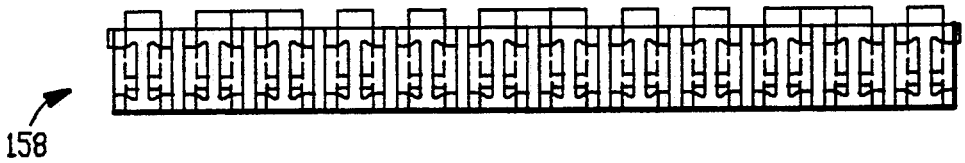
FIG. 9 is a front view in elevation of the FIG. 8 hammer flange.
Figure 10:
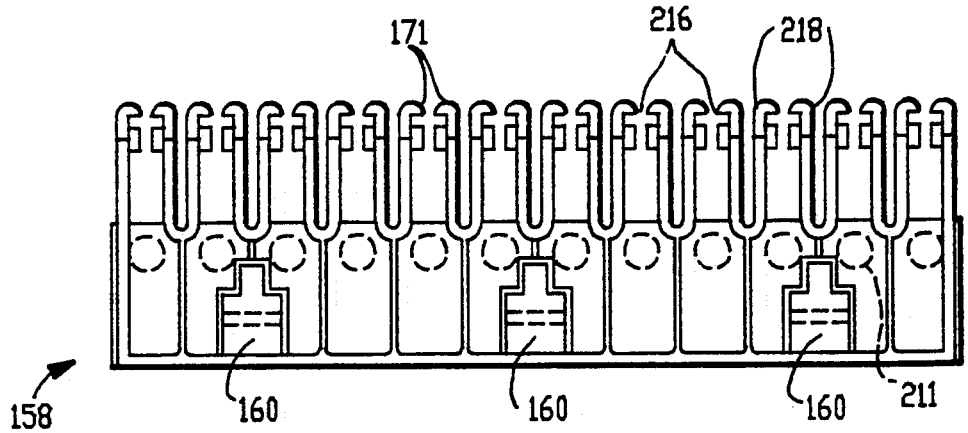
FIG. 10 is a bottom plan view of the FIG. 8 hammer flange.
Figure 11:
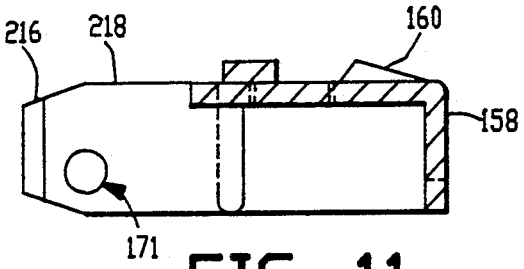
FIG. 11 is a transverse sectional view of the FIG. 8 hammer flange taken along the section line 11—11 in FIG. 8.
Figure 12:
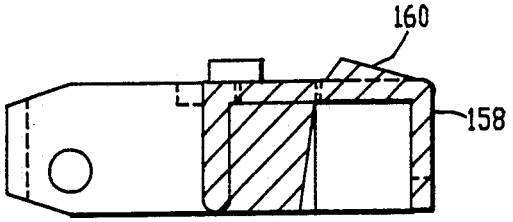
FIG. 12 is a transverse sectional view of the FIG. 8 hammer flange taken along the section line 12—12 in FIG. 8.
Figure 13:
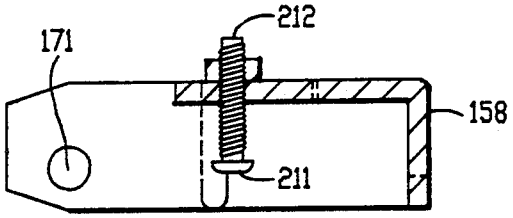
FIG. 13 is a transverse sectional view of the FIG. 8 hammer flange taken along the section line 13—13 in FIG. 8.
Figure 14:
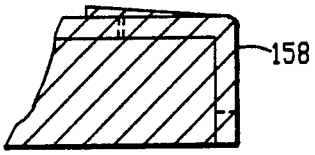
FIG. 14 is a transverse partial sectional view of the FIG. 8 hammer flange taken along the line 14—14 in FIG. 8.

The action rail 150 further includes a top clamping portion 19 which cooperates with three snap locks 160 formed in each flange 158 (FIGS. 8–10) to enable each flange 158 to be snap locked into the action rail between the horizontal shelf 157 and the top clamping portion 159. The snap locks 160 have outer contours which are congruent with the underside of the top clamping portion so that the flange 158 is precisely aligned with the action rail 150 when snap-locked into place.

Figure 6A:
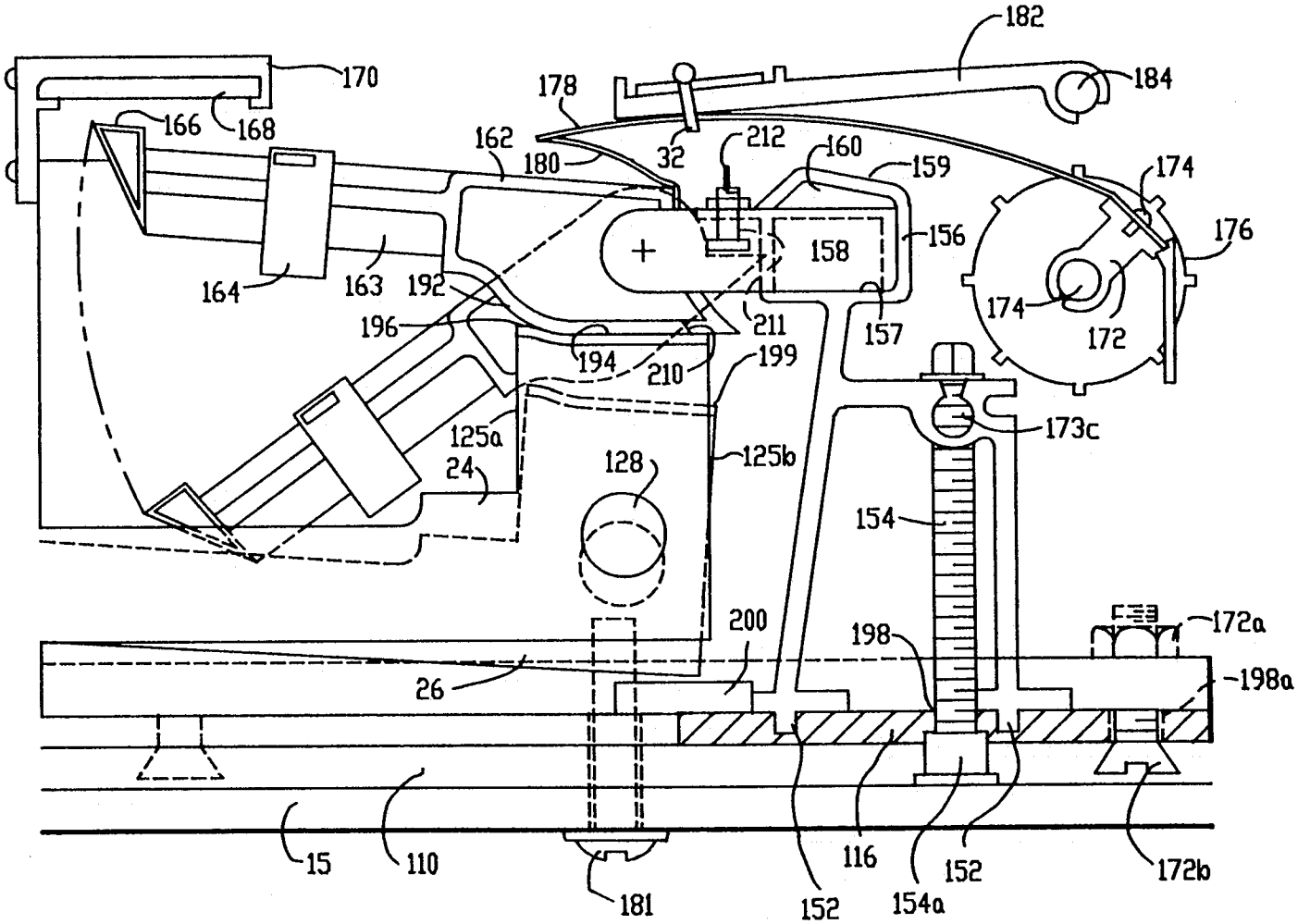
FIG. 6A is an enlarged, diagrammatic portion of the FIG. 6 right side sectional view, illustrating details of the hammer action assembly of the FIG. 1 keyboard.
Figure 6C:
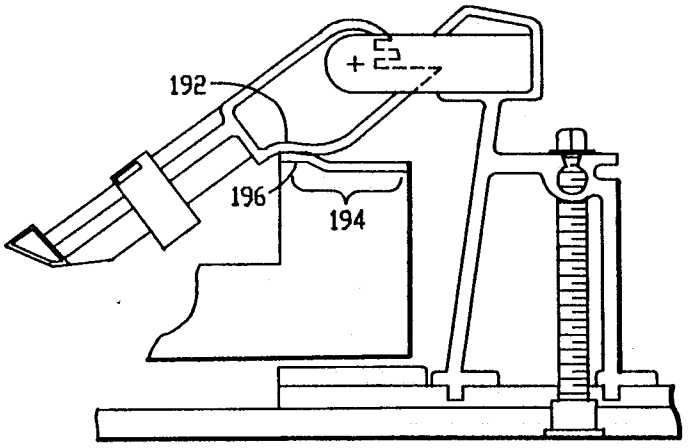
FIGS. 6B, 6C, 6D, 6E, 6F and 6G are diagrams illustrating establishment of discontinuity 'kerchunk' between the playing key and the hammer, by virtue of position adjustability of the action rail relative to the keys.
Figure 15:
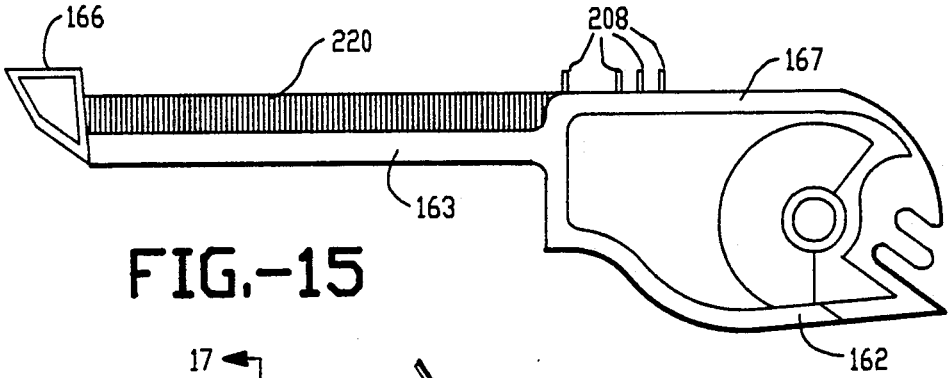
Figure 16:
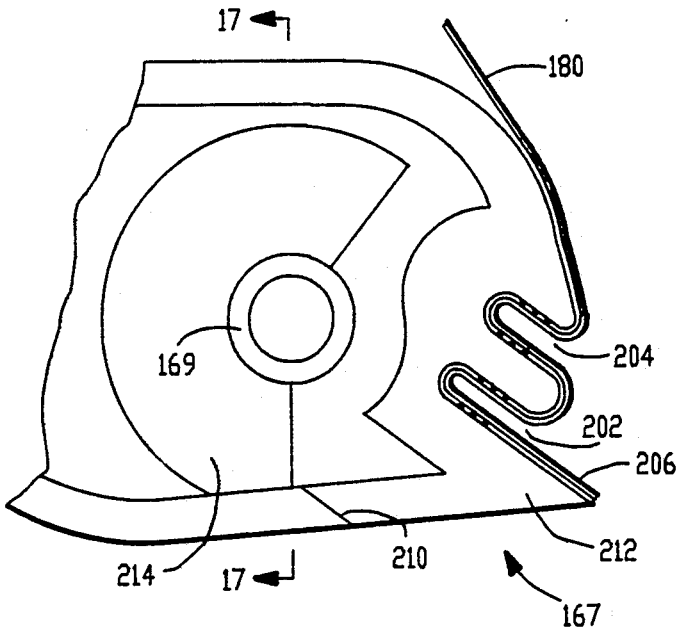
FIG. 16 is a greatly enlarged side view of the snap engagement end of the FIG. 15 hammer.

Referring to FIG. 6A, a hammer 162, molded of a different plastic material than the flange, ABS plastic for example, snap-locks into each hammer station of the flange 158. The hammer 162 includes a hammer mass 164 which may be adjustably clamped at any desired location along a shank portion 163 of the hammer. A hammer head 166 at the free end of the hammer 162 comes into contact with a hammer stop compression pad 168 at the end of the upward throw of the hammer and then falls and locks into place via the chisel edges 210 at its escapement distance away from the hammer stop pad 168 when any of the keys 24, 26 are struck and held down, even momentarily. The compression pad 168 is mounted and carried within an extruded aluminum hammer stop rail 170. Referring to FIGS. 15 and 16, the hammer 162 includes a journal end 167 which is formed with a transversely extending cylindrical hub 169 which surroundingly engages hammer mounting pins 171 of the molded flange 158 at each hammer station (FIGS. 8–14) when the hammer 162 is snap locked into the hammer station of the flange 158.

Figure 18B:
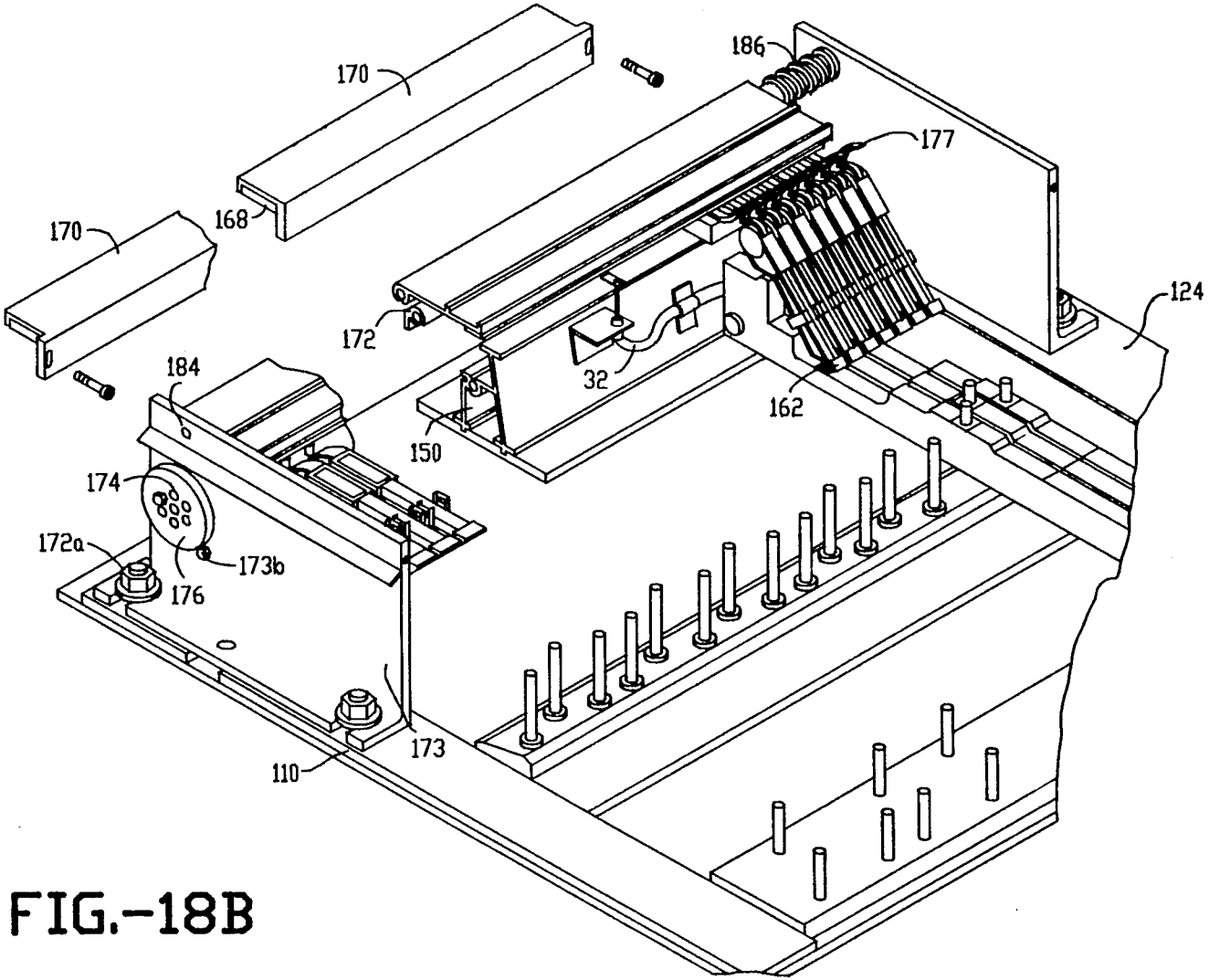
FIG. 18B is a diagrammatic view in perspective of a percussive action electronic keyboard with the cover removed and showing the alignment bushing positioned in the end block assembly, a single flange and hammer assembly positioned above several keys, and the control cable.
Figure 19B:
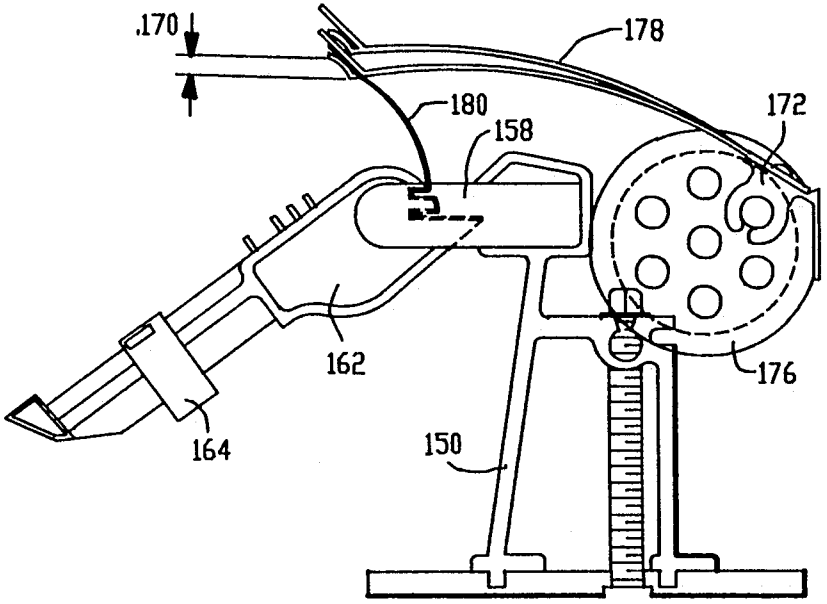
Figure 19A:
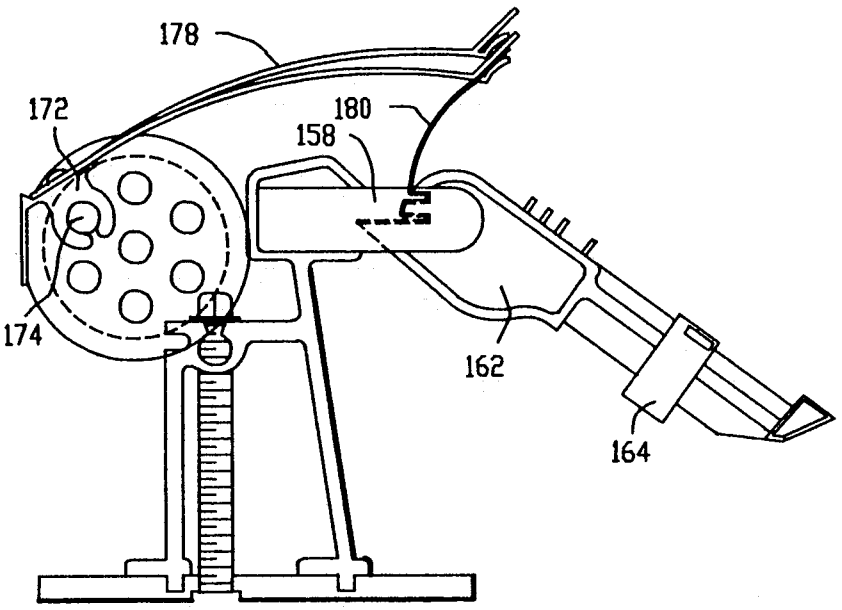
Figure 17:
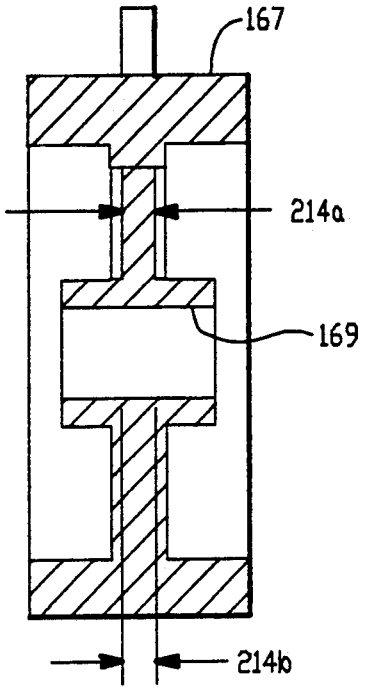
Figure 19D:
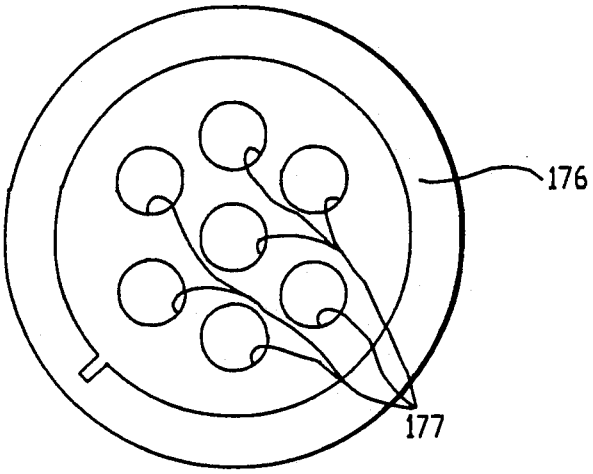
Figure 18A:
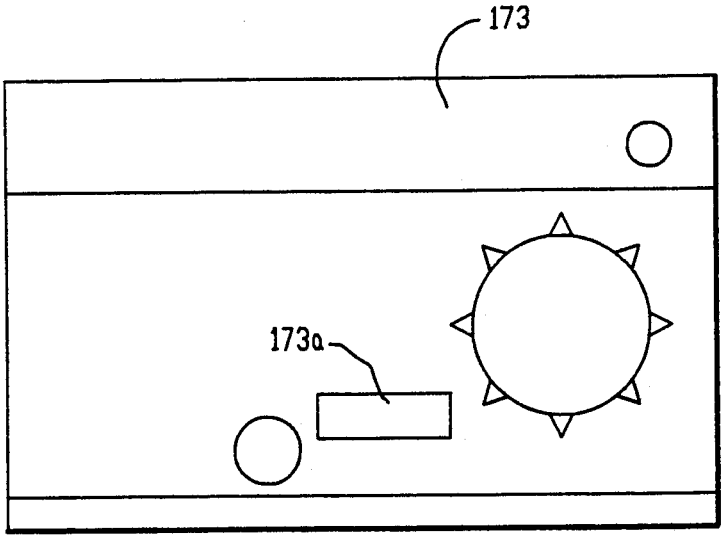
Figure 19C:
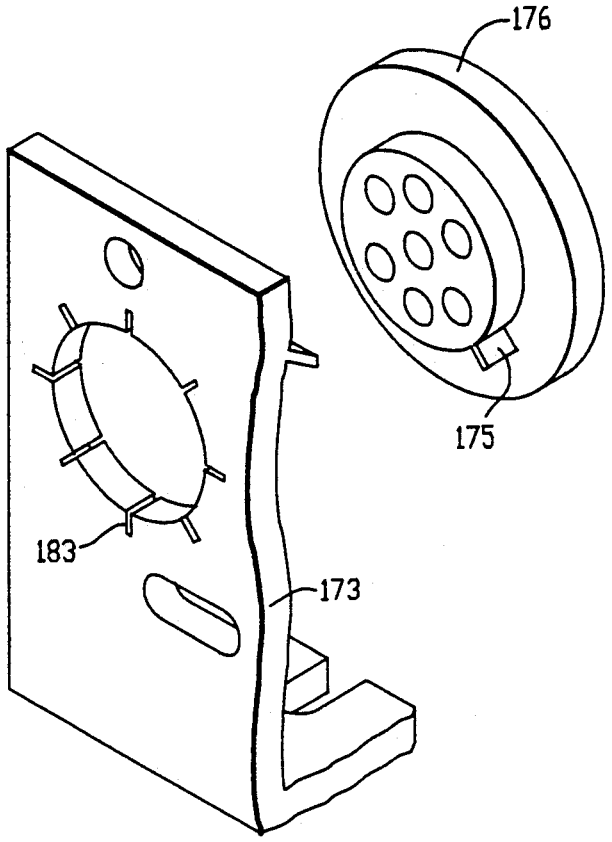
Figure 23P:
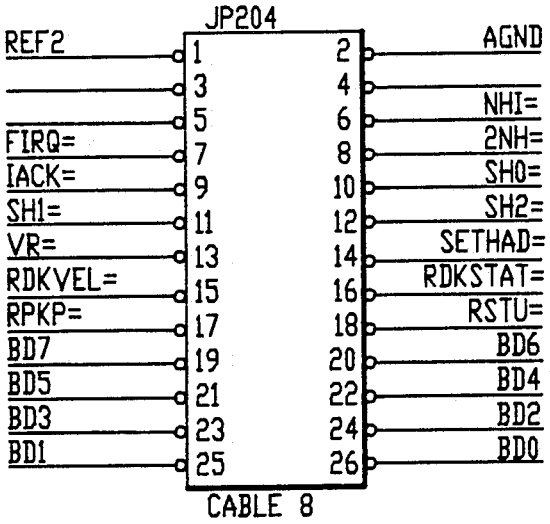
FIGS. 23A, 23B, 23C, 23D, 23E, 23F, 23G, 23H, 23I, 23J, 23K, 23L, 23M, 23N, 23O, and 23P together form an electrical schematic and block diagram of a key scanner state machine for repetitively scanning each key cell of the key sensor array of FIG. 21 to determine if the key has been depressed.

Referring to FIGS. 6, 18 and 18B, a leaf spring pivot rail 172 is mounted between two end support blocks 173 adjacent the respective side walls 12 and 14 by two leaf spring pivot rail fastener screws 174 which pass through two leaf spring pivot rail bushings 176 and thread into the rail 172. The end blocks 173 are secured to the baseplate 15 and keyframe 110 by the bolts 11 and threaded holes in support blocks 173 and to the keyframe 110 by the screws **172*b* and nuts 172*a*. Referring to FIGS. 18 and 18*b*, the end support blocks 173 are secured to action rail 150 by the self-threading bolts 173*b* passing through slotted holes 173*a* in support blocks 173 and secured in holeway 173*c* in action rail 150, as best seen in FIG. 18A. Securing support blocks 173 and action rail 150 to the baseplate 15 and keyframe 110 provides a non-warping base support for the solid keyframe assembly 110**, which is made of wood.

Alignment of the leaf spring pivot rail 172 relative to the action rail 150 is adjustably established at the factory with the aid of two leaf spring pivot rail bushings 176. As shown in FIGS. 19A, 19B, 19C, and 19D, each bushing 176 defines a plurality of openings 177 any one of which being sized to receive the screw 174 therethrough. A matching set of opposed holes 177 is selected at the factory per the customer's specification in order to establish the vertical and horizontal dimensions separating the leaf spring pivot rail 172 and the action rail 150. The opposed holes 177 define a plurality of factory settings which provide a plurality of playing action feels when action adjust lever 28 is selected by the player in an effect position. A key 175 on the bushing 176 mates with one of a plurality of keyways 183 formed in a circular opening of the end block 173. Since the holes 177 are at different radii, rotation of the bushing 176 and alignment of its key 175 with the different keyways provides a simple way of obtaining a wide variety of relative distance alignment setups.

Referring to FIG. 6A, each hammer 162 has a corresponding leaf spring 178 which is attached at one end to the leaf spring pivot rail 172 by a screw 179. The leaf spring 178 attaches at its free end to a woven fabric or other suitable material bridle strap 180. The bridle strap attaches to the journal end 167 of the hammer 162 as best seen in FIG. 16 and provides a spring bias force which selectively resists the movement of the hammer 162 toward its impact position with the hammer stop compression pad 168 so as to impart further tactile sensation to the player of the keyboard.

Referring to FIGS. 18 and 18B, a transverse, pivotally mounted leaf spring relief bar 182 is controlled by position of the action wheel 28 and central strand of the control cable 32. The relief bar 182 is mounted to the end blocks 173 via two mounting pins 184 floating in two pivot pin bushings 184*a* for smooth pivot motion. A compression spring 186 is preloaded against support block 173 to hold the relief bar assembly 182 in place after a one pin at a time snap-in assembly procedure. The leaf spring relief bar is pivotally mounted against the upward pull of the leaf springs 178 within the distance dictated by the length of the bridle straps so that when the central strand of cable 32 is affected by the action adjust lever assembly 28, the preload of the leaf springs 178 will selectably encounter the movement of the hammers 162 during the upward strike motion caused by depressing keys 24, 26 during play, thereby adjusting when and how much leaf spring preload is experienced by the player, making the playing action of keyboard 10 adjustable from light to heavy by the player via the adjust lever 28. The compression spring 186 biases the relief bar 182 against the direction of pull against the leaf springs 178 imparted by the central strand of the cable 32. The leaf spring 178 includes tine openings 188 which enable individual hammers 162 to engage and release each of the leaf springs 178, thereby allowing for independent leaf spring and hammer interaction.

Referring again to FIG. 6, a keyboard system power supply includes a transformer 190 which is mounted to the substrate 15 and support frame 110 at a location inbetween and to the rear of the end blocks 173 within the housing of the keyboard 10. The power supply converts line current into low voltage DC required for the electronic control circuitry 230.

Referring to FIG. 6A, each hammer 162 includes a symmetrical S-shaped cam follower surface 192 which is contacted by an upwardly facing cam surface 194 of the raised hammer-strike or cam follower end portion 125 of each key 24, 26 when it is depressed. The cam surface 194 includes a raised portion 196. As is perhaps best seen in FIG. 6A, a mounting hole 198 defined through the backrail 116 for each bolt 154 and 'T' nut 154*a*, and a mounting hole 198*a* defined through backrail 116 for each bolt 172*b*, have larger inside diameters than the outside diameter of the respective bolts 154 and 172*b*. The clearance between the backrail 116 and each bolt 154 and 'T' nut 154*a* provides a range of adjustment, preferably about .060'.

By providing this range of adjustment at the factory during assembly of the keyboard 10, the spacing of the action rail 150 is adjustable relative to each key 24, 26. This adjustment has a pronounced effect upon the relationship between the cam surface 194 of the key 24, 26 and the follower surface 192 of the associated hammer 162 as shown in FIGS. 6B–6G. In the alignment shown in FIGS. 6B,C and D, the follower surface 192 always follows the raised portion 196 of the cam surface 194 throughout its range of movement, and there is no noticeable discontinuity as the key is depressed during play. After the hammer has struck the hammer stop pad and fallen to its escapement position as shown in FIG. 6D, the follower surface 192 is completely contacted by the flat portion of the key cam surface 194 and the inside portion 125*c* of follower surface 192 is supported by the inside sloping portion 125*d* of the raised portion 125*b*. In the resting position shown in FIG. 6B, the end cam portion 125*b* and the entire raised cam portion 196 are both broadly contacted by the large curved portion 125*e* of the follower surface 192.

Figure 6E:
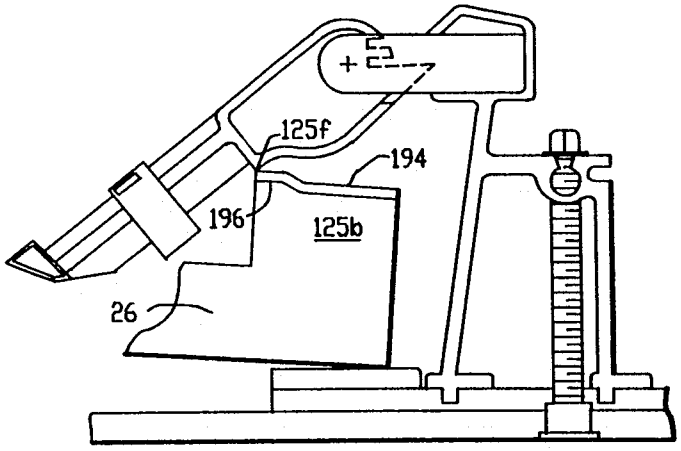
Figure 6B:
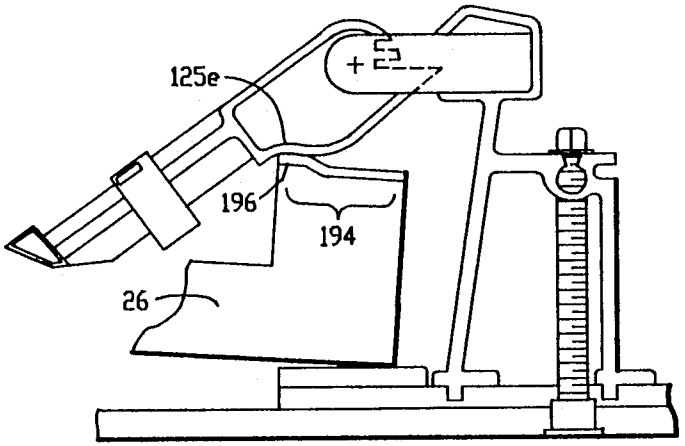
Figure 6D:
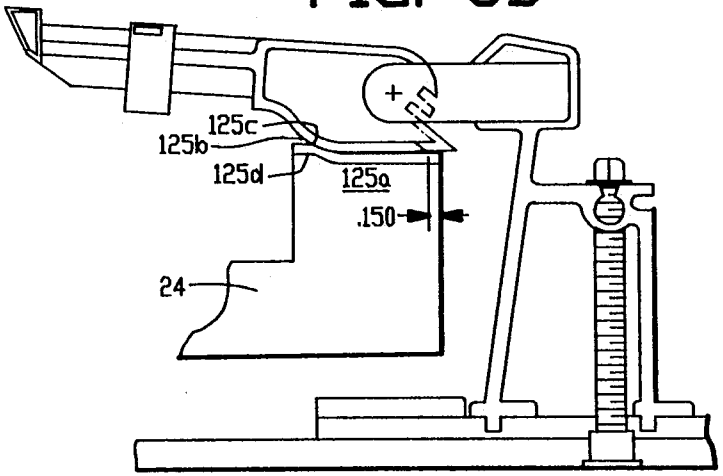
Figure 6G:
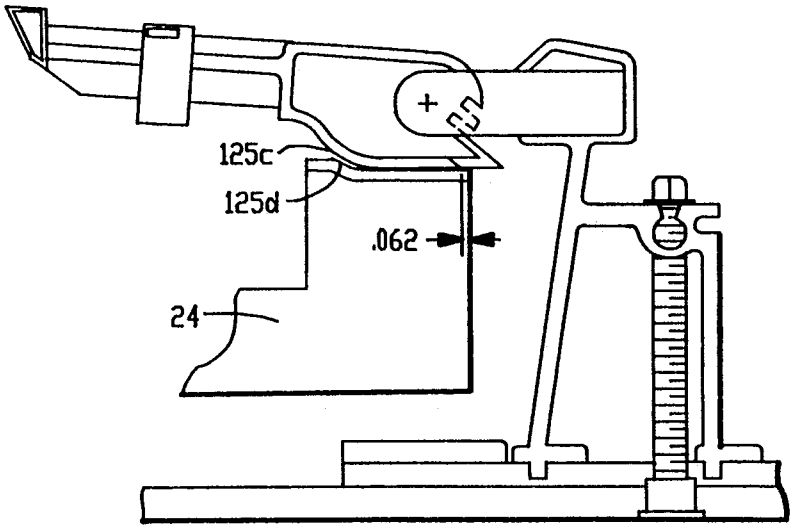
Figure 6F:
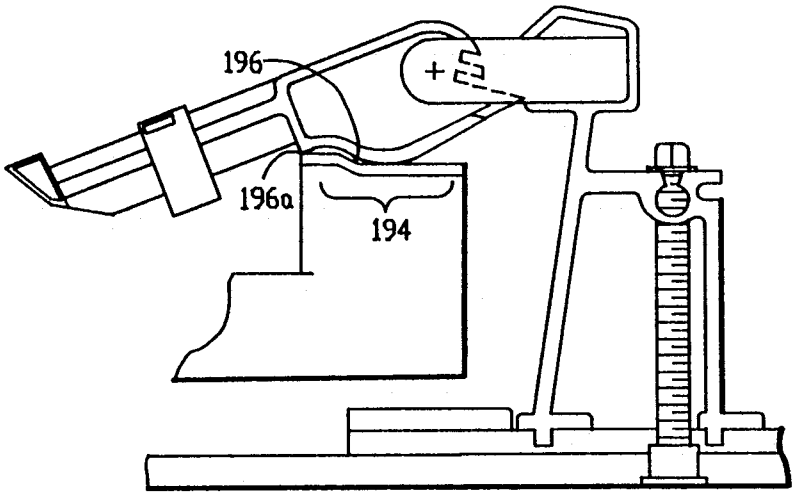

In another alignment shown in FIGS. 6E,F and G, the inside portion 125*c* of the follower surface 192 is not contacted by the inside sloping portion 125*d* after the hammer has struck and fallen to its escapement position, FIG. 6G. In the resting position shown in FIG. 6E, the leading edge portion 125*f* of the follower surface 192 is resting on the raised portion 196 of cam surface 194. In this second alignment as shown in FIG. 6F, there is a discontinuity of contact between the cam surface 194 and the follower surface 196 which creates the tactile sensation which the applicant calls 'kerchunk'. If kerchunk is desired, the back rail and action rail are aligned as shown in FIGS. 6A,E,F and G; if not, then the back rail and action rail are moved toward the keys 24, 26 to eliminate the contact discontinuity, as shown in FIGS. 6B,C and D.

Each cam surface 194 is provided with a fabric pad 199 to dampen impact forces between the cam surface 194 and follower surface 192. A longitudinal felt strip 200 attached to the front of the back rail 116 dampens the fall of each key 24, 26 at its resting position.

Referring to FIGS. 15 and 16, the journal portion 167 of each hammer includes two slots 202 and 204 which have tines 205 formed therein. During assembly of the keyboard 10, the bridle strap 180 is looped in two places and then inserted into the slots 202 and 204, and then glued in place. A stop shelf 206 of the journal portion 167 extends outwardly adjacent to the slot 202, and the bridle strap 180 is dimensioned to cover the stop shelf 206 in order to provide a stop felt. Knock off pins 208 extend from the top of the hammer 162, and one of these pins will be used to secure the free end of the bridle strap 180 until it may be connected to its leaf spring 178 during final assembly The multiple pins enable the bridle strap to be made to one of a variety of predetermined lengths, based upon the spatial relationship between the leaf spring pivot rail 172 and the action rail 150, as established by the selection of holes 177 in the leaf spring pivot rail bushings 176.

Each hammer 162 is formed with two chisel edges 210 separated by a central part 212 extending out to form the stop shelf 206. These chisel edges contact the fabric pad 198 at the cam surface 194 of each key 24, 26, and thereby reduce hammer bounce after the hammer 162 strikes the hammer stop pad 168 and falls to its escapement position.

Figure 17:
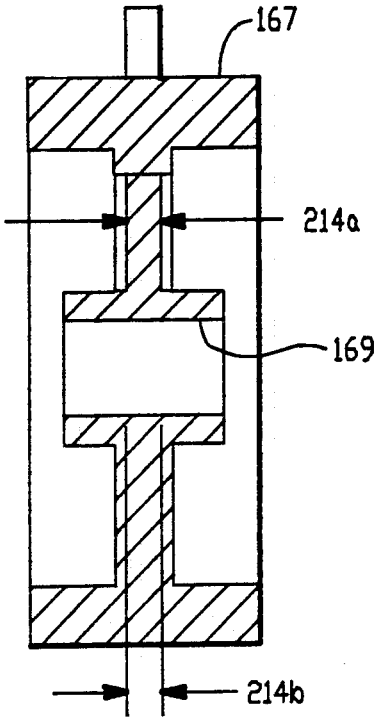
FIG. 17 is a sectional view of the FIG. 15 hammer taken along the line 17—17 in FIG. 16.
Figure 19D:
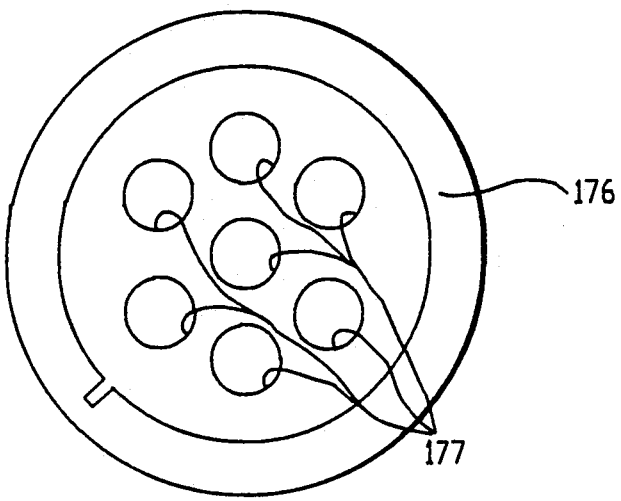
FIGS. 19A, 19B, 19C and 19D are detail views of the leaf spring pivot rail and end block assembly, showing the rotationally positionable alignment bushing for adjustably positioning the leaf spring pivot rail relative to the action rail in the FIG. 1 keyboard.

The journal portion 167 of each hammer 162 includes a semi-circular web 214 which may be provided with a predetermined surface treatment to add a controlled amount of texture or surface finish thereto on each side. The web portion 214 of the journal region of the hammer 162 cooperates with oppositely facing blade edges 216 of two front parts 218 formed at each hammer station in the hammer flange 158. As seen in FIG. 17, the thickness dimension of the web portion 214 smoothly varies from a thicker cross section dimension at the top 214*a* to a thinner cross section dimension at the bottom 214*b*.

With this arrangement, the oppositely facing blade edges 216 of the flange 158 come into contact with the thickened web portion 214*a* when the hammer 162 is at rest position, but go out of contact with the thinned web portion 214*b* as the hammer moves toward its striking position. This arrangement between the flange 158 and the hammer 162 causes all of the hammers to be precisely aligned at their rest positions, and enables them to be freely movable in the region of impact during play. Also, when the edges 216 come into contact with the web 214 as the hammer 162 moves towards its resting position, hammer bounce is further dampened and impeded.

A threaded metal hammer locus adjustment screw 211 is integrally molded into the hammer flange 158 at each hammer station, as shown in FIGS. 6A, 8, 10 and 13. The adjustment screw 211 has a smooth hemispherical lower end which comes into contact with the stop shelf 206 of the hammer 162 which is cushioned by the bridle strap 180 at its rest position. A flattened tab end 212 of each screw 211 enables the screw to be rotated up and down in the flange 158 and thereby adjusts the range of throw of the hammer 162 between its resting position and its momentary impact position against the hammer stop compression pad 168.

The shank portion 163 of the hammer 162 has a top rail which is 'coined' with vertical ridges and grooves 220 (FIG. 15), so that a weight clamp having opposed vertical blades may engage the grooves 220 so that the weight will maintain its preset position on the shank irrespective of hammer velocity and impact force during extended use of the keyboard 10.

Control System 230

Figure 27A:
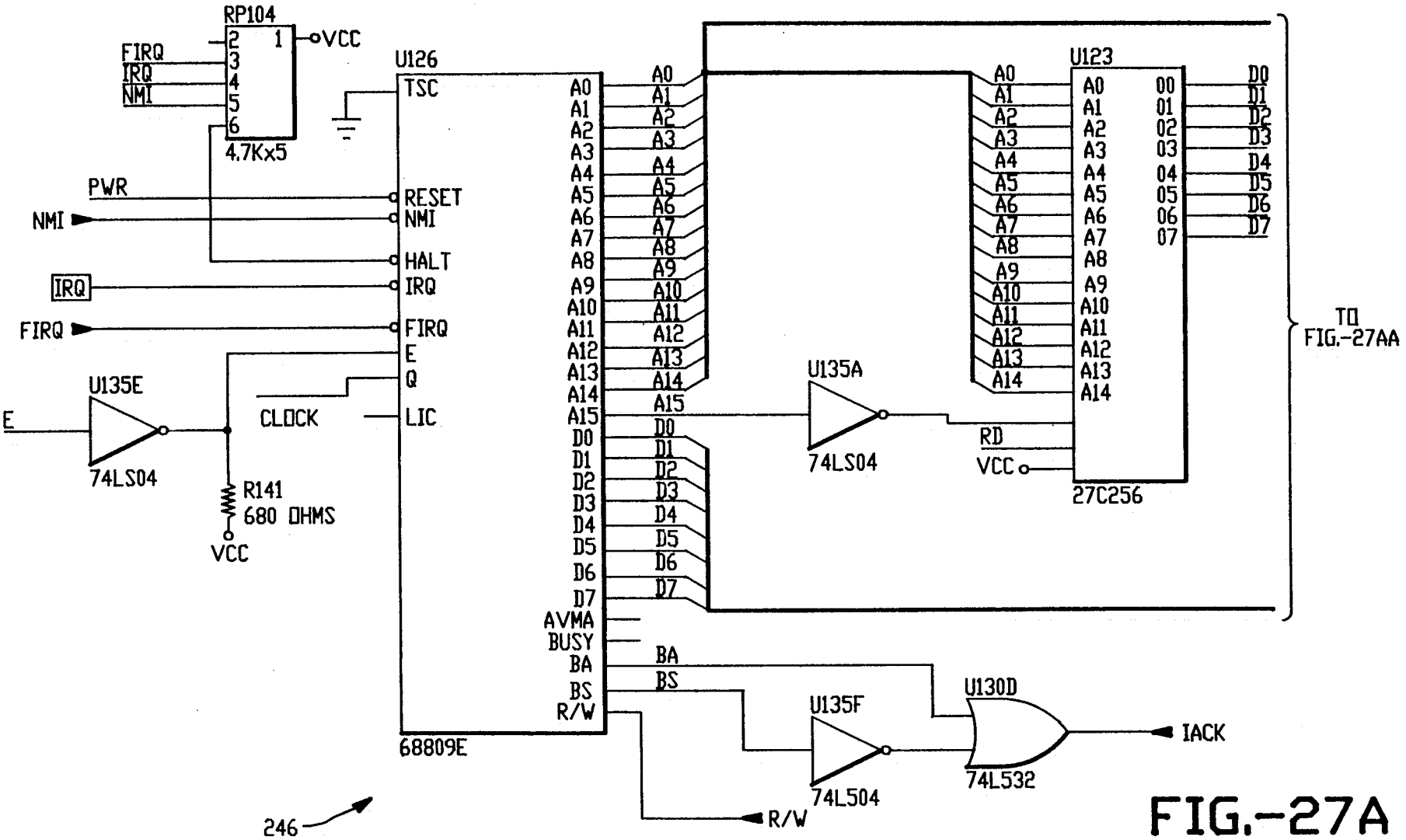
FIGS. 27A, 27AA and 27B are electrical schematic and block diagrams of a microprocessor supervisor circuit of the FIG. 20 control circuit.
Figure 27A:
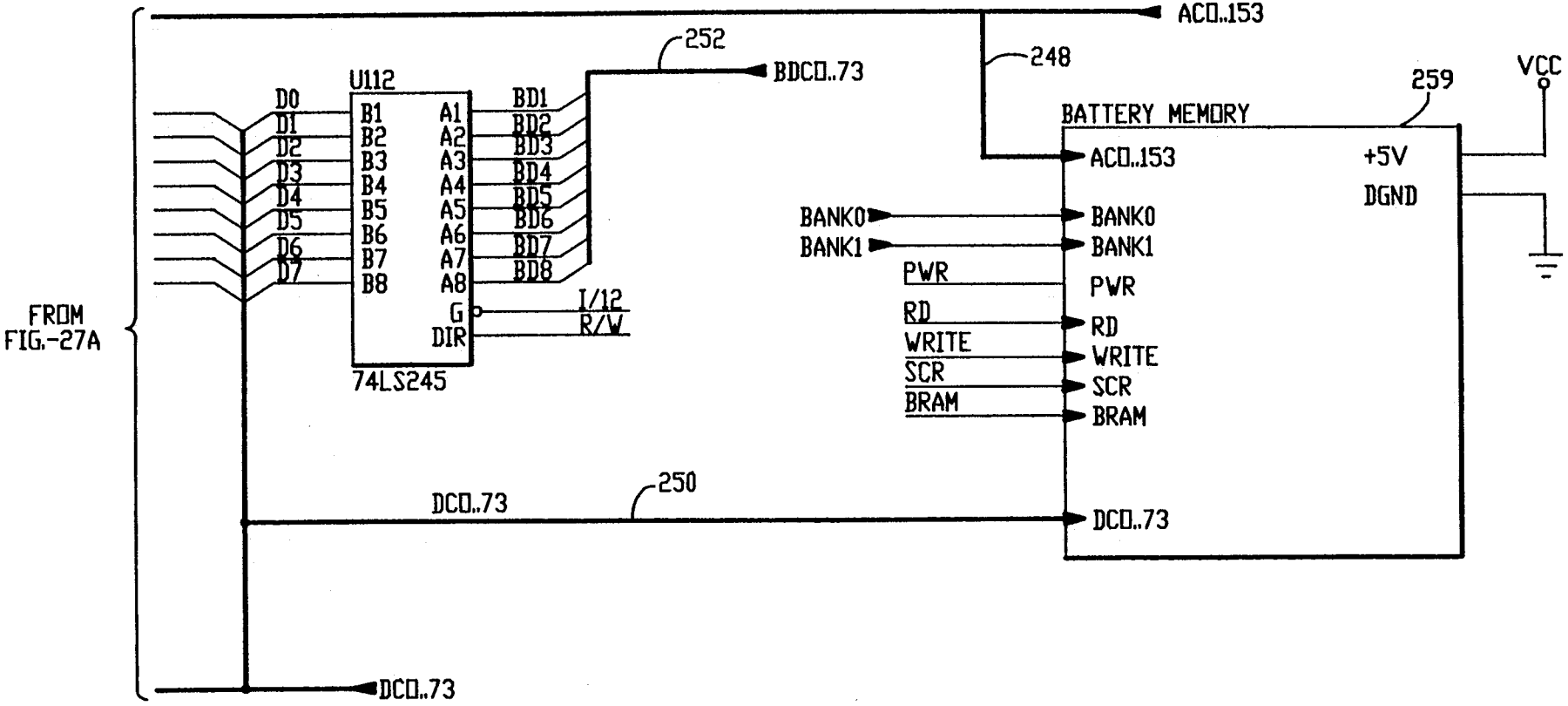
Figure 27B:
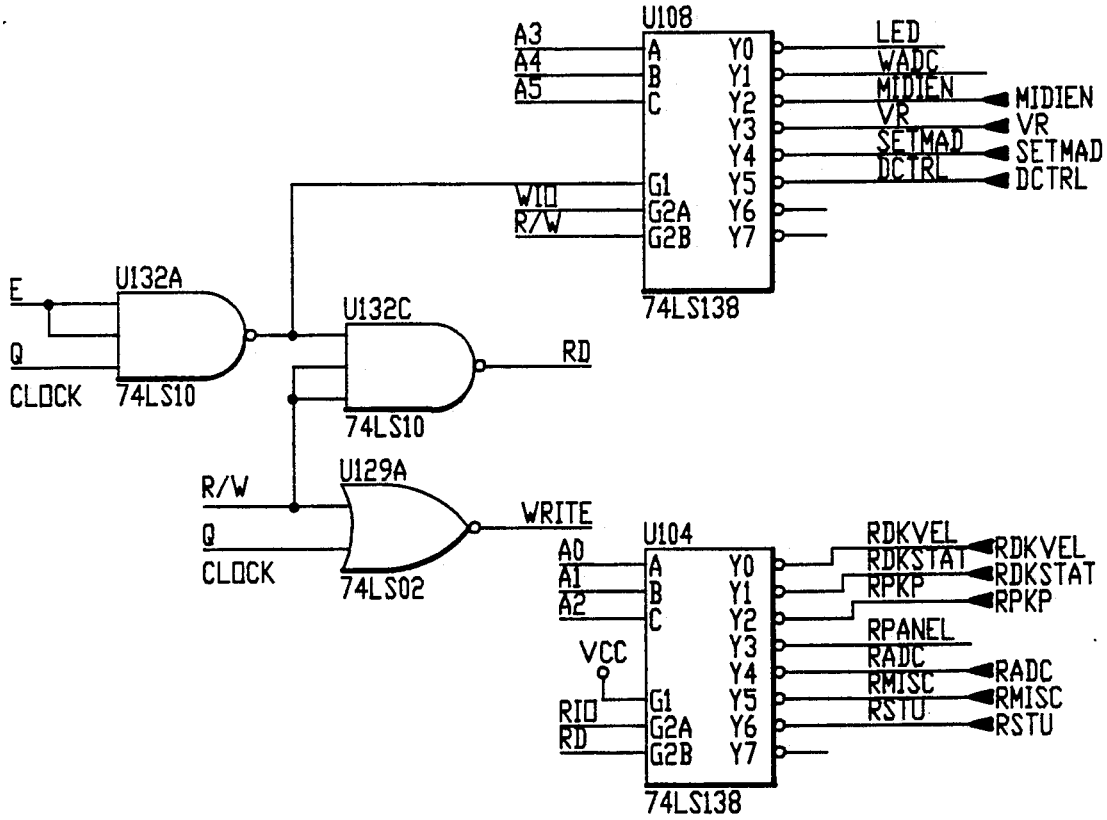

The microprocessor-based electronic control system 230 for controlling functionality of the keyboard 10 is set forth structurally in FIGS. 20 through 27, and functionally in FIGS. 5, and 28 through 30B. With reference to FIGS. 20A and 20B. The control system 230 includes keyboard sensor array 232 (FIG. 21), a keyboard scanner state machine 234 (FIGS. 22 and 23*a–p*), and a cable 235 connecting the keyboard sensor array 232 with the scanner 234. The control system 230 further includes an analog input circuit 236 (FIGS. 24 and 24A), a MIDI input/output circuit 238 (FIG. 25), a floppy disk controller circuit 240 (FIG. 26), a front panel circuit 242 including the printed circuit boards 7242*a*, 242*b*, a rear panel circuit 244, and a microprocessor supervisor and memory circuit 246 (FIG. 27).

The control system 230 includes a 16 bit address bus 24B, a 'D' 8 bit data bus 250, a 'BD' 8 bit data bus 252, an 'ADA' four bit analog multiplexer address bus 254, four UART lines 256, three 'SH' sample and hold select lines 258 and a number of additional single control lines which will be referred to by the name given to each in the figures. Common reference numerals and common names indicate that the lines indicated thereby are commonly connected.

Referring to FIG. 21, the individual key cell keyboard sensor array implementation 232 defines an arrangement of key cells 260 of interleaved contacts. The individual key cells are arranged in groups of four. One contact for each cell is parallel connected with like contacts of three other, adjacent cells. The other contact for each cell leads through a one way diode to one of four scan buses 262*a*, 262*b*, 262*c* and 262*d*. A decoder U501 is clocked at a predetermined clocking rate. The decoder has eight outputs, each of which are connected to four parallel contacts of four adjacent key cells 260.

If FSR material is pressed onto one of the cells as its associated key is depressed, current from the one contact flows through the FSR material into the other contact and is led through the diode to one of the four scan buses 262*a*, 262*b*, 262*c* and 262*d*. The amount of current flow is directly related to pressure applied by the player to the playing key. Thus, it is possible to detect current flow during a scan by sequentially monitoring the four scan buses. Each key is thereby identified by the enabled output of the decoder and the particular scan bus during each phase of the bus scan operation.

Key Scanner State Machine 234

Figure 22:
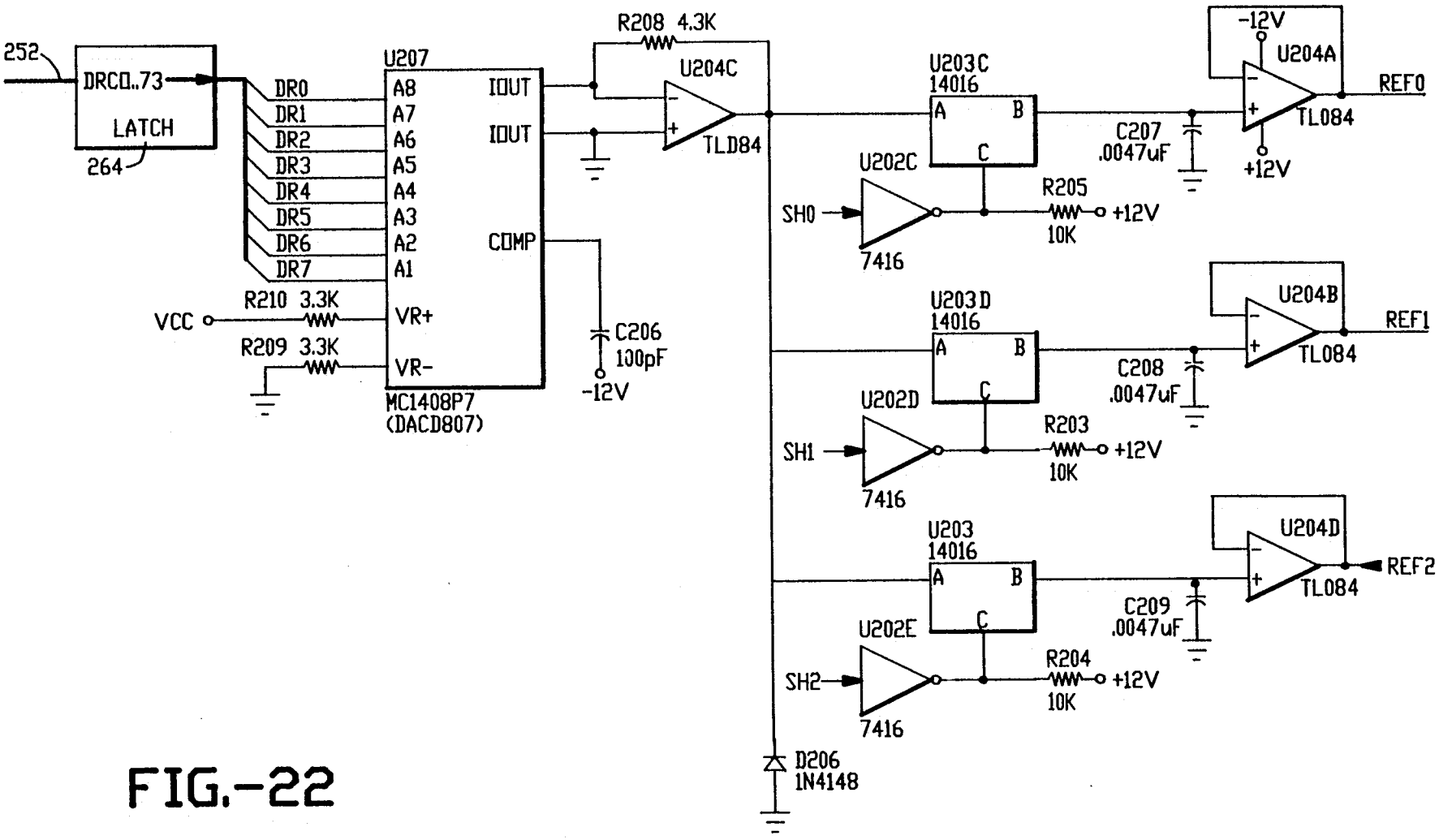
FIG. 22 is an electrical schematic and block diagram of a key sensor programmable threshold voltage establishment circuit for establishing a plurality of sensitivity thresholds for the key sensor array of FIG. 21.

Referring to FIG. 22, three voltage reference values REF 0, REF 1 and REF 2 are generated by a programmable threshold voltage generator circuit. An eight bit digital word generated by the microprocessor supervisor circuit 246, and put out on the bus 252, is latched into a latch 264 and is then put into a 256-step digital to analog converter U207. The analog voltage put out in response to the digital word by the converter U207 is then buffered in a buffer U204C and passed to three individually enabled, analog sample/hold circuits U203C, U203D and U203B. Each sample/hold is controlled by one of the SH lines of the bus 258, and leads to an output buffer/driver U204A, U204B and U204D. The buffer U204A puts out REF 0, the buffer U204B puts out REF 1, and the buffer U204D puts out REF The keyboard scanner state machine 234 serves as an interface between a musical instrument clavier type keyboard, such as the keyboard 10, and a microprocessor controller or computer, such as the microprocessor circuit 246. The keyboard scanner state machine is depicted structurally in FIGS. 23A through 23P, and commonly labelled signal lines appearing throughout these drawings denote common connections.

The keyboard scanner state machine 234 senses key-on and key-off events, including the velocity with which keys are pressed and released. The state machine 234 also measures the continuous downward force (pressure) on each depressed key. A dedicated state machine is preferred herein in order to provide a usable range of velocity measurements for 88 keys, instead of using the programming capability of the microprocessor. With new high speed processors, however, an implementation which relies entirely upon software to carry out the scan and velocity measurements is within the scope and contemplation of the present invention. In this preferred embodiment, the microprocessor circuit 246 is interrupted only when a key event is detected by the scanner circuit 234. A key count occurs whenever a key is depressed or released.

Figure 23A:
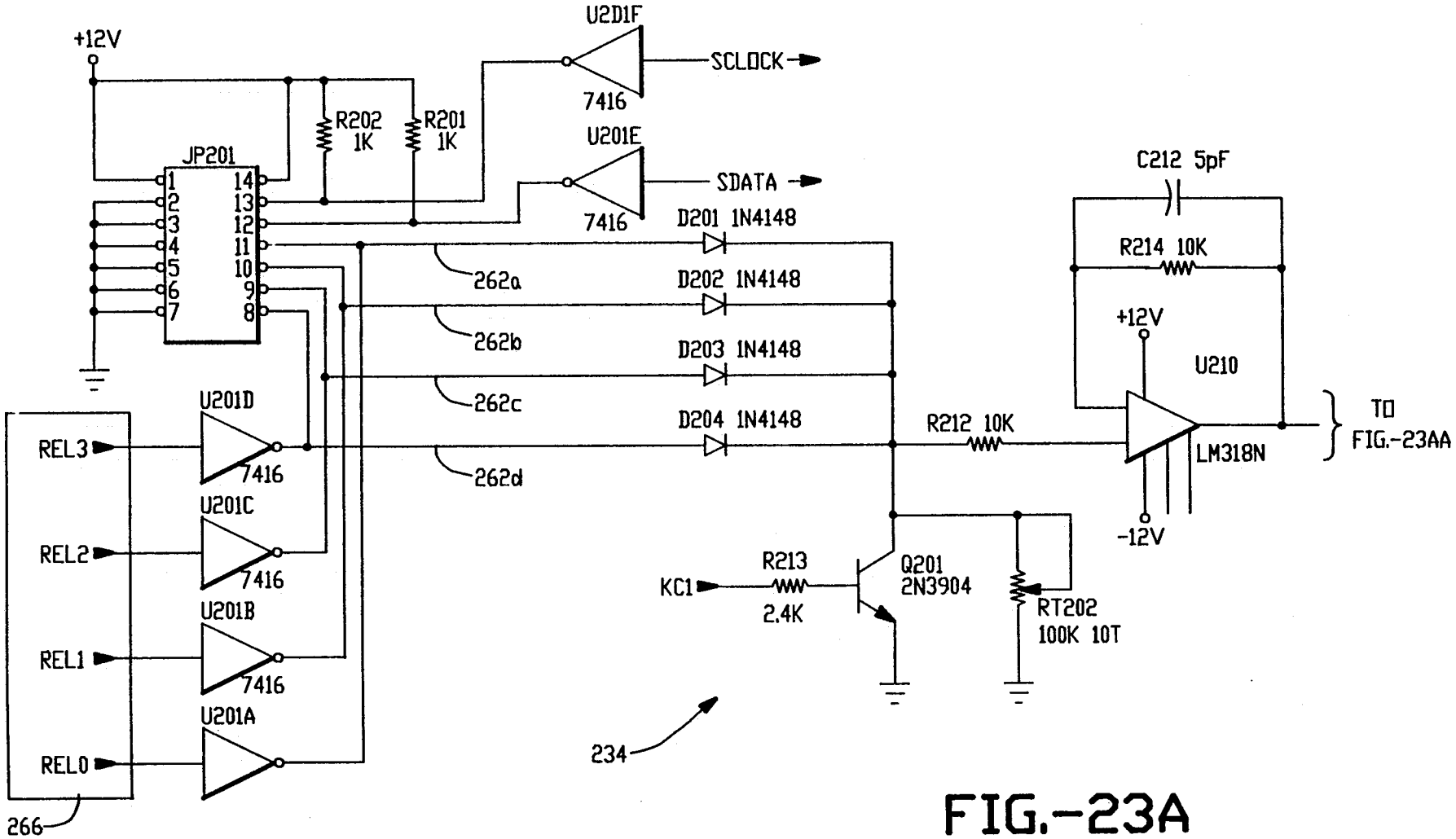
Figure 23A:
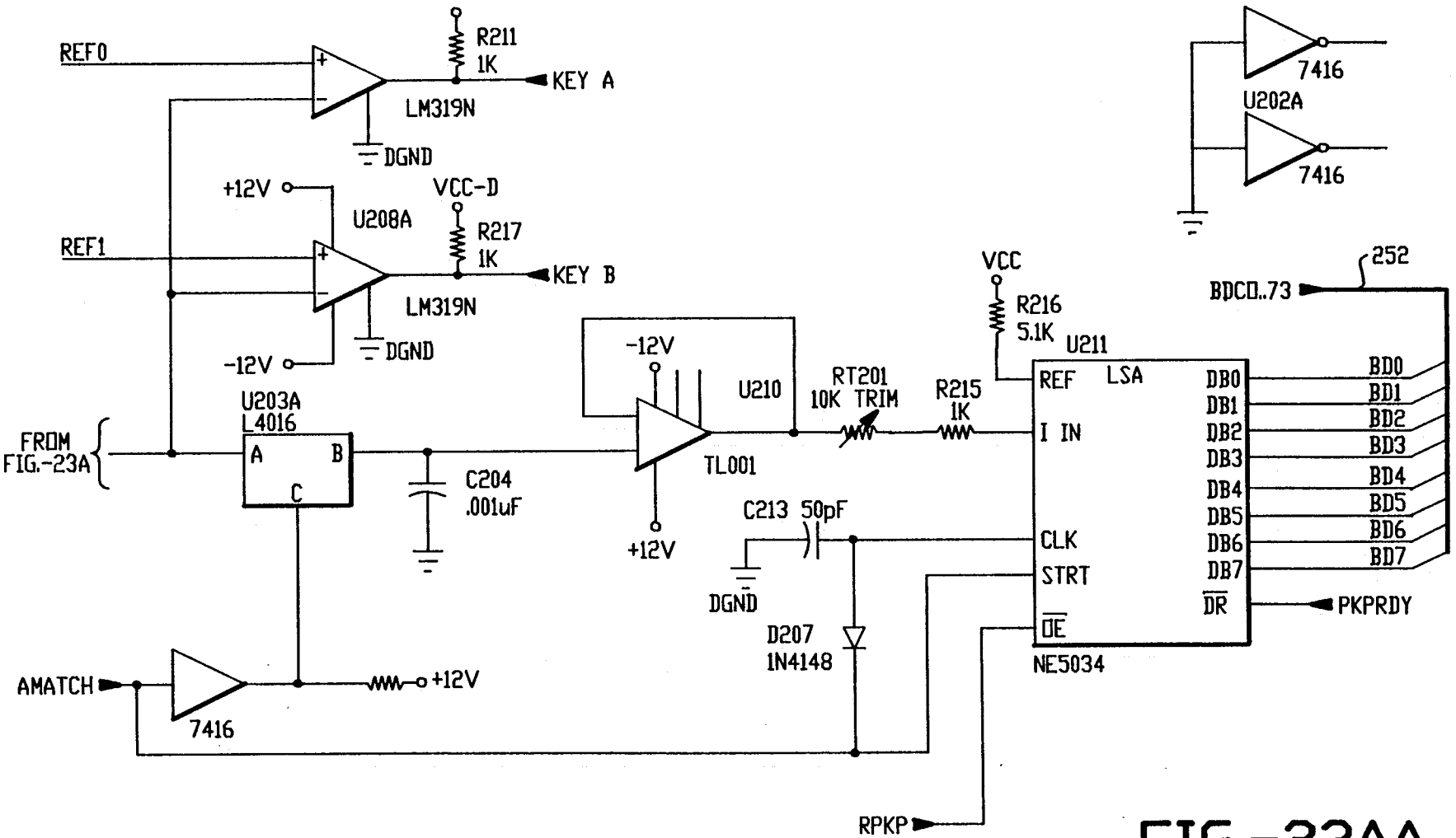
Figure 23B:
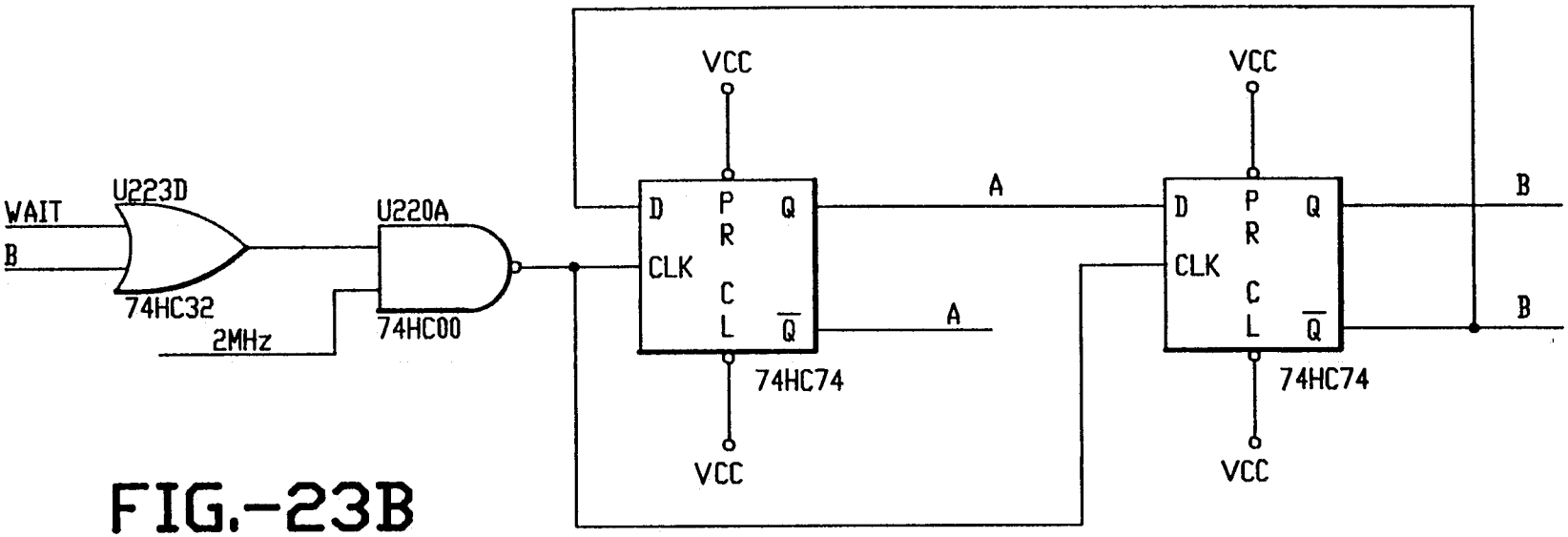
Figure 23F:
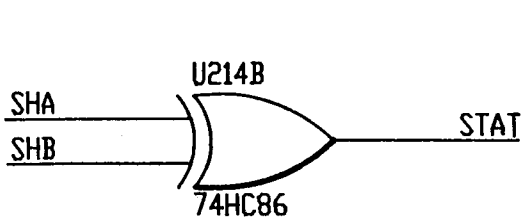
Figure 23D:
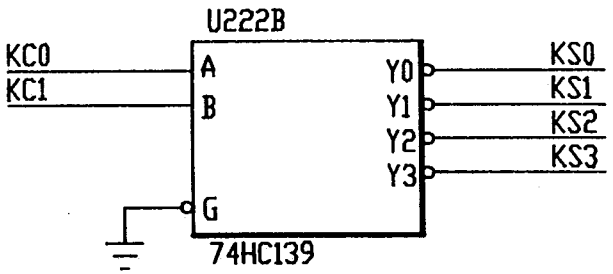
Figure 23C:
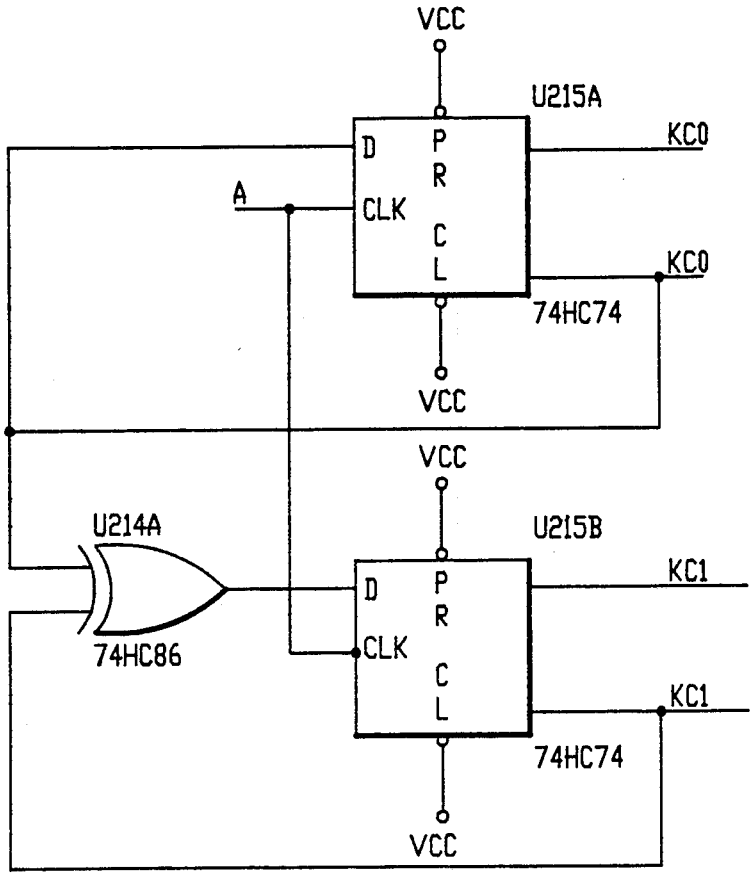
Figure 23E:
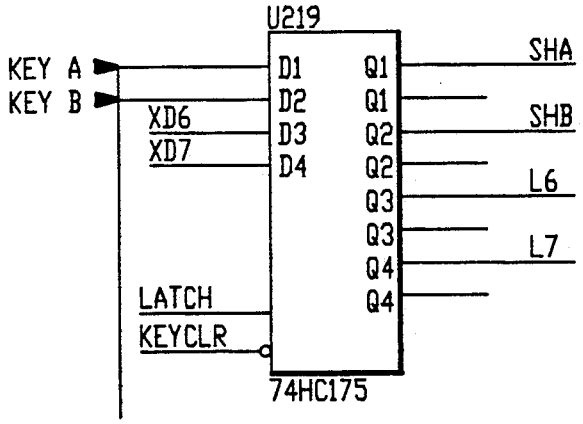
Figure 23G:
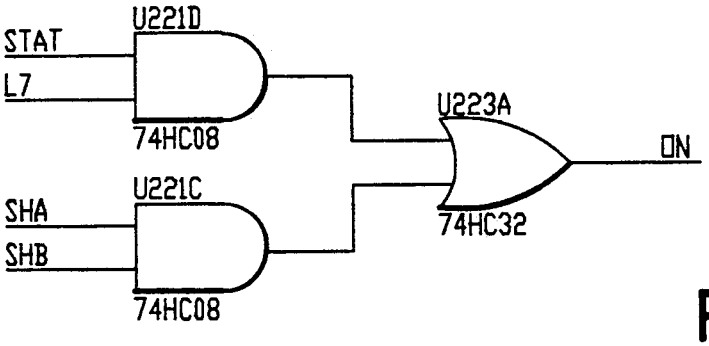
Figure 23H:
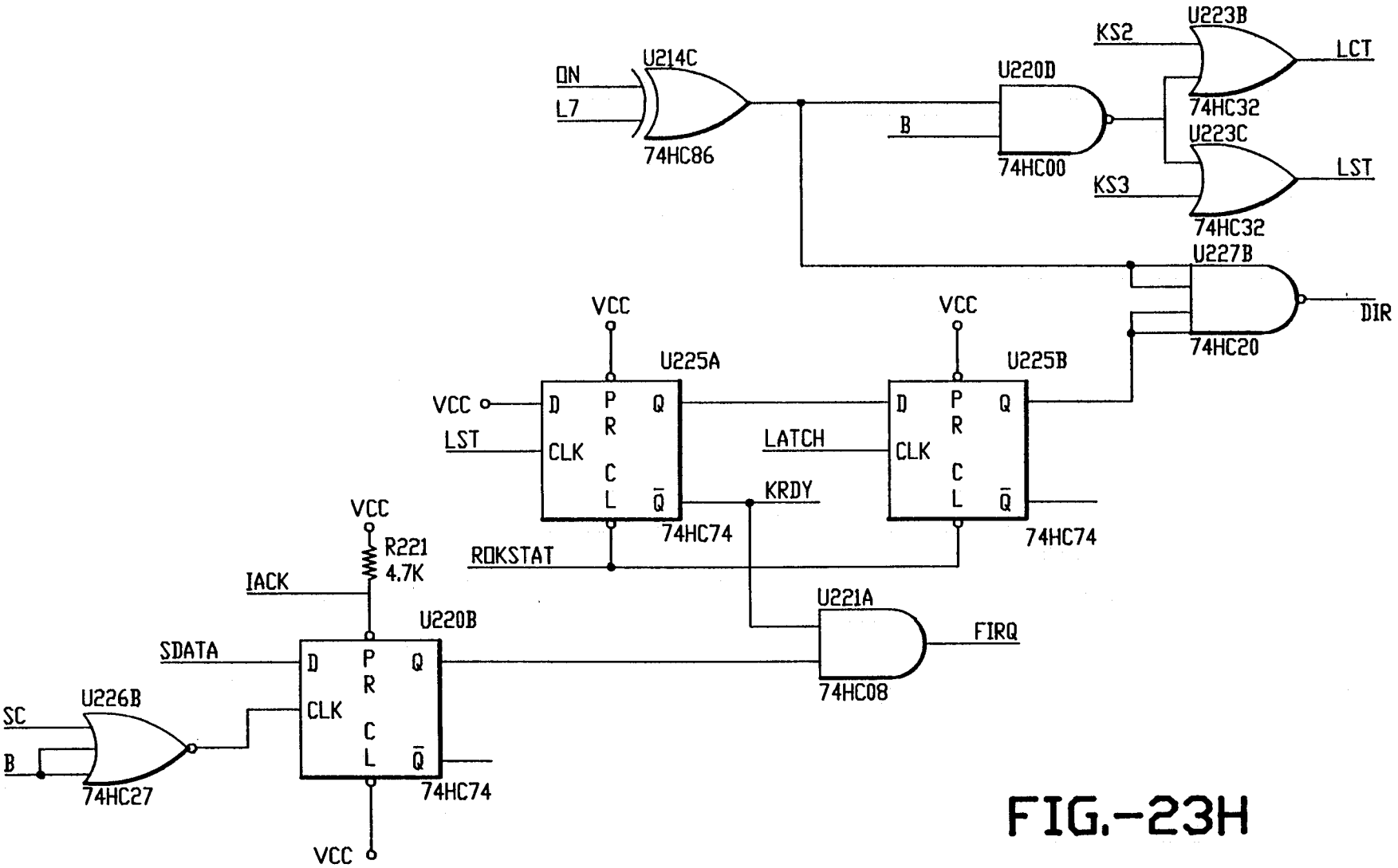
Figure 23I:
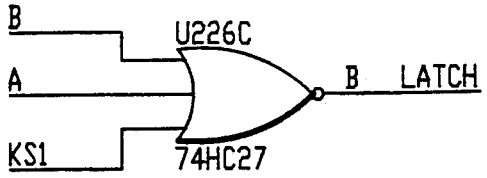
Figure 23J:
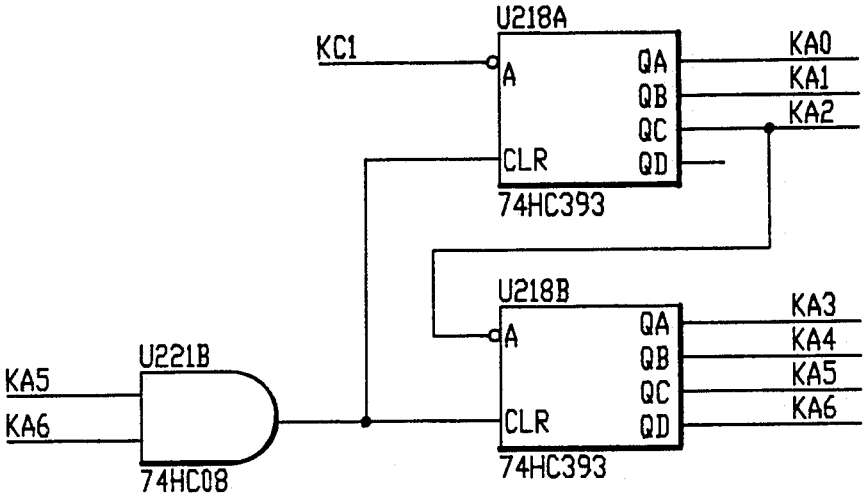
Figure 23M:
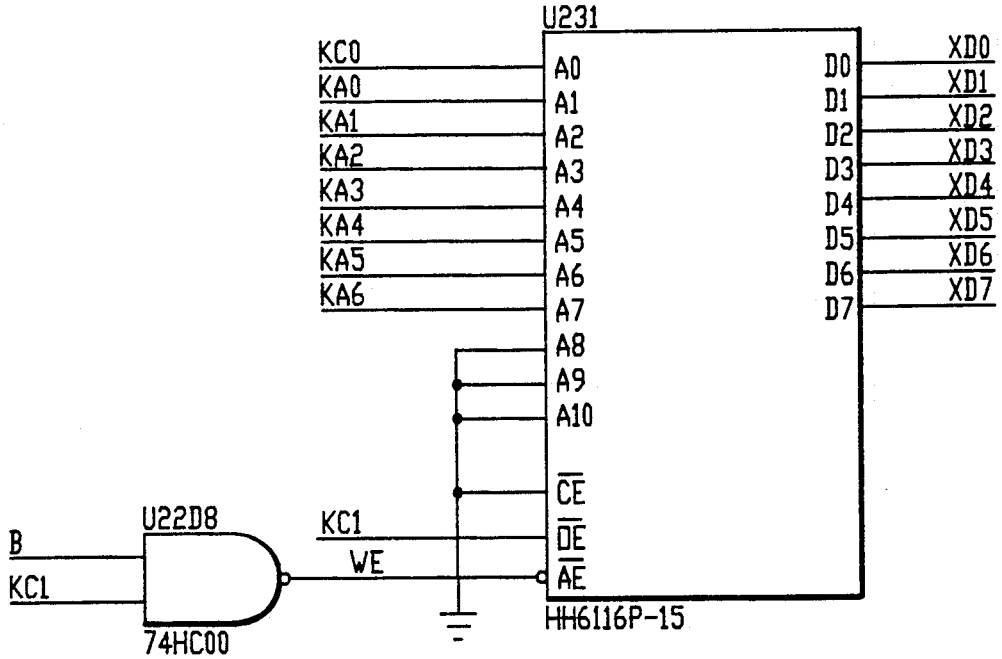
Figure 23K:
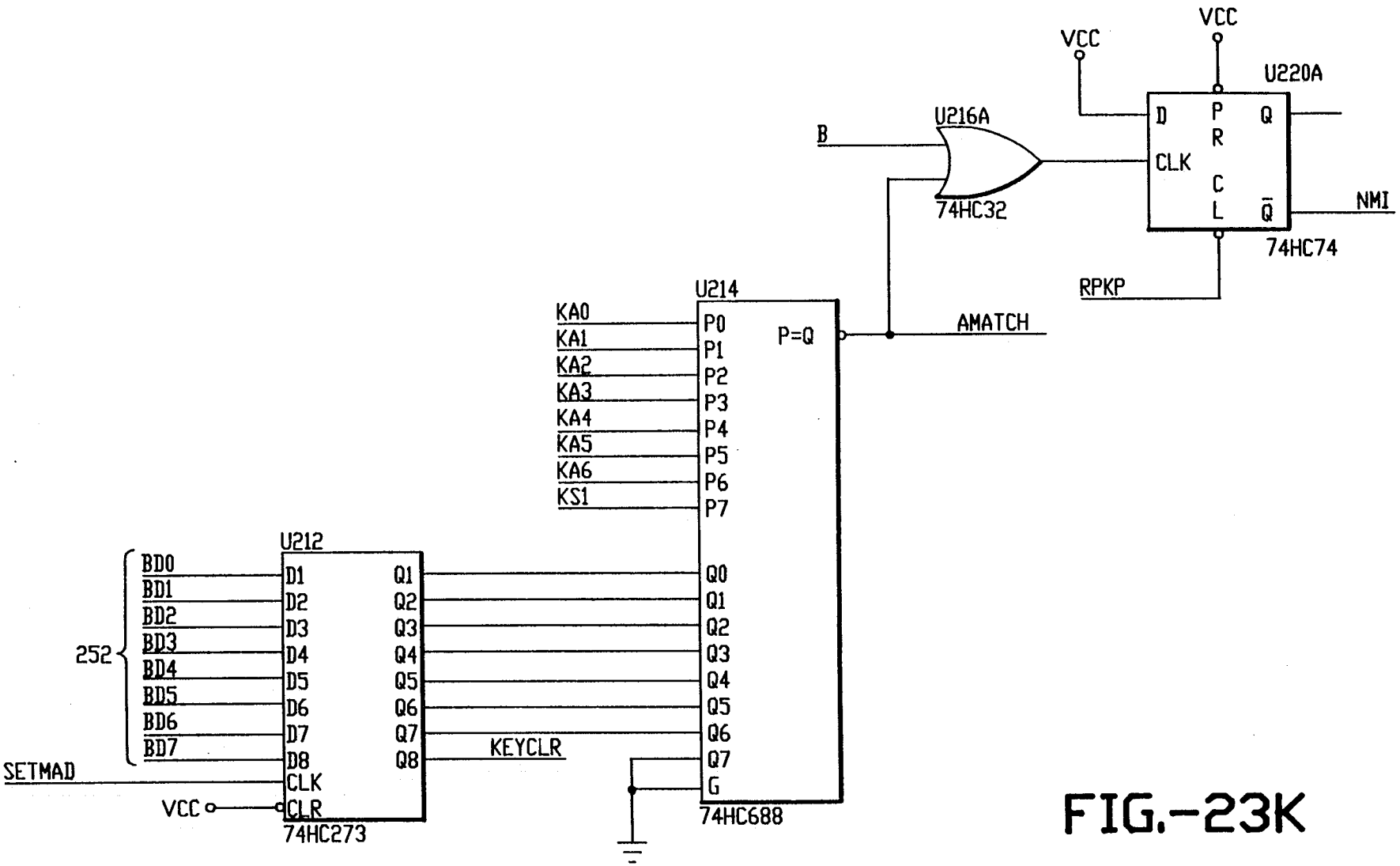
Figure 23L:
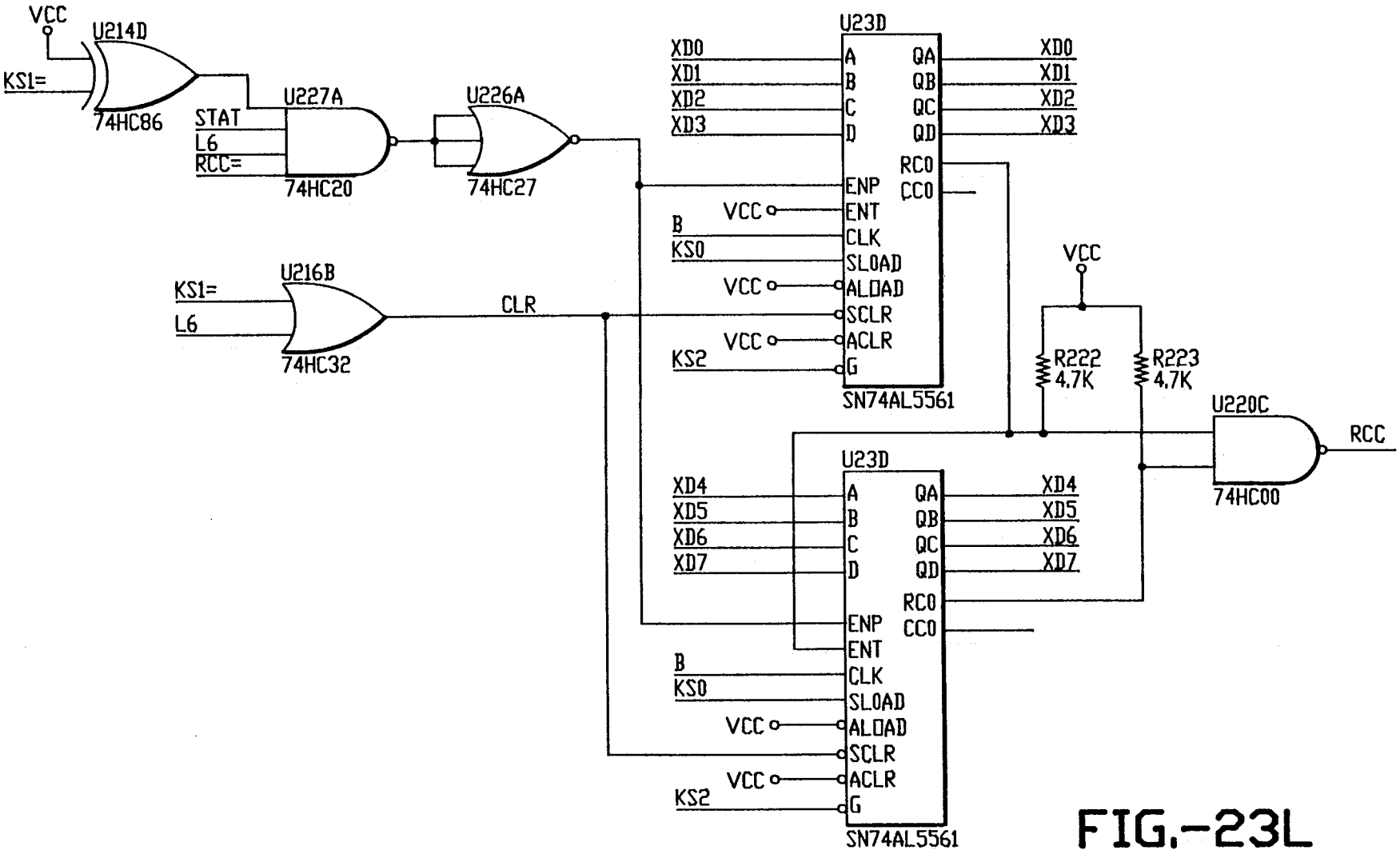
Figure 23N:
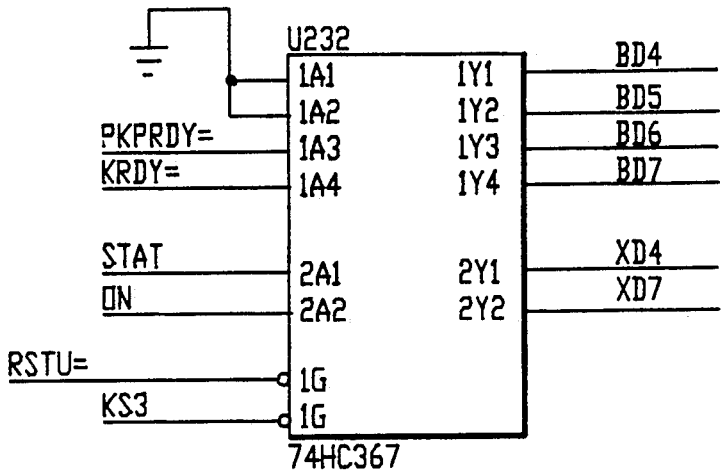
Figure 23O:
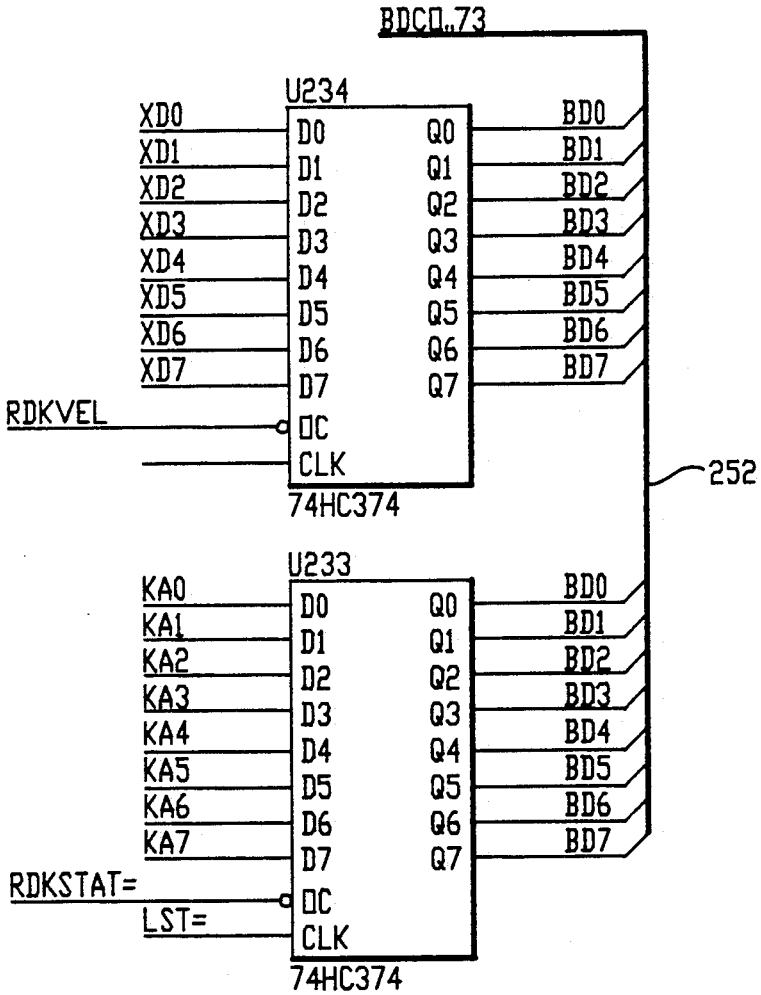
Figure 19C:
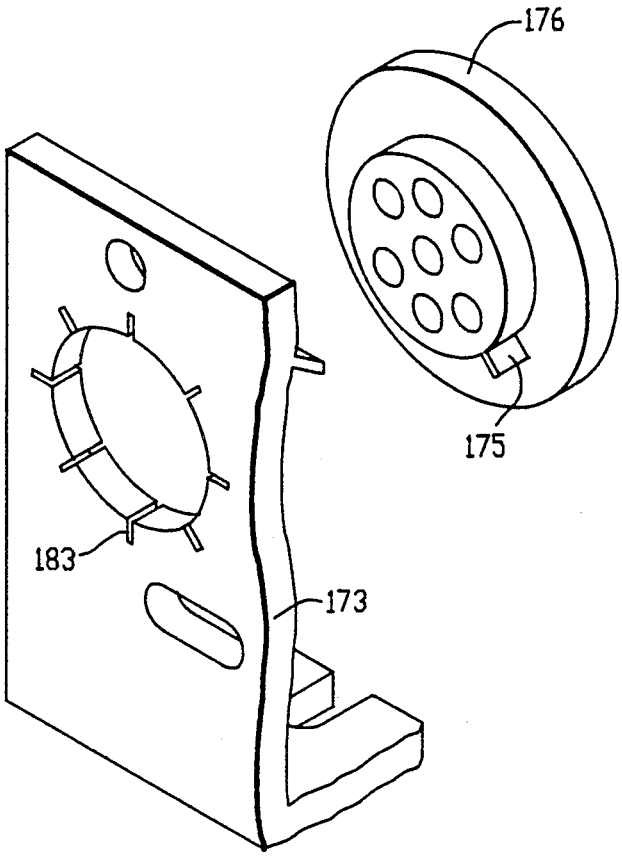
Figure 23P:
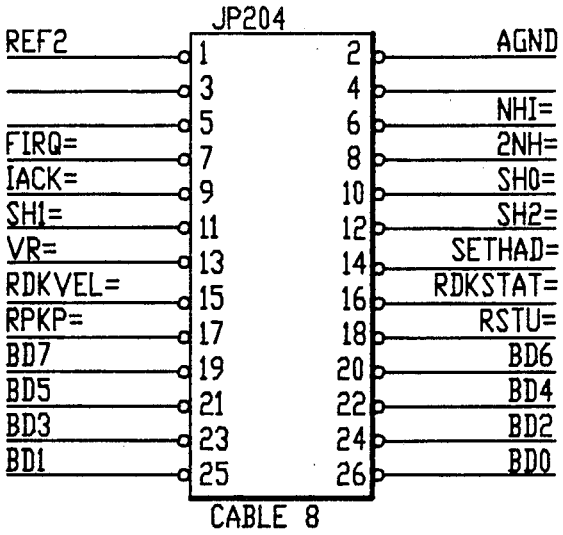
Figure 20A:
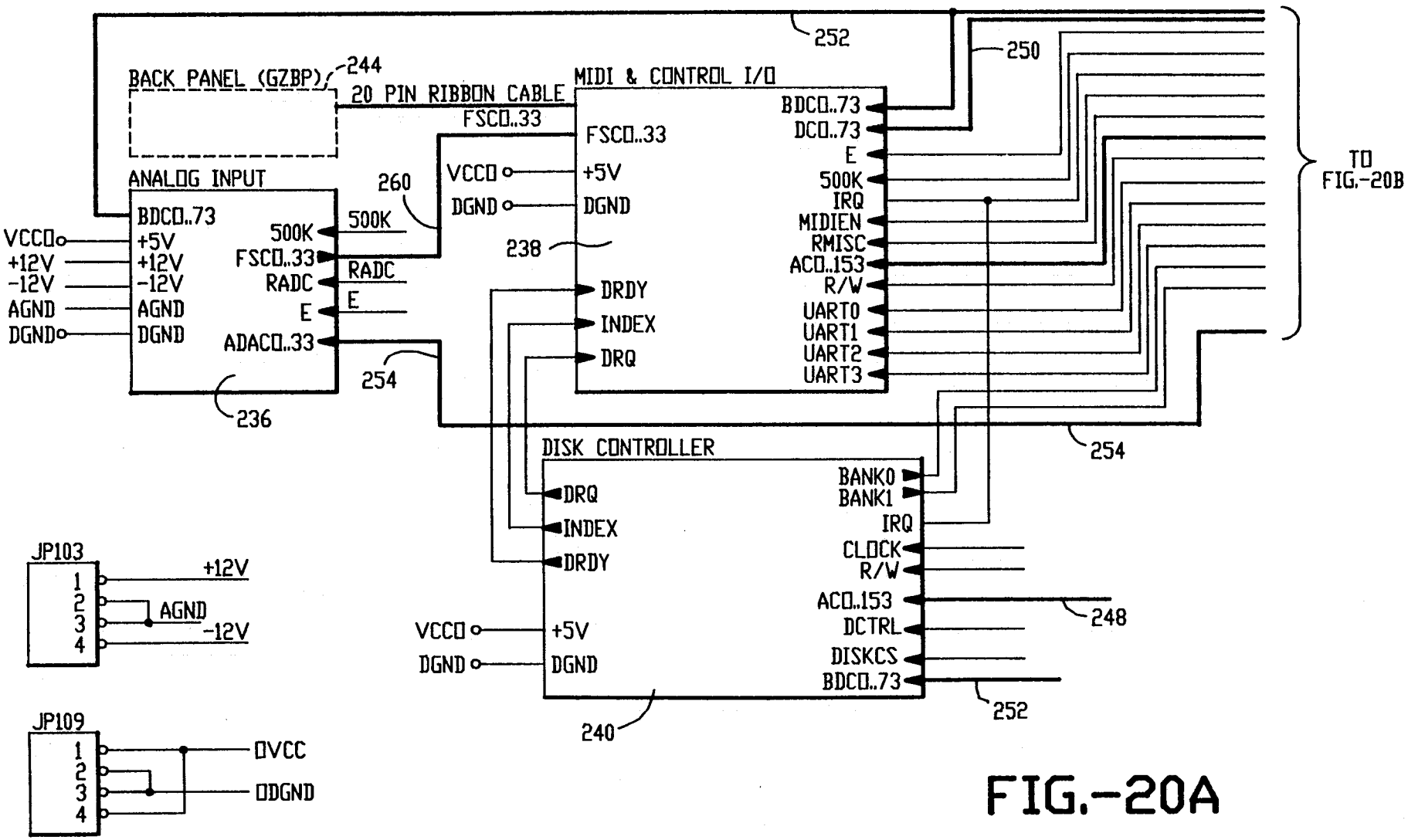
FIGS. 20A and 20B form an overall electrical system structural block diagram of a control system for controlling operations within the FIG. 1 keyboard.
Figure 20B:
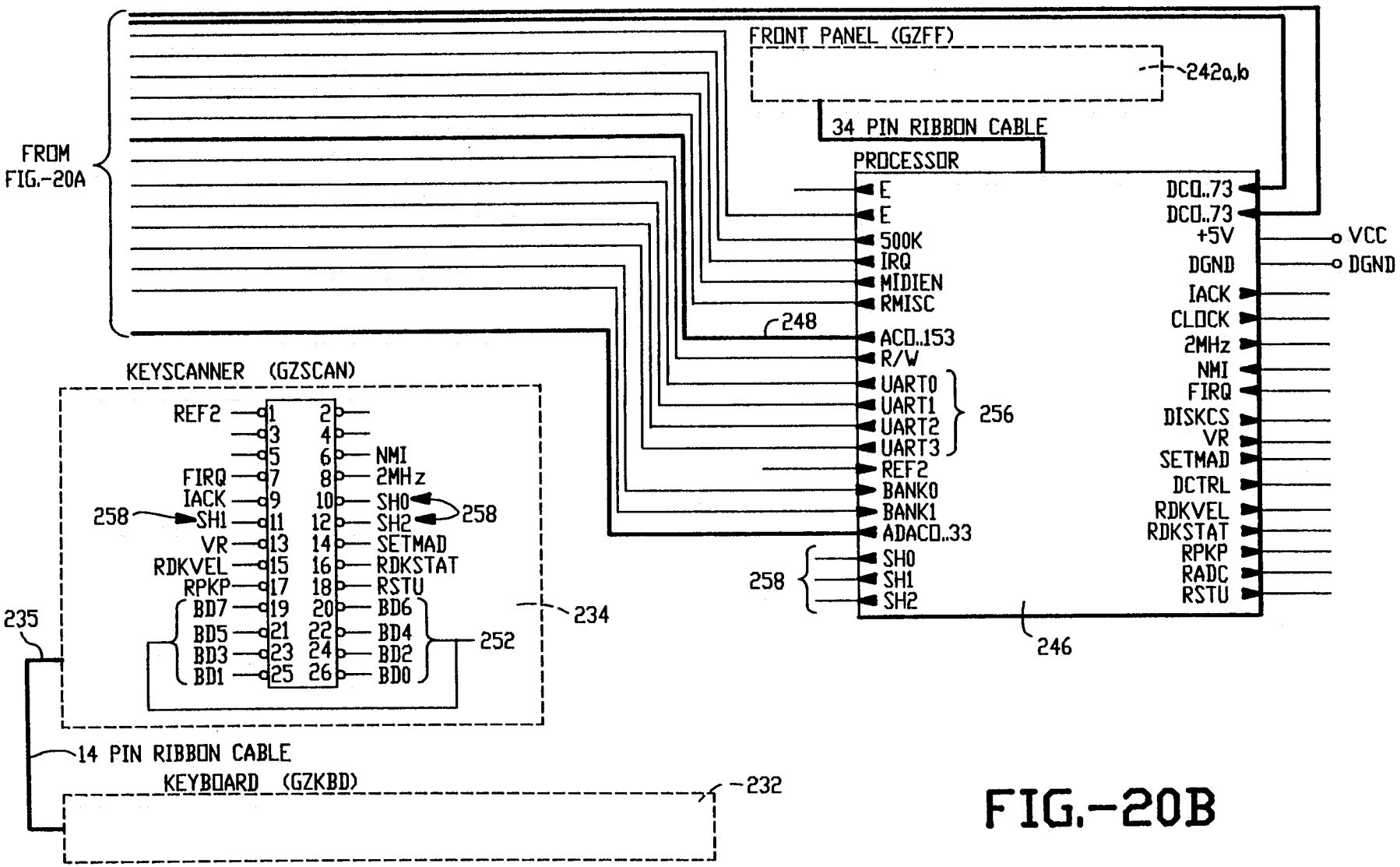

The keyboard scanner state machine 234 connects to, four scan buses 262*a*, 262*b*, 262*c* and 262*d* (FIG. 23A and 23AA). A selector logic circuit 266 enables one of the scan buses at a time. A transistor Q201 grounds all four scan buses during switching intervals to discharge any distributed capacitance charges developed in the wiring and FSR material, etc. The current present on the enabled scan bus is converted into a voltage at a variable resistor RT 202 (which provides an adjustment to compensate for variations in FSR material characteristics), amplified and shaped in a fast buffer amplifier U210. The voltage is then passed on to two voltage comparator circuits: U208B which compares the scan bus signal amplitude with the REF 0 voltage, and U208A which compares the scan bus signal amplitude with the REF 1 voltage. If the scan amplitude is greater than REF 0, a KEY A logical signal is generated and put out. If the scan amplitude is greater than REF 1, then a KEY B logical signal is generated and put out. The KEY A and KEY B signals go to keyboard scanner velocity sensing circuitry.

Figure 28:
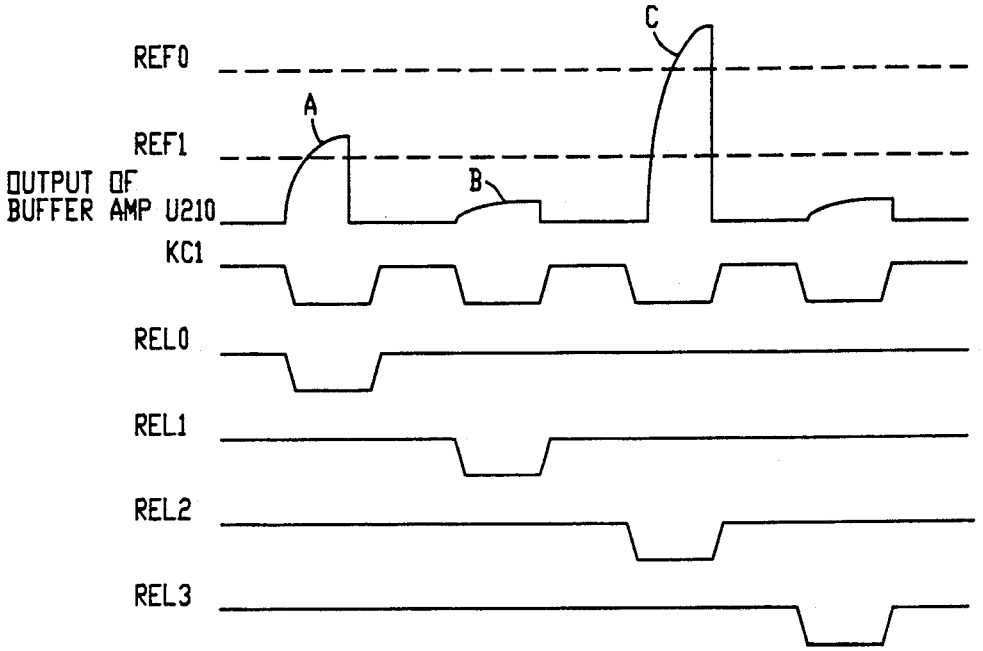
FIG. 28 is a graph of a series of waveform diagrams illustrating operation of the threshold circuits within the FIG. 23 keyboard scanner circuit.

With reference to FIG. 28, REF 0 represents a high voltage threshold value, and REF 1 represents a lower voltage threshold value. Signal peak A denotes a key which has started to turn on but has not yet crossed the upper threshold REF 0 i.e., a key event has occurred. Signal B represents a key which is off, and signal C represents a key which is fully on. The keyboard clock signal KC1 which controls the transistor Q201 and the four negative logic scan bus select signals REL 0, REL 1, REL 2 and REL 3 are also shown in time relationship with the A, B and C key amplitude signals in FIG. 28.

In order to develop a key pressure value (as compared to velocity), which may be read whenever desired by the microprocessor circuit 246, the incoming scan amplitude signal is also passed to a sample/hold circuit U203A and buffer U205. It is then available to be digitized in an analog to digital converter U211. The microprocessor controller 246 obtains a key pressure reading by enabling the U211 AtoD via a line RPKP and then by writing the converted value onto the data bus 252.

The scanner state machine 234 is based on a 2MHz clock signal which is time divided into an A time phase and a B time phase by the two-phase 500 KHz clock circuit shown in FIG. 23-B. Two keyboard clock signals KC0 and KC1, and their logical inverses, are generated from the A period by the latch circuit depicted in FIG. 23-C. Four keyboard scan signals KS0, KS1, KS2 and KS3 are generated from the KC0 and KC1 signals by a decoder depicted in FIG. 23-D.

A quad latch U219 receives the Key A and Key B values from the comparators U208A and B (FIGS. 23A and 23AA) and receives the prior status bit STAT as XD6 and the prior ON bit as XD7. Four signals are put out by the circuit U219: SWA, SWB, L6 and L7. An exclusive OR gate U214B (FIG. 23-F) compares SWA and SWB in order to develop a key status transition signal (key event) STAT. The STAT signal indicates whether the latched values for KEY A and KEY B are equal or not. STAT is true when a key is in transition from off to on, or from on to off. STAT is false when a key is either fully on or fully off.

A logic circuit depicted in FIG. 23-G develops an ON signal from L7, STAT, SWA and SWB. ON is true when a key is fully on, or if ON was true during the last scan, but is currently in transition.

A logic circuit depicted in FIG. 23-H develops from ON, L7, B, KS2 and KS3 certain control signals including LCT which is used to clock a key velocity value latch (U234, FIG. 23-O), and LST which is used to clock a key status value latch (U233, FIG. 23-0). The FIG. 23-H circuit also develops a WAIT* signal and a host processor interrupt signal and a host processor interrupt signal FIRQ which indicates to the host microprocessor circuit 246 that a key event has occurred. The flag FIRQ is cleared by the host processor 246 by reading the latch U233 or by generating an interrupt acknowledgement signal IACK.

A LATCH signal generated by a logic gate depicted in FIG. 23-I from B, A, and KSl represents a single key scan interval, and it clocks the latch U219 (FIG. 23-E) and a latch U225B of the part of the FIG. 23-H circuit which generates the WAIT signal.

A logic circuit depicted in FIG. 23-J generates eight key address signals KA0 to KA6 from the KC1 signal. These address signals correspond to the particular key presently being scanned, and they are applied to address a 2048 by eight bit random access memory array U231 depicted in FIG. 23-M and containing information about the key recorded during the last scan.

A tri-state buffer U232 of FIG. 23-N places the PKPRDY and KRDY status signals respectively generated by the pressure analog to digital converter U211 of FIG. 23-A, and the velocity logic key event circuitry of FIGS. 23-H onto bit positions of the BD data bus in response to a microprocessor generated status request signal RSTU, so that each flag may be read and acted upon by the microprocessor supervisor circuit 246. Similarly, the STAT and ON signals are put out as XD6 and XD7 bit positions during the KS3 scan cycle.

The XD0 through XD7 values representing current velocity information for a key are latched and held in a latch U234 of FIG. 23-O and are put out onto the BD data bus 252 in response to a read keyboard velocity signal RDKVEL put out by the microprocessor 246. Similarly, the status of the keyboard scanner, as indicated by the present key address, is latched and held in a latch U233 of FIG. 23-O and put out onto the BD data bus 252 in response to a read keyboard status signal RDKSTAT generated by the microprocessor controller 246.

FIG. 23-P merely illustrates the signal lines which extend from the keyboard scanner 234 to the balance of the control system 230.

Key Pressure Sense Operation

A logic circuit depicted in FIG. 23-K compares a key address sent by the microprocessor 246 to the scanner over the BD data bus 252 with the address values KA0-7 generated by the FIG. 23-J circuit. If an equivalence is detected, indicating that the keyboard scan has reached the key whose pressure is to sensed and converted to digital data, a signal AMATCH is generated and sent to enable the sample and hold circuit U203A of the FIG. 23-A pressure sense circuitry. This causes the incoming amplitude from the key to be latched and held. At the same time, the AMATCH signal starts the pressure sensor analog digital converter U211 to convert the held key pressure amplitude value into a digital word. The latch U220A of the FIG. 23-k comparison circuit generates a non maskable interrupt (NMI) and sends it to the microprocessor circuit 246. When the data conversion is complete, a PKPRDY signal is put out by the analog to digital converter U211 and sent as a bit position 7 value on the BD bus 252 as latched through the latch U232 (FIG. 23-N). This DB bus bit seven signal is read by the microprocessor circuit 246 and it thereupon generates and sends a RPKP signal to output the digital pressure value from the converter U211 onto the DB data bus 252 and to reset the NMI latch U220A. The pressure value for the selected key is then available on the data bus for further processing by the microprocessor circuit 246. A new NMI interrupt will be generated and sent out to the microprocessor each time the keyboard scan reaches the key value latched into the latch U212 of the FIG. 23-K, until a new key address is supplied by the microprocessor circuit 246.

Key Velocity Sense Operations

The key on/off sensing, velocity measurement and pressure sense operation use the single FSR sense cell 260 provided for each of the 88 keys in the FIG. 21 keyboard embodiment. Application of a downward force on a key 24, 26 causes a decrease in electrical resistance between the fingers of the cell 260 because of the characteristics of the FSR material. This change of resistance generates a higher direct current, which is converted to a voltage as explained above in conjunction with FIG. 28.

With one sensor 260 for each key, all keys on the keyboard 10 are rapidly scanned in sequence and the voltage developed from each key sensor 260 is compared with the programmed reference thresholds REF 0 and REF 1. When a key is pressed, the derived key voltage will cross one and then both of these programmed thresholds if pressed far enough. When the first threshold reference is reached, e.g. REF 1 in FIG. 28, the key scanner begins to count the number of full keyboard scans that occur until the other threshold is reached. When both thresholds REF 1 and REF 0 have been crossed, as at point C in FIG. 28, the key scanner generates an interrupt FIRQ at the gate U22IA of FIG. 23-H for the microprocessor circuit 246 and then first sends the key number KAO-6 and a flag XD7 indicating whether the event was a key-on or key-off event as held in the status latch U233, and then the scan count XDO-7 held in the velocity latch U234. These bytes are sequentially presented to the BD data bus 252 by the control signals RDKVEL and RDKSTAT. The scan count value is used by the microprocessor circuit 246 to calculate a velocity value for the particular key being sensed, since the number of key scans occurring from the time the first threshold REF 1 was crossed until the time the second threshold REF 2 was crossed, or vice versa, is a direct analog of the rate at which the key is being depressed, or released.

By making the reference thresholds REF 0 and REF 1 programmable, either by using the microprocessor supervisor circuit 246 or by using potentiometers, the physical point at which keys turn on and off may be adjusted. Having adjustable reference threshold values REF 0 and REF 1 also enables the dynamic range (or time scale) for velocity sensing to be altered.

The basic unit of time measurement is the keyboard scan. A keyboard scan is the time taken by the key scanner to address every key on the keyboard 10 and return to the beginning again. In the preferred embodiment disclosed herein, one keyboard scan requires 768 microseconds to complete. The velocity timing resolution is therefore 768 microseconds per increment per key. With an eight bit velocity counter (U229, U230 of FIG. 23-L), the slowest key transition that can be measured is 197 milliseconds (768 us. * 256).

The scan is subdivided into a bus address cycle during which a group of four keys are enabled on the sensor printed circuit 232. One bus address cycle takes 32 microseconds. The bus address cycle is further divided into the four *8* microsecond key address cycles KS0, KS1, KS2 and KS3, during each one of which the current present on the buses 262*a*, 262*b*, 262*c* and 262*d* are read and converted into voltages.

In order to measure the velocity of all of the keys of the keyboard 10, the key scanner must keep track of key status for each individual key through successive keyboard scan cycles. During the time interval between the occurrence of REF 1 and REF 0 for a key being depressed, which is counted by the eight bit counter, the intermediate status and counter values for each key in a transitional state are stored in the fast random access memory U231.

The random access memory U231 is addressed by the key address counter (U218) which is clocked at the beginning of each key address cycle. The key address counter U218 counts up to 95 and then resets to zero to start counting up again. The shift clock SDATA for the key sensor board shift registers (e.g. U501 of FIG. 21) is generated at the end of every fourth key address cycle, and the data for the shift registers (SDATA) is generated between the counts 92 and 95 of the address counter U218 in order to set up the sensor shift registers for the next scan.

During each key address cycle, the keyboard scanner goes through four separate phases, Phase Zero, Phase One, Phase Two and Phase Three.

Phase Zero occurs when KC0 equals zero and KC1 equals zero. During this first phase of a key address cycle, the RAM outputs are enabled and the value of the accumulated velocity count is loaded as a preset into the data inputs of the eight bit counter (U229 and U230).

Phase One occurs when KCO equals one and KC1 equals zero. In phase one, a second byte of data is enabled on the RAM outputs, containing two status bits from the previous scan. These two bits represent the previous values of the signals STAT and ON are presented as inputs to the latch U219, along with the current values of KEY A and KEY B. Also, during phase one a combination of status signals is used to determine what will happen to the velocity counter. The counter will count up (increment) if the counter was not at its maximum count at the last scan and the key was in transition at the last scan and the key is presently in transition. The counter will reset to zero if the key was fully off or fully on during the last scan. Otherwise, the counter output will remain unchanged. Finally, during phase one, the address match comparator U213 is enabled to initiate a pressure reading if the current key address corresponds to the value stored in the latch U212.

Phase Two occurs when KC0 equals zero and KC1 equals one. In phase two the RAM switches to input (write) mode and the velocity counter outputs are written into memory at the address pointed to for this key, replacing the old count value. At this point, if a key event has just occurred, the count value is also written into the velocity output latch (U234). A key event occurs when: ON is false and ON was true at the last scan, or ON is true and was false at the last scan.

Phase Three occurs when KC0 and KC1 both equal one. During phase three, the current values of STAT and ON are written into the second byte of RAM at the current key address, replacing the previous status values. If a key event has happened during this key scan, the key address (7 bits) and ON are written into the eight bit key status output latch U233. Also, when a key event occurs, the interrupt generator flip-flop U225A is clocked, thereby setting the FIRQ interrupt request line to the microprocessor 246.

Ordinarily, the interrupt flip-flop U225A is cleared when the status output latch U233 has been read by the microprocessor circuit 246. If the interrupt flip-flop is not cleared, and the key scanner encounters a second key event, key scanner system operation will be halted during Phase One of the key address cycle at the key at which the event is detected. When the interrupt for the last key event is finally cleared, the key scanner will continue from the place where it stopped, and the new key event will be clocked into the output latches and another interrupt will be generated.

This method for handling multiple key events close together works well, since only rarely will two key events happen within the same 768 microsecond keyboard scan cycle. When two events do occur within this cycle, the microcomputer 246 usually responds to interrupts quickly enough that any resultant velocity errors are negligible.

The key scanner also generates an interrupt FIRQ every time that the key address reaches 92 (which is beyond key 88 of the 88 key keyboard 10, and therefore beyond occurrence of any key event). This interrupt is provided as a marker to the microprocessor circuit 246 and is not related to key scanning operations at the scanner. The interrupt is cleared automatically by the microprocessor 246 by enablement of the interrupt acknowledge line IACK.

Analog Input Circuit 236

Figure 24:
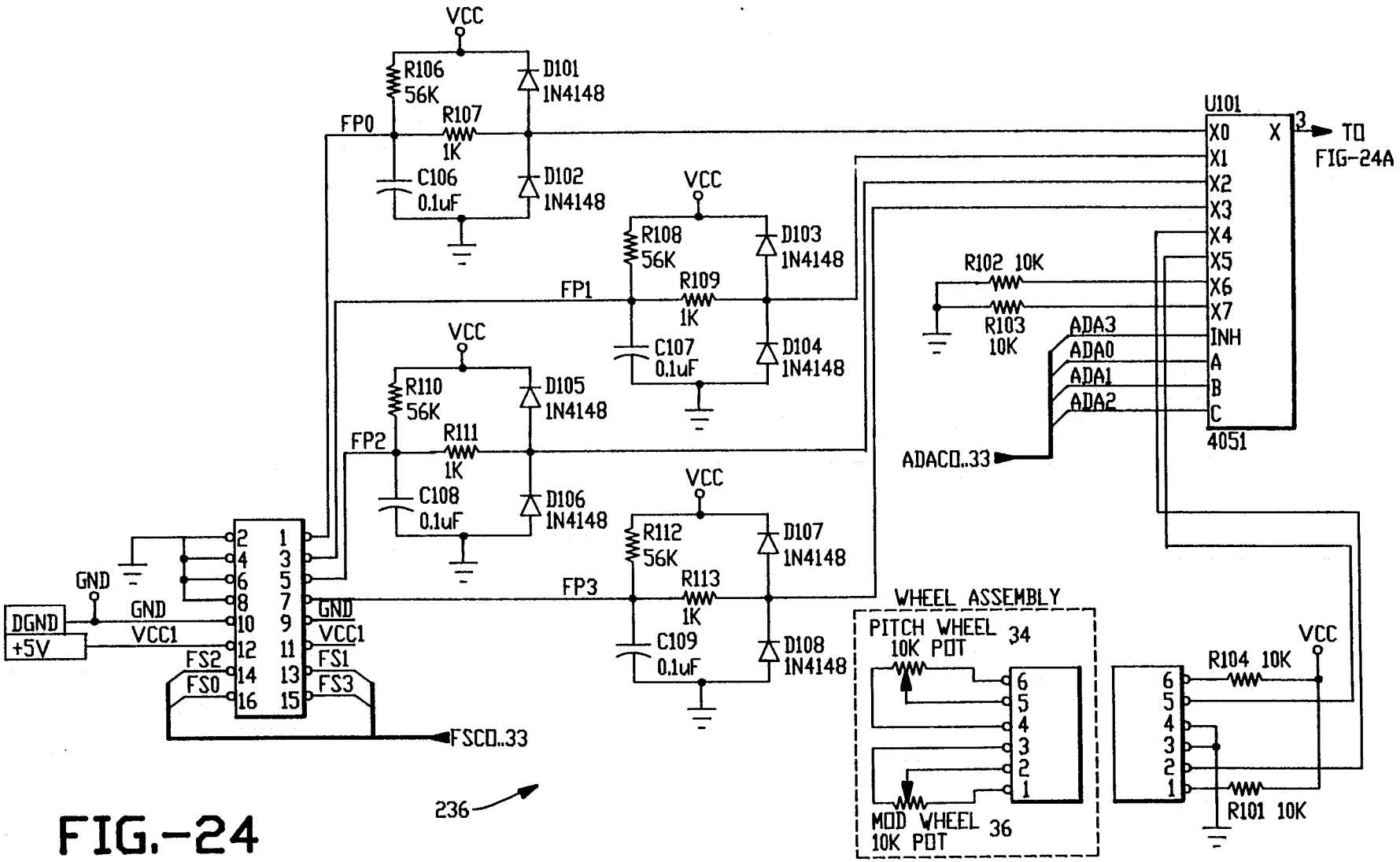
FIGS. 24 and 24A form an electrical schematic and block diagram of a multiplexed-input analog to digital conversion circuit of the FIG. 20 control circuit.
Figure 24A:
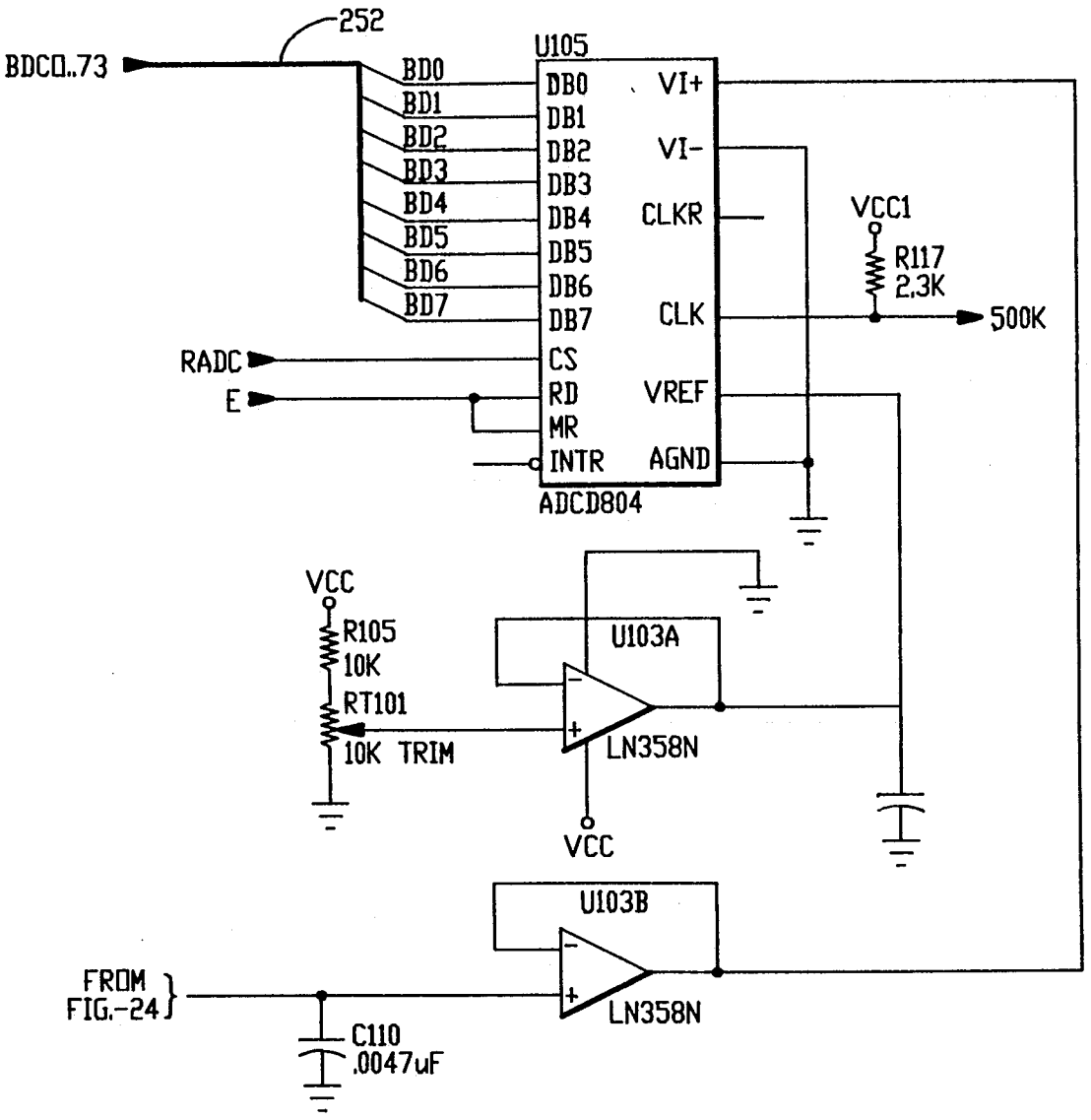

Referring to FIGS. 24 and 24A electrical details of the analog input circuit are presented. Four analog inputs FP0-3, leading from the foot pedal jacks 60*a–d* (and analog foot controls, such as the variable control 20) connect to four inputs of an eight input analog multiplexer U101. Two other inputs thereof are from the pitch wheel 34 and the controller wheel 36.

A particular analog input is selected in accordance with address information sent by the microprocessor circuit 246 over the ADA0-3 bus 254. The selected analog signal is buffered by passage through a buffer amplifier U103B and then delivered to an input of an analog to digital converter U105. A voltage reference for conversion of the incoming analog signal is established by a potentiometer RT101 and an amplifier U103A. An address value RADC for the A to D UI05 is decoded at the microprocessor circuit 246 and causes the digital value converted by the converter to be put out on the BD data bus 252 and thereupon read by the microprocessor 246 for further processing and action. In this way, the microprocessor is able to obtain digital values corresponding to settings of the foot pedals and the pitch and controller wheels.

While the foot switch signals from the foot switch jacks 58*a–c* and 62 pass through the analog input circuit, these are digital values which are sent directly to the MIDI and control circuit 238 on the FS0-3 bus 260 where they are presented to the BD data bus (bits 0–4) via a three state buffer controlled by the microprocessor circuit 246.

MIDI and Control Input/Output Circuit 238

Figure 25:
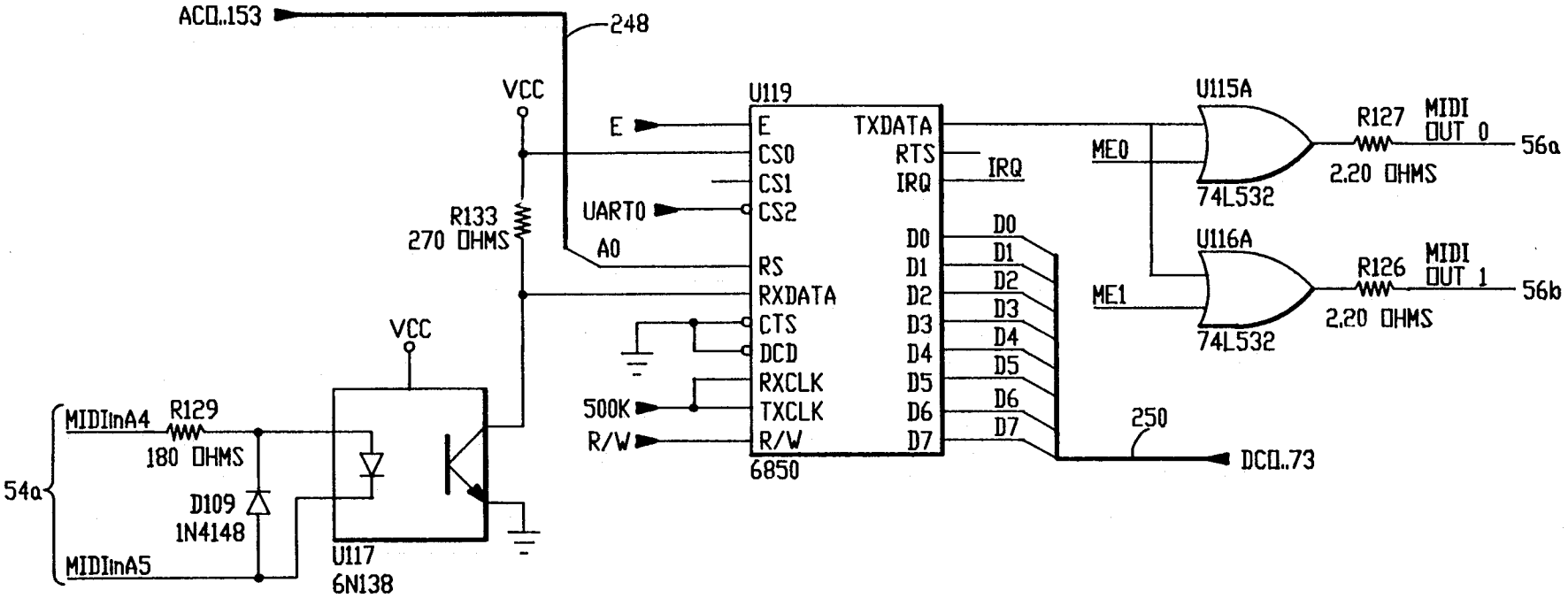
FIG. 25 is an electrical schematic and block diagram of one of four identical digital to MIDI input/output circuits of the FIG. 20 control circuit, the input being connected to one of the MIDI input paths and each of the output circuits being connected to two of the eight MIDI system output paths of the FIG. 1 keyboard.
Figure 26:
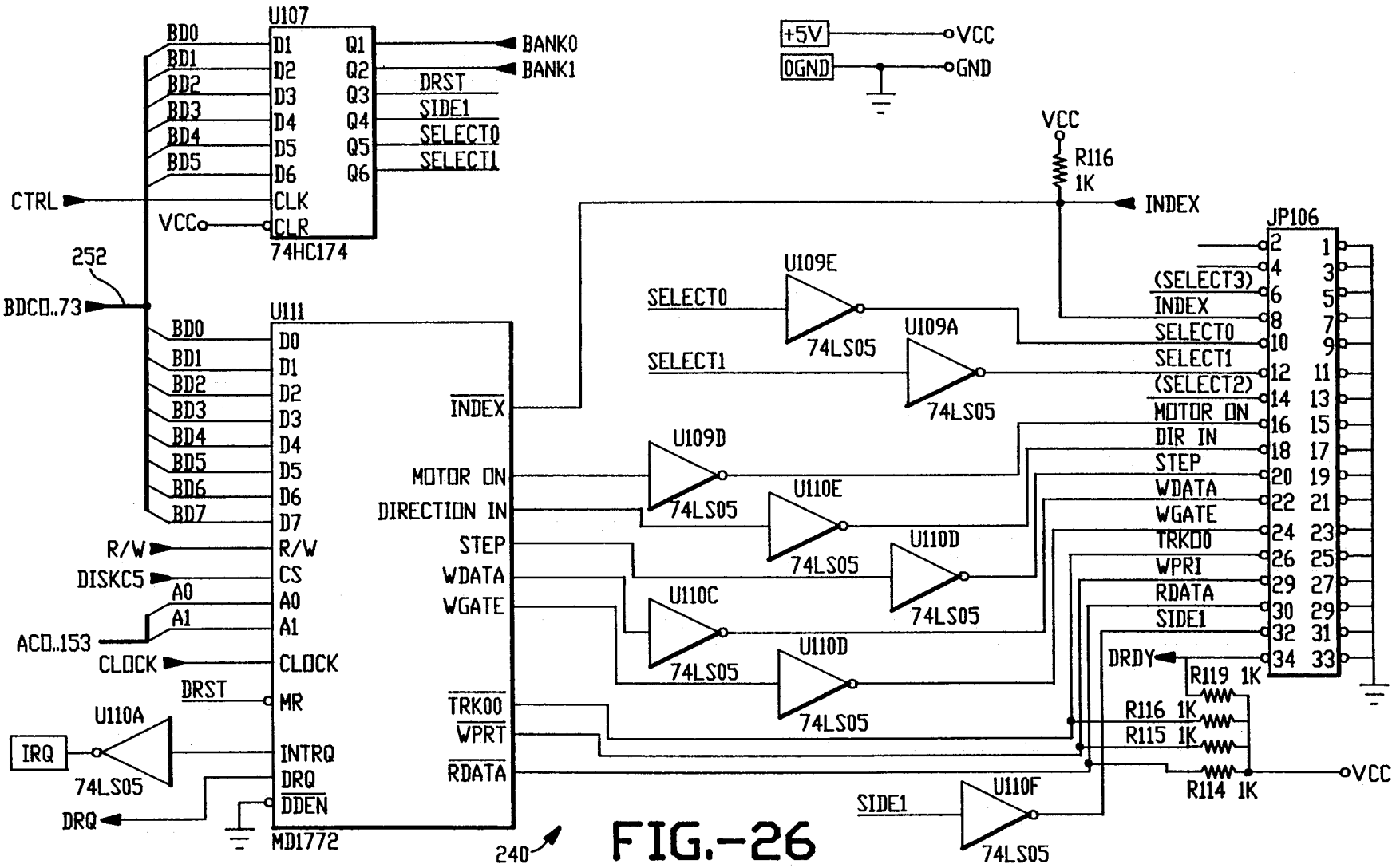
FIG. 26 is an electrical schematic and block diagram of a floppy disk drive controller circuit of the FIG. 20 control circuit.

FIG. 25 sets forth one unit of the MIDI and control input/output circuit 238. Four circuits are actually included in this circuit block, and the one presented in FIG. 25 is representative of each. It is based around a UART U119 which sends and receives digital data to and from the microprocessor controller circuit via a D bus 250. The UART U119 is addressed by a predetermined bit position of the address bus 248. A MIDI serial data read data input is provided from one of the MIDI input jacks, e.g. the jack 54*a*. A MIDI serial data write data output is provided to e.g. two MIDI output jacks, such as the jacks 56*a* and 56*b*, through two selectors U115A and U115B, each enabled by a digital signal generated from the microprocessor circuit 246. The function of the UART U119 is to convert parallel by bit, eight bit data words into serial bit streams in MIDI format, and vice versa. The UART U119 is clocked at a basic clock rate of 500 KHz, for both send and receive, in accordance with the MIDI convention. It obtains the attention of the microprocessor circuit 246 by virtue of its connection to the interrupt request line IRQ.

Disk Controller 240

The disk controller circuit 240 is based around an integrated circuit chip, type WD 1772 floppy disk controller, or equivalent. Basically, this chip receives and sends digital command and user data to and from the other circuit elements via the BD data bus 252. The chip decodes digital commands from the microprocessor circuit 246 and controls the micro- floppy disk drive 40 by turning on its spindle motor, moving the head transducer actuator to a desired concentric track of the floppy disk, reading the sector identification information read from the formatted disk and then performing either write data or read data operations, as may be called for by the microprocessor controller 246. Two floppy disks, the internal disk 40 and an external disk connectable at the jack 64, may be controlled by the chip U111.

The controls and indicators at the front panel 16, including the global display 72 and the 80 character LCD display 78 are connected to driving and decode latch circuitry present on a circuit board 254 mounted directly behind the front panel 16, as shown in FIG. 6. A connector cable 256 provides data bus connections to and from the microprocessor controller circuit 246, so that the switches 66, 74, 80, 82, 88*a* and 88*b* may be sensed, indicator lamps 68, 70 76 84, and 86 illuminated, and data values written to and displayed by the displays 72 and 78.

Microprocessor Controller Circuit 246

The microprocessor controller circuit (FIGS. 27A and 27AA) is predicated upon a Motorola 68809E microprocessor (U126) operating at a clock cycle rate of 8 MHz generated by a two phase crystal clock (not shown). The circuit 246 includes a 32 kilobyte read only program memory (U123), as well as a battery backup memory 258 to save system setup values. Decoders U108 and U014 (FIG. 27B) attached to the address bus 248 and other control lines provide select and control signals to the MIDI interface circuit 238, the key scanner circuit 234, the disk drive interface circuit 240, and the analog input circuit 236. A bidirectional buffer U112 links the BD data bus 252 to the D data bus 250.

Figure 29:
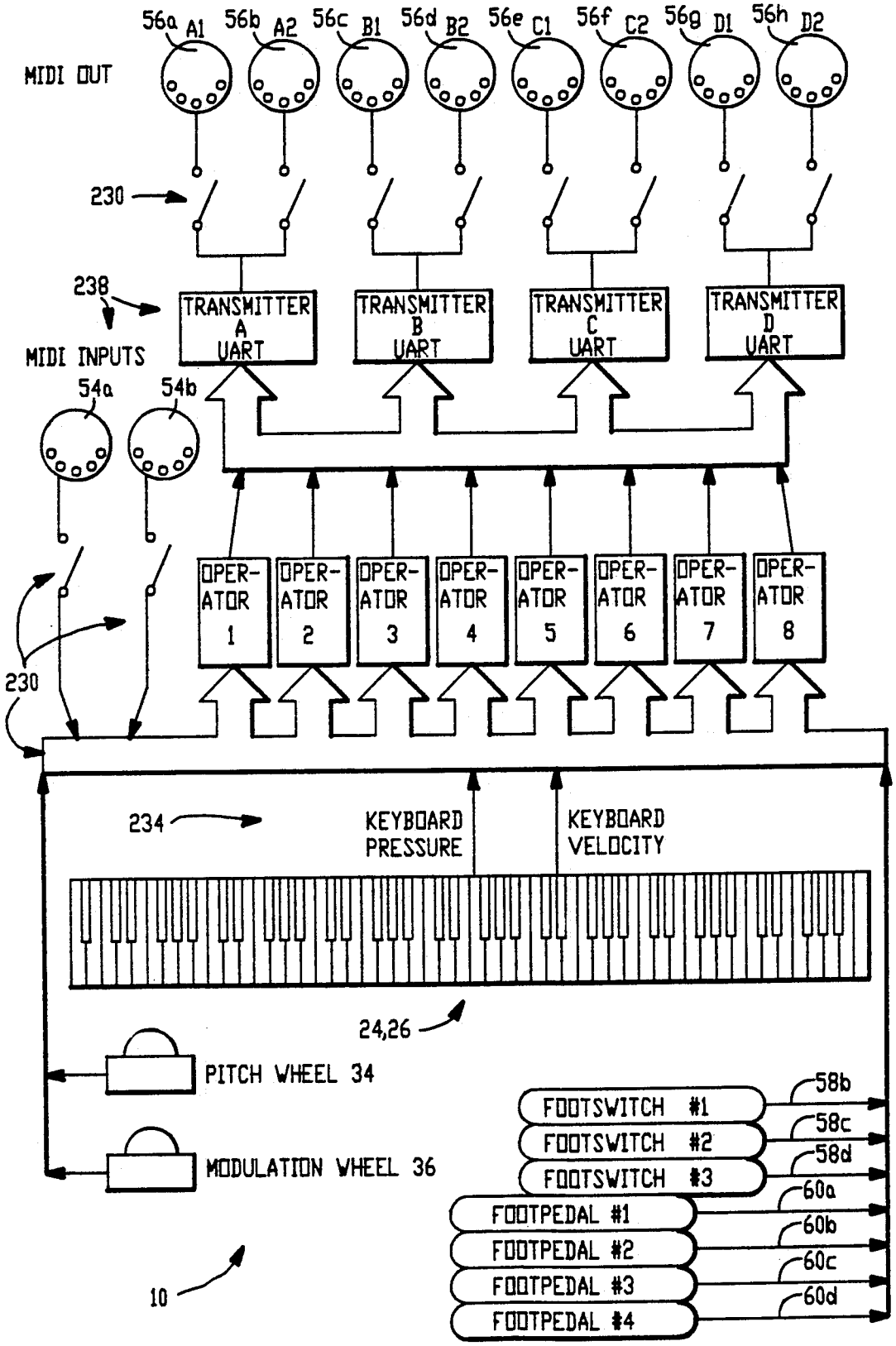
FIG. 29 is a functional operational block diagram illustrating the operation of the FIG. 20 control circuit within the FIG. 1 keyboard.

FIG. 29 provides an overview of signal paths and processes carried out within the keyboard 10. The keys 24 and 26 provide keyboard velocity and keyboard pressure values to the control system 230 via the keyboard scanner state machine 234. System global setups and system exclusive patch libraries may be selectively received via the two MIDI input ports 54*a* and 54*b*. Four MIDI output transmitters each selectively provide two MIDI outputs, for a total of eight MIDI outputs.

Other digital and analog inputs, such as the pitch wheel 34 and the controller wheel 36, footswitches 58 and footpedals 60, provide further operating parameters to the keyboard control system 230.

The various system setups may be carried out by up to eight separate operators, and each operator may communicate with a synthesis or music generation device via one of the eight MIDI ports 56*a–h*. Thus, the keyboard 10 may simultaneously control operation of up to eight external music and/or percussion generation devices, such as the device 11.

Figure 30A:
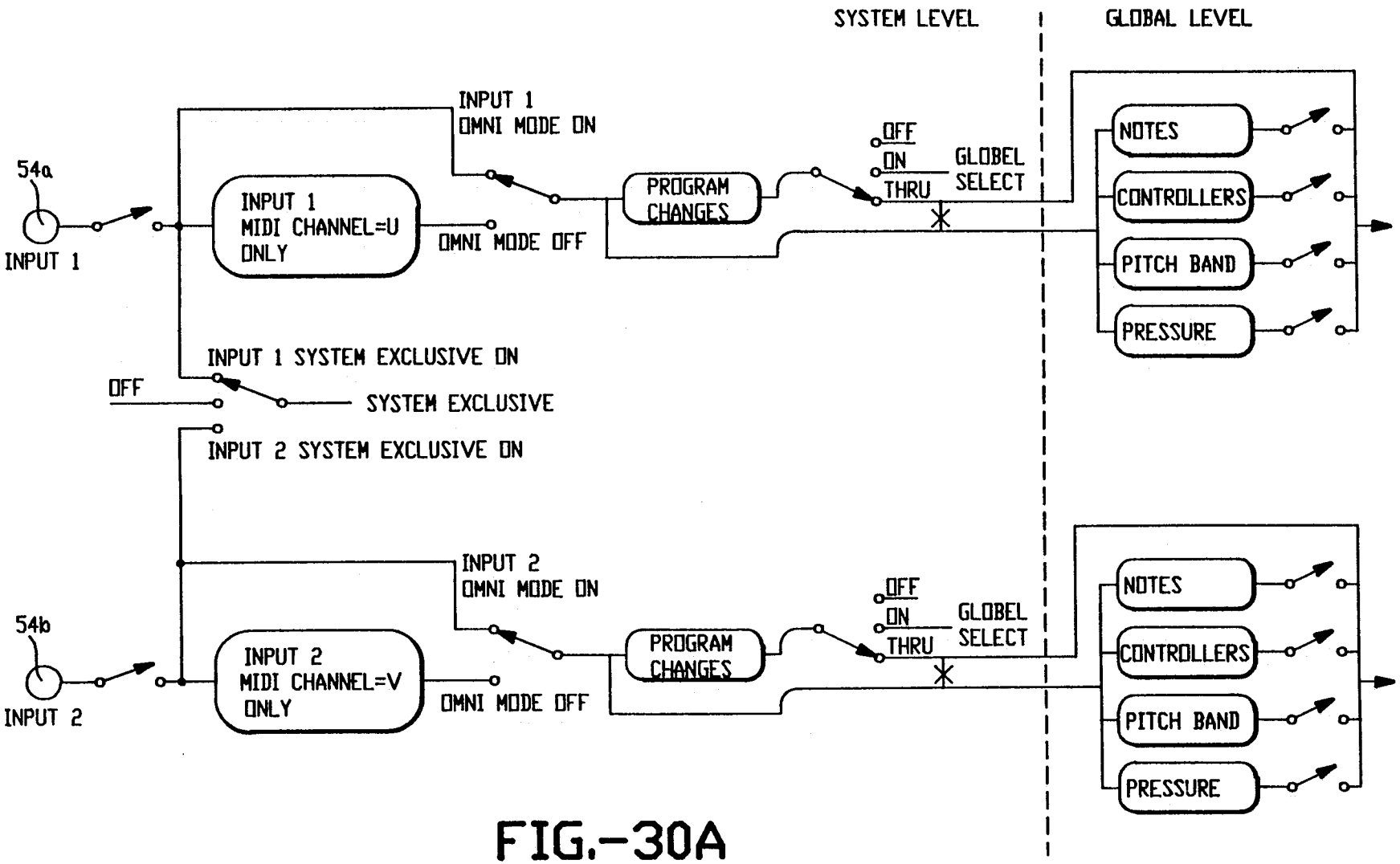
FIGS. 30A and 30B comprise a flow diagram of command flow through the FIG. 20 control circuit in response to externally supplied operational commands.
Figure 30B:
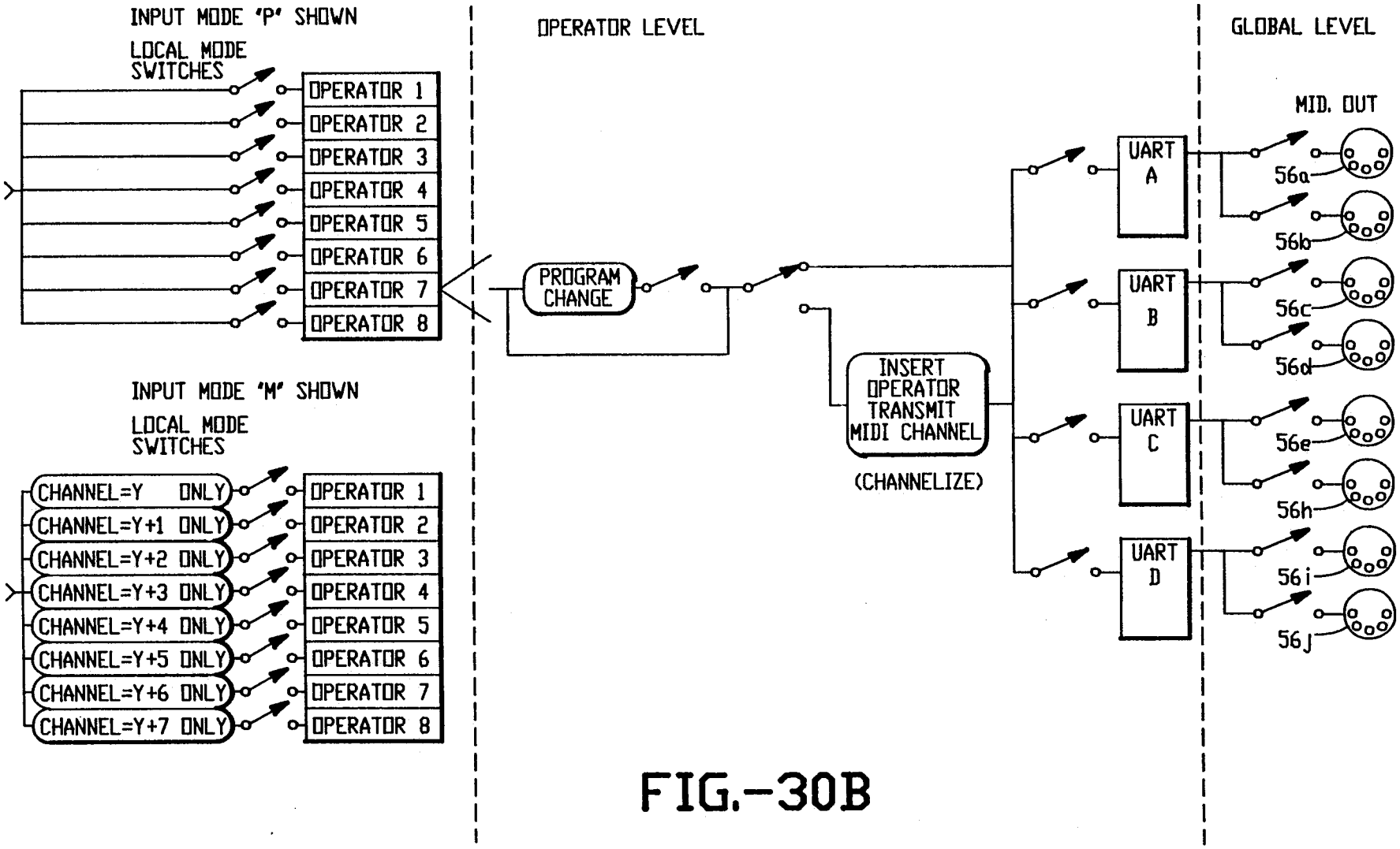

With reference to the flow diagram depicted in FIGS. 30A and 30B, there are two modes that can be used with the two MIDI input ports 54*a* and 54*b*. A first mode, called the "P" mode provides a normal operational input mode, while a second mode, called the "M" mode, has been implemented for use with external controllers such as a guitar controller. The two modes operate quite differently within the keyboard 10.

Each MIDI channel is given a channel number by convention. In the first or "P" mode the input channel is set to the MIDI channel actually being received by the keyboard 10, unless the OMNI mode is selected. If the OMNI mode is selected, then the keyboard will receive all of the 16 MIDI channels. The MIDI input channel number or selection of the OMNI mode is handled at the page zero utilities program level, functional command 15. Then, the particular MIDI input channel is enabled by a selection at page zero, functional command 16.

Functional command 17, page zero, enables internal routing of program changes being received by the keyboard 10 via the selected MIDI input channel. These program changes may be routed any one of three ways: off, on or through. When set to off, program changes will be ignored by the keyboard controller system 230. When set to on, incoming program changes will be sent to the global select functional level and cause the change of globals from these incoming program changes. When set to the through mode, program changes will go through the keyboard 10 directly to the synthesizer or synthesizers 11 and will change their patches. The operator local mode of the keyboard 10 should be off in order for the local user of the keyboard 10 to see MIDI input information, as displayed at page one, functional command 8.

Channelize is another function that affects how the selected MIDI input channel is routed (page two, functional command 6). In the "P" mode, channelization (or reassignment of input channel information) occurs only when the channelize option is selected on page two for the given operator. Otherwise, output of MIDI information goes through the normal channel assignments of global operators set up in the currently selected global program.

In the "M" mode, if OMNI is on, then the keyboard 10 will receive on all incoming MIDI channels, with one exception. If OMNI is on and an input channel is selected at page zero, functional command 15, then that channel becomes the "base" channel. At this point, the keyboard 10 will ignore any information coming in on channels below the "base" channel. For example, with OMNI on and a base channel of 5 selected, the keyboard 10 will receive MIDI commands and information on all incoming MIDI channels from 5 and up, but will ignore all information on channels from 0 to 4. If the OMNI mode is off, then the selected input channel must be the same as the received channel as is required in the "P" mode.

At least one of the four UARTS in the MIDI and control input/output circuit 238 must be enabled before any incoming MIDI information will be able to leave the keyboard 10 on a MIDI output. This is accomplished at page two, functional command 5. Also, the MIDI out enables must be on, page one, functional command 3.

The major difference between the P mode and the M mode is in the way the base channel affects the M mode at the operators level of program execution, and this difference is graphed at FIG. 30B. With the OMNI mode on and with a base channel selected, and with all operator channelize functions turned off, the base channel will be routed to all operators with a channelized offset beginning with operator 2 and above. Again, the local mode of the operators must be turned off or the MIDI input information will be ignored.

In the M mode, if the base channel "V" equals channel 5, for example, this channel will be sent to operator 1, whereas channel 6 will be sent to operator 2, channel 7 to operator 3, channel 8 to operator 4, channel 9 to operator 5, channel 10 to operator 6, channel 11 to operator 7, and channel 12 to operator 8. If the base channel V is set to 15, for example, operator 1 will see channel 15, operator 2 will see channel 16, but operator 3 will see channel 1 and so forth. That is to say, the channel selection process wraps around at channel 16. In addition, if an operators channelize function, page two, functional command 6 is on, then the operator's input channel will be forced to the particular operator's output channel. Again, the UART enables and the MIDI transmit enables must be on.

As explained above in conjunction with FIG. 5, the control software for the keyboard 10 is divided into three pages. The first page, page zero, controls system utilities. The second page, page one, controls the global system program setup; and, the third page, page two, controls set up of the eight operators which may be active within a global program setup.

In performance mode the LCD display 78 displays the currently selected global program. In the program advance library (PAL) mode, the current PAL position is displayed by the display 78.

Page Zero, Utilities

Page Zero, Functional Command (FC) 0: This command allows changing the current global program, the page number, or the functional command number. When the cursor of the display 78 is on the global program select field, the edit footswitch **58*a*** acts as a momentary switch.

Page Zero, FC When the cursor is placed on a "GO" field, and the "Yes" control **88*b* is pressed, a MIDI tune command is transmitted over all active MIDI utility outputs of the keyboard 10**.

Page Zero, FC 2: This command is a Program Advance Library Edit command. In this command, the current PAL position is selected and the global program number for that position may be edited. Entering a value of 100 will place a marker that will cause the PAL to jump back to the beginning when advanced to this point.

Page Zero, FC 3: PAL insert/delete command. A new global program number may be entered in the list thereof at the selected PAL position. For a delete, the current position is selected and entered; the existing global program number is then displayed at the LCD display. The cursor is moved to Go and the Yes key is depressed, without entry of a new global program number.

Page Zero, FC 4: Copy current global to new position. A new PAL position is entered; the cursor is moved to Go and the yes key depressed. This command copies the current global program to another position in memory.

Page Zero, FC 5: This command exchanges a specified global program with the currently selected global program in memory.

Page Zero, FC 6: This command copies one operator in the current global program to another global program and operator location. Operator select button 66 on the front panel 16 are depressed during execution of this command to specify the origination and destination operators, the cursor is moved to Go, and the Yes button is then pressed.

Page Zero, FC 7: This command enables recall of the last edited global program from memory. If a global program was accidentally changed before writing edits, the edited global program can be recalled from an edit buffer memory location, so long as no edits were made since changing global programs.

Page Zero, FC 8: This command enables the front panel FSR membrane switches to be programmed to have sensitivity thresholds from zero to 99.

Page Zero, FC 9: This command sets the polarity of the edit footswitch 58*a*.

Page Zero, FC 10: This command enables the user to select one of three user definable key velocity/pressure scaling tables. These tables map input values from 0 to 127 to the corresponding scale values selected.

Page Zero, FC 11: This command enables the user to enter up to 32 user defined MIDI messages. The message number is selected, the message name is edited, and the message is entered with hex values. The first byte must be 80(Hex) or greater. The end of the message is set when FE(Hex) is entered. Parameters to be included later are indicated by placing FF(Hex) in the message. All status bytes 80(Hex) through EF(Hex) automatically have the operator MIDI channel inserted.

Page Zero, FC 12: This command enables global programs for the keyboard 10 to be transmitted and received over MIDI in the system exclusive format. Individual global programs, or all, may be selected for transmission and/or reception.

Page Zero, FC 13: This command enables the two MIDI input paths 54*a* and 54*b* to be enabled and disabled individually.

Page Zero, FC 14: This command selects the input MIDI channel for each of the MIDI paths 54*a* and 54*b* and also selects OMNI mode status.

Page Zero, FC 15: This command selects the MIDI output path or paths that will be active in the edit mode only.

Page Zero, FC 16: This command selects the method of handling incoming MIDI program select commands. As explained above in conjunction with FIG. 30*a* and 30*b*, options are off, on and through.

Page Zero, FC 17: This command enables selection of which MIDI input path 54*a* or 54*b* will be enabled for system exclusive recognition. Only one input at a time may be enabled for system exclusive recognition.

Page Zero, FC 18: This command enables short MIDI command sequences to be recorded into memory to be used later when requesting system exclusive data dumps. The recorded sequence may be given a ten character name. After the cursor is placed on Go and the Yes button is depressed, all received MIDI information on the selected system exclusive input will be stored in local memory, up to a limit of 244 bytes. The operation will be cancelled automatically after a set time period has elapsed during which no data has been received over the system exclusive input.

Page Zero, FC 19: This command selects whether the internal micro-floppy disk drive 40 or whether an optional external disk drive connected at the jack 64 will be used. Placing the cursor at Go and pressing the Yes button will cause the selected disk directory to be scanned, the number of files therein reported, and the percentage of available disk space indicated.

Page Zero, FC 20: This command causes all present global system set up programs and data to be written to disk as a file. The disk file name is entered or a random name is selected by entering a space character at the first character of the name. The cursor is moved to Go and the Yes button depressed. Up to 100 global set ups, PAL, User Scales and User MIDI messages presently stored in active memory may be recorded in this file.

Page Zero, FC 21: This command saves the currently loaded synthesizer name extraction subroutine to disk.

Page Zero, FC 22: This command saves all User Scales to disk as a separate file. User Scales may later be loaded back into current memory individually or all together.

Page Zero, FC 23 This command saves all user MIDI messages in a separate file.

Page Zero, FC 24: This commands saves all current system exclusive data request messages to disk in a separate file.

Page Zero, FC 25: This command records incoming MIDI system exclusive data (in any format) directly to a specified disk file. This file may be retrieved and retransmitted from disk later. Within this command, the length of data expected is entered, the cursor is moved to Go and the Yes button is depressed. A data request message will be generated and transmitted via one of the UARTS and all received MIDI information will then be recorded to the disk file. The process will cancel if no data is received within a set time limit.

Page Zero, FC 26: This command enables a specified file to be loaded into active memory from disk. The file name is selected by number. For system files, user message files and user scale files, either all or individual sections may be loaded to a selected destination location.

Page Zero, FC 27: This command enables a specified file to be erased from the micro-floppy disk. Disk storage space freed by this operation is then available for storing other information.

Page Zero, FC 28: This command enables new disks to be formatted at initialization thereof. It also functions as a disk erase command, enabling erasure of an entire disk.

Page Zero, FC 29: This command enables the keyboard 10 to be "unlocked". When the keyboard "Lock" is on, the user must enter a six character code word the next time that the keyboard is turned on. Otherwise, the keyboard 10 will not enter the performance mode and will not enter the edit mode.

Page Zero, FC 30: This command enables a test mode to be entered by the keyboard 10. This routine checks keyboard velocity/pressure calibration and pedal and wheel testing.

Page One, Globals

Page One parameters are stored as part of a global set up program.

Page One, FC 0: This command selects edit page one.

Page One, FC 1: This command enables a global pitch value to be transposed for all eight operators active within the current global setup. The range of transposition is minus 48 to plus 48 semitones.

Page One, FC 2: This command enables a global program to be named. A global program may have up to 16 characters for a name.

Page One, FC 3: This command enables the outputs of the four MIDI transmitters to be routed to any combination of two outputs for each. UART transmitters are labelled A, B, C and D, and each of the two possible output jacks thereof are labelled 1 and 2. The selected output enables apply to all operators in the current global setup program.

Page One, FC 4: This command enables operators to be programmed to wake up either On or Off. Wake up occurs when leaving edit mode, stepping through the Program Advance Library (PAL) or pressing the Write button 74. After wake up, operators may be turned on and off manually by depressing any of the eight operator control buttons 66*a* to 66*h* at the front panel 16.

Page One, FC 5: This command enables key action thresholds to be set. As previously explained in conjunction with FIG. 28, key action thresholds are used to adjust the sensitivity of the keyboard 10 and to set the dynamic range of velocity. A low note-on threshold means that only a light touch on the keys is required for notes to be sensed during play. A wide difference between the note-on and note-off thresholds will increase the dynamic range of the velocity response of the keyboard. Typical values would be note off=20 and note on =40.

Page One, FC 6: This command enables global set up programs to be protected against editing by preventing access to the edit buffer within memory. When this memory protect command is off, normal editing may be performed.

Page One, FC 7: This command permits viewing and editing all eight operator MIDI transmit channels on a single display which provides operator and MIDI channel correlation.

Page One, FC 8: This command enables the local mode of each of the eight internal MIDI operators to be turned off to enable received incoming MIDI information to pass through the operator When an operator is turned off, keyboard control and pedal, footswitch and wheel control is disabled relative to the particular operator.

Page One, FC 9: This command enables received incoming MIDI information to be assigned to an operator. The normal mode is called "P" mode where all qualified MIDI commands go to all non-local MIDI operators (pass through). Mode "M" is designed with guitar controllers in mind, so that MIDI on sequential channels is assigned to corresponding operators. If mode M is selected, the MIDI input should also be in OMNI On mode.

Page One, FC 10: This command enables selected MIDI commands to be filtered out of the incoming MIDI data stream before the stream reaches the internal MIDI operators. Note-on and note-off commands may be filtered, and controllers, pitch bend and pressure may also be separately enabled and disabled.

Page One, FC 11: This command enables each MIDI input port to have MIDI commands enabled or disabled, including whether the Notes are on or off, the controls are on or off the pitch bend is on or off and the pressure is on or off.

Page One, FC 12: This sustain hold command enables notes being held with a sustain pedal to remain playing while an operator is turned off. When the operator is turned back on, the held notes will stop sustaining action if the sustain pedal has been released. When this sustain hold command is off, if any foot controls or wheels are assigned to MIDI sustain (controller number 66) a sustain off command is transmitted when an operator is turned off.

Page One, FC 13: This command allows disabling of all MIDI controllers in a global program without having to change any operator controller assignment. When MIDI Controller Output is turned off, the operator assignments are not changed, rather they are merely temporarily disabled. Turning MIDI controller output back on thereupon enables normal operation.

Page Two, Operators

There are two ways to select an operator to edit. The first is to press an operator button 66 while in the edit mode. The second is to position the display cursor of the LCD text display 78 on page two and enter the desired command number.

Page Two, FC 0: This command enables the operator edit page to be selected and also enables selection of a particular operator, such as "1=strings" for example, to be edited.

Page Two, FC 1: This command enables each operator to be programmed to transmit a program select command when it wakes up. A number from 0 to 127 is selected, or the-1 key is selected to disable a patch select. The operator name may also be edited.

Page Two, FC 2: This command sends a patch dump request to a particular synthesizer and extracts the synthesizer name from the resulting system exclusive dump. If a "name finder" file has been loaded from disk, and the proper MIDI cable arrangements have been established, the name of the selected name. Moving the cursor between the patch number field and the first name character field should cause a display on the LCD display which associates an operator name with the particular synthesizer, such as "operator 1 name=-strings; get from synth: Yamaha DX-7", for example. In addition to a patch select command, any other short MIDI message can be transmitted during wake up, either before or after the patch select. Select −1 to −7 disable, or a message number from 0 to 31 to choose a MIDI message defined at the system level. Up to two parameters may be defined which will be substituted into the message in place of default (X) and (Y) labels.

Page Two, FC 3: This command enables selection of the MIDI channel for all messages originating in the selected operator.

Page Two, FC 4: This command enables operator output to be routed to any combination of the four MIDI UART transmitters A, B, C and D.

Page Two, FC 5: This command enables selection of a channelize option and activation of the program change switch. Further processing of MIDI input is possible with the keyboard 10. The channelize option forces any incoming MIDI commands to take on the operator MIDI transmit channel. The program change switch enables filtering out of any program change commands.

Page Two, FC 6: This command sets the operating range of the current operator in a range from 01 to 88.

Page Two, FC 7: This command enables operators to be pitch transposed independently, in addition to the global transposition command at Page One. Herein, the range is minus 48 to plus 48 semitones.

Page Two, FC 8: This command disables the keyboard pitch completely. If keyboard pitch is disabled, any key played within the range of the keyboard will result in a middle C note, offset only by the selected operator pitch transposition.

Page Two, FC 9: This command selects a velocity scaling table and upper and lower limits in a range between 01 and 127. Eight scales are available (including three user scales) and all eight may also be inverted. Upper and lower limits allow setting the maximum and minimum velocity values that will be transmitted.

Page Two, FC 10: This command sets the velocity window limits, thus eliminating any played notes with scaled velocities below or above the selected range.

Page Two, FC 11: This command enables global (channel) and polyphonic aftertouch to be enabled independently.

Page Two, FC 12: This command permits key pressure to be scaled. The same scales available for velocity are also available for pressure (poly and channel). Upper and lower limits between 127 and 01 may also be set with this command.

Page Two, FC 13: This command enables footswitch polarity to be programmed differently for each operator.

Page Two, FC 14, 15, 16: Each of these commands enables one of the three footswitches to be routed to any MIDI controller number and also some other functions such as sequencer start, stop, all notes off, etc.

Page Two, FC 17: This command enables the four variable footpedals to be used normally or to be reversed in polarity.

Page Two, FC 18-24: These commands enable the four pedals and the two control wheels to be assigned to a wide range of controller numbers, from 01 through 128. Like the pedals, the wheels may also be reversed or used normally, programmed separately in each operator.

Here follows an object code listing of a control program which implements the above commands when installed within the structural environment of the control system 230 of the keyboard 10.

| | | | | | | | | | | | | | | | | |
|---|---|---|---|---|---|---|---|---|---|---|---|---|---|---|---|---|
| 8000 | 8D | AB | C4 | BE | C0 | 99 | C1 | 5B | C1 | 98 | C2 | 67 | A4 | 6A | 94 | 92 |
| 8010 | E4 | 77 | 94 | E3 | E9 | 1F | E5 | 82 | E6 | 1A | 95 | 2A | 8A | 38 | 89 | DF |
| 8020 | 95 | 0B | 95 | 06 | A6 | B9 | AD | 22 | AD | 2A | 95 | 3A | A7 | 02 | AD | 7D |
| 8030 | C0 | 24 | C2 | F1 | E3 | 53 | E3 | 3E | E3 | 31 | E3 | 62 | 2A | 2A | 20 | 20 |
| 8040 | 20 | 20 | 20 | 20 | 20 | 20 | 20 | 20 | 20 | 20 | 4B | 54 | 49 | 20 | 20 | 47 |
| 8050 | 5A | 2D | 31 | 30 | 30 | 30 | 20 | 20 | 20 | 20 | 20 | 20 | 20 | 20 | 20 | |
| 8060 | 20 | 20 | 2A | 2A | FF | 4B | 54 | 49 | 20 | 47 | 5A | 2D | 44 | 49 | 53 | 4B |
| 8070 | 20 | 4F | 50 | 45 | 52 | 41 | 54 | 49 | 4E | 47 | 20 | 53 | 59 | 53 | 54 | 45 |
| 8080 | 4D | 20 | 28 | 43 | 29 | 20 | 31 | 39 | 38 | 38 | 20 | 20 | 20 | 47 | 5A | 2D |
| 8090 | 31 | 30 | 30 | 30 | 20 | 46 | 49 | 52 | 4D | 57 | 41 | 52 | 45 | 20 | 56 | 45 |
| 80A0 | 52 | 53 | 49 | 4F | 4E | 20 | 31 | 2E | 30 | 30 | 20 | 28 | 43 | 29 | 20 | 31 |
| 80B0 | 39 | 38 | 38 | 20 | 20 | FF | 45 | 6C | 65 | 63 | 74 | 72 | 6F | 6E | 69 | 63 |
| 80C0 | 73 | 20 | 61 | 6E | 64 | 20 | 73 | 6F | 66 | 74 | 77 | 61 | 72 | 65 | 20 | 62 |
| 80D0 | 79 | 20 | 41 | 6E | 6E | 65 | 20 | 47 | 72 | 61 | 68 | 61 | 6D | 20 | 61 | 6E |
| 80E0 | 64 | 20 | 50 | 61 | 75 | 6C | 20 | 4A | 2E | 20 | 57 | 68 | 69 | 74 | 65 | 20 |
| 80F0 | 28 | 43 | 29 | 20 | 31 | 39 | 38 | 38 | FF | 20 | 20 | 20 | 20 | 7B | 47 | 5A |
| 8100 | 20 | 31 | 2E | 30 | 30 | 7D | 20 | 20 | 20 | 20 | 53 | 45 | 4C | 45 | 43 | 54 |
| 8110 | 20 | 45 | 44 | 49 | 54 | 20 | 50 | 41 | 47 | 45 | 20 | 3A | 20 | 20 | FF | F0 |
| 8120 | 7E | FD | 00 | 06 | 02 | 00 | 00 | 24 | 01 | 00 | 01 | 00 | 31 | 2E | 30 | 30 |
| 8130 | F7 | FE | 34 | 02 | A6 | A0 | A7 | 80 | 5A | 26 | F9 | 35 | 82 | 34 | 02 | A6 |
| 8140 | 80 | A7 | A0 | 5A | 26 | F9 | 35 | 82 | 34 | 02 | A6 | A0 | 84 | 7F | A7 | 80 |
| 8150 | 5A | 26 | F7 | 35 | 82 | 34 | 02 | A6 | 80 | 84 | 7F | A7 | A0 | 5A | 26 | F7 |
| 8160 | 35 | 82 | 10 | AE | 81 | 27 | 10 | A6 | 80 | A7 | A4 | 20 | F5 | 4F | 10 | AE |
| 8170 | 81 | 27 | 04 | A7 | A4 | 20 | F7 | 39 | 50 | 23 | 5D | C4 | 5D | 87 | 52 | C4 |
| 8180 | 52 | C3 | 5D | D9 | 5D | DA | 59 | 67 | 5D | 90 | 5D | 91 | 57 | 4C | 59 | 65 |
| 8190 | 59 | 66 | 5D | 99 | 5D | 9A | 30 | 02 | 30 | 03 | 30 | 04 | 5F | E1 | 00 | 00 |
| 81A0 | 5D | DD | 5D | DE | 5D | 7B | 52 | 86 | 52 | 99 | 30 | 03 | 52 | 90 | 52 | 92 |
| 81B0 | 52 | 94 | 52 | 8F | 52 | 91 | 52 | 93 | 52 | 95 | 52 | 96 | 52 | 97 | 5D | 83 |
| 81C0 | 5D | D3 | 52 | 9D | 52 | 9E | 67 | 00 | 00 | 00 | 5D | AD | 19 | 52 | 87 | 80 |
| 81D0 | 52 | 88 | 80 | 52 | 89 | 80 | 52 | 8A | 80 | 5D | 7E | 0F | 52 | 8B | 01 | 00 |
| 81E0 | 00 | 1A | 50 | 86 | FF | B7 | 30 | 10 | 4A | 26 | FD | 86 | 40 | 1F | 8B | 8E |
| 81F0 | BF | 78 | B7 | 5D | 5D | BF | 5D | 5E | 86 | 7F | B7 | 30 | 20 | 86 | FF | B7 |
| 8200 | 52 | C5 | B7 | 5D | 80 | B6 | 38 | 02 | 10 | CE | 5C | DD | 10 | FF | 5A | 86 |
| 8210 | CC | C6 | E0 | 8E | 5D | 1D | ED | 83 | ED | 83 | BF | 5A | 88 | CC | C7 | 66 |
| 8220 | 8E | 5D | 5D | ED | 83 | ED | 83 | BF | 5A | 8A | BD | 8C | A0 | BD | 8C | F3 |
| 8230 | BD | E9 | 37 | 8E | 81 | 78 | BD | 81 | 6D | BE | 57 | 4A | 8C | 56 | E6 | 25 |
| 8240 | 05 | 8C | 57 | 4A | 25 | 06 | 8E | 56 | E6 | BF | 57 | 4A | B6 | 5D | AD | 81 |
| 8250 | 63 | 23 | 02 | 86 | 19 | 34 | 02 | 86 | 1E | B7 | 5D | AD | BD | 8B | DB | 35 |
| 8260 | 02 | B7 | 5D | AD | BD | D5 | D8 | CC | 86 | F9 | FD | 30 | 00 | BD | BF | A0 |
| 8270 | BD | D5 | D8 | BD | C2 | F1 | CC | 86 | A4 | FD | 30 | 00 | 8E | 8A | 16 | BD |
| 8280 | C0 | 24 | BD | C0 | 9C | BD | 8A | B8 | BD | D5 | D8 | BD | 8B | 04 | BD | D5 |
| 8290 | D8 | 86 | 7F | B7 | 30 | 04 | 12 | 12 | B6 | 38 | 03 | 8A | F0 | 81 | FE | 10 |
| 82A0 | 26 | 00 | 33 | 8E | 81 | CA | BD | 81 | 62 | 8E | 81 | A0 | BD | 81 | 6D | 4F |
| 82B0 | BD | 8B | 98 | 5F | 8E | FE | B7 | BD | 81 | 3D | 4F | BD | 8B | BE | C6 | 20 |
| 82C0 | 8E | FF | B7 | BD | 81 | 3D | B6 | 38 | 03 | 43 | 84 | 0F | 26 | F8 | 86 | FF |
| 82D0 | B7 | 52 | 8C | B7 | 30 | 03 | 8E | B7 | 56 | BD | C0 | 24 | BD | C0 | 9C | 86 |
| 82E0 | 01 | B7 | 5D | 84 | BD | FD | 87 | 7F | 5D | 84 | CC | 86 | 99 | FD | 30 | 00 |
| 82F0 | BD | F5 | 16 | 1C | AF | B6 | 52 | 99 | 81 | 63 | 23 | 04 | 4F | B7 | 52 | 99 |
| 8300 | B7 | 52 | 9A | BD | CD | 94 | 7F | 5D | 84 | BD | CE | 0C | 86 | FF | B7 | 52 |
| 8310 | 98 | 4F | BD | 8B | FB | BD | 8D | 07 | B6 | 52 | 83 | 4C | 81 | 07 | 23 | F2 |
| 8320 | 4F | 5F | B7 | 5D | 98 | B7 | 5D | DA | FD | 59 | 65 | BD | 8A | B8 | B6 | 5D |
| 8330 | 8A | 8A | 1F | B7 | 5D | 8A | B7 | 30 | 04 | 7F | 5D | 89 | 7F | 5D | AE | B6 |
| 8340 | 5D | 92 | B7 | 5D | 93 | 8E | 80 | 3C | BD | C0 | 24 | C6 | 28 | BD | 8C | 08 |
| 8350 | B6 | 57 | 4C | 27 | 21 | F6 | 5D | 8A | C4 | FD | F7 | 5D | 8A | CC | 50 | 41 |
| 8360 | FD | 50 | 94 | CC | 4C | 20 | FD | 50 | 96 | FC | 57 | 4A | 83 | 56 | E6 | 1F |
| 8370 | 98 | C6 | 4E | BD | C1 | 5B | BD | C0 | 9C | 20 | 2A | B7 | 5D | 93 | C6 | 07 |
| 8380 | 8E | D2 | 0D | A5 | 85 | 26 | 03 | 5A | 2A | F9 | 34 | 04 | BD | 8B | EE | 8E |

-continued

| | | | | | | | | | | | | | | | | |
|---|---|---|---|---|---|---|---|---|---|---|---|---|---|---|---|---|
| 8390 | 8C | 3A | BD | C0 | 4C | 35 | 02 | 4C | C6 | 31 | BD | C1 | 5B | C6 | 36 | BD |
| 83A0 | AD | 69 | BD | C0 | 9C | B6 | 5D | 92 | B1 | 5D | 93 | 27 | 05 | 4D | 26 | CB |
| 83B0 | 20 | 90 | B6 | 5F | E1 | 27 | 27 | 8E | 50 | 8F | CC | 58 | 3D | ED | 84 | 4C |
| 83C0 | ED | 06 | 86 | 20 | A7 | 04 | A7 | 0A | B6 | 5F | DF | C6 | 47 | BD | C1 | 5B |
| 83D0 | B6 | 5F | E0 | C6 | 4D | BD | C1 | 5B | BD | C0 | 9C | 7F | 5F | E1 | BD | 8D |
| 83E0 | 43 | BD | D6 | BE | BD | D8 | 15 | BD | D6 | 5D | BD | D7 | B4 | BD | C3 | 3F |
| 83F0 | BD | C6 | A7 | B6 | 52 | 98 | 81 | 64 | 24 | 18 | BD | 8B | 35 | BD | 8B | 24 |
| 8400 | B6 | 52 | A3 | B7 | 5D | BC | B6 | 52 | 98 | B7 | 52 | 99 | BD | CD | 9B | 16 |
| 8410 | FE | F4 | B6 | 5D | 7C | 2A | 0E | 84 | 01 | 27 | 0A | 7D | 57 | 4C | 10 | 27 |
| 8420 | 01 | 51 | 16 | 03 | EC | B6 | 5D | 8F | 27 | 46 | 7F | 5D | 8F | 85 | 01 | 10 |
| 8430 | 26 | 01 | 40 | 85 | 02 | 10 | 26 | 03 | 81 | 85 | 0C | 10 | 26 | 03 | B4 | 85 |
| 8440 | 10 | 27 | 2D | B6 | 5D | 8A | 84 | EF | B7 | 30 | 04 | BD | 8B | 35 | BD | 8B |
| 8450 | 24 | B6 | 52 | 99 | BD | 88 | 70 | 86 | 65 | BD | 88 | 70 | B6 | 50 | 13 | B7 |
| 8460 | 5D | 88 | BD | 8C | 53 | B6 | 5D | 8A | 8A | 10 | B7 | 30 | 04 | 16 | FE | 96 |
| 8470 | B6 | 5D | 8E | 10 | 27 | FF | 2E | C6 | 07 | 8E | D2 | 0D | A5 | 85 | 26 | 03 |
| 8480 | 5A | 2A | F9 | BD | 8B | EE | D6 | 6C | 53 | F4 | 5D | 8E | F7 | 5D | 8E | 96 |
| 8490 | 6C | B5 | 5D | 88 | 27 | 21 | B5 | 5D | 83 | 27 | 2D | B8 | 5D | 88 | B7 | 5D |
| 84A0 | 88 | BD | 8B | 43 | BD | 84 | E9 | 96 | 74 | B7 | 52 | 94 | D6 | 6C | 53 | F4 |
| 84B0 | 5D | 83 | F7 | 5D | 83 | 20 | 06 | B8 | 5D | 88 | B7 | 5D | 88 | B6 | 5D | 8E |
| 84C0 | 26 | B5 | BD | CE | 0C | 16 | FE | DD | 0D | 22 | 26 | 0B | B8 | 5D | 88 | B7 |
| 84D0 | 5D | 88 | BD | 8B | 43 | 20 | E6 | BA | 5D | 83 | B7 | 5D | 83 | BD | 8B | 43 |
| 84E0 | 8D | 07 | B6 | 52 | 94 | 97 | 74 | 20 | D4 | 34 | 36 | BD | D0 | D7 | 86 | 65 |
| 84F0 | BD | 8B | 98 | 8E | 50 | 00 | F6 | 52 | 83 | 58 | A6 | A5 | B7 | 5D | AF | A6 |
| 8500 | 85 | A7 | A5 | B6 | 5D | AF | A7 | 85 | 5C | A6 | A5 | B7 | 5D | AF | A6 | 85 |
| 8510 | A7 | A5 | B6 | 5D | AF | A7 | 85 | 31 | A9 | 00 | 18 | B6 | 52 | 83 | C6 | 1D |
| 8520 | 3D | 31 | AB | 9E | 64 | C6 | 1D | A6 | 84 | B7 | 5D | AF | A6 | A4 | A7 | 80 |
| 8530 | B6 | 5D | AF | A7 | A0 | 5A | 26 | EF | 86 | 65 | BD | 8B | BE | 1F | 21 | F6 |
| 8540 | 52 | 83 | C4 | 07 | 58 | 58 | 3A | 96 | 1D | 8D | 23 | D7 | 1D | 96 | 1E | 8D |
| 8550 | 1D | D7 | 1E | 96 | 1F | 8D | 17 | D7 | 1F | 96 | 20 | 8D | 11 | D7 | 20 | BD |
| 8560 | D1 | 72 | 7F | 5D | AE | 96 | 7C | 27 | 03 | BD | 8D | 07 | 35 | B6 | E6 | 84 |
| 8570 | A7 | 80 | 39 | 8E | 96 | 4D | F6 | 52 | 8F | 58 | AE | 85 | 8C | A0 | FD | 27 |
| 8580 | 0A | 8C | A2 | C8 | 27 | 05 | 8C | A3 | 09 | 26 | 06 | 7F | 52 | 90 | 7F | 52 |
| 8590 | 97 | BD | D2 | DF | BD | 8B | 35 | BD | 8B | 24 | 7F | 5D | 87 | BD | D2 | B0 |
| 85A0 | B6 | 52 | 8C | 43 | B7 | 30 | 10 | BD | 8B | DB | 7C | 52 | C2 | B6 | 52 | A3 |
| 85B0 | B7 | 5D | BC | 7F | 5D | AE | 1C | AF | 7F | 5D | 84 | F6 | 52 | C2 | 27 | 31 |
| 85C0 | 7F | 5D | 89 | B6 | 52 | 86 | 81 | 02 | 26 | 0B | 8E | D2 | 0D | B6 | 52 | 95 |
| 85D0 | A6 | 86 | B7 | 5D | 89 | F6 | 5D | 8A | CA | 0C | C4 | FE | B6 | 52 | 86 | 27 |
| 85E0 | 0A | 81 | 01 | 26 | 04 | C4 | FA | 20 | 02 | C4 | F6 | F7 | 5D | 8A | F7 | 30 |
| 85F0 | 04 | BD | 8D | 3E | BD | C2 | 15 | BD | C3 | 00 | 8E | AC | CC | F6 | 52 | 93 |
| 8600 | 4F | 58 | 49 | AE | 8B | 8C | B1 | 99 | 26 | 05 | B6 | 52 | 94 | 26 | 51 | 4F |
| 8610 | 8E | 5B | 5B | E6 | 84 | C1 | 10 | 24 | 32 | 30 | 01 | 4C | E6 | 84 | C1 | 10 |
| 8620 | 24 | 29 | 30 | 02 | 4C | E6 | 84 | C1 | 10 | 24 | 20 | 30 | 02 | E6 | 84 | C1 |
| 8630 | 10 | 25 | 2D | C4 | 0F | E7 | 84 | FC | 52 | 8F | FD | 52 | 96 | 86 | 02 | B7 |
| 8640 | 52 | 90 | 4F | B7 | 52 | 8F | B7 | 52 | 86 | 20 | 0F | C4 | 0F | E7 | 84 | B7 |
| 8650 | 52 | 86 | 26 | 06 | FC | 52 | 96 | FD | 52 | 8F | 7C | 52 | C2 | 16 | FF | 56 |
| 8660 | B6 | 5D | 7C | 2A | 21 | F6 | 52 | 86 | 58 | 8E | 52 | 8F | EC | 85 | 10 | 83 |
| 8670 | 00 | 02 | 26 | 09 | B6 | 52 | 86 | 81 | 02 | 10 | 25 | 00 | D7 | B6 | 5D | 7C |
| 8680 | 84 | 01 | 10 | 26 | 00 | CE | B6 | 5D | 8F | 27 | 06 | 85 | 01 | 10 | 26 | 00 |
| 8690 | C3 | F6 | 52 | 86 | 10 | 27 | 00 | 9D | C1 | 01 | 27 | 4F | F6 | 52 | 95 | BD |
| 86A0 | 8B | EE | 85 | 10 | 27 | 24 | B6 | 5D | 8A | 84 | EF | B7 | 30 | 04 | B6 | 52 |
| 86B0 | 99 | BD | 89 | 55 | F6 | 52 | 95 | 86 | 65 | BD | 89 | 55 | BD | 8C | 53 | B6 |
| 86C0 | 5D | 8A | 8A | 10 | B7 | 30 | 04 | 16 | FE | EC | B6 | 5D | 8E | 10 | 26 | 00 |
| 86D0 | 90 | F6 | 52 | 93 | 2A | 01 | 5F | C1 | 1A | 23 | 02 | C6 | 1A | F7 | 52 | 93 |
| 86E0 | 8E | AC | CC | 58 | AE | 85 | AD | 84 | 16 | FE | CB | 85 | 10 | 27 | 27 | B6 |
| 86F0 | 5D | 8A | 84 | EF | B7 | 30 | 04 | B6 | 52 | 99 | BD | 88 | 70 | 86 | 65 | BD |
| 8700 | 88 | 70 | B6 | 50 | 13 | B7 | 5D | 88 | BD | 8C | 53 | B6 | 5D | 8A | 8A | 10 |
| 8710 | B7 | 30 | 04 | 16 | FE | A0 | B6 | 5D | 8E | 26 | 46 | F6 | 52 | 91 | 2A | 01 |
| 8720 | 5F | C1 | 0E | 23 | 02 | C6 | 0E | F7 | 52 | 91 | 8E | A6 | 97 | 58 | AE | 85 |
| 8730 | AD | 84 | 16 | FE | 81 | F6 | 52 | 8F | 2A | 01 | 5F | C1 | 1E | 23 | 02 | C6 |
| 8740 | 1E | F7 | 52 | 8F | 8E | 96 | 4D | 58 | AE | 85 | AD | 84 | B6 | 5D | 8E | 26 |
| 8750 | 10 | 16 | FE | 62 | B6 | 52 | 85 | B1 | 52 | 99 | 10 | 27 | FB | A8 | 16 | FB |
| 8760 | 92 | 5F | 8E | D2 | 0D | A5 | 85 | 26 | 05 | 5C | C1 | 07 | 23 | F7 | B6 | 52 |
| 8770 | 86 | 81 | 02 | 26 | 22 | F1 | 52 | 95 | 26 | 1D | 0D | 22 | 27 | 19 | BD | 84 |
| 8780 | E9 | A6 | 85 | B8 | 5D | 83 | B7 | 5D | 83 | 96 | 74 | 97 | 75 | B6 | 52 | 94 |
| 8790 | 97 | 74 | 96 | 75 | B7 | 52 | 94 | F7 | 52 | 95 | A6 | 85 | B7 | 5D | 89 | BD |
| 87A0 | 8B | EE | B6 | 52 | 86 | 81 | 02 | 27 | 08 | 7F | 52 | 94 | 86 | 02 | B7 | 52 |
| 87B0 | 86 | B7 | 52 | C2 | 7F | 5D | AE | 16 | FD | FC | F6 | 5D | 8A | CA | 02 | B6 |
| 87C0 | 57 | 4C | 88 | 01 | 84 | 01 | B7 | 57 | 4C | 27 | 0D | C4 | FD | F7 | 5D | 8A |
| 87D0 | F7 | 30 | 04 | BE | 57 | 4A | 20 | 68 | F7 | 5D | 8A | F7 | 30 | 04 | CC | 20 |
| 87E0 | 20 | FD | 50 | 98 | FD | 50 | 96 | FD | 50 | 94 | FD | 50 | 92 | BD | C0 | 9C |
| 87F0 | 16 | FB | B2 | 85 | 04 | 26 | 1A | 86 | 08 | 8D | 5B | BE | 57 | 4A | A6 | 1F |
| 8800 | 81 | 64 | 10 | 27 | FB | 9F | 30 | 1F | 8C | 56 | E6 | 10 | 25 | FB | 96 | 20 |
| 8810 | 28 | 86 | 04 | 8D | 41 | BE | 57 | 4A | 30 | 01 | 8C | 57 | 4A | 10 | 24 | FB |
| 8820 | 84 | A6 | 84 | 81 | 64 | 26 | 12 | BE | 57 | 4A | 8C | 56 | E6 | 23 | 0A | A6 |
| 8830 | 1F | 81 | 63 | 22 | 04 | 30 | 1F | 20 | F1 | 7D | 57 | 4C | 10 | 27 | FB | 65 |
| 8840 | A6 | 84 | BF | 57 | 4A | 81 | 64 | 10 | 27 | FB | 5A | 25 | 03 | 4F | A7 | 84 |
| 8850 | B7 | 52 | 98 | 16 | FB | 4F | 34 | 06 | 86 | 0A | BD | CC | 13 | 4F | BD | C4 |
| 8860 | BE | BD | C4 | BE | A6 | E4 | BD | C4 | BE | 86 | F7 | BD | C4 | BE | 35 | 86 |
| 8870 | 34 | 04 | 8D | 1F | 24 | 05 | BD | 8C | 7D | 35 | 84 | 5F | BD | 8B | EE | 0F |
| 8880 | 7C | 0F | 22 | F6 | 52 | 83 | 5C | C1 | 07 | 23 | F1 | 7F | 5D | C2 | 7F | 5D |
| 8890 | 83 | 35 | 84 | 34 | 76 | BD | 8B | BE | 1F | 23 | BD | 8B | 98 | A6 | A8 | 17 |
| 88A0 | 2A | 5C | A6 | E4 | 81 | 63 | 22 | 56 | 8E | 88 | B2 | BD | 8A | 38 | 1A | 01 |

-continued

| | | | | | | | | | | | | | | | | |
|---|---|---|---|---|---|---|---|---|---|---|---|---|---|---|---|---|
| 88B0 | 35 | F6 | 2F | 2F | 2F | 2F | 2F | 2F | 20 | 20 | 55 | 4E | 41 | 42 | 4C | 45 |
| 88C0 | 20 | 54 | 4F | 20 | 57 | 52 | 49 | 54 | 45 | 20 | 47 | 4C | 4F | 42 | 41 | 4C |
| 88D0 | 20 | 21 | 20 | 20 | 2F | 2F | 2F | 2F | 2F | 2F | 20 | 20 | 20 | 20 | 44 | 45 |
| 88E0 | 53 | 54 | 49 | 4E | 41 | 54 | 49 | 4F | 4E | 20 | 4D | 45 | 4D | 4F | 52 | 59 |
| 88F0 | 20 | 49 | 53 | 20 | 50 | 52 | 4F | 54 | 45 | 43 | 54 | 45 | 44 | FF | 86 | 07 |
| 8900 | BD | 8B | FB | BD | D0 | D7 | B6 | 52 | 83 | 4A | 2A | F4 | 8E | 50 | 00 | C6 |
| 8910 | 18 | BD | 81 | 3D | 4F | BD | 8B | FB | 8D | 21 | 9E | 64 | C6 | 1D | BD | 81 |
| 8920 | 3D | 8D | 25 | C6 | 04 | A6 | 80 | A7 | C0 | 5A | 26 | F9 | BD | D1 | 72 | B6 |
| 8930 | 52 | 83 | 4C | 81 | 07 | 23 | DE | 1C | FE | 35 | F6 | 34 | 02 | B6 | 5D | DB |
| 8940 | B7 | 5D | 81 | B7 | 30 | 28 | 35 | 82 | 34 | 02 | B6 | 5D | DC | B7 | 5D | 81 |
| 8950 | B7 | 30 | 28 | 35 | 82 | 8D | 12 | 10 | 25 | 03 | 22 | 0F | 22 | 0F | 7C | 96 |
| 8960 | 6C | 43 | B4 | 5D | 83 | B7 | 5D | 83 | 39 | 34 | 36 | BD | 8B | 98 | A6 | A8 |
| 8970 | 17 | 2A | 10 | A6 | E4 | 81 | 63 | 22 | 0A | 8E | 88 | B2 | BD | 8A | 38 | 1A |
| 8980 | 01 | 35 | B6 | 31 | A9 | 00 | 18 | 86 | 1D | 3D | 31 | AB | B6 | 52 | 95 | BD |
| 8990 | 8B | FB | BD | D0 | D7 | 9E | 64 | C6 | 1D | BD | 81 | 3D | A6 | E4 | BD | 8B |
| 89A0 | BE | E6 | 61 | 58 | 58 | 31 | A5 | C6 | 04 | BD | 81 | 3D | A6 | E4 | BD | 8B |
| 89B0 | 98 | 8E | 50 | 00 | F6 | 52 | 95 | C4 | 07 | 58 | 3A | E6 | 61 | C4 | 07 | 58 |
| 89C0 | 31 | A5 | EC | 84 | 84 | 80 | C4 | 80 | 34 | 06 | EC | A4 | 84 | 7F | C4 | 7F |
| 89D0 | AA | E0 | A7 | A0 | EA | E0 | E7 | A4 | BD | D1 | 72 | 1C | FE | 35 | B6 | BD |
| 89E0 | C2 | F1 | 34 | 10 | 8E | 89 | F1 | BD | C0 | 24 | 35 | 10 | BD | C0 | 4C | 20 |
| 89F0 | 4D | 20 | 20 | 20 | 20 | 45 | 52 | 52 | 4F | 52 | 20 | 21 | 20 | 20 | 28 | 50 |
| 8A00 | 72 | 65 | 73 | 73 | 20 | 59 | 45 | 53 | 20 | 74 | 6F | 20 | 63 | 6F | 6E | 74 |
| 8A10 | 69 | 6E | 75 | 65 | 29 | FF | 4B | 45 | 59 | 53 | 43 | 41 | 4E | 4E | 45 | 52 |
| 8A20 | 20 | 4E | 4F | 54 | 20 | 52 | 45 | 53 | 50 | 4F | 4E | 44 | 49 | 4E | 47 | FF |
| 8A30 | 8E | 50 | 4A | 86 | FF | A7 | 88 | 4F | BD | C2 | F1 | BD | C0 | 24 | BD | C0 |
| 8A40 | 9C | CC | BF | BF | FD | 30 | 00 | FC | 52 | C6 | C3 | 0F | 42 | 34 | 06 | FC |
| 8A50 | 52 | C6 | 10 | A3 | E4 | 22 | 0B | BD | 8D | 3E | B6 | 5D | 8E | BA | 5D | 8F |
| 8A60 | 26 | ED | 35 | 06 | BD | 8D | 3E | B6 | 5D | 7C | 2B | 14 | B6 | 5D | 8E | BA |
| 8A70 | 5D | 8F | 26 | 0C | 4F | BD | DB | BE | 4D | 26 | 05 | BD | DC | 8E | 27 | E4 |
| 8A80 | BD | C2 | 15 | 7C | 52 | C2 | 7F | 5D | AE | 39 | BD | 8D | 3E | 4F | BD | DB |
| 8A90 | BE | 81 | 01 | 27 | 0A | 81 | FF | 26 | F1 | 1A | 01 | 34 | 01 | 20 | 07 | 7F |
| 8AA0 | 5D | AE | 1C | FE | 34 | 01 | 4F | B7 | 5D | 8E | B7 | 5D | 8F | B7 | 5D | AE |
| 8AB0 | BD | C2 | 15 | 7C | 52 | C2 | 35 | 81 | 34 | 11 | 1C | BF | 4F | B7 | 5D | 80 |
| 8AC0 | B7 | 30 | 20 | FC | 52 | C6 | C3 | 00 | 04 | FD | 5D | AF | FC | 52 | C6 | 10 |
| 8AD0 | B3 | 5D | AF | 23 | F7 | 86 | 7F | B7 | 30 | 20 | 1A | 40 | 4F | 8E | 00 | 00 |
| 8AE0 | A7 | 89 | 5A | 8D | A7 | 89 | 5A | ED | A7 | 89 | 5B | AD | A7 | 89 | 5B | 4D |
| 8AF0 | 30 | 01 | 8C | 00 | 58 | 25 | E9 | 86 | FF | B7 | 30 | 20 | B7 | 5D | 80 | 7F |
| 8B00 | 5D | AE | 35 | 91 | 34 | 17 | 1A | 40 | 4F | B7 | 52 | 83 | 8B | 40 | C6 | 80 |
| 8B10 | 1F | 01 | CC | 00 | 80 | A7 | 80 | 5A | 26 | FB | B6 | 52 | 83 | 4C | 81 | 07 |
| 8B20 | 23 | E7 | 35 | 97 | 34 | 17 | 1A | 40 | 8E | 5B | 4D | CC | 00 | 58 | A7 | 80 |
| 8B30 | 5A | 26 | FB | 35 | 97 | 34 | 02 | 86 | 07 | BD | 8B | FB | 8D | 05 | 4A | 2A |
| 8B40 | F8 | 35 | 82 | 34 | 16 | B6 | 52 | 83 | 8B | 40 | C6 | 80 | 1F | 01 | C6 | 7F |
| 8B50 | A6 | 85 | 26 | 2D | 5A | 2A | F9 | B6 | 50 | 17 | 85 | 40 | 26 | 21 | 9E | 64 |
| 8B60 | 30 | 89 | 00 | 14 | C6 | 09 | A6 | 80 | 81 | 40 | 27 | 05 | 5A | 26 | F7 | 35 |
| 8B70 | 96 | CC | B0 | 40 | 9A | 3B | FD | 52 | BF | 7F | 52 | C1 | BD | D0 | CA | 35 |
| 8B80 | 96 | 6A | 85 | 96 | 3B | 8A | 80 | FD | 52 | BF | 86 | 40 | B7 | 52 | C1 | BD |
| 8B90 | D0 | CA | A6 | 85 | 27 | BE | 20 | E9 | 34 | 06 | 44 | 44 | 44 | 44 | 44 | 84 |
| 8BA0 | 03 | 34 | 02 | B6 | 5D | 81 | 84 | FC | AA | E0 | B7 | 5D | 81 | B7 | 30 | 28 |
| 8BB0 | B7 | 5D | DB | A6 | E4 | 84 | 1F | 8A | 60 | 5F | 1F | 02 | 35 | 86 | 34 | 06 |
| 8BC0 | F6 | 5D | 81 | CA | 03 | F7 | 5D | 81 | F7 | 30 | 28 | F7 | 5D | DC | C6 | 20 |
| 8BD0 | 3D | 8B | 13 | 84 | 1F | 8A | 60 | 1F | 02 | 35 | 86 | 86 | 2D | B7 | 5D | 78 |
| 8BE0 | 86 | 3F | B7 | 5D | 79 | 86 | C8 | B0 | 5D | AD | B7 | 5D | 7A | 39 | 34 | 04 |
| 8BF0 | C4 | 07 | F7 | 52 | 83 | CB | 40 | 1F | 9B | 35 | 84 | 34 | 02 | 84 | 07 | B7 |
| 8C00 | 52 | 83 | 8B | 40 | 1F | 8B | 35 | 82 | 34 | 36 | 8E | 50 | 4A | 3A | 34 | 04 |
| 8C10 | 10 | 8E | 8C | 2E | C6 | 0C | BD | 81 | 32 | B6 | 52 | 99 | 35 | 04 | CB | 07 |
| 8C20 | BD | C1 | 5B | 10 | 8E | 50 | 00 | C6 | 10 | BD | 81 | 32 | 35 | B6 | 47 | 4C |
| 8C30 | 4F | 42 | 41 | 4C | 20 | 20 | 20 | 20 | 3D | 20 | 4F | 50 | 45 | 52 | 41 | 54 |
| 8C40 | 4F | 52 | 20 | 20 | 20 | 20 | 3D | FF | 4E | 4F | 20 | 4D | 45 | 53 | 53 | 41 |
| 8C50 | 47 | 45 | FE | 1C | AF | CC | 00 | 87 | 34 | 06 | BD | D6 | 7B | BD | D6 | 16 |
| 8C60 | C6 | 64 | 5A | 26 | FD | BD | D5 | D8 | BD | D6 | 22 | BD | D6 | 5B | EC | E4 |
| 8C70 | 83 | 00 | 01 | ED | E4 | 26 | E3 | 32 | 62 | 7F | 5D | AE | 39 | 34 | 36 | 10 |
| 8C80 | 8E | A9 | A6 | 8E | A6 | 97 | 5F | 10 | AC | 81 | 27 | 07 | 5C | C1 | 0E | 23 |
| 8C90 | F6 | 35 | B6 | F7 | 52 | 91 | 7F | 52 | 92 | 86 | 01 | B7 | 52 | 86 | 35 | B6 |
| 8CA0 | CC | 52 | CF | FD | 52 | CB | FD | 52 | CD | CC | 53 | 54 | FD | 53 | 50 | FD |
| 8CB0 | 53 | 52 | CC | 53 | D9 | FD | 53 | D5 | FD | 53 | D7 | CC | 54 | 5E | FD | 54 |
| 8CC0 | 5A | FD | 54 | 5C | CC | 54 | E2 | FD | 54 | DE | FD | 54 | E0 | CC | 55 | E6 |
| 8CD0 | FD | 55 | E2 | FD | 55 | E4 | 86 | 7F | B7 | 52 | CA | B7 | 53 | 4F | B7 | 53 |
| 8CE0 | D4 | B7 | 54 | 59 | 86 | 03 | B7 | 00 | 00 | B7 | 08 | 00 | B7 | 10 | 00 | B7 |
| 8CF0 | 18 | 00 | 39 | 34 | 07 | 1A | 50 | CC | C3 | 9E | FD | 50 | 1B | 86 | 95 | 8D |
| 8D00 | E5 | 86 | 15 | 8D | E7 | 35 | 87 | 34 | 06 | 96 | 1F | 2B | 02 | 8D | 6A | D6 |
| 8D10 | 13 | 2B | 0A | 96 | 3B | 8A | C0 | FD | 52 | BF | BD | D0 | BE | 96 | 20 | 85 |
| 8D20 | 80 | 27 | 0E | BD | CC | 04 | 10 | 8E | 6D | 80 | 86 | FE | A7 | A8 | 64 | 8D |
| 8D30 | 76 | 96 | 1F | 2A | 02 | 8D | 42 | 35 | 86 | 8D | 08 | 7E | D6 | 5B | 8D | 03 |
| 8D40 | 7E | D6 | 5B | 1C | AF | BD | D6 | 16 | BD | DA | E3 | B6 | 5D | C4 | 27 | 26 |
| 8D50 | 2A | 12 | CC | 79 | 4F | FD | 5D | 8B | F7 | 5D | C4 | FC | 52 | C6 | C3 | 19 |
| 8D60 | 6E | FD | 52 | C8 | FC | 52 | C6 | 10 | B3 | 52 | C8 | 23 | 09 | B6 | 52 | 85 |
| 8D70 | BD | C1 | C0 | 7F | 5D | C4 | 7E | D6 | 22 | 96 | 1E | 85 | 20 | 26 | 14 | 86 |
| 8D80 | 70 | BD | 8B | 98 | D6 | 1E | C4 | 1F | 86 | 18 | 3D | 31 | AB | 96 | 20 | D6 |
| 8D90 | 1F | 8D | 1E | 39 | 34 | 26 | CC | C4 | BE | FD | 50 | 18 | A6 | E4 | 84 | 0F |
| 8DA0 | B7 | 50 | 1A | C6 | 80 | 20 | 1F | 96 | 20 | D6 | 1F | 34 | 26 | C6 | 80 | 20 |
| 8DB0 | 04 | 34 | 26 | C6 | 18 | 34 | 06 | CC | D0 | B8 | FD | 50 | 18 | 96 | 3B | 84 |
| 8DC0 | 0F | B7 | 50 | 1A | 35 | 06 | A6 | A0 | 2B | 07 | 5A | 26 | F9 | 35 | A6 | A6 |

-continued

| | | | | | | | | | | | | | | | |
|---|---|---|---|---|---|---|---|---|---|---|---|---|---|---|---|
| 8DD0 | A0 | 81 | FE | 27 | 2B | 81 | FD | 26 | 07 | A6 | A0 | 5A | 2A | 16 | 20 | 20 |
| 8DE0 | 81 | FF | 26 | 15 | A6 | E4 | 84 | 7F | 34 | 06 | EC | 62 | 1E | 89 | ED | 62 |
| 8DF0 | 35 | 06 | 20 | 05 | 84 | F0 | BA | 50 | 1A | AD | 9F | 50 | 18 | 5A | 26 | CF |
| 8E00 | 35 | A6 | 53 | 45 | 4C | 45 | 43 | 54 | FF | 20 | 54 | 52 | 41 | 4E | 53 | 4D |
| 8E10 | 49 | 54 | 20 | 4D | 41 | 53 | 54 | 45 | 52 | 20 | 54 | 55 | 4E | 45 | 20 | 43 |
| 8E20 | 4F | 4D | 4D | 41 | 4E | 44 | 20 | 4F | 4E | 20 | 20 | 20 | 20 | 20 | 20 | 20 |
| 8E30 | 20 | 20 | 20 | 41 | 4C | 4C | 20 | 41 | 43 | 54 | 49 | 56 | 45 | 20 | 4D | 49 |
| 8E40 | 44 | 49 | 20 | 4F | 55 | 54 | 50 | 55 | 54 | 53 | 2E | 2E | 2E | FF | 44 | 55 |
| 8E50 | 4D | 50 | 20 | 47 | 4C | 4F | 42 | 41 | 4C | 20 | 44 | 41 | 54 | 41 | 20 | 4F |
| 8E60 | 56 | 45 | 52 | 20 | 4D | 49 | 44 | 49 | 20 | 20 | 20 | 20 | 20 | 20 | 20 | 20 |
| 8E70 | 20 | 20 | 20 | 20 | 20 | 20 | 54 | 52 | 41 | 4E | 53 | 4D | 49 | 54 | 3A | 20 |
| 8E80 | 41 | 4C | 4C | FF | 54 | 52 | 41 | 4E | 53 | 4D | 49 | 54 | 54 | 49 | 4E | 47 |
| 8E90 | 3A | FF | 4E | 4F | 20 | 4E | 41 | 4D | 45 | 20 | 20 | 20 | 20 | 20 | 20 | 20 |
| 8EA0 | 20 | 20 | 20 | 20 | 4F | 50 | 45 | 52 | 41 | 54 | 49 | 4F | 4E | 20 | 43 | 4F |
| 8EB0 | 4D | 50 | 4C | 45 | 54 | 45 | 20 | 2D | 20 | 20 | 20 | 20 | 20 | 20 | 20 | 20 |
| 8EC0 | 20 | 20 | 20 | 20 | 20 | 20 | 20 | 20 | 20 | 50 | 52 | 45 | 53 | 53 | 20 | 22 |
| 8ED0 | 59 | 45 | 53 | 22 | 20 | 54 | 4F | 20 | 43 | 4F | 4E | 54 | 49 | 4E | 55 | 45 |
| 8EE0 | 2E | FF | 20 | 50 | 72 | 6F | 67 | 72 | 61 | 6D | 20 | 41 | 64 | 76 | 61 | 6E |
| 8EF0 | 63 | 65 | 20 | 4C | 69 | 62 | 72 | 61 | 72 | 79 | 20 | 45 | 44 | 49 | 54 | 20 |
| 8F00 | 20 | 20 | 20 | 20 | 20 | 20 | 20 | 50 | 41 | 4C | 20 | 20 | 20 | 20 | 3D | 20 |
| 8F10 | 47 | 4C | 4F | 42 | 41 | 4C | 20 | 20 | 20 | 20 | 3D | FF | 50 | 72 | 6F | 67 |
| 8F20 | 72 | 61 | 6D | 20 | 41 | 64 | 76 | 61 | 6E | 63 | 65 | 20 | 4C | 69 | 62 | 72 |
| 8F30 | 61 | 72 | 79 | 20 | 49 | 4E | 53 | 45 | 52 | 54 | 20 | 20 | 20 | 20 | 20 | 20 |
| 8F40 | 20 | 47 | 4C | 4F | 42 | 41 | 4C | 20 | 20 | 20 | 20 | 20 | 41 | 54 | 20 | 50 |
| 8F50 | 41 | 4C | 20 | 50 | 4F | 53 | 49 | 54 | 49 | 4F | 4E | FF | 44 | 45 | 4C | 45 |
| 8F60 | 54 | 45 | 50 | 41 | 4C | 20 | 20 | 20 | 20 | 3D | 20 | 4D | 41 | 52 | 4B | 45 |
| 8F70 | 52 | 20 | 31 | 30 | 30 | 20 | 4C | 4F | 4F | 50 | 20 | 42 | 41 | 43 | 4B | 20 |
| 8F80 | 54 | 4F | 20 | 50 | 41 | 4C | FF | 20 | 20 | 20 | 20 | 43 | 4F | 50 | 59 | 20 |
| 8F90 | 43 | 55 | 52 | 52 | 45 | 4E | 54 | 20 | 47 | 4C | 4F | 42 | 41 | 4C | 20 | 28 |
| 8FA0 | 20 | 20 | 29 | 20 | 20 | 20 | 20 | 20 | 20 | 20 | 20 | 20 | 20 | 20 | 20 | 20 |
| 8FB0 | 20 | 20 | 20 | 20 | 20 | 20 | 20 | 54 | 4F | 20 | 47 | 4C | 4F | 42 | 41 | 4C |
| 8FC0 | FF | 20 | 20 | 20 | 20 | 53 | 57 | 41 | 50 | 20 | 43 | 55 | 52 | 52 | 45 | 4E |
| 8FD0 | 54 | 20 | 47 | 4C | 4F | 42 | 41 | 4C | 20 | 28 | 20 | 20 | 29 | 20 | 20 | 20 |
| 8FE0 | 20 | 20 | 20 | 20 | 20 | 20 | 20 | 20 | 20 | 20 | 20 | 20 | 20 | 20 | 20 | 57 |
| 8FF0 | 49 | 54 | 48 | 20 | 47 | 4C | 4F | 42 | 41 | 4C | FF | 20 | 20 | 20 | 43 | 4F |
| 9000 | 50 | 59 | 20 | 4F | 50 | 45 | 52 | 41 | 54 | 4F | 52 | 20 | 20 | 20 | 22 | 20 |
| 9010 | 20 | 20 | 20 | 20 | 20 | 20 | 20 | 20 | 20 | 22 | 20 | 20 | 20 | 20 | 20 | 20 |
| 9020 | 20 | 20 | 20 | 20 | 20 | 20 | 20 | 54 | 4F | 20 | 47 | 4C | 4F | 42 | 41 | 4C |
| 9030 | 20 | 20 | 20 | 20 | 4F | 50 | 45 | 52 | 41 | 54 | 4F | 52 | FF | 55 | 4E | 41 |
| 9040 | 42 | 4C | 45 | 20 | 54 | 4F | 20 | 43 | 4F | 50 | 59 | 20 | 46 | 52 | 4F | 4D |
| 9050 | 20 | 45 | 44 | 49 | 54 | 45 | 44 | 20 | 47 | 4C | 4F | 42 | 41 | 4C | FF | 20 |
| 9060 | 52 | 45 | 43 | 41 | 4C | 4C | 20 | 4C | 41 | 53 | 54 | 20 | 45 | 44 | 49 | 54 |
| 9070 | 45 | 44 | 20 | 47 | 4C | 4F | 42 | 41 | 4C | 20 | 28 | 20 | 20 | 29 | 20 | 20 |
| 9080 | 20 | 20 | 20 | 20 | 41 | 4E | 44 | 20 | 57 | 52 | 49 | 54 | 45 | 20 | 54 | 4F |
| 9090 | 20 | 43 | 55 | 52 | 52 | 45 | 4E | 54 | 20 | 47 | 4C | 4F | 42 | 41 | 4C | FF |
| 90A0 | 20 | 20 | 20 | 20 | 20 | 53 | 45 | 54 | 20 | 46 | 52 | 4F | 4E | 54 | 20 | 50 |
| 90B0 | 41 | 4E | 45 | 4C | 20 | 53 | 57 | 49 | 54 | 43 | 48 | 20 | 20 | 20 | 20 | 20 |
| 90C0 | 20 | 20 | 20 | 20 | 20 | 20 | 20 | 20 | 20 | 20 | 20 | 20 | 20 | 20 | 20 | 20 |
| 90D0 | 53 | 45 | 4E | 53 | 49 | 54 | 49 | 56 | 49 | 54 | 59 | 20 | 3D | FF | 45 | 44 |
| 90E0 | 49 | 54 | 20 | 43 | 55 | 53 | 54 | 4F | 4D | 20 | 53 | 43 | 41 | 4C | 45 | 20 |
| 90F0 | 20 | 20 | 20 | 3A | 20 | 20 | 5B | 31 | 32 | 33 | 34 | 35 | 36 | 37 | 38 | 5D |
| 9100 | FF | 55 | 53 | 45 | 52 | 20 | 4D | 49 | 44 | 49 | 20 | 4D | 45 | 53 | 53 | 41 |
| 9110 | 47 | 45 | FF | 7E | 54 | 4F | 20 | 4D | 49 | 44 | 49 | 20 | 52 | 45 | 51 | 55 |
| 9120 | 45 | 53 | 54 | 20 | 4D | 45 | 53 | 53 | 41 | 47 | 45 | FF | 53 | 57 | 49 | 54 |
| 9130 | 43 | 48 | 3A | 20 | 46 | 53 | 57 | 20 | 31 | 20 | 20 | 46 | 53 | 57 | 20 | 32 |
| 9140 | 20 | 20 | 46 | 53 | 57 | 20 | 33 | 20 | 20 | 45 | 44 | 49 | 54 | 20 | 20 | 20 |
| 9150 | 20 | 20 | 50 | 4F | 4C | 41 | 52 | 49 | 54 | 59 | 3A | FF | 20 | 20 | 20 | 20 |
| 9160 | 46 | 49 | 4C | 45 | 53 | 20 | 4F | 4E | 20 | 44 | 49 | 53 | 4B | 3A | 20 | 20 |
| 9170 | 20 | 20 | 25 | 20 | 4F | 46 | 20 | 53 | 50 | 41 | 43 | 45 | 20 | 55 | 53 | 45 |
| 9180 | 44 | FF | 20 | 53 | 45 | 4C | 45 | 43 | 54 | 20 | 50 | 52 | 49 | 4D | 41 | 52 |
| 9190 | 59 | 20 | 44 | 49 | 53 | 4B | 20 | 44 | 52 | 49 | 56 | 45 | 20 | 3A | 20 | 20 |
| 91A0 | 20 | 20 | 20 | 20 | 20 | 20 | 20 | 3C | 47 | 45 | 54 | 20 | 44 | 49 | 53 | 4B |
| 91B0 | 20 | 49 | 4E | 46 | 4F | 3E | FF | 53 | 41 | 56 | 45 | 20 | 53 | 59 | 53 | 54 |
| 91C0 | 45 | 4D | 20 | 28 | 41 | 4C | 4C | 20 | 47 | 4C | 4F | 42 | 41 | 4C | 53 | 20 |
| 91D0 | 26 | 20 | 50 | 41 | 4C | 29 | FF | 54 | 4F | 20 | 44 | 49 | 53 | 4B | 20 | 46 |
| 91E0 | 49 | 4C | 45 | 3A | FF | 53 | 41 | 56 | 45 | 3A | FF | 46 | 4F | 52 | 4D | 41 |
| 91F0 | 54 | 20 | 44 | 49 | 53 | 4B | 20 | 2D | 20 | 57 | 49 | 4C | 4C | 20 | 45 | 52 |
| 9200 | 41 | 53 | 45 | 20 | 44 | 49 | 53 | 4B | 20 | 28 | 41 | 29 | 21 | 20 | 20 | 20 |
| 9210 | 45 | 4E | 54 | 45 | 52 | 20 | 56 | 45 | 52 | 49 | 46 | 49 | 43 | 41 | 54 | 49 |
| 9220 | 4F | 4E | 20 | 43 | 4F | 44 | 45 | 20 | 52 | 20 | 3A | FF | 4C | 4F | 41 | 44 |
| 9230 | 20 | 46 | 52 | 4F | 4D | 20 | 44 | 49 | 53 | 4B | 3A | 20 | 46 | 49 | 4C | 45 |
| 9240 | 20 | 3F | 20 | 20 | 3A | FF | 45 | 52 | 41 | 53 | 45 | 20 | 46 | 49 | 4C | 45 |
| 9250 | 20 | 46 | 52 | 4F | 4D | 20 | 44 | 49 | 53 | 4B | 3A | 3F | FF | 43 | 4F | 50 |
| 9260 | 59 | 20 | 46 | 49 | 4C | 45 | 20 | 54 | 4F | 20 | 44 | 52 | 49 | 56 | 45 | 20 |
| 9270 | 20 | 3A | 3F | 20 | 20 | 3A | FF | 4C | 4F | 41 | 44 | 49 | 4E | 47 | 20 | 46 |
| 9280 | 49 | 4C | 45 | FF | 43 | 4F | 50 | 59 | 49 | 4E | 47 | 20 | 46 | 49 | 4C | 45 |
| 9290 | FF | 45 | 52 | 41 | 53 | 49 | 4E | 47 | 20 | 46 | 49 | 4C | 45 | FF | 44 | 49 |
| 92A0 | 53 | 4B | 20 | 49 | 53 | 20 | 45 | 4D | 50 | 54 | 59 | FF | 46 | 49 | 4C | 45 |
| 92B0 | 20 | 4E | 41 | 4D | 45 | 20 | 5B | 20 | 2E | 2E | 2E | 2E | 2E | 2E | 2E | 2E |
| 92C0 | 2E | 2E | 2E | 2E | 2E | 2E | 2E | 2E | 20 | 5D | 20 | 41 | 4C | 52 | 45 | 41 |
| 92D0 | 44 | 59 | 20 | 20 | 45 | 58 | 49 | 53 | 54 | 53 | 2E | 20 | 52 | 45 | 50 | 4C |
| 92E0 | 41 | 43 | 45 | 20 | 45 | 58 | 49 | 53 | 54 | 49 | 4E | 47 | 20 | 46 | 49 | 4C |

-continued

| | | | | | | | | | | | | | | | | |
|---|---|---|---|---|---|---|---|---|---|---|---|---|---|---|---|---|
| 92F0 | 45 | 20 | 3F | 20 | 28 | 59 | 45 | 53 | 2F | 4E | 4F | 29 | FF | 2D | 2D | 20 |
| 9300 | 53 | 43 | 41 | 4E | 4E | 49 | 4E | 47 | 20 | 44 | 49 | 52 | 45 | 43 | 54 | 4F |
| 9310 | 52 | 59 | 20 | 2D | 2D | FF | 46 | 4F | 52 | 4D | 41 | 54 | 20 | 43 | 4F | 4D |
| 9320 | 50 | 4C | 45 | 54 | 45 | 20 | 2D | 20 | 20 | 20 | 20 | 20 | 42 | 41 | 44 | 20 |
| 9330 | 53 | 45 | 43 | 54 | 4F | 52 | 28 | 53 | 29 | FF | 45 | 4D | 50 | 54 | 59 | 20 |
| 9340 | 20 | 20 | 20 | 20 | 4D | 49 | 44 | 49 | 20 | 49 | 4E | 50 | 55 | 54 | FF | 20 |
| 9350 | 20 | 20 | 43 | 48 | 41 | 4E | 4E | 45 | 4C | 3A | 20 | 20 | 20 | 28 | 4F | 4D |
| 9360 | 4E | 49 | 29 | 20 | 30 | 30 | 20 | 28 | 4F | 4D | 4E | 49 | 29 | FF | 20 | 20 |
| 9370 | 50 | 52 | 4F | 47 | 52 | 41 | 4D | 20 | 43 | 48 | 41 | 4E | 47 | 45 | 53 | 3A |
| 9380 | FF | 20 | 53 | 59 | 53 | 54 | 45 | 4D | 20 | 45 | 58 | 43 | 4C | 55 | 53 | 49 |
| 9390 | 56 | 45 | 3A | FF | 55 | 54 | 49 | 4C | 49 | 54 | 59 | 20 | 20 | 20 | 41 | 31 |
| 93A0 | 20 | 41 | 32 | 20 | 42 | 31 | 20 | 42 | 32 | 20 | 43 | 31 | 20 | 43 | 32 | 20 |
| 93B0 | 44 | 31 | 20 | 44 | 32 | 20 | 20 | 50 | 31 | 20 | 4D | 49 | 44 | 49 | 20 | 4F |
| 93C0 | 55 | 54 | 53 | 3A | FF | 55 | 4E | 44 | 45 | 46 | 49 | 4E | 45 | 44 | 20 | 20 |
| 93D0 | 20 | 20 | 53 | 49 | 4E | 47 | 4C | 45 | 20 | 47 | 4C | 4F | 42 | 41 | 4C | 47 |
| 93E0 | 5A | 20 | 53 | 59 | 53 | 54 | 45 | 4D | 20 | 20 | 20 | 20 | 44 | 41 | 54 | 41 |
| 93F0 | 20 | 52 | 45 | 51 | 55 | 45 | 53 | 54 | 20 | 4D | 49 | 44 | 49 | 20 | 53 | 59 |
| 9400 | 53 | 2E | 20 | 45 | 58 | 2E | 4D | 49 | 44 | 49 | 20 | 4D | 45 | 53 | 53 | 41 |
| 9410 | 47 | 45 | 53 | 4E | 41 | 4D | 45 | 20 | 46 | 49 | 4E | 44 | 45 | 52 | 20 | 20 |
| 9420 | 43 | 55 | 53 | 54 | 4F | 4D | 20 | 53 | 43 | 41 | 4C | 45 | 53 | 4D | 49 | 44 |
| 9430 | 49 | 20 | 43 | 54 | 52 | 4C | 20 | 4D | 53 | 47 | 53 | 4F | 46 | 54 | 57 | 41 |
| 9440 | 52 | 45 | 20 | 46 | 49 | 4C | 45 | 47 | 4C | 4F | 42 | 41 | 4C | 20 | 20 | 50 |
| 9450 | 41 | 4C | 20 | 20 | 20 | 20 | 20 | 53 | 43 | 41 | 4C | 45 | 53 | 20 | 20 | 55 |
| 9460 | 53 | 52 | 20 | 4D | 53 | 47 | 53 | 52 | 53 | 54 | 20 | 4D | 53 | 47 | 20 | B6 |
| 9470 | 5A | 7A | C6 | 18 | BD | C1 | 5B | BD | E0 | 12 | 24 | 07 | 7C | 52 | C2 | 7F |
| 9480 | 5D | DA | 39 | 34 | 10 | 30 | 08 | 10 | 8E | 50 | 73 | C6 | 10 | BD | 81 | 3D |
| 9490 | 35 | 90 | 34 | 04 | A6 | 84 | BD | DB | BE | A1 | 84 | 27 | 1B | 4D | 2A | 09 |
| 94A0 | 81 | C0 | 24 | 04 | 86 | 7F | 20 | 01 | 4F | A1 | E4 | 23 | 02 | A6 | E4 | A7 |
| 94B0 | 84 | 7C | 52 | C2 | 1A | 01 | 35 | 84 | A6 | 84 | 1C | FE | 35 | 84 | 34 | 36 |
| 94C0 | A6 | 01 | 81 | 09 | 23 | 01 | 4F | C6 | 0D | 3D | 8E | 93 | C5 | 30 | 8B | 10 |
| 94D0 | 8E | 50 | 4A | E6 | E4 | 31 | A5 | CC | 3A | 20 | ED | A1 | C6 | 0D | BD | 81 |
| 94E0 | 3D | 35 | B6 | 34 | 36 | BD | C2 | F1 | 8E | 92 | FD | BD | C0 | 4C | BD | C0 |
| 94F0 | 9C | 35 | B6 | 8E | 93 | 44 | 8D | 13 | CC | 31 | 32 | B7 | 50 | 60 | F7 | 50 |
| 9500 | 6A | 39 | 34 | 36 | 20 | 0A | 8D | 03 | 7E | BF | F4 | 34 | 36 | BD | C0 | 78 |
| 9510 | 5F | B6 | 52 | 8F | BD | C1 | 5B | CC | 50 | 30 | FD | 50 | 70 | B6 | 52 | 90 |
| 9520 | 26 | 06 | CC | 00 | 02 | BD | C2 | 8F | 35 | B6 | 86 | 01 | BD | DB | B5 | 81 |
| 9530 | 01 | 2F | 04 | 7C | 52 | C2 | 39 | 32 | 62 | 39 | 34 | 02 | B1 | 52 | 90 | 25 |
| 9540 | 19 | BD | DC | 8E | 26 | 08 | B6 | 52 | 90 | 27 | 1E | 32 | 61 | 39 | BB | 52 |
| 9550 | 90 | 2A | 01 | 4F | A1 | E4 | 23 | 02 | A6 | E4 | B7 | 52 | 90 | FC | 52 | 8F |
| 9560 | FD | 52 | 96 | 7C | 52 | C2 | 32 | 63 | 39 | B6 | 52 | 8F | BD | DB | B5 | B1 |
| 9570 | 52 | 8F | 27 | F2 | B7 | 52 | 8F | 20 | E4 | 8E | 52 | 99 | C6 | 63 | BD | 94 |
| 9580 | 92 | 24 | 06 | BD | CD | 9B | BD | 8B | DB | 39 | B6 | 52 | 86 | BD | DB | B5 |
| 9590 | B1 | 52 | 86 | 27 | 10 | 4D | 2A | 01 | 4F | 81 | 02 | 23 | 02 | 86 | 02 | B7 |
| 95A0 | 52 | 86 | 7C | 52 | C2 | 39 | BD | 95 | 0B | 8E | 91 | D7 | BD | C0 | 4C | CC |
| 95B0 | 5B | 5D | B7 | 50 | 7F | F7 | 50 | 90 | BD | BF | F4 | 39 | 34 | 06 | CC | 5B |
| 95C0 | 5D | B7 | 50 | 62 | F7 | 50 | 6D | 35 | 86 | 34 | 06 | B7 | 5D | AF | 7F | 5D |
| 95D0 | B0 | 86 | 58 | B7 | 5D | B3 | 8E | 50 | 72 | B6 | 5D | AF | 81 | 15 | 23 | 0B |
| 95E0 | 31 | 21 | B6 | 5D | AF | 4A | B7 | 5D | AF | 20 | F1 | 8C | 50 | 97 | 22 | 47 |
| 95F0 | A6 | A0 | 81 | FE | 27 | 41 | 81 | FF | 26 | 15 | 86 | 28 | A7 | 80 | B6 | 5D |
| 9600 | B3 | A7 | 80 | 88 | 01 | B7 | 5D | B3 | CC | 29 | 20 | ED | 81 | 20 | DC | 81 |
| 9610 | FD | 26 | 11 | CC | 28 | 7E | ED | 81 | CC | 29 | 20 | ED | 81 | 86 | 01 | B7 |
| 9620 | 5D | B0 | 20 | C7 | BD | C1 | 98 | 30 | 02 | 7D | 5D | B0 | 27 | BD | 86 | 63 |
| 9630 | A7 | 1D | 7F | 5D | B0 | 20 | B4 | A6 | E4 | 81 | 02 | 25 | 0E | B6 | 5D | AF |
| 9640 | 80 | 0C | 48 | 48 | 8B | 28 | C6 | 03 | BD | C2 | 8F | 35 | 86 | 96 | 8B | 97 |
| 9650 | 03 | 97 | 2A | 97 | CF | 98 | A9 | 99 | 00 | 99 | 84 | 9A | 4B | 9A | 98 | 9A |
| 9660 | D7 | 9B | 54 | 9C | 94 | 9D | 54 | 9D | 6E | 9D | E7 | A3 | 92 | A4 | 37 | A4 |
| 9670 | E0 | A5 | 49 | A4 | 92 | A5 | A3 | 9E | 8F | 9F | C9 | EE | 70 | A0 | FD | A2 |
| 9680 | C8 | A3 | 09 | A6 | 18 | F7 | 20 | F8 | E4 | 96 | E1 | B6 | 52 | C2 | 27 | 1D |
| 9690 | 8E | 80 | F9 | BD | C0 | 78 | 8E | 8E | 02 | BD | C0 | 4C | BD | 95 | 02 | C6 |
| 96A0 | 2F | BD | A6 | D8 | 8E | A7 | 6B | BD | C2 | 67 | BD | C0 | 99 | 86 | 02 | BD |
| 96B0 | 95 | 3A | 81 | 01 | 10 | 27 | FE | D2 | 16 | FE | BE | 8E | 5D | DD | 34 | 16 |
| 96C0 | 30 | 02 | 4F | 5F | EB | 80 | 89 | 00 | 8C | 5F | DD | 25 | F7 | 10 | B3 | 5D |
| 96D0 | DD | 26 | 0A | 10 | 83 | 00 | 00 | 27 | 04 | 1C | FE | 35 | 96 | 1A | 01 | 35 |
| 96E0 | 96 | 8D | D8 | 25 | 07 | B6 | 52 | 86 | A1 | 02 | 27 | 0E | B6 | 52 | 86 | 8E |
| 96F0 | 52 | 8F | 81 | 02 | 22 | 03 | 48 | 6A | 86 | 39 | B6 | 52 | C2 | 27 | 02 | 6E |
| 9700 | 05 | 6E | 03 | B6 | 52 | C2 | 27 | 0F | 8E | 8E | 09 | BD | 95 | 06 | 8E | 98 |
| 9710 | A7 | BD | C2 | 67 | BD | C0 | 99 | 86 | 01 | BD | 95 | 3A | BD | 95 | 2A | 86 |
| 9720 | F6 | BD | C4 | BE | 7F | 52 | 90 | 16 | 07 | 5A | B6 | 52 | C2 | 27 | 62 | 8E |
| 9730 | 8E | E2 | BD | 95 | 0B | BE | 57 | 4A | A6 | 84 | 81 | 63 | 23 | 26 | 8E | 8F |
| 9740 | 62 | BD | C0 | 4C | BE | 57 | 4A | 8C | 56 | E6 | 23 | 0A | A6 | 1F | 81 | 63 |
| 9750 | 22 | 04 | 30 | 1F | 20 | F1 | 1F | 10 | 83 | 56 | E6 | 1F | 98 | C6 | 4D | BD |
| 9760 | C1 | 5B | 20 | 14 | 34 | 02 | C6 | 38 | BD | C1 | 5B | 35 | 02 | BD | 8B | 98 |
| 9770 | 8E | 50 | 88 | C6 | 10 | BD | 81 | 48 | FC | 57 | 4A | 83 | 56 | E6 | 1F | 98 |
| 9780 | C6 | 2C | BD | C1 | 5B | 8E | 97 | CB | BD | C2 | 67 | 7F | 50 | D5 | BD | C0 |
| 9790 | 99 | BE | 57 | 4A | 86 | 02 | BD | 95 | 3A | 81 | 01 | 26 | 29 | 1F | 10 | 83 |
| 97A0 | 56 | E6 | 1F | 98 | B7 | 5D | AF | BD | DB | BE | B1 | 5D | AF | 27 | 16 | 4D |
| 97B0 | 2A | 01 | 4F | 81 | 63 | 23 | 02 | 86 | 63 | 1F | 89 | 4F | C3 | 56 | E6 | FD |
| 97C0 | 57 | 4A | 7C | 52 | C2 | 39 | C6 | 64 | 7E | 94 | 92 | 2C | 02 | 38 | 17 | B6 |
| 97D0 | 52 | C2 | 10 | 27 | 00 | 5D | 8E | 8F | 1C | BD | 95 | 06 | B6 | 52 | 9A | 2A |
| 97E0 | 2B | 8E | 8F | 5C | 10 | 8E | 50 | 65 | C6 | 06 | BD | 81 | 3D | A6 | 9F | 57 |
| 97F0 | 4A | 81 | 64 | 25 | 10 | 34 | 02 | 8E | 8F | 6B | 10 | 8E | 50 | 72 | C6 | 06 |
| 9800 | BD | 81 | 3D | 35 | 02 | C6 | 2F | BD | C1 | 5B | 20 | 0E | 81 | 64 | 23 | 02 |

-continued

| | | | | | | | | | | | | | | | | |
|---|---|---|---|---|---|---|---|---|---|---|---|---|---|---|---|---|
| 9810 | 86 | 64 | B7 | 52 | 9A | C6 | 2F | BD | C1 | 5B | FC | 57 | 4A | 83 | 56 | E6 |
| 9820 | 1F | 98 | C6 | 43 | BD | C1 | 5B | 8E | 98 | A1 | BD | C2 | 67 | BD | C0 | 99 |
| 9830 | 7F | 52 | C3 | 86 | 04 | BD | 95 | 3A | BE | 57 | 4A | 81 | 01 | 27 | 46 | 81 |
| 9840 | 02 | 27 | 33 | 81 | 03 | 10 | 27 | FF | 54 | BD | 95 | 2A | BE | 57 | 4A | B6 |
| 9850 | 52 | 9A | 2B | 17 | E6 | 84 | A7 | 80 | 1F | 98 | 8C | 57 | 49 | 23 | F5 | 7A |
| 9860 | 52 | 90 | 86 | 01 | B7 | 52 | C3 | B7 | 52 | C2 | 39 | 8C | 57 | 49 | 24 | EF |
| 9870 | A6 | 01 | A7 | 80 | 20 | F5 | BE | 57 | 4A | B6 | 52 | 9A | 10 | 2B | FF | 46 |
| 9880 | C6 | 64 | 16 | 00 | 6F | 86 | 01 | BD | DB | B5 | 81 | 01 | 27 | 12 | F6 | 52 |
| 9890 | 9A | 4D | 2F | 04 | CA | 80 | 20 | 02 | C4 | 7F | F7 | 52 | 9A | 7C | 52 | C2 |
| 98A0 | 39 | 1B | 06 | 2F | 03 | 43 | 03 | 4D | 02 | B6 | 52 | C2 | 27 | 27 | 8E | 8F |
| 98B0 | 87 | BD | 95 | 06 | B6 | 52 | 99 | C6 | 1C | BD | C1 | 5B | B6 | 52 | 9A | 81 |
| 98C0 | 63 | 23 | 01 | 4F | B7 | 52 | 9A | C6 | 3D | BD | C1 | 5B | 8E | 98 | FA | BD |
| 98D0 | C2 | 67 | BD | C0 | 99 | 86 | 03 | BD | 95 | 3A | 81 | 01 | 10 | 27 | FC | 99 |
| 98E0 | 81 | 02 | 27 | 0E | BD | 95 | 2A | B6 | 52 | 9A | BD | 88 | 93 | 10 | 24 | 05 |
| 98F0 | 90 | 39 | C6 | 63 | 8E | 52 | 9A | 7E | 94 | 92 | 1C | 02 | 3D | 02 | 4D | 02 |
| 9900 | B6 | 52 | C2 | 27 | 27 | 8E | 8F | C1 | BD | 95 | 06 | B6 | 52 | 99 | C6 | 1C |
| 9910 | BD | C1 | 5B | B6 | 52 | 9A | 81 | 63 | 23 | 01 | 4F | B7 | 52 | 9A | C6 | 3D |
| 9920 | BD | C1 | 5B | 8E | 98 | FA | BD | C2 | 67 | BD | C0 | 99 | 86 | 03 | BD | 95 |
| 9930 | 3A | 81 | 01 | 10 | 27 | FC | 42 | 81 | 02 | 10 | 27 | FF | B5 | BD | 95 | 2A |
| 9940 | B6 | 52 | 99 | 8D | 37 | 25 | 07 | B6 | 52 | 9A | 8D | 30 | 24 | 06 | 8E | 88 |
| 9950 | B2 | 16 | F0 | E4 | B6 | 52 | 99 | 34 | 02 | 86 | 66 | BD | 88 | 70 | B6 | 52 |
| 9960 | 9A | BD | CD | 9B | A6 | E4 | BD | 88 | 93 | 86 | 66 | BD | CD | 9B | B6 | 52 |
| 9970 | 9A | BD | 88 | 93 | A6 | E0 | BD | CD | 9B | 16 | 05 | 05 | BD | 8B | 98 | A6 |
| 9980 | A8 | 17 | 48 | 39 | B6 | 52 | C2 | 27 | 42 | 8E | 8F | FB | BD | 95 | 06 | F6 |
| 9990 | 52 | 95 | BD | 8B | EE | CB | 31 | F7 | 50 | 5E | 9E | 64 | 10 | 8E | 50 | 61 |
| 99A0 | C6 | 0A | BD | 81 | 3D | B6 | 52 | 9A | 81 | 63 | 23 | 01 | 4F | B7 | 52 | 9A |
| 99B0 | C6 | 39 | BD | C1 | 5B | B6 | 52 | 9C | 84 | 07 | B7 | 52 | 9C | 8B | 31 | B7 |
| 99C0 | 50 | 8F | 8E | 9A | 43 | BD | C2 | 67 | BD | C0 | 99 | 86 | 04 | BD | 95 | 3A |
| 99D0 | 81 | 01 | 26 | 15 | B6 | 5D | 8E | 27 | 0A | 7F | 5D | 8E | BD | 9A | 30 | B7 |
| 99E0 | 52 | 95 | 39 | 8E | 52 | 95 | 7E | AD | 02 | 81 | 02 | 10 | 27 | FF | 03 | 81 |
| 99F0 | 03 | 27 | 29 | BD | 95 | 2A | B6 | 5D | C2 | 27 | 06 | 8E | 90 | 3D | 16 | EF |
| 9A00 | DE | B6 | 52 | 9A | F6 | 52 | 9C | BD | 89 | 69 | 24 | 01 | 39 | B6 | 52 | 9A |
| 9A10 | B1 | 52 | 99 | 26 | 03 | BD | CD | 9B | 16 | 04 | 66 | B6 | 5D | 8E | 27 | 0A |
| 9A20 | 7F | 5D | 8E | BD | 9A | 30 | B7 | 52 | 9C | 39 | 8E | 52 | 9C | 7E | AD | 02 |
| 9A30 | 34 | 14 | 8E | D2 | 0D | 5F | A5 | 85 | 26 | 05 | 5C | C1 | 07 | 23 | F7 | 1F |
| 9A40 | 98 | 35 | 94 | 14 | 0E | 39 | 02 | 45 | 01 | 4D | 02 | B6 | 52 | C2 | 27 | 29 |
| 9A50 | 8E | 90 | 5F | BD | 95 | 06 | B6 | 52 | 84 | 81 | 63 | 23 | 03 | B6 | 52 | 99 |
| 9A60 | B7 | 52 | 84 | C6 | 1F | BD | C1 | 5B | B6 | 52 | 99 | C6 | 44 | BD | C1 | 5B |
| 9A70 | 8E | 98 | A7 | BD | C2 | 67 | BD | C0 | 99 | 86 | 01 | BD | 95 | 3A | BD | 95 |
| 9A80 | 2A | B6 | 52 | 99 | 34 | 02 | 86 | 64 | BD | CD | 9B | A6 | E4 | BD | 88 | 70 |
| 9A90 | 35 | 02 | BD | CD | 9B | 16 | 03 | E9 | B6 | 52 | C2 | 27 | 17 | 8E | 90 | A0 |
| 9AA0 | BD | 95 | 0B | B6 | 5D | AD | C6 | 41 | BD | C1 | 5B | 8E | 9A | C4 | BD | C2 |
| 9AB0 | 67 | BD | C0 | 99 | 86 | 01 | BD | 95 | 3A | 8E | 5D | AD | C6 | 63 | BD | 94 |
| 9AC0 | 92 | 7E | 8B | DB | 41 | 02 | B6 | 38 | 05 | 84 | 0F | B1 | 5D | AF | 27 | 06 |
| 9AD0 | B7 | 5D | AF | 7C | 52 | C2 | 39 | 8D | ED | B6 | 52 | C2 | 27 | 42 | 8E | 91 |
| 9AE0 | 2C | BD | 95 | 0B | 10 | 8E | 9B | 50 | 8E | 50 | 7D | 5F | 86 | 2B | A7 | 84 |
| 9AF0 | B6 | 5D | 7E | A5 | A5 | 26 | 04 | 86 | 2D | A7 | 84 | 86 | 28 | A7 | 01 | 86 |
| 9B00 | 29 | A7 | 05 | 30 | 02 | B6 | 38 | 05 | B8 | 5D | 7E | A4 | A5 | BD | BF | DE |
| 9B10 | 30 | 05 | 5C | C1 | 03 | 23 | D5 | 8E | 9B | 48 | BD | C2 | 67 | BD | C0 | 99 |
| 9B20 | 86 | 04 | BD | 95 | 3A | 8E | 9B | 4F | 30 | 86 | 86 | 01 | BD | DB | B5 | 81 |
| 9B30 | 01 | 27 | 14 | E6 | 84 | 4D | 2F | 05 | FA | 5D | 7E | 20 | 04 | 53 | F4 | 5D |
| 9B40 | 7E | F7 | 5D | 7E | 7C | 52 | C2 | 39 | 33 | 01 | 3A | 01 | 41 | 01 | 48 | 01 |
| 9B50 | 02 | 04 | 08 | 01 | B6 | 52 | C2 | 10 | 27 | 00 | 4E | 8E | 90 | DE | BD | 95 |
| 9B60 | 06 | B6 | 52 | 9D | 81 | 03 | 25 | 02 | 86 | 02 | B7 | 52 | 9D | 8B | 31 | B7 |
| 9B70 | 50 | 5F | 8E | 50 | EA | F6 | 52 | 9D | 58 | 58 | 58 | 3A | 10 | 8E | 50 | 66 |
| 9B80 | C6 | 08 | BD | 81 | 55 | 8E | 51 | 11 | B6 | 52 | 9D | 5F | 44 | 56 | 30 | 8B |
| 9B90 | C6 | 28 | A6 | 84 | BD | C1 | 5B | 30 | 88 | 10 | CB | 04 | C1 | 48 | 25 | F2 |
| 9BA0 | 8E | 9C | 65 | BD | C2 | 67 | BD | C0 | 99 | 86 | 12 | BD | 95 | 3A | 81 | 12 |
| 9BB0 | 27 | 3F | 81 | 01 | 27 | 24 | 81 | 0A | 25 | 28 | 80 | 0A | 48 | 48 | 48 | 48 |
| 9BC0 | 8B | 0F | 81 | 80 | 25 | 02 | 86 | 7F | 8E | 51 | 02 | 30 | 86 | B6 | 52 | 9D |
| 9BD0 | 5F | 44 | 56 | 30 | 8B | C6 | 7F | 7E | 94 | 92 | 8E | 52 | 9D | C6 | 02 | 7E |
| 9BE0 | AD | 04 | 8E | 50 | E8 | 30 | 86 | F6 | 52 | 9D | 58 | 58 | 58 | 3A | 16 | 03 |
| 9BF0 | 1B | BD | 95 | 2A | 86 | 01 | B7 | 52 | C2 | B7 | 52 | C3 | 4F | B7 | 52 | 90 |
| 9C00 | 5F | 34 | 06 | 4F | 34 | 02 | 8E | 51 | 02 | B6 | 52 | 9D | 5F | 44 | 56 | 30 |
| 9C10 | 8B | 86 | 08 | B7 | 5D | AF | A6 | 0F | A0 | E4 | 1F | 89 | C4 | 80 | 34 | 04 |
| 9C20 | 5F | 44 | 56 | AA | E4 | 44 | 56 | AA | E4 | 44 | 56 | AA | E4 | 44 | 56 | AA |
| 9C30 | E0 | ED | 61 | 10 | 8E | 00 | 10 | B6 | 5D | AF | 81 | 08 | 26 | 03 | 4F | 20 |
| 9C40 | 02 | A6 | E4 | 5F | E3 | 61 | 4D | 2A | 0B | 81 | C0 | 25 | 04 | 4F | 5F | 20 |
| 9C50 | 03 | CC | 7F | FF | A7 | 80 | 31 | 3F | 26 | EA | A7 | E4 | B6 | 5D | AF | 4A |
| 9C60 | 26 | B1 | 32 | 63 | 39 | 15 | 01 | 80 | 01 | 81 | 01 | 82 | 01 | 83 | 01 | 84 |
| 9C70 | 01 | 85 | 01 | 86 | 01 | 87 | 01 | 28 | 03 | 2C | 03 | 30 | 03 | 34 | 03 | 38 |
| 9C80 | 03 | 3C | 03 | 40 | 03 | 44 | 03 | 4D | 02 | 34 | 04 | F6 | 52 | 9D | 58 | 58 |
| 9C90 | 58 | 3A | 35 | 84 | B6 | 52 | C2 | 10 | 27 | 00 | 64 | 8E | 91 | 01 | BD | 95 |
| 9CA0 | 0B | BD | 95 | BC | 86 | 70 | BD | 8B | 98 | B6 | 52 | 9E | 84 | 1F | B7 | 52 |
| 9CB0 | 9E | C6 | 15 | BD | C1 | 5B | B6 | 52 | 90 | 81 | 01 | 26 | 06 | CC | 15 | 02 |
| 9CC0 | BD | C2 | 8F | B6 | 52 | 9E | C6 | 18 | 3D | 31 | AB | 10 | BF | 5D | B1 | 8E |
| 9CD0 | 50 | 63 | C6 | 0A | BD | 81 | 48 | F6 | 52 | 90 | C1 | 01 | 23 | 18 | C1 | 0B |
| 9CE0 | 22 | 14 | 8E | 50 | 61 | A6 | 85 | BD | C3 | 7D | B6 | 52 | 90 | 8B | 17 | C6 |
| 9CF0 | 01 | BD | C2 | 8F | 20 | 06 | B6 | 52 | 90 | BD | 95 | C9 | BD | C0 | 99 | 86 |
| 9D00 | 19 | BD | 9D | CA | 81 | 01 | 22 | 1F | B6 | 52 | 9E | BD | DB | B5 | B1 | 52 |
| 9D10 | 9E | 26 | 01 | 39 | 4D | 2F | 08 | 81 | 1F | 23 | 05 | 86 | 1F | 20 | 01 | 4F |
| 9D20 | B7 | 52 | 9E | 7C | 52 | C2 | 39 | 10 | BE | 5D | B1 | 80 | 02 | 31 | A6 | 81 |

-continued

| | | | | | | | | | | | | | | | | |
|---|---|---|---|---|---|---|---|---|---|---|---|---|---|---|---|---|
| 9D30 | 09 | 22 | 0A | A6 | A4 | BD | DB | A4 | A1 | A4 | 26 | 0C | 39 | 1F | 89 | A6 |
| 9D40 | A4 | BD | DB | BE | A1 | A4 | 27 | 0B | C1 | 0A | 26 | 02 | 8A | 80 | A7 | A4 |
| 9D50 | 7C | 52 | C2 | 39 | BD | CC | 04 | 10 | 8E | 6D | 80 | 10 | BF | 5D | B1 | 86 |
| 9D60 | 64 | B7 | 5D | 86 | B6 | 52 | C2 | 27 | 58 | 8E | B7 | E3 | 20 | 18 | BD | CC |
| 9D70 | 04 | 10 | 8E | 6D | 00 | 10 | BF | 5D | B1 | 86 | 6E | B7 | 5D | 86 | B6 | 52 |
| 9D80 | C2 | 27 | 3E | 8E | 91 | 17 | BD | 95 | 0B | BD | 95 | BC | 10 | BE | 5D | B1 |
| 9D90 | 8E | 50 | 63 | C6 | 0A | BD | 81 | 48 | F6 | 52 | 90 | 27 | 18 | C1 | 0A | 22 |
| 9DA0 | 14 | 8E | 50 | 62 | A6 | 85 | BD | C3 | 7D | B6 | 52 | 90 | 8B | 18 | C6 | 01 |
| 9DB0 | BD | C2 | 8F | 20 | 09 | B6 | 52 | 90 | 27 | 01 | 4C | BD | 95 | C9 | BD | C0 |
| 9DC0 | 99 | B6 | 5D | 86 | 8D | 04 | 4C | 16 | FF | 5D | 34 | 16 | BE | 5D | B1 | 86 |
| 9DD0 | 0C | 30 | 0A | E6 | 80 | C1 | FE | 27 | 07 | 4C | 2B | 04 | A1 | E4 | 25 | F3 |
| 9DE0 | 32 | 61 | 35 | 14 | 7E | 95 | 3A | B6 | 52 | C2 | 27 | 30 | 8E | 8E | 4E | BD |
| 9DF0 | 95 | 06 | B6 | 52 | 9A | 81 | 64 | 24 | 1A | C6 | 20 | F7 | 50 | 81 | C6 | 35 |
| 9E00 | BD | C1 | 5B | BD | 8B | 98 | 8E | 50 | 85 | C6 | 10 | BD | 81 | 48 | 86 | 3D |
| 9E10 | B7 | 50 | 83 | 8E | 9F | 1B | BD | C2 | 67 | BD | C0 | 99 | 86 | 02 | BD | 95 |
| 9E20 | 3A | 81 | 01 | 10 | 27 | 00 | 63 | BD | 95 | 2A | B6 | 52 | 9A | 81 | 64 | 24 |
| 9E30 | 05 | BD | CC | 62 | 20 | 4B | 8E | 8E | 84 | BD | C0 | 54 | BD | F3 | 60 | 4F |
| 9E40 | 34 | 02 | C6 | 17 | BD | C1 | 5B | BD | C0 | 9C | B6 | 38 | 03 | 85 | 01 | 26 |
| 9E50 | 0B | 35 | 02 | 7A | 52 | 90 | 8E | F4 | 63 | 7E | 89 | DF | BD | D5 | D8 | 35 |
| 9E60 | 02 | BD | CC | 62 | 4C | 81 | 63 | 23 | D7 | BD | CC | B6 | 4F | BD | CD | 24 |
| 9E70 | 4C | 81 | 02 | 23 | F8 | 4F | BD | CD | 47 | 4C | 81 | 1F | 23 | F8 | BD | CC |
| 9E80 | F5 | 7A | 52 | 90 | 8E | 8E | 99 | 16 | EB | AE | C6 | 65 | 16 | FA | 65 | B6 |
| 9E90 | 52 | C2 | 27 | 14 | 8E | 91 | B7 | BD | 95 | A6 | 86 | 36 | BD | A0 | 86 | 8E |
| 9EA0 | 9F | 21 | BD | C2 | 67 | BD | C0 | 99 | 86 | 11 | BD | 95 | 3A | 81 | 01 | 10 |
| 9EB0 | 26 | 00 | 54 | BD | 95 | 2A | 86 | 02 | B7 | 57 | 4E | CC | 00 | 76 | FD | 57 |
| 9EC0 | 52 | 7F | 57 | 54 | 5F | 4F | F7 | 57 | 4D | FD | 57 | 50 | 4C | B7 | 52 | C2 |
| 9ED0 | B7 | 57 | 4F | BD | E2 | 00 | 10 | 25 | 00 | 21 | 4D | 27 | 13 | BD | 9F | 49 |
| 9EE0 | 24 | 07 | 7C | 52 | 90 | 7C | 52 | C2 | 39 | BD | 9F | 6A | 10 | 25 | 00 | 0B |
| 9EF0 | BD | DC | D3 | BD | E9 | 1F | 25 | 06 | 16 | FF | 86 | BD | E9 | 1F | 7A | 52 |
| 9F00 | 90 | 7F | 5D | DA | 16 | EA | D8 | 8E | 57 | 53 | 30 | 86 | A6 | 84 | BD | DB |
| 9F10 | A4 | A1 | 84 | 27 | 05 | 7C | 52 | C2 | A7 | 84 | 39 | 35 | 03 | 4D | 02 | 08 |
| 9F20 | 0D | 4D | 02 | 9A | 01 | 9B | 01 | 9C | 01 | 9D | 01 | 9E | 01 | 9F | 01 | A0 |
| 9F30 | 01 | A1 | 01 | A2 | 01 | A3 | 01 | A4 | 01 | A5 | 01 | A6 | 01 | A7 | 01 | A8 |
| 9F40 | 01 | A9 | 01 | 38 | 03 | 23 | 03 | 4D | 02 | BD | E9 | 1F | 8E | 92 | AC | BD |
| 9F50 | C0 | 24 | 8E | 57 | 55 | 10 | 8E | 50 | 56 | C6 | 10 | BD | 81 | 3D | BD | C0 |
| 9F60 | 9C | CC | BF | BF | FD | 30 | 00 | 16 | EB | 20 | BE | 57 | 52 | B6 | 57 | 54 |
| 9F70 | 34 | 12 | 4F | B7 | 5D | DA | B7 | 5A | 7A | B7 | 5A | 79 | 8E | 58 | 65 | F6 |
| 9F80 | 59 | 67 | 30 | 8B | FC | 59 | 65 | ED | 03 | 10 | 8E | 48 | 00 | C6 | 18 | BD |
| 9F90 | 81 | 3D | BD | E3 | C5 | 35 | 22 | 10 | BF | 57 | 52 | B7 | 57 | 54 | 39 | 02 |
| 9FA0 | 07 | B7 | 56 | 03 | 05 | B7 | 56 | 01 | 08 | 6D | 80 | 01 | 06 | 67 | 00 | 01 |
| 9FB0 | 03 | 6D | 00 | 02 | 01 | 50 | 00 | 02 | 09 | B7 | 56 | F6 | 5D | BE | 8E | 9F |
| 9FC0 | 9F | 58 | 58 | 3A | EC | 84 | AE | 02 | 39 | B6 | 52 | C2 | 27 | 78 | 8E | 91 |
| 9FD0 | E5 | BD | 95 | A6 | F6 | 5D | BE | C1 | 06 | 23 | 03 | 7F | 5D | BE | C1 | 06 |
| 9FE0 | 26 | 08 | BD | 96 | BB | 24 | 03 | 7A | 5D | BE | B6 | 52 | 90 | 26 | 07 | 86 |
| 9FF0 | 3F | B7 | 50 | 59 | 20 | 2B | 8D | C3 | 8E | 93 | C5 | 86 | 0D | 3D | 30 | 8B |
| A000 | 10 | 8E | 50 | 52 | C6 | 0D | BD | 81 | 55 | 86 | 3A | A7 | A0 | BD | CC | 04 |
| A010 | 8D | A9 | A6 | 84 | 81 | 2A | 26 | 02 | 6C | 84 | 8D | 9F | C6 | 10 | BD | C0 |
| A020 | 85 | B6 | 57 | 55 | 81 | 2A | 26 | 10 | 8D | 91 | 8C | B7 | 56 | 27 | 09 | 10 |
| A030 | 8E | 57 | 55 | C6 | 10 | BD | C0 | 85 | 86 | 36 | BD | A0 | 86 | 8E | 9F | 1F |
| A040 | BD | C2 | 67 | BD | C0 | 99 | 86 | 12 | BD | 95 | 3A | 81 | 01 | 26 | 1D | B6 |
| A050 | 5D | BE | BD | DB | B5 | B1 | 5D | BE | 26 | 01 | 39 | 4D | 2A | 01 | 4F | 81 |
| A060 | 06 | 23 | 02 | 86 | 06 | B7 | 5D | BE | 7C | 52 | C2 | 39 | 4A | 81 | 01 | 10 |
| A070 | 26 | FE | 94 | BD | 95 | 2A | BD | 9F | BB | F7 | 57 | 4E | 5F | FD | 57 | 53 |
| A080 | F7 | 57 | 52 | 16 | FE | 3E | 34 | 36 | B6 | 57 | 55 | 81 | 20 | 2E | 3F | 10 |
| A090 | 8E | 8E | 92 | 8E | 57 | 55 | C6 | 10 | BD | 81 | 32 | FC | 52 | C6 | 98 | 00 |
| A0A0 | D8 | 00 | 34 | 06 | C6 | 41 | BD | C1 | 5B | FC | 50 | 8B | FD | 57 | 5F | B6 |
| A0B0 | 50 | 8D | B7 | 57 | 61 | A6 | E4 | B8 | 52 | C7 | 84 | 0F | 8B | 41 | B7 | 57 |
| A0C0 | 5D | 35 | 06 | 44 | 44 | 44 | 44 | 84 | 0F | 8B | 41 | B7 | 57 | 5E | 10 | 8E |
| A0D0 | 57 | 55 | E6 | E4 | 8E | 50 | 4A | 3A | C6 | 10 | BD | 81 | 32 | 35 | B6 | 02 |
| A0E0 | 00 | 00 | 02 | 00 | 00 | 04 | 67 | 01 | 02 | 00 | 00 | 02 | 00 | 02 | 04 | 1F |
| A0F0 | 01 | 02 | 00 | 00 | 04 | 02 | 01 | 02 | 00 | 00 | 02 | 00 | 00 | B6 | 52 | C2 |
| A100 | 10 | 27 | 00 | B1 | 8E | 92 | 2C | BD | A2 | 7E | 10 | 25 | 00 | A7 | A6 | 01 |
| A110 | 81 | 09 | 23 | 01 | 4F | C6 | 03 | 3D | 10 | 8E | A0 | DF | 31 | AB | E6 | A4 |
| A120 | F7 | 5D | 86 | E6 | 21 | F7 | 5D | B0 | 86 | 39 | BD | 94 | BE | A6 | 22 | 10 |
| A130 | 27 | 00 | 7F | 81 | 01 | 27 | 0F | 8E | 91 | 13 | 10 | 8E | 50 | 67 | C6 | 08 |
| A140 | BD | 81 | 3D | 16 | 00 | 6C | F6 | 52 | 9A | 2B | 5C | C1 | 64 | 25 | 19 | 86 |
| A150 | 03 | B7 | 5D | 86 | 8E | 94 | 4F | 10 | 8E | 50 | 67 | C0 | 64 | 86 | 08 | 3D |
| A160 | 3A | C6 | 08 | BD | 81 | 3D | 20 | 4A | B6 | 52 | 9B | B1 | 5D | B0 | 23 | 06 |
| A170 | B6 | 52 | 9A | B7 | 52 | 9B | B6 | 5D | B0 | 81 | 02 | 26 | 12 | B6 | 52 | 9A |
| A180 | 8B | 31 | B7 | 50 | 67 | B6 | 52 | 9B | 8B | 31 | B7 | 50 | 6D | 20 | 10 | B6 |
| A190 | 52 | 9A | C6 | 1D | BD | C1 | 5B | B6 | 52 | 9B | C6 | 23 | BD | C1 | 5B | CC |
| A1A0 | 54 | 4F | FD | 50 | 6A | 20 | 0B | CC | 41 | 4C | FD | 50 | 67 | F7 | 50 | 69 |
| A1B0 | 20 | 00 | BD | A2 | B4 | B6 | 5D | 86 | BD | 95 | 3A | 81 | 01 | 27 | 22 | 81 |
| A1C0 | 03 | 10 | 27 | 00 | 7E | 81 | 04 | 10 | 27 | 00 | A0 | BD | 95 | 2A | 8E | 92 |
| A1D0 | 77 | BD | C0 | 54 | BD | EA | DA | BD | E9 | 1F | 10 | 25 | FD | 20 | 16 | FC |
| A1E0 | A0 | B6 | 5A | 7A | BD | DB | BE | B1 | 5A | 7A | 27 | 26 | C6 | FF | F7 | 52 |
| A1F0 | 9A | 81 | FE | 25 | 01 | 4F | B1 | 5A | 77 | 25 | 04 | B6 | 5A | 77 | 4A | B7 |
| A200 | 5A | 7A | B1 | 5A | 79 | 25 | 0C | B0 | 5A | 79 | B1 | 5A | 7B | 24 | 04 | 7C |
| A210 | 52 | C2 | 39 | 4F | F6 | 5A | 7A | 83 | 00 | 20 | 2A | 01 | 5F | 1F | 98 | 20 |
| A220 | 04 | 4F | B7 | 5A | 7A | B7 | 5A | 79 | BD | 94 | E3 | BD | DE | 91 | BD | E9 |
| A230 | 1F | 10 | 25 | FC | CC | 86 | 01 | B7 | 5D | DA | B7 | 52 | C2 | 86 | FF | B7 |
| A240 | 52 | 9A | 39 | B6 | 52 | 9A | BD | DB | BE | B1 | 52 | 9A | 27 | 1C | 7C | 52 |

-continued

| | | | | | | | | | | | | | | | | |
|---|---|---|---|---|---|---|---|---|---|---|---|---|---|---|---|---|
| A250 | C2 | 4D | 2A | 04 | 86 | FF | 20 | 08 | B1 | 5D | B0 | 23 | 03 | B6 | 5D | B0 |
| A260 | B7 | 52 | 9A | 81 | 63 | 22 | 03 | B7 | 52 | 9B | 39 | 8E | 52 | 9B | F6 | 5D |
| A270 | B0 | BD | 94 | 92 | 81 | 63 | 23 | 02 | 86 | 63 | B7 | 52 | 9B | 39 | BD | 95 |
| A280 | 06 | B6 | 52 | 90 | 27 | 1D | B6 | 5D | DA | 26 | 05 | 32 | 62 | 7E | A2 | 21 |
| A290 | B6 | 5A | 77 | 27 | 06 | BD | 94 | 6F | 1C | FE | 39 | 8E | 92 | 9E | BD | C0 |
| A2A0 | 4C | 20 | 0C | 4F | B7 | 5A | 7A | B7 | 5D | DA | 86 | FF | B7 | 52 | 9A | 86 |
| A2B0 | 01 | B7 | 5D | 86 | 8E | A2 | C0 | BD | C2 | 67 | BD | C0 | 99 | 1A | 01 | 39 |
| A2C0 | 18 | 03 | 4D | 02 | 1D | 03 | 23 | 03 | B6 | 52 | C2 | 27 | 15 | 86 | 02 | B7 |
| A2D0 | 5D | 86 | 8E | 92 | 46 | BD | A2 | 7E | 25 | 08 | 86 | 3B | BD | 94 | BE | BD |
| A2E0 | A2 | B4 | B6 | 5D | 86 | BD | 95 | 3A | 81 | 01 | 10 | 23 | FE | F3 | BD | 95 |
| A2F0 | 2A | 8E | 92 | 91 | BD | C0 | 54 | BD | E3 | C5 | 25 | 03 | BD | DE | 91 | BD |
| A300 | E9 | 1F | 10 | 25 | FB | FB | 16 | FB | 78 | B6 | 52 | C2 | 10 | 27 | 00 | 20 |
| A310 | 86 | 02 | B7 | 5D | 86 | 8E | 92 | 5D | BD | A2 | 7E | 25 | 13 | B6 | 5D | D3 |
| A320 | 43 | 84 | 01 | 8B | 41 | B7 | 50 | 60 | 86 | 3B | BD | 94 | BE | BD | A2 | B4 |
| A330 | B6 | 5D | 86 | BD | 95 | 3A | 81 | 01 | 10 | 23 | FE | A5 | BD | 95 | 2A | BD |
| A340 | C2 | F1 | BD | E0 | 12 | BD | E0 | 2E | BD | E3 | 53 | BD | E3 | 31 | 7F | 5D |
| A350 | DA | BD | E2 | 00 | 24 | 06 | BD | E3 | 3E | 7E | 9E | FB | 4D | 27 | 1D | BD |
| A360 | 9F | 49 | 24 | 09 | 7A | 52 | 90 | 7C | 52 | C2 | 7E | E3 | 3E | B6 | 5A | 7A |
| A370 | 34 | 02 | BD | 9F | 6A | 35 | 02 | B7 | 5A | 7A | 25 | DA | BD | E3 | 3E | BD |
| A380 | DE | 91 | 25 | D5 | BD | DF | BC | 25 | D0 | BD | E2 | 67 | BD | E3 | 3E | 16 |
| A390 | FF | 68 | B6 | 52 | C2 | 27 | 41 | BD | 94 | F3 | 8E | 93 | 4F | BD | C0 | 4C |
| A3A0 | CC | 2D | 2D | 7D | 52 | 87 | 2B | 06 | FD | 50 | 81 | FD | 50 | 83 | 7D | 52 |
| A3B0 | 88 | 2B | 06 | FD | 50 | 8B | FD | 50 | 8D | C6 | 3D | B6 | 52 | 87 | 84 | 0F |
| A3C0 | 4C | BD | C1 | 5B | C6 | 47 | B6 | 52 | 88 | 84 | 0F | 4C | BD | C1 | 5B | 8E |
| A3D0 | A4 | 2F | BD | C2 | 67 | BD | C0 | 99 | 86 | 04 | BD | 95 | 3A | 4A | 10 | 8E |
| A3E0 | 52 | 87 | 85 | 02 | 27 | 04 | 10 | 8E | 52 | 88 | 85 | 01 | 27 | 29 | A6 | A4 |
| A3F0 | 84 | 0F | 4C | 34 | 02 | BD | DB | B5 | A1 | E0 | 26 | 01 | 39 | 4A | 2B | 08 |
| A400 | 81 | 0F | 23 | 05 | 86 | 0F | 20 | 01 | 4F | 34 | 02 | A6 | A4 | 84 | 80 | AA |
| A410 | E0 | A7 | A4 | 7C | 52 | C2 | 39 | 86 | 01 | BD | DB | B5 | 81 | 01 | 27 | 0E |
| A420 | E6 | A4 | C4 | 0F | 4D | 2F | 02 | CA | 80 | E7 | A4 | 7C | 52 | C2 | 39 | 37 |
| A430 | 04 | 3D | 02 | 41 | 04 | 47 | 02 | B6 | 52 | C2 | 27 | 20 | BD | 94 | F3 | C6 |
| A440 | 3D | B6 | 52 | 89 | 84 | 80 | BD | BF | E2 | C6 | 47 | B6 | 52 | 8A | 84 | 80 |
| A450 | BD | BF | E2 | 8E | A4 | 8E | BD | C2 | 67 | BD | C0 | 99 | 86 | 02 | BD | 95 |
| A460 | 3A | 8E | D2 | 14 | 10 | 8E | 52 | 88 | 31 | A6 | 86 | 01 | BD | DB | B5 | 81 |
| A470 | 01 | 27 | 16 | 4D | 2F | 06 | A6 | 84 | AA | A4 | 20 | 05 | A6 | 84 | 43 | A4 |
| A480 | A4 | A7 | A4 | 7C | 52 | C2 | 1A | 01 | 39 | A6 | A4 | 1C | FE | 39 | 3D | 04 |
| A490 | 47 | 04 | B6 | 52 | C2 | 27 | 1B | 8E | 93 | 94 | BD | 95 | 0B | 10 | 8E | 52 |
| A4A0 | 8C | 8E | D2 | 19 | C6 | 35 | BD | AA | D9 | 8E | A8 | 56 | BD | C2 | 67 | BD |
| A4B0 | C0 | 99 | 86 | 08 | BD | 95 | 3A | 8E | D2 | 18 | 30 | 86 | BD | A4 | 6A | BD |
| A4C0 | D2 | B0 | B6 | 52 | 8C | 43 | B7 | 30 | 10 | 39 | 34 | 16 | 8E | 50 | 4A | 3A |
| A4D0 | 81 | 02 | 25 | 0A | CC | 54 | 48 | ED | 81 | CC | 52 | 55 | ED | 84 | 35 | 96 |
| A4E0 | B6 | 52 | C2 | 27 | 2A | BD | 94 | F3 | 8E | 93 | 6E | BD | C0 | 4C | C6 | 3D |
| A4F0 | B6 | 52 | 89 | 84 | 03 | BD | BF | E2 | 8D | D0 | C6 | 47 | B6 | 52 | 8A | 84 |
| A500 | 03 | BD | BF | E2 | 8D | C4 | 8E | A4 | 8E | BD | C2 | 67 | BD | C0 | 99 | 86 |
| A510 | 02 | BD | 95 | 3A | 8E | D2 | 0D | 10 | 8E | 52 | 88 | 31 | A6 | A6 | A4 | 84 |
| A520 | 03 | B7 | 5D | AF | BD | DB | B5 | B1 | 5D | AF | 26 | 01 | 39 | 4D | 2B | 08 |
| A530 | 81 | 02 | 23 | 05 | 86 | 02 | 20 | 01 | 4F | B7 | 5D | AF | A6 | A4 | 84 | FC |
| A540 | BA | 5D | AF | A7 | A4 | 7C | 52 | C2 | 39 | B6 | 52 | C2 | 27 | 30 | BD | 94 |
| A550 | F3 | 8E | 93 | 81 | BD | C0 | 4C | B6 | 52 | 8B | 84 | 03 | 81 | 03 | 26 | 01 |
| A560 | 4F | B7 | 52 | 8B | C6 | 3D | 84 | 01 | BD | BF | E2 | C6 | 47 | B6 | 52 | 8B |
| A570 | 84 | 02 | BD | BF | E2 | 8E | A4 | 8E | BD | C2 | 67 | BD | C0 | 99 | 86 | 02 |
| A580 | BD | 95 | 3A | 8E | D2 | 0C | 30 | 86 | 86 | 01 | BD | DB | B5 | 81 | 01 | 26 |
| A590 | 01 | 39 | 4D | 2F | 04 | A6 | 84 | 20 | 01 | 4F | B7 | 52 | 8B | 7C | 52 | C2 |
| A5A0 | 7E | D2 | DF | B6 | 52 | C2 | 27 | 1C | 8E | 91 | 82 | BD | 95 | 06 | B6 | 5D |
| A5B0 | D3 | 84 | 01 | B7 | 5D | D3 | 8B | 41 | B7 | 50 | 6A | 8E | A6 | 14 | BD | C2 |
| A5C0 | 67 | BD | C0 | 99 | 86 | 02 | BD | 95 | 3A | 81 | 01 | 27 | 3D | BD | 95 | 2A |
| A5D0 | 4F | B7 | 5A | 79 | B7 | 52 | 90 | BD | 94 | E3 | BD | DE | 91 | BD | E9 | 1F |
| A5E0 | 10 | 25 | F9 | 1D | 8E | 91 | 5C | BD | C0 | 4C | B6 | 5A | 77 | C6 | 28 | BD |
| A5F0 | C1 | 5B | B6 | 5A | 7C | C6 | 0A | 3D | 34 | 04 | B6 | 5A | 7D | C6 | 0A | 3D |
| A600 | AB | E0 | C6 | 3B | BD | C1 | 5B | 16 | E4 | 26 | 10 | 8E | 5D | D3 | 8E | D2 |
| A610 | 0D | 16 | FE | 56 | 20 | 01 | 4D | 02 | B6 | 52 | C2 | 27 | 2A | 8E | 91 | EB |
| A620 | BD | 95 | 06 | B6 | 5D | D3 | 84 | 01 | 8B | 41 | B7 | 50 | 6C | B6 | 5D | AF |
| A630 | 2B | 04 | 81 | 20 | 24 | 02 | 86 | 20 | B7 | 5D | AF | B7 | 50 | 8E | 8E | A6 |
| A640 | 93 | BD | C2 | 67 | BD | C0 | 99 | 86 | 01 | F6 | 5D | AF | C1 | 52 | 26 | 02 |
| A650 | 86 | 02 | BD | 95 | 3A | 81 | 01 | 27 | 28 | BD | 95 | 2A | 7F | 5D | AF | BD |
| A660 | E7 | 3C | BD | E9 | 1F | 10 | 25 | F8 | 95 | 8E | 8E | 99 | B6 | 50 | 1A | 10 |
| A670 | 27 | E3 | C5 | 8E | 93 | 16 | BD | C0 | 24 | C6 | 12 | BD | C1 | 5B | 16 | E3 |
| A680 | AF | B6 | 5D | AF | BD | DB | A4 | B1 | 5D | AF | 27 | 06 | 7C | 52 | C2 | B7 |
| A690 | 5D | AF | 39 | 44 | 01 | 4D | 02 | A7 | 3B | A7 | C4 | A7 | 6F | A8 | 2C | A8 |
| A6A0 | 7D | A8 | BD | A9 | A6 | AA | 23 | A8 | 66 | A9 | 5E | AA | 68 | AA | 70 | A9 |
| A6B0 | C1 | A9 | CF | 96 | E1 | 34 | 36 | 20 | 05 | 34 | 36 | BD | C0 | 78 | 5F | B6 |
| A6C0 | 52 | 91 | BD | C1 | 5B | CC | 50 | 31 | FD | 50 | 70 | B6 | 52 | 92 | 26 | 06 |
| A6D0 | CC | 00 | 02 | BD | C2 | 8F | 35 | B6 | 34 | 36 | 8E | 50 | 4A | 3A | 10 | 8E |
| A6E0 | AA | FC | C6 | 06 | BD | 81 | 32 | E6 | 61 | CB | 07 | B6 | 52 | 99 | BD | C1 |
| A6F0 | 5B | 86 | 3D | A7 | 04 | 10 | 8E | 50 | 00 | 30 | 06 | C6 | 10 | BD | 81 | 32 |
| A700 | 35 | B6 | 34 | 02 | B1 | 52 | 92 | 25 | 19 | BD | DC | 8E | 26 | 08 | B6 | 52 |
| A710 | 92 | 27 | 18 | 32 | 61 | 39 | BB | 52 | 92 | 2A | 01 | 4F | A1 | E4 | 23 | 02 |
| A720 | A6 | E4 | B7 | 52 | 92 | 7C | 52 | C2 | 32 | 63 | 39 | B6 | 52 | 91 | BD | DB |
| A730 | B5 | B1 | 52 | 91 | 27 | F2 | B7 | 52 | 91 | 20 | EA | B6 | 52 | C2 | 27 | 1D |
| A740 | 8E | 80 | F9 | BD | C0 | 78 | 8E | AB | 09 | BD | C0 | 4C | BD | A6 | B5 | C6 |
| A750 | 2F | BD | A6 | D8 | 8E | A7 | 6B | BD | C2 | 67 | BD | C0 | 99 | 86 | 02 | BD |
| A760 | A7 | 02 | 81 | 01 | 10 | 27 | EE | 22 | 16 | EE | 0E | 26 | 02 | 36 | 02 | 7D |

-continued

| | | | | | | | | | | | | | | | | |
|---|---|---|---|---|---|---|---|---|---|---|---|---|---|---|---|---|
| A770 | 52 | C2 | 27 | 14 | 8E | AA | F3 | BD | A6 | B9 | C6 | 28 | BD | A6 | D8 | 8E |
| A780 | A7 | A4 | BD | C2 | 67 | BD | C0 | 99 | 86 | 10 | BD | A7 | 02 | 8E | 4F | FF |
| A790 | 30 | 86 | A6 | 84 | BD | DB | A4 | A1 | 84 | 27 | 08 | A7 | 84 | B7 | 52 | C2 |
| A7A0 | B7 | 5D | C2 | 39 | 98 | 01 | 99 | 01 | 9A | 01 | 9B | 01 | 9C | 01 | 9D | 01 |
| A7B0 | 9E | 01 | 9F | 01 | A0 | 01 | A1 | 01 | A2 | 01 | A3 | 01 | A4 | 01 | A5 | 01 |
| A7C0 | A6 | 01 | A7 | 01 | 7D | 52 | C2 | 27 | 21 | 8E | AB | 10 | BD | A6 | B9 | 8E |
| A7D0 | A8 | 28 | BD | C2 | 67 | C6 | 2B | B6 | 50 | 10 | 2A | 03 | 40 | C6 | 2D | F7 |
| A7E0 | 50 | 83 | C6 | 3B | BD | C1 | 5B | BD | C0 | 99 | 86 | 02 | BD | A7 | 02 | 81 |
| A7F0 | 01 | 27 | 12 | 4F | BD | DB | B5 | 4D | 26 | 01 | 39 | B7 | 52 | C2 | B7 | 5D |
| A800 | C2 | 70 | 50 | 10 | 39 | 8E | 50 | 10 | A6 | 84 | BD | DB | BE | A1 | 84 | 27 |
| A810 | 16 | 81 | 30 | 2F | 02 | 86 | 30 | 81 | D0 | 2C | 02 | 86 | D0 | A7 | 84 | 86 |
| A820 | 01 | B7 | 5D | C2 | B7 | 52 | C2 | 39 | 3B | 02 | 39 | 01 | 10 | 8E | 50 | 14 |
| A830 | B6 | 52 | C2 | 27 | 17 | 8E | AB | 29 | BD | A6 | B9 | 8E | D2 | 19 | C6 | 35 |
| A840 | BD | AA | D9 | 8E | A8 | 56 | BD | C2 | 67 | BD | C0 | 99 | 86 | 08 | BD | A7 |
| A850 | 02 | 8E | D2 | 18 | 20 | 4F | 35 | 02 | 38 | 02 | 3B | 02 | 3E | 02 | 41 | 02 |
| A860 | 44 | 02 | 47 | 02 | 4A | 02 | 10 | 8E | 50 | 15 | B6 | 52 | C2 | 27 | 23 | 8E |
| A870 | AB | BD | BD | A6 | B9 | 8E | AB | FA | BD | C0 | 4C | 20 | 0F | 10 | 8E | 50 |
| A880 | 13 | B6 | 52 | C2 | 27 | 17 | 8E | AB | BD | BD | A6 | B9 | 8E | D2 | 0D | C6 |
| A890 | 35 | BD | AA | D9 | 8E | A8 | 56 | BD | C2 | 67 | BD | C0 | 99 | 86 | 08 | BD |
| A8A0 | A7 | 02 | 8E | D2 | 0C | 30 | 86 | BD | A4 | 6A | 24 | 10 | 86 | 01 | B7 | 5D |
| A8B0 | C2 | 10 | 8C | 50 | 13 | 26 | 05 | A6 | A4 | B7 | 5D | 88 | 39 | B6 | 52 | C2 |
| A8C0 | 10 | 27 | 00 | 7C | 8E | AB | 5A | BD | A6 | B9 | 8E | AB | 77 | BD | C0 | 4C |
| A8D0 | B6 | 50 | 11 | 2A | 01 | 4F | 81 | 62 | 23 | 02 | 86 | 62 | B7 | 50 | 11 | B6 |
| A8E0 | 50 | 12 | 81 | 01 | 2C | 02 | 86 | 01 | 81 | 63 | 23 | 02 | 86 | 63 | B7 | 50 |
| A8F0 | 12 | B1 | 50 | 11 | 22 | 1F | 26 | 06 | 4C | B7 | 50 | 12 | 20 | 17 | F6 | 52 |
| A900 | 92 | 27 | 09 | C1 | 01 | 27 | 01 | 5F | 5C | F7 | 52 | 92 | F6 | 50 | 11 | F7 |
| A910 | 50 | 12 | B7 | 50 | 11 | C6 | 37 | B6 | 50 | 11 | BD | C1 | 5B | 81 | 0A | 22 |
| A920 | 05 | 86 | 21 | B7 | 50 | 84 | C6 | 49 | B6 | 50 | 12 | BD | C1 | 5B | 81 | 0F |
| A930 | 22 | 05 | 86 | 21 | B7 | 50 | 96 | 8E | A9 | 5A | BD | C2 | 67 | BD | C0 | 99 |
| A940 | 86 | 02 | BD | A7 | 02 | 8E | 50 | 10 | 30 | 86 | C6 | 63 | BD | 94 | 92 | 24 |
| A950 | 08 | 86 | 01 | B7 | 52 | C2 | B7 | 5D | C2 | 39 | 37 | 02 | 49 | 02 | B6 | 52 |
| A960 | C2 | 27 | 28 | 8E | AC | 8D | BD | A6 | B9 | B6 | 50 | 17 | C6 | 50 | 85 | 08 |
| A970 | 27 | 02 | C6 | 4D | F7 | 50 | 8D | C6 | 50 | 85 | 10 | 27 | 02 | C6 | 4D | F7 |
| A980 | 50 | 93 | 8E | A9 | A2 | BD | C2 | 67 | BD | C0 | 99 | 86 | 02 | BD | A7 | 02 |
| A990 | 81 | 01 | 26 | 07 | 10 | 8E | D2 | 10 | 16 | 00 | 5B | 10 | 8E | D2 | 11 | 16 |
| A9A0 | 00 | 54 | 43 | 01 | 49 | 01 | 10 | 8E | D2 | 14 | B6 | 52 | C2 | 10 | 27 | 00 |
| A9B0 | 40 | 8E | AB | 9B | BD | A6 | B9 | B6 | 52 | 99 | C6 | 0C | BD | C1 | 5B | 20 |
| A9C0 | 1D | 10 | 8E | D2 | 13 | B6 | 52 | C2 | 27 | 27 | 8E | AC | 05 | 20 | 0C | 10 |
| A9D0 | 8E | D2 | 12 | B6 | 52 | C2 | 27 | 19 | 8E | AC | 26 | BD | A6 | B9 | B6 | 50 |
| A9E0 | 17 | A4 | A4 | C6 | 39 | BD | BF | E2 | 8E | AA | 21 | BD | C2 | 67 | BD | C0 |
| A9F0 | 99 | 86 | 01 | BD | A7 | 02 | 1F | 21 | 10 | 8E | 50 | 17 | BD | A4 | 6A | 24 |
| AA00 | 1F | A6 | 84 | 81 | 80 | 10 | 26 | FF | 48 | B4 | 50 | 17 | BA | 5D | C2 | B7 |
| AA10 | 5D | C2 | B6 | 52 | 99 | BD | 8B | 98 | A6 | A8 | 17 | 84 | 7F | A7 | A8 | 17 |
| AA20 | 39 | 39 | 93 | B6 | 52 | C2 | 27 | 2B | 8E | AB | BD | BD | A6 | B9 | 8E | AB |
| AA30 | ED | BD | C0 | 4C | C6 | 35 | 4F | BD | 8B | FB | 96 | 3B | 4C | BD | C1 | 5B |
| AA40 | CB | 03 | B6 | 52 | 83 | 4C | 81 | 07 | 23 | ED | 8E | A8 | 56 | BD | C2 | 67 |
| AA50 | BD | C0 | 99 | 86 | 08 | BD | A7 | 02 | 4A | BD | 8B | FB | F6 | 5D | 83 | D4 |
| AA60 | 6C | 10 | 27 | 06 | 87 | 7E | DB | BE | 86 | 31 | 10 | 8E | AA | C9 | 20 | 06 |
| AA70 | 86 | 32 | 10 | 8E | AA | CD | 7D | 52 | C2 | 27 | 3A | 8E | AC | 43 | BD | A6 |
| AA80 | B9 | B7 | 50 | 58 | B6 | 50 | 16 | C6 | 21 | A4 | A4 | BD | BF | E2 | B6 | 50 |
| AA90 | 16 | C6 | 30 | A4 | 21 | BD | BF | E2 | B6 | 50 | 16 | C6 | 4D | A4 | 23 | BD |
| AAA0 | BF | E2 | B6 | 50 | 16 | C6 | 40 | A4 | 22 | BD | BF | E2 | 8E | AA | D1 | BD |
| AAB0 | C2 | 67 | BD | C0 | 99 | 86 | 04 | BD | A7 | 02 | 4A | 30 | A6 | 10 | 8E | 50 |
| AAC0 | 16 | BD | A4 | 6A | 10 | 25 | FE | 89 | 39 | 01 | 02 | 08 | 04 | 10 | 20 | 80 |
| AAD0 | 40 | 21 | 03 | 30 | 03 | 40 | 03 | 4D | 03 | 34 | 16 | 86 | 08 | 34 | 02 | A6 |
| AAE0 | A4 | A4 | 80 | BD | BF | C7 | CB | 03 | A6 | E4 | 4A | A7 | E4 | 26 | F0 | 32 |
| AAF0 | 61 | 35 | 96 | 20 | 20 | 20 | 20 | 20 | 20 | 20 | 20 | 20 | 47 | 4C | 4F | 42 |
| AB00 | 41 | 4C | 20 | 4E | 41 | 4D | 45 | 3A | FF | 20 | 20 | 45 | 44 | 49 | 54 | FF |
| AB10 | 20 | 20 | 20 | 20 | 20 | 20 | 20 | 47 | 4C | 4F | 42 | 41 | 4C | 20 | 54 | 52 |
| AB20 | 41 | 4E | 53 | 50 | 4F | 53 | 45 | 3A | FF | 4D | 49 | 44 | 49 | 20 | 4F | 55 |
| AB30 | 54 | 20 | 20 | 41 | 31 | 20 | 41 | 32 | 20 | 42 | 31 | 20 | 42 | 32 | 20 | 43 |
| AB40 | 31 | 20 | 43 | 32 | 20 | 44 | 31 | 20 | 44 | 32 | 20 | 20 | 50 | 31 | 20 | 20 |
| AB50 | 20 | 45 | 4E | 41 | 42 | 4C | 45 | 53 | 3A | FF | 20 | 20 | 20 | 20 | 20 | 20 |
| AB60 | 20 | 4B | 45 | 59 | 20 | 41 | 43 | 54 | 49 | 4F | 4E | 20 | 54 | 48 | 52 | 45 |
| AB70 | 53 | 48 | 4F | 4C | 44 | 53 | FF | 20 | 20 | 20 | 20 | 4E | 4F | 54 | 45 | 2D |
| AB80 | 4F | 46 | 46 | 20 | 3D | 20 | 30 | 30 | 20 | 20 | 20 | 20 | 20 | 20 | 4E | 4F |
| AB90 | 54 | 45 | 2D | 4F | 4E | 20 | 3D | 20 | 30 | 30 | FF | 20 | 20 | 47 | 4C | 4F |
| ABA0 | 42 | 41 | 4C | 20 | 20 | 20 | 20 | 4D | 45 | 4D | 4F | 52 | 59 | 20 | 50 | 52 |
| ABB0 | 4F | 54 | 45 | 43 | 54 | 20 | 53 | 54 | 41 | 54 | 55 | 53 | FF | 4F | 50 | 45 |
| ABC0 | 52 | 41 | 54 | 4F | 52 | 20 | 20 | 20 | 31 | 20 | 20 | 32 | 20 | 20 | 33 | 20 |
| ABD0 | 20 | 34 | 20 | 20 | 35 | 20 | 20 | 36 | 20 | 20 | 37 | 20 | 20 | 38 | 20 | 20 |
| ABE0 | 50 | 31 | 20 | 20 | 20 | 57 | 41 | 4B | 45 | 20 | 55 | 50 | FF | 4D | 49 | 44 |
| ABF0 | 49 | 20 | 43 | 48 | 41 | 4E | 4E | 45 | 4C | FF | 4C | 4F | 43 | 41 | 4C | 20 |
| AC00 | 4D | 4F | 44 | 45 | FF | 20 | 20 | 20 | 20 | 4F | 50 | 45 | 52 | 41 | 54 | 4F |
| AC10 | 52 | 20 | 53 | 55 | 53 | 54 | 41 | 49 | 4E | 20 | 48 | 4F | 4C | 44 | 20 | 4F |
| AC20 | 50 | 54 | 49 | 4F | 4E | FF | 20 | 20 | 20 | 20 | 20 | 20 | 4D | 49 | 44 | 49 |
| AC30 | 20 | 43 | 4F | 4E | 54 | 52 | 4F | 4C | 4C | 45 | 52 | 20 | 4F | 55 | 54 | 50 |
| AC40 | 55 | 54 | FF | 4D | 49 | 44 | 49 | 20 | 49 | 4E | 50 | 55 | 54 | 20 | 32 | 20 |
| AC50 | 45 | 4E | 41 | 42 | 4C | 45 | 53 | 3A | 20 | 4E | 4F | 54 | 45 | 53 | 20 | 3D |
| AC60 | 20 | 20 | 20 | 20 | 20 | 20 | 50 | 31 | 43 | 54 | 52 | 4C | 53 | 20 | 3D | 20 |
| AC70 | 20 | 20 | 20 | 20 | 20 | 50 | 52 | 45 | 53 | 53 | 55 | 52 | 45 | 20 | 3D | 20 |
| AC80 | 20 | 20 | 20 | 20 | 20 | 46 | 41 | 2D | 46 | 43 | 20 | 3D | FF | 53 | 45 | 4C |

-continued

| | | | | | | | | | | | | | | | | |
|---|---|---|---|---|---|---|---|---|---|---|---|---|---|---|---|---|
| AC90 | 45 | 43 | 54 | 20 | 4D | 49 | 44 | 49 | 20 | 49 | 4E | 50 | 55 | 54 | 20 | 20 |
| ACA0 | 20 | 20 | 20 | 20 | 20 | 31 | 20 | 20 | 20 | 20 | 20 | 32 | 20 | 20 | 20 | 20 |
| ACB0 | 50 | 31 | 4F | 50 | 45 | 52 | 41 | 54 | 4F | 52 | 20 | 41 | 53 | 53 | 49 | 47 |
| ACC0 | 4E | 4D | 45 | 4E | 54 | 20 | 4D | 4F | 44 | 45 | 3A | FF | AD | C5 | AE | 2D |
| ACD0 | B2 | C6 | AF | 90 | B0 | BA | B1 | 00 | B1 | 99 | B2 | 30 | B2 | 81 | B2 | FE |
| ACE0 | B4 | 6D | B4 | D0 | B3 | 8E | B5 | 89 | B6 | 3C | B6 | 42 | B6 | 48 | B6 | 4E |
| ACF0 | B5 | E3 | B6 | 54 | B6 | 5A | B5 | 19 | B6 | 2A | B6 | 30 | B6 | 36 | B1 | 4D |
| AD00 | 96 | E1 | C6 | 07 | 34 | 04 | A6 | 84 | 4C | BD | DB | B5 | 4A | A1 | 84 | 27 |
| AD10 | 0F | 4D | 2A | 01 | 4F | A1 | E4 | 23 | 02 | A6 | E4 | A7 | 84 | 7C | 52 | C2 |
| AD20 | 35 | 84 | C6 | 42 | 34 | 36 | C6 | 09 | 20 | 06 | C6 | 48 | 34 | 36 | C6 | 03 |
| AD30 | 10 | 8E | 50 | 4C | 8E | B7 | 43 | BD | 81 | 3D | CC | 20 | 31 | FB | 52 | 95 |
| AD40 | ED | A1 | A7 | A0 | EC | E4 | AE | 62 | BD | C0 | 85 | 20 | 02 | 34 | 36 | 5F |
| AD50 | B6 | 52 | 93 | BD | C1 | 5B | CC | 50 | 32 | FD | 50 | 70 | B6 | 52 | 94 | 26 |
| AD60 | 06 | CC | 00 | 02 | BD | C2 | 8F | 35 | B6 | 34 | 36 | 8E | 50 | 4A | 3A | 10 |
| AD70 | 9E | 64 | 31 | A9 | 00 | 00 | C6 | 0A | BD | 81 | 32 | 35 | B6 | 34 | 02 | B1 |
| AD80 | 52 | 94 | 25 | 19 | BD | DC | 8E | 26 | 08 | B6 | 52 | 94 | 27 | 18 | 32 | 61 |
| AD90 | 39 | BB | 52 | 94 | 2A | 01 | 4F | A1 | E4 | 23 | 02 | A6 | E4 | B7 | 52 | 94 |
| ADA0 | 7C | 52 | C2 | 32 | 63 | 39 | B6 | 52 | 93 | BD | DB | B5 | B1 | 52 | 93 | 27 |
| ADB0 | F2 | B7 | 52 | 93 | 20 | EA | 34 | 06 | F6 | 5D | 83 | D4 | 6C | 27 | 01 | 4F |
| ADC0 | B7 | 5D | 86 | 35 | 86 | B6 | 52 | C2 | 27 | 2A | 8E | 80 | F9 | BD | C0 | 78 |
| ADD0 | 8E | B7 | 39 | BD | C0 | 4C | BD | AD | 4D | F6 | 52 | 95 | CB | 31 | F7 | 50 |
| ADE0 | 87 | C6 | 41 | BD | AD | 69 | 86 | 3D | B7 | 50 | 89 | 8E | AE | 0E | BD | C2 |
| ADF0 | 67 | BD | C0 | 99 | 86 | 02 | BD | AD | 7D | 81 | 01 | 10 | 27 | E7 | 8B | 8E |
| AE00 | 52 | 95 | BD | AD | 02 | 8E | D2 | 0D | A6 | 86 | B7 | 5D | 89 | 39 | 26 | 02 |
| AE10 | 3D | 01 | 8E | 67 | 00 | 34 | 16 | BD | CC | 04 | C6 | 10 | A6 | 80 | 81 | 20 |
| AE20 | 2D | 07 | 5A | 26 | F7 | 1C | FE | 35 | 96 | 1A | 01 | 35 | 96 | 86 | 0C | BD |
| AE30 | AD | B6 | 7D | 52 | C2 | 10 | 27 | 00 | 77 | 8E | B7 | 4D | BD | AD | 22 | C6 |
| AE40 | 18 | BD | AD | 69 | B6 | 52 | 94 | 81 | 02 | 26 | 35 | 8E | B7 | 58 | BD | C0 |
| AE50 | 4C | BD | BF | F4 | BD | AE | 12 | 25 | 14 | 10 | 8E | 50 | 82 | C6 | 10 | BD |
| AE60 | 81 | 55 | 96 | 13 | 84 | 7F | C6 | 49 | BD | C1 | 5B | 20 | 3A | C6 | 03 | B6 |
| AE70 | 52 | 94 | B1 | 5D | AF | 22 | 02 | C6 | 01 | F7 | 52 | 94 | F7 | 52 | C2 | 39 |
| AE80 | 8E | B7 | 88 | BD | C0 | 4C | BD | AE | 12 | 25 | 0D | 8E | 50 | 96 | CC | 3C |
| AE90 | 4E | ED | 81 | CC | 46 | 3E | ED | 84 | C6 | 40 | 96 | 13 | 2B | 05 | BD | C1 |
| AEA0 | 5B | 20 | 04 | 4F | BD | BF | E2 | 8E | AF | 78 | BD | C2 | 67 | BD | C0 | 99 |
| AEB0 | B6 | 52 | 94 | B7 | 5D | AF | B6 | 5D | 86 | DB | AD | 7D | 81 | 02 | 10 | 27 |
| AEC0 | 00 | 41 | 81 | 01 | 26 | 1E | 96 | 13 | BD | DB | BE | 91 | 13 | 27 | 33 | 4D |
| AED0 | 2A | 0A | 81 | C0 | 22 | 04 | 86 | 80 | 20 | 02 | 86 | FF | 97 | 13 | 86 | 01 |
| AEE0 | 97 | 7C | 20 | 14 | 1F | 89 | 4F | D3 | 64 | CB | FD | 1F | 01 | A6 | 84 | BD |
| AEF0 | BD | A4 | A1 | 84 | 27 | 0C | A7 | 84 | 96 | 6C | B7 | 52 | C2 | 97 | 22 | B7 |
| AF00 | 5D | C2 | 39 | BD | 95 | 2A | BD | C2 | F1 | 8E | B7 | 68 | BD | C0 | 54 | BD |
| AF10 | C0 | 9C | 7F | 5D | C4 | 8E | 6E | 00 | BF | 5D | C9 | FC | 67 | 10 | C3 | 6E |
| AF20 | 00 | FD | 5D | AF | 10 | 8E | 67 | 13 | 96 | 13 | 84 | 7F | 1F | 89 | BD | 8D |
| AF30 | AB | BD | E6 | F5 | FC | 5D | C9 | 10 | B3 | 5D | AF | 24 | 1D | B6 | 5D | C4 |
| AF40 | 26 | 18 | FC | 52 | C6 | 10 | 83 | 05 | 16 | 24 | 0F | C4 | 07 | 26 | E5 | 7C |
| AF50 | 52 | C7 | BD | D5 | D8 | BD | C6 | A7 | 20 | DA | 10 | 8E | 67 | 00 | 4F | E6 |
| AF60 | A8 | 12 | 31 | AB | 8E | 6E | 00 | AD | A4 | 10 | 9E | 64 | 31 | A9 | 00 | 00 |
| AF70 | C6 | 0A | BD | 81 | 55 | 16 | FF | 80 | 40 | 03 | 4D | 02 | 7C | 01 | 7D | 01 |
| AF80 | 7E | 01 | 7F | 01 | 80 | 01 | 81 | 01 | 82 | 01 | 83 | 01 | 84 | 01 | 85 | 01 |
| AF90 | 86 | 04 | BD | AD | B6 | B6 | 52 | C2 | 10 | 27 | 00 | 88 | 8E | B7 | A0 | BD |
| AFA0 | AD | 22 | 86 | 70 | BD | 8B | 98 | 96 | 1E | 84 | 1F | B7 | 52 | 9E | C6 | 23 |
| AFB0 | BD | C1 | 5B | B6 | 52 | 94 | 81 | 04 | 26 | 18 | 8E | B7 | F8 | BD | C0 | 4C |
| AFC0 | 96 | 1F | 2B | 57 | 8E | B8 | 1D | 10 | 8E | 50 | 83 | C6 | 06 | BD | 81 | 3D |
| AFD0 | 20 | 49 | 96 | 20 | 84 | 7F | C6 | 3A | BD | C1 | 5B | 96 | 1F | 84 | 7F | C6 |
| AFE0 | 44 | BD | C1 | 5B | 96 | 1F | 2B | 0C | 8E | B8 | 1D | 10 | 8E | 50 | 93 | C6 |
| AFF0 | 06 | BD | 81 | 3D | 96 | 1E | 85 | 20 | 27 | 08 | CC | 2D | 2D | FD | 50 | 6D |
| B000 | 20 | 19 | 86 | 70 | BD | 8B | 98 | B6 | 52 | 9E | C6 | 18 | 3D | 31 | AB | 10 |
| B010 | BF | 5D | B1 | 8E | 50 | 72 | C6 | 0A | BD | 81 | 48 | 8E | B0 | B2 | BD | C2 |
| B020 | 67 | BD | C0 | 99 | B6 | 5D | 86 | BD | AD | 7D | 81 | 01 | 27 | 24 | 81 | 02 |
| B030 | 27 | 50 | 81 | 03 | 27 | 50 | 86 | 01 | BD | DB | B5 | 81 | 01 | 26 | 01 | 39 |
| B040 | 4D | 2F | 06 | 96 | 1F | 8A | 80 | 20 | 04 | 96 | 1F | 84 | 7F | 97 | 1F | 16 |
| B050 | FE | 8C | 96 | 1E | 84 | 3F | 85 | 20 | 27 | 02 | 86 | FF | 34 | 02 | BD | DB |
| B060 | B5 | A1 | E0 | 26 | 01 | 39 | 4D | 2B | 11 | 81 | 1F | 22 | 11 | 34 | 02 | 96 |
| B070 | 1E | 84 | C0 | AA | E0 | 97 | 1E | 16 | FE | 64 | 86 | 3F | 20 | EF | 86 | 1F |
| B080 | 20 | EB | C6 | 20 | 20 | 02 | C6 | 1F | BD | B4 | 26 | A6 | 84 | 84 | 7F | 34 |
| B090 | 02 | BD | DB | BE | A1 | E0 | 26 | 01 | 39 | 4D | 2A | 09 | 81 | C0 | 22 | 04 |
| B0A0 | 86 | 7F | 20 | 01 | 4F | 34 | 02 | A6 | 84 | 84 | 80 | AA | E0 | A7 | 84 | 16 |
| B0B0 | FE | 2C | 23 | 02 | 3A | 03 | 44 | 03 | 39 | 06 | 86 | 01 | BD | AD | B6 | B6 |
| B0C0 | 52 | C2 | 27 | 22 | 8E | B7 | 56 | BD | AD | 22 | 8E | B8 | 23 | BD | C0 | 4C |
| B0D0 | C6 | 18 | BD | AD | 69 | C6 | 47 | 96 | 3B | 4C | BD | C1 | 5B | 8E | B0 | FE |
| B0E0 | BD | C2 | 67 | BD | C0 | 99 | B6 | 5D | 86 | BD | AD | 7D | C6 | 3B | BD | B4 |
| B0F0 | 26 | C6 | 0F | BD | AD | 04 | 7D | 52 | C2 | 10 | 26 | FD | FB | 39 | 47 | 02 |
| B100 | 86 | 04 | BD | AD | B6 | B6 | 52 | C2 | 27 | 22 | 8E | B8 | 42 | BD | AD | 2A |
| B110 | C6 | 3F | 8E | D2 | 0D | 96 | 0A | A4 | 80 | BD | BF | C7 | CB | 03 | 8C | D2 |
| B120 | 10 | 23 | F2 | 8E | B1 | 45 | BD | C2 | 67 | BD | C0 | 99 | B6 | 5D | 86 | BD |
| B130 | AD | 7D | 4A | 8E | D2 | 0D | 30 | 86 | C6 | 0A | BD | B4 | 2F | BD | A4 | 6A |
| B140 | 10 | 25 | FD | B4 | 39 | 3F | 02 | 42 | 02 | 45 | 02 | 48 | 02 | 86 | 02 | BD |
| B150 | AD | B6 | B6 | 52 | C2 | 27 | 21 | 8E | B8 | 72 | BD | AD | 22 | C6 | 35 | 96 |
| B160 | 1E | 84 | 80 | BD | BF | E2 | C6 | 4B | 96 | 1E | 84 | 40 | BD | BF | E2 | 8E |
| B170 | B1 | 95 | BD | C2 | 67 | BD | C0 | 99 | B6 | 5D | 86 | BD | AD | 7D | 8E | D2 |
| B180 | 14 | 81 | 01 | 27 | 03 | 8E | D2 | 13 | C6 | 1E | BD | B4 | 2F | BD | A4 | 6A |
| B190 | 10 | 25 | FD | 64 | 39 | 35 | 03 | 4B | 03 | 86 | 03 | BD | AD | B6 | B6 | 52 |
| B1A0 | C2 | 27 | 40 | 8E | B8 | AF | BD | AD | 22 | C6 | 3E | 96 | 0C | 4C | BD | C1 |

-continued

| | | | | | | | | | | | | | | | | |
|---|---|---|---|---|---|---|---|---|---|---|---|---|---|---|---|---|
| B1B0 | 5B | C6 | 4B | 96 | 0B | 4C | BD | C1 | 5B | B6 | 52 | 94 | 27 | 22 | 8E | B8 |
| B1C0 | EC | 10 | 8E | 50 | 72 | C6 | 0E | BD | 81 | 3D | 8E | B2 | 2A | BD | C2 | 67 |
| B1D0 | B6 | 52 | 94 | 81 | 02 | 25 | 09 | CC | 01 | 01 | FD | 50 | D8 | FD | 50 | E5 |
| B1E0 | BD | C0 | 99 | B6 | 52 | 94 | 26 | 06 | B6 | 5D | 86 | BD | AD | 7D | 8E | 5B |
| B1F0 | 4D | 5F | A6 | 85 | 81 | 10 | 24 | 06 | 5C | C1 | 57 | 23 | F5 | 39 | 80 | 10 |
| B200 | A7 | 85 | B6 | 52 | 94 | 81 | 01 | 27 | 0B | D7 | 0B | 7F | 52 | 94 | D1 | 0C |
| B210 | 25 | 09 | 20 | 0D | D7 | 0C | 7C | 52 | 94 | 20 | 0C | 96 | 0C | 97 | 0B | D7 |
| B220 | 0C | BD | 8C | 53 | BD | 8A | B8 | 16 | FC | CE | 29 | 0C | 29 | 0C | 29 | 0C |
| B230 | 86 | 02 | BD | AD | B6 | B6 | 52 | C2 | 27 | 20 | 8E | B8 | FA | BD | AD | 22 |
| B240 | C6 | 2B | 96 | 12 | 2A | 03 | 40 | C6 | 2D | F7 | 50 | 83 | C6 | 3B | BD | C1 |
| B250 | 5B | 8E | A8 | 28 | BD | C2 | 67 | BD | C0 | 99 | B6 | 5D | 86 | BD | AD | 7D |
| B260 | 81 | 01 | 27 | 0D | 4F | BD | DB | B5 | 4D | 26 | 01 | 39 | 00 | 12 | 16 | FC |
| B270 | 87 | C6 | 12 | BD | B4 | 26 | BD | A8 | 08 | 7D | 52 | 2C | 10 | 26 | FC | 78 |
| B280 | 39 | 86 | 01 | BD | AD | B6 | B6 | 52 | C2 | 27 | 1C | 8E | B9 | 06 | BD | AD |
| E290 | 22 | C6 | 1F | 96 | 78 | 84 | 01 | 97 | 78 | 88 | 01 | BD | BF | E2 | 8E | B2 |
| B2A0 | C4 | BD | C2 | 67 | BD | C0 | 99 | B6 | 5D | 86 | BD | AD | 7D | C6 | 78 | BD |
| B2B0 | B4 | 2F | 8E | D2 | 0D | BD | A4 | 6A | 24 | 09 | A6 | A4 | 88 | 01 | A7 | A4 |
| B2C0 | 16 | FC | 35 | 39 | 1F | 03 | 86 | 01 | BD | AD | B6 | B6 | 52 | C2 | 27 | 18 |
| B2D0 | 8E | B7 | E3 | BD | AD | 22 | C6 | 39 | 96 | 20 | 84 | 80 | BD | BF | E2 | 8E |
| B2E0 | AA | 21 | BD | C2 | C7 | BD | C0 | 99 | B6 | 5D | 86 | BD | AD | 7D | C6 | 20 |
| B2F0 | BD | B4 | 2F | 8E | D2 | 14 | BD | A4 | 6A | 10 | 25 | FB | FB | 39 | 86 | 03 |
| B300 | BD | AD | B6 | B6 | 52 | C2 | 27 | 29 | 8E | B9 | 28 | BD | AD | 2A | 96 | 71 |
| B310 | C6 | 14 | BD | C1 | 5B | D6 | 71 | BD | B4 | 39 | 96 | 11 | C6 | 37 | BD | C1 |
| B320 | 5B | 96 | 10 | C6 | 4D | BD | C1 | 5B | 8E | B3 | 88 | BD | C2 | 67 | BD | C0 |
| B330 | 99 | B6 | 5D | 86 | BD | AD | 7D | 81 | 01 | 26 | 1B | 96 | 71 | BD | DB | B5 |
| B340 | 91 | 71 | 26 | 01 | 39 | 4D | 2B | 08 | 81 | 0F | 23 | 05 | 86 | 0F | 20 | 01 |
| B350 | 4F | 97 | 71 | 16 | FB | A2 | 81 | 02 | 26 | 16 | C6 | 11 | BD | B4 | 26 | D6 |
| B360 | 10 | BD | 94 | 92 | 24 | 16 | 4D | 26 | 02 | 86 | 01 | 97 | 11 | 16 | FB | 88 |
| B370 | C6 | 10 | BD | B4 | 26 | C6 | 7F | BD | 94 | 92 | 25 | 01 | 39 | 91 | 11 | 24 |
| B380 | 02 | 96 | 11 | 97 | 10 | 16 | FB | 70 | 14 | 02 | 37 | 03 | 4D | 03 | 86 | 03 |
| B390 | BD | AD | B6 | B6 | 52 | C2 | 27 | 40 | 8E | B9 | 28 | BD | AD | 2A | CC | 50 |
| B3A0 | 52 | FD | 50 | 52 | FD | 50 | 75 | FD | 50 | 8B | 86 | 53 | B7 | 50 | 54 | B7 |
| B3B0 | 50 | 77 | B7 | 50 | 8D | 96 | 70 | C6 | 14 | BD | C1 | 5B | D6 | 70 | BD | B4 |
| B3C0 | 39 | 96 | 0F | C6 | 37 | BD | C1 | 5B | 96 | 0E | C6 | 4D | BD | C1 | 5B | 8E |
| B3D0 | B3 | 88 | BD | C2 | 67 | BD | C0 | 99 | B6 | 5D | 86 | BD | AD | 7D | 81 | 01 |
| B3E0 | 26 | 1B | 96 | 70 | BD | DB | B5 | 91 | 70 | 26 | 01 | 39 | 4D | 2B | 08 | 81 |
| B3F0 | 0F | 23 | 05 | 86 | 0F | 20 | 01 | 4F | 97 | 70 | 16 | FA | FB | 81 | 02 | 26 |
| B400 | 0D | C6 | 0F | BD | B4 | 26 | D6 | 0E | BD | 94 | 92 | 25 | 16 | 39 | C6 | 0E |
| B410 | BD | B4 | 26 | C6 | 7F | BD | 94 | 92 | 25 | 01 | 39 | 91 | 0F | 24 | 04 | 96 |
| B420 | 0F | 97 | 0E | 16 | FA | D2 | 34 | 06 | 9E | 64 | 4F | 30 | 8B | 35 | 86 | 34 |
| B430 | 06 | 10 | 9E | 64 | 4F | 31 | AB | 35 | 86 | 34 | 36 | 8E | D3 | 30 | C4 | 07 |
| B440 | C1 | 05 | 25 | 08 | C0 | 05 | F7 | 52 | 9D | 8E | 50 | EA | 58 | 58 | 58 | 3A |
| B450 | 10 | 8E | 50 | 67 | C6 | 08 | BD | 81 | 55 | A6 | 61 | 85 | 08 | 26 | 0C | CC |
| B460 | 4E | 4F | FD | 50 | 62 | CC | 52 | 4D | FD | 50 | 64 | 35 | B6 | 86 | 02 | BD |
| B470 | AD | B6 | B6 | 52 | C2 | 27 | 1D | 8E | B9 | 6D | BD | AD | 2A | 96 | 6E | C6 |
| B480 | 43 | BD | C1 | 5B | 96 | 6D | C6 | 49 | BD | C1 | 5B | 8E | B4 | CC | BD | C2 |
| B490 | 67 | BD | C0 | 99 | B6 | 5D | 86 | BD | AD | 7D | 81 | 01 | 26 | 16 | C6 | 6E |
| B4A0 | BD | B4 | 26 | D6 | 6D | BD | 94 | 92 | 24 | 16 | 4D | 26 | 04 | 86 | 01 | 97 |
| B4B0 | 6E | 16 | FA | 44 | C6 | 6D | BD | B4 | 26 | C6 | 7F | BD | 94 | 92 | 25 | 01 |
| B4C0 | 39 | 91 | 6E | 24 | 04 | 96 | 6E | 97 | 6D | 16 | FA | 2C | 43 | 03 | 49 | 03 |
| B4D0 | 86 | 02 | BD | AD | B6 | B6 | 52 | C2 | 27 | 1D | 8E | B9 | A7 | BD | AD | 22 |
| B4E0 | 96 | 72 | C6 | 4D | BD | BF | E2 | 96 | 73 | C6 | 38 | BD | BF | E2 | 8E | B5 |
| B4F0 | 15 | BD | C2 | 67 | BD | C0 | 99 | B6 | 5D | 86 | BD | AD | 7D | 81 | 01 | 27 |
| B500 | 04 | C6 | 72 | 20 | 02 | C6 | 73 | BD | B4 | 2F | 8E | D2 | 0D | BD | A4 | 6A |
| B510 | 10 | 25 | F9 | E4 | 39 | 38 | 03 | 4D | 03 | 86 | 03 | BD | AD | B6 | BD | 9A |
| B520 | C6 | B6 | 52 | C2 | 27 | 45 | 8E | B9 | E6 | BD | AD | 2A | 10 | 8E | D2 | 0D |
| B530 | 8E | 50 | 85 | C6 | 01 | 86 | 2B | A7 | 84 | 96 | 6F | A5 | A5 | 26 | 04 | 86 |
| B540 | 2D | A7 | 84 | 86 | 28 | A7 | 01 | 86 | 29 | A7 | 05 | 30 | 02 | B6 | 38 | 05 |
| B550 | 43 | B8 | 5D | 7E | 98 | 6F | A4 | A5 | BD | BF | DE | 30 | 05 | 5C | C1 | 03 |
| B560 | 23 | D3 | 8E | B5 | 83 | BD | C2 | 67 | BD | C0 | 99 | B6 | 5D | 86 | BD | AD |
| B570 | 7D | 8E | D2 | 0D | 30 | 86 | C6 | 6F | BD | B4 | 2F | BD | A4 | 6A | 10 | 25 |
| B580 | F9 | 76 | 39 | 3B | 01 | 42 | 01 | 49 | 01 | 86 | 04 | BD | AD | B6 | B6 | 52 |
| B590 | C2 | 27 | 2B | 8E | BA | 18 | BD | AD | 2A | 96 | 1D | 8E | D2 | 0D | 10 | 8E |
| B5A0 | 50 | 84 | A5 | 80 | 27 | 04 | C6 | 2D | 20 | 02 | C6 | 2B | E7 | A4 | 31 | 25 |
| B5B0 | 8C | D2 | 10 | 23 | ED | 8E | B5 | DB | BD | C2 | 67 | BD | C0 | 99 | B6 | 5D |
| B5C0 | 86 | BD | AD | 7D | 8E | D2 | 0C | 30 | 86 | C6 | 1D | BD | B4 | 2F | BD | A4 |
| B5D0 | 6A | 24 | 07 | A8 | 84 | A7 | A4 | 16 | F9 | 1E | 39 | 3A | 01 | 3F | 01 | 44 |
| B5E0 | 01 | 49 | 01 | 86 | 02 | BD | AD | B6 | B6 | 52 | C2 | 27 | 2B | 8E | BA | 46 |
| B5F0 | BD | AD | 2A | 96 | 1D | 8E | D2 | 11 | 10 | 8E | 50 | 85 | A5 | 80 | 27 | 04 |
| B600 | C6 | 2D | 20 | 02 | C6 | 2B | E7 | A4 | 31 | 2A | 8C | D2 | 12 | 23 | ED | 8E |
| B610 | B6 | 26 | BD | C2 | 67 | BD | C0 | 99 | B6 | 5D | 86 | BD | AD | 7D | 8E | D2 |
| B620 | 10 | 30 | 86 | 16 | FF | A3 | 3B | 01 | 45 | 01 | C6 | 14 | 86 | 01 | 20 | 2E |
| B630 | C6 | 15 | 86 | 02 | 20 | 28 | C6 | 16 | 86 | 03 | 20 | 22 | C6 | 17 | 86 | 04 |
| B640 | 20 | 1C | C6 | 18 | 86 | 05 | 20 | 16 | C6 | 19 | 86 | 06 | 20 | 10 | C6 | 1A |
| B650 | 86 | 07 | 20 | 0A | C6 | 1B | 86 | 08 | 20 | 04 | C6 | 1C | 86 | 09 | 10 | 9E |
| B660 | 64 | 31 | A5 | B7 | 5D | AF | 86 | 01 | BD | AD | B6 | 7D | 52 | C2 | 10 | 27 |
| B670 | 00 | B0 | B6 | 5D | AF | 81 | 03 | 23 | 23 | 80 | 03 | 81 | 04 | 23 | 09 | 80 |
| B680 | 04 | 34 | 02 | 8E | BA | 74 | 20 | 05 | 34 | 02 | 8E | BA | 9B | BD | AD | 22 |
| B690 | 35 | 02 | 8B | 30 | B7 | 50 | 61 | B7 | 50 | 76 | 20 | 12 | 34 | 02 | 8E | BA |
| B6A0 | C2 | BD | AD | 22 | 35 | 02 | 8B | 30 | B7 | 50 | 64 | B7 | 50 | 76 | 86 | 3D |
| B6B0 | B7 | 50 | 83 | A6 | A4 | C6 | 35 | BD | C1 | 5B | 8E | BA | F3 | E6 | A4 | C1 |
| B6C0 | 86 | 23 | 39 | B6 | 5D | AF | 81 | 03 | 22 | 30 | C1 | E8 | 24 | 2C | C1 | C8 |

-continued

| | | | | | | | | | | | | | | | | |
|---|---|---|---|---|---|---|---|---|---|---|---|---|---|---|---|---|
| B6D0 | 25 | 28 | 34 | 20 | 8E | BA | E9 | 10 | 8E | 50 | 85 | C6 | 0A | BD | 81 | 3D |
| B6E0 | 86 | 70 | BD | 8B | 98 | AE | E4 | A6 | 84 | 80 | C8 | 84 | 1F | C6 | 18 | 3D |
| B6F0 | 30 | AB | 10 | 8E | 50 | 8F | C6 | 0A | 20 | 11 | C6 | 86 | 4F | 58 | 49 | 30 |
| B700 | 8B | AE | 84 | 34 | 20 | 10 | 8E | 50 | 85 | C6 | 14 | A6 | 80 | 2B | 05 | A7 |
| B710 | A0 | 5A | 26 | F7 | 35 | 20 | 8E | B7 | 37 | BD | C2 | 67 | 7F | 50 | D3 | BD |
| B720 | C0 | 99 | B6 | 5D | 86 | BD | AD | 7D | A6 | A4 | BD | DB | BE | A1 | A4 | 26 |
| B730 | 01 | 39 | A7 | A4 | 16 | F7 | C1 | 35 | 1B | 20 | 20 | 20 | 20 | 20 | 20 | 45 |
| B740 | 44 | 49 | 54 | 20 | 4F | 50 | 45 | 52 | 41 | 54 | 4F | 52 | FF | 4E | 41 | 4D |
| B750 | 45 | 20 | 20 | 20 | 20 | 3D | 20 | FF | 47 | 45 | 54 | 20 | 46 | 52 | 4F | 4D |
| B760 | 20 | 53 | 59 | 4E | 54 | 48 | 3A | FF | 57 | 41 | 49 | 54 | 49 | 4E | 47 | 20 |
| B770 | 46 | 4F | 52 | 20 | 53 | 59 | 4E | 54 | 48 | 20 | 54 | 4F | 20 | 52 | 45 | 53 |
| B780 | 50 | 4F | 4E | 44 | 2E | 2E | 2E | FF | 20 | 20 | 20 | 53 | 59 | 4E | 54 | 48 |
| B790 | 20 | 50 | 41 | 54 | 43 | 48 | 20 | 53 | 45 | 4C | 45 | 43 | 54 | 20 | 3D | FF |
| B7A0 | 55 | 53 | 45 | 52 | 20 | 57 | 41 | 4B | 45 | 2D | 55 | 50 | 20 | 4D | 45 | 53 |
| B7B0 | 53 | 41 | 47 | 45 | 20 | 20 | 20 | 20 | 20 | 20 | 20 | 20 | 20 | 20 | 20 | 20 |
| B7C0 | 20 | 20 | 20 | 20 | 20 | 20 | 28 | 58 | 29 | 20 | 3D | 20 | 20 | 20 | 20 | 20 |
| B7D0 | 28 | 59 | 29 | 20 | 3D | 20 | 20 | 20 | 20 | 20 | 28 | 41 | 46 | 54 | 45 | 52 |
| B7E0 | 20 | 29 | FF | 4D | 49 | 44 | 49 | 20 | 43 | 4F | 4E | 54 | 52 | 4F | 4C | 20 |
| B7F0 | 4D | 45 | 53 | 53 | 41 | 47 | 45 | FF | 54 | 52 | 41 | 4E | 53 | 4D | 49 | 54 |
| B800 | 20 | 4D | 45 | 53 | 53 | 41 | 47 | 45 | 20 | 41 | 46 | 54 | 45 | 52 | 20 | 20 |
| B810 | 50 | 41 | 54 | 43 | 48 | 20 | 53 | 45 | 4C | 45 | 43 | 54 | FF | 42 | 45 | 46 |
| B820 | 4F | 52 | 45 | 20 | 20 | 20 | 20 | 20 | 20 | 20 | 4D | 49 | 44 | 49 | 20 | 54 |
| B830 | 52 | 41 | 4E | 53 | 4D | 49 | 54 | 20 | 43 | 48 | 41 | 4E | 4E | 45 | 4C | 20 |
| B840 | 3D | FF | 54 | 52 | 41 | 4E | 53 | 4D | 49 | 54 | 54 | 45 | 52 | 20 | 20 | 20 |
| B850 | 20 | 20 | 41 | 20 | 20 | 42 | 20 | 20 | 43 | 20 | 20 | 44 | 20 | 20 | 20 | 20 |
| B860 | 50 | 32 | 20 | 20 | 20 | 20 | 20 | 20 | 20 | 20 | 45 | 4E | 41 | 42 | 4C | 45 |
| B870 | 53 | FF | 20 | 4D | 49 | 44 | 49 | 20 | 49 | 4E | 50 | 55 | 54 | 20 | 50 | 52 |
| B880 | 4F | 43 | 45 | 53 | 53 | 49 | 4E | 47 | 20 | 20 | 50 | 32 | 43 | 48 | 41 | 4E |
| B890 | 4E | 45 | 4C | 49 | 5A | 45 | 20 | 3D | 20 | 20 | 20 | 20 | 20 | 20 | 50 | 52 |
| B8A0 | 4F | 47 | 52 | 41 | 4D | 20 | 43 | 48 | 41 | 4E | 47 | 45 | 20 | 3D | FF | 20 |
| B8B0 | 53 | 45 | 54 | 20 | 4B | 45 | 59 | 42 | 4F | 41 | 52 | 44 | 20 | 4C | 49 | 4D |
| B8C0 | 49 | 54 | 53 | 20 | 20 | 20 | 20 | 50 | 32 | 20 | 20 | 20 | 20 | 20 | 20 | 20 |
| B8D0 | 20 | 20 | 20 | 20 | 20 | 20 | 20 | 20 | 20 | 4C | 4F | 57 | 20 | 3D | 20 | 30 |
| B8E0 | 30 | 20 | 20 | 20 | 20 | 48 | 49 | 47 | 48 | 20 | 3D | FF | 28 | 50 | 52 | 45 |
| B8F0 | 53 | 53 | 20 | 32 | 20 | 4B | 45 | 59 | 53 | 29 | 20 | 54 | 52 | 41 | 4E | 53 |
| B900 | 50 | 4F | 53 | 45 | 3A | FF | 4B | 45 | 59 | 42 | 4F | 41 | 52 | 44 | 20 | 50 |
| B910 | 49 | 54 | 43 | 48 | 20 | 3D | FF | 4C | 4F | 43 | 41 | 4C | 20 | 43 | 4F | 4E |
| B920 | 54 | 52 | 4F | 4C | 20 | 20 | 3D | FF | 56 | 45 | 4C | 2E | 53 | 43 | 41 | 4C |
| B930 | 45 | 20 | 3D | 20 | 58 | 58 | 20 | 20 | 52 | 45 | 56 | 20 | 20 | 58 | 58 | 58 |
| B940 | 58 | 58 | 58 | 58 | 58 | 20 | 50 | 32 | 4C | 4F | 20 | 56 | 45 | 4C | 20 | 4C |
| B950 | 49 | 4D | 49 | 54 | 20 | 3D | 20 | 20 | 20 | 20 | 20 | 20 | 20 | 20 | 48 | 49 |
| B960 | 20 | 56 | 45 | 4C | 20 | 4C | 49 | 4D | 49 | 54 | 20 | 3D | FF | 56 | 45 | 4C |
| B970 | 4F | 43 | 49 | 54 | 59 | 20 | 57 | 49 | 4E | 44 | 4F | 57 | 20 | 20 | 20 | 20 |
| B980 | 4C | 4F | 57 | 20 | 20 | 48 | 49 | 47 | 48 | 20 | 20 | 50 | 32 | 50 | 4C | 41 |
| B990 | 59 | 20 | 4E | 4F | 54 | 45 | 53 | 20 | 57 | 2F | 56 | 45 | 4C | 2E | 20 | 42 |
| B9A0 | 45 | 54 | 57 | 45 | 45 | 4E | FF | 20 | 20 | 41 | 46 | 54 | 45 | 52 | 54 | 4F |
| B9B0 | 55 | 43 | 48 | 20 | 45 | 4E | 41 | 42 | 4C | 45 | 20 | 20 | 20 | 20 | 20 | 50 |
| B9C0 | 32 | 43 | 48 | 41 | 4E | 20 | 50 | 52 | 45 | 53 | 53 | 55 | 52 | 45 | 20 | 3D |
| B9D0 | 20 | 20 | 20 | 20 | 20 | 20 | 50 | 4F | 4C | 59 | 20 | 50 | 52 | 45 | 53 | 53 |
| B9E0 | 55 | 52 | 45 | 20 | 3D | FF | 46 | 4F | 4F | 54 | 53 | 57 | 49 | 54 | 43 | 48 |
| B9F0 | 20 | 31 | 20 | 20 | 20 | 20 | 20 | 20 | 32 | 20 | 20 | 20 | 20 | 20 | 20 | 33 |
| BA00 | 20 | 20 | 20 | 20 | 50 | 32 | 20 | 20 | 20 | 20 | 20 | 20 | 20 | 20 | 20 | 50 |
| BA10 | 4F | 4C | 41 | 52 | 49 | 54 | 59 | FF | 50 | 45 | 44 | 41 | 4C | 20 | 20 | 20 |
| BA20 | 50 | 45 | 44 | 31 | 20 | 50 | 45 | 44 | 32 | 20 | 50 | 45 | 44 | 33 | 20 | 50 |
| BA30 | 45 | 44 | 34 | 20 | 20 | 20 | 50 | 32 | 20 | 20 | 20 | 20 | 20 | 50 | 4F | 4C |
| BA40 | 41 | 52 | 49 | 54 | 59 | FF | 57 | 48 | 45 | 45 | 4C | 20 | 20 | 20 | 20 | 57 |
| BA50 | 48 | 45 | 45 | 4C | 31 | 20 | 20 | 20 | 57 | 48 | 45 | 45 | 4C | 32 | 20 | 20 |
| BA60 | 20 | 20 | 20 | 20 | 50 | 32 | 20 | 20 | 20 | 20 | 20 | 50 | 4F | 4C | 41 | 52 |
| BA70 | 49 | 54 | 59 | FF | 20 | 20 | 20 | 57 | 48 | 45 | 45 | 4C | 20 | 58 | 20 | 52 |
| BA80 | 4F | 55 | 54 | 49 | 4E | 47 | 3A | 20 | 20 | 20 | 20 | 20 | 50 | 32 | 57 | 48 |
| BA90 | 4C | 20 | 58 | 20 | 3D | 20 | 43 | 54 | 52 | 4C | FF | 20 | 20 | 20 | 50 | 45 |
| BAA0 | 44 | 41 | 4C | 20 | 58 | 20 | 52 | 4F | 55 | 54 | 49 | 4E | 47 | 3A | 20 | 20 |
| BAB0 | 20 | 20 | 20 | 50 | 32 | 50 | 45 | 44 | 20 | 58 | 20 | 3D | 20 | 43 | 54 | 52 |
| BAC0 | 4C | FF | 20 | 46 | 4F | 4F | 54 | 53 | 57 | 49 | 54 | 43 | 48 | 20 | 58 | 20 |
| BAD0 | 52 | 4F | 55 | 54 | 49 | 4E | 47 | 3A | 20 | 20 | 50 | 32 | 46 | 53 | 57 | 20 |
| BAE0 | 58 | 20 | 3D | 20 | 43 | 54 | 42 | 4C | FF | 55 | 53 | 45 | 52 | 20 | 4D | 53 |
| BAF0 | 47 | 3A | 20 | BC | 12 | BC | 27 | BC | 38 | BC | 12 | BC | 4A | BC | 5A | BC |
| BB00 | 6A | BC | 75 | BC | 81 | BC | 12 | BC | 89 | BC | 8D | BC | 12 | BC | 12 | BC |
| BB10 | 12 | BC | 12 | BC | 98 | BC | AB | BC | BE | BC | D1 | BC | 12 | BC | 12 | BC |
| BB20 | 12 | BC | 12 | BC | 12 | BC | 12 | BC | 12 | BC | 12 | BC | 12 | BC | 12 | BC |
| BB30 | 12 | BC | 12 | BC | 12 | BC | 27 | BC | 38 | BC | 12 | BC | 4A | BC | 5A | BC |
| BB40 | 6A | BC | 75 | BC | 81 | BC | 12 | BC | 89 | BC | 8D | BC | 12 | BC | 12 | BC |
| BB50 | 12 | BC | 12 | BC | 98 | BC | AB | BC | BE | BC | D1 | BC | 12 | BC | 12 | BC |
| BB60 | 12 | BC | 12 | BC | 12 | BC | 12 | BC | 12 | BC | 12 | BC | 12 | BC | 12 | BC |
| BB70 | 12 | BC | 12 | BC | E4 | BC | F1 | BC | FC | BD | 06 | BC | 12 | BD | 11 | BC |
| BB80 | 12 | BC | 12 | BC | 12 | BC | 12 | BC | 12 | BC | 12 | BC | 12 | BC | 12 | BC |
| BB90 | 12 | BC | 12 | BD | 18 | BD | 2B | BD | 3E | BD | 51 | BC | 12 | BC | 12 | BC |
| BBA0 | 12 | BC | 12 | BC | 12 | BC | 12 | BC | 12 | BD | 64 | BD | 77 | BD | 85 | BD |
| BBB0 | 92 | BD | A0 | BD | AD | BD | BC | BD | CB | BD | DE | BD | F1 | BE | 06 | BC |
| BBC0 | 12 | BC | 12 | BC | 12 | BC | 12 | BC | 12 | BC | 12 | BC | 12 | BC | 12 | BC |
| BBD0 | 12 | BC | 12 | BC | 12 | BC | 12 | BC | 12 | BC | 12 | BC | 12 | BC | 12 | BC |
| BBE0 | 12 | BC | 12 | BC | 12 | BE | 1B | BE | 67 | BE | 7C | BE | 8A | BE | 9F | BE |

-continued

| | | | | | | | | | | | | | | | | |
|---|---|---|---|---|---|---|---|---|---|---|---|---|---|---|---|---|
| BBF0 | B3 | BE | C7 | BE | 5C | BE | 4D | BE | 3B | BE | 2D | BE | DB | BE | F0 | BC |
| BC00 | 01 | 2D | 20 | 4E | 4F | 54 | 20 | 41 | 53 | 53 | 49 | 47 | 4E | 45 | 44 | 20 |
| BC10 | 2D | FF | 75 | 6E | 64 | 65 | 66 | 69 | 6E | 65 | 64 | 20 | 63 | 6F | 6E | 74 |
| BC20 | 72 | 6F | 6C | 6C | 65 | 72 | FF | 4D | 4F | 44 | 55 | 4C | 41 | 54 | 49 | 4F |
| BC30 | 4E | 20 | 44 | 45 | 50 | 54 | 48 | FF | 42 | 52 | 45 | 41 | 54 | 48 | 20 | 43 |
| BC40 | 4F | 4E | 54 | 52 | 4F | 4C | 4C | 45 | 52 | FF | 46 | 4F | 4F | 54 | 20 | 43 |
| BC50 | 4F | 4E | 54 | 52 | 4F | 4C | 4C | 45 | 52 | FF | 50 | 4F | 52 | 54 | 41 | 4D |
| BC60 | 45 | 4E | 54 | 4F | 20 | 54 | 49 | 4D | 45 | FF | 44 | 41 | 54 | 41 | 20 | 45 |
| BC70 | 4E | 54 | 52 | 59 | FF | 4D | 41 | 49 | 4E | 20 | 56 | 4F | 4C | 55 | 4D | 45 |
| BC80 | FF | 42 | 41 | 4C | 41 | 4E | 43 | 45 | FF | 50 | 41 | 4E | FF | 45 | 58 | 50 |
| BC90 | 52 | 45 | 53 | 53 | 49 | 4F | 4E | FF | 47 | 45 | 4E | 45 | 52 | 41 | 4C | 20 |
| BCA0 | 50 | 55 | 52 | 50 | 4F | 53 | 45 | 20 | 23 | 31 | FF | 47 | 45 | 4E | 45 | 52 |
| BCB0 | 41 | 4C | 20 | 50 | 55 | 52 | 50 | 4F | 53 | 45 | 20 | 23 | 32 | FF | 47 | 45 |
| BCC0 | 4E | 45 | 52 | 41 | 4C | 20 | 50 | 55 | 52 | 50 | 4F | 53 | 45 | 20 | 23 | 33 |
| BCD0 | FF | 47 | 45 | 4E | 45 | 52 | 41 | 4C | 20 | 50 | 55 | 52 | 50 | 4F | 53 | 45 |
| BCE0 | 20 | 23 | 34 | FF | 44 | 41 | 4D | 50 | 45 | 52 | 20 | 50 | 45 | 44 | 41 | 4C |
| BCF0 | FF | 50 | 4F | 52 | 54 | 41 | 4D | 45 | 4E | 54 | 4F | FF | 53 | 4F | 53 | 54 |
| BD00 | 45 | 4E | 55 | 54 | 4F | FF | 53 | 4F | 46 | 54 | 20 | 50 | 45 | 44 | 41 | 4C |
| BD10 | FF | 48 | 4F | 4C | 44 | 20 | 32 | FF | 47 | 45 | 4E | 45 | 52 | 41 | 4C | 20 |
| BD20 | 50 | 55 | 52 | 50 | 4F | 53 | 45 | 20 | 23 | 35 | FF | 47 | 45 | 4E | 45 | 52 |
| BD30 | 41 | 4C | 20 | 50 | 55 | 52 | 50 | 4F | 53 | 45 | 20 | 23 | 36 | FF | 47 | 45 |
| BD40 | 4E | 45 | 52 | 41 | 4C | 20 | 50 | 55 | 52 | 50 | 4F | 53 | 45 | 20 | 23 | 37 |
| BD50 | FF | 47 | 45 | 4E | 45 | 52 | 41 | 4C | 20 | 50 | 55 | 52 | 50 | 4F | 53 | 45 |
| BD60 | 20 | 23 | 38 | FF | 45 | 58 | 54 | 2E | 20 | 45 | 46 | 46 | 45 | 43 | 54 | 53 |
| BD70 | 20 | 44 | 45 | 50 | 54 | 48 | FF | 54 | 52 | 45 | 4D | 45 | 4C | 4F | 20 | 44 |
| BD80 | 45 | 50 | 54 | 48 | FF | 43 | 48 | 4F | 52 | 55 | 53 | 20 | 44 | 45 | 50 | 54 |
| BD90 | 48 | FF | 43 | 45 | 4C | 45 | 53 | 54 | 45 | 20 | 44 | 45 | 50 | 54 | 48 | FF |
| BDA0 | 50 | 48 | 41 | 53 | 45 | 52 | 20 | 44 | 45 | 50 | 54 | 48 | FF | 44 | 41 | 54 |
| BDB0 | 41 | 20 | 49 | 4E | 43 | 52 | 45 | 4D | 45 | 4E | 54 | FF | 44 | 41 | 54 | 41 |
| BDC0 | 20 | 44 | 45 | 43 | 52 | 45 | 4D | 45 | 4E | 54 | FF | 4E | 4F | 4E | 2D | 52 |
| BDD0 | 45 | 47 | 2E | 20 | 50 | 41 | 52 | 41 | 4D | 20 | 4D | 53 | 42 | FF | 4E | 4F |
| BDE0 | 4E | 2D | 52 | 45 | 47 | 2E | 20 | 50 | 41 | 52 | 41 | 4D | 20 | 4C | 53 | 42 |
| BDF0 | FF | 52 | 45 | 47 | 49 | 53 | 54 | 45 | 52 | 45 | 44 | 20 | 50 | 41 | 52 | 41 |
| BE00 | 4D | 20 | 4D | 53 | 42 | FF | 52 | 45 | 47 | 49 | 53 | 54 | 45 | 52 | 45 | 44 |
| BE10 | 20 | 50 | 41 | 52 | 41 | 4D | 20 | 4C | 53 | 42 | FF | 52 | 45 | 53 | 45 | 54 |
| BE20 | 20 | 41 | 4C | 4C | 20 | 43 | 54 | 52 | 4C | 4C | 52 | 53 | FF | 53 | 45 | 51 |
| BE30 | 55 | 45 | 4E | 43 | 45 | 20 | 53 | 54 | 4F | 50 | FF | 53 | 45 | 51 | 55 | 45 |
| BE40 | 4E | 43 | 45 | 20 | 43 | 4F | 4E | 54 | 49 | 4E | 55 | 45 | FF | 53 | 45 | 51 |
| BE50 | 55 | 45 | 4E | 43 | 45 | 20 | 53 | 54 | 41 | 52 | 54 | FF | 50 | 49 | 54 | 43 |
| BE60 | 48 | 20 | 42 | 45 | 4E | 44 | FF | 4C | 4F | 43 | 41 | 4C | 20 | 43 | 4F | 4E |
| BE70 | 54 | 52 | 4F | 4C | 20 | 53 | 57 | 49 | 54 | 43 | 48 | FF | 41 | 4C | 4C | 20 |
| BE80 | 4E | 4F | 54 | 45 | 53 | 20 | 4F | 46 | 46 | FF | 4F | 4D | 4E | 49 | 20 | 4D |
| BE90 | 4F | 44 | 45 | 20 | 4F | 46 | 46 | 20 | 53 | 57 | 49 | 54 | 43 | 48 | FF | 4F |
| BEA0 | 4D | 4E | 49 | 20 | 4D | 4F | 44 | 45 | 20 | 4F | 4E | 20 | 53 | 57 | 49 | 54 |
| BEB0 | 43 | 48 | FF | 4D | 4F | 4E | 4F | 20 | 4D | 4F | 44 | 45 | 20 | 4F | 4E | 20 |
| BEC0 | 53 | 57 | 49 | 54 | 43 | 48 | FF | 50 | 4F | 4C | 59 | 20 | 4D | 4F | 44 | 45 |
| BED0 | 20 | 4F | 4E | 20 | 53 | 57 | 49 | 54 | 43 | 48 | FF | 4D | 49 | 44 | 49 | 20 |
| BEE0 | 4D | 53 | 47 | 20 | 50 | 41 | 52 | 41 | 4D | 45 | 54 | 45 | 52 | 20 | 58 | FF |
| BEF0 | 4D | 49 | 44 | 49 | 20 | 4D | 53 | 47 | 20 | 50 | 41 | 52 | 41 | 4D | 45 | 54 |
| BF00 | 45 | 52 | 20 | 59 | FF | 7D | 38 | 06 | 2A | 09 | 7C | 52 | C7 | 26 | 03 | 7C |
| BF10 | 52 | C6 | 3B | 34 | 16 | 1A | 50 | FC | 38 | 00 | 5D | 2B | 13 | 8E | 5A | ED |
| BF20 | 3A | 43 | 26 | 01 | 4C | A7 | 84 | 8E | 5B | 4D | 3A | 6C | 84 | 35 | 16 | 3B |
| BF30 | C4 | 7F | 8E | 5A | 8D | 3A | 43 | 26 | 01 | 4C | A7 | 84 | 8E | 5B | 4D | 3A |
| BF40 | A6 | 84 | 8B | 10 | A7 | 84 | 35 | 16 | 3B | A6 | E4 | 1E | 8A | 34 | 02 | F6 |
| BF50 | 5D | 80 | C4 | 7F | 8E | 5B | AD | 3A | B6 | 38 | 06 | 85 | 40 | 27 | 0D | B6 |
| BF60 | 38 | 06 | 85 | 40 | 27 | 06 | B6 | 38 | 02 | 35 | 01 | 3B | B6 | 38 | 02 | 35 |
| BF70 | 01 | A7 | 84 | CE | 5D | 5D | 37 | 88 | B6 | 5D | 7F | 27 | 14 | 7F | 5D | 7F |
| BF80 | F6 | 52 | C5 | 5A | F7 | 52 | C5 | 2A | 08 | C6 | FF | F7 | 5D | 80 | F7 | 30 |
| BF90 | 20 | 3B | 91 | 7A | 23 | 02 | 97 | 7A | 37 | 88 | 38 | 38 | 06 | 0C | 01 | FF |
| BFA0 | 34 | 12 | 8E | BF | 9A | A6 | 80 | B7 | 28 | 00 | B6 | 28 | 00 | 2B | FB | A6 |
| BFB0 | 80 | 81 | FF | 27 | 05 | B7 | 28 | 00 | 20 | F0 | 35 | 92 | 34 | 36 | 10 | 8E |
| BFC0 | 50 | 86 | C6 | 0A | 16 | 00 | 6F | 34 | 16 | 8E | 50 | 4A | 3A | 4D | 27 | 07 |
| BFD0 | CC | 4F | 4E | ED | 84 | 35 | 96 | CC | 2D | 2D | ED | 84 | 35 | 96 | 34 | 16 |
| BFE0 | 20 | 06 | 34 | 16 | 8E | 50 | 4A | 3A | 4D | 26 | E5 | CC | 4F | 46 | ED | 81 |
| BFF0 | E7 | 84 | 35 | 96 | 34 | 06 | B6 | 52 | C3 | 26 | 0E | CC | 3C | 47 | FD | 50 |
| C000 | 96 | CC | 4F | 3E | FD | 50 | 98 | 35 | 86 | CC | 2D | 4F | FD | 50 | 96 | CC |
| C010 | 4B | 2D | FD | 50 | 98 | 7A | 52 | C3 | 35 | 86 | 34 | 36 | 10 | 8E | 50 | 50 |
| C020 | C6 | 22 | 20 | 12 | 34 | 36 | 10 | 8E | 50 | 4A | C6 | 50 | 20 | 08 | 34 | 36 |
| C030 | 10 | 8E | 50 | 4A | C6 | 28 | A6 | 80 | 81 | FF | 27 | 07 | A7 | A0 | 5A | 26 |
| C040 | F5 | 35 | B6 | 86 | 20 | A7 | A0 | 5A | 26 | FB | 35 | B6 | 34 | 36 | 10 | 8E |
| C050 | 50 | 72 | 20 | E0 | BD | C2 | F1 | 8D | 02 | 20 | 41 | 34 | 36 | 10 | 8E | 50 |
| C060 | 4A | 8E | C0 | 6F | C6 | 09 | BD | 81 | 3D | AE | 62 | C6 | 47 | 20 | C7 | 2D |
| C070 | 20 | 42 | 55 | 53 | 59 | 20 | 2D | 20 | 10 | 8E | 50 | 4A | CC | 20 | 20 | ED |
| C080 | A1 | A7 | A0 | C6 | 4D | A6 | 80 | 81 | 80 | 24 | 06 | A7 | A0 | 5A | 26 | F5 |
| C090 | 39 | 86 | 20 | A7 | A0 | 5A | 26 | FB | 39 | 7F | 52 | C2 | 34 | 16 | 86 | FF |
| C0A0 | B7 | 5D | 96 | 8E | 50 | 4A | C6 | 50 | B6 | 28 | 00 | 2B | FB | 86 | 02 | B7 |
| C0B0 | 28 | 00 | B6 | 5D | 98 | 27 | 3C | B6 | 5D | 97 | 27 | 37 | B6 | 28 | 00 | 2B |
| C0C0 | FB | A6 | 88 | 50 | 27 | 08 | B6 | 5D | 96 | 2A | 03 | F7 | 5D | 96 | A6 | 88 |
| C0D0 | 50 | 27 | 16 | 2B | 04 | 30 | 01 | 20 | 0C | A6 | 80 | 84 | 7F | 81 | 20 | 26 |
| C0E0 | 04 | 86 | FF | 20 | 06 | 86 | 20 | 20 | 02 | A6 | 80 | B7 | 28 | 01 | 5A | 26 |
| C0F0 | CB | 20 | 21 | B6 | 28 | 00 | 2B | FB | B6 | 5D | 98 | 27 | 0D | A6 | 88 | 50 |
| C100 | 27 | 08 | B6 | 5D | 96 | 2A | 03 | F7 | 5D | 96 | A6 | 80 | 84 | 7F | B7 | 28 |

-continued

| | | | | | | | | | | | | | | | | |
|---|---|---|---|---|---|---|---|---|---|---|---|---|---|---|---|---|
| C110 | 01 | 5A | 26 | DF | B6 | 5D | 96 | 2B | 05 | 86 | 50 | B0 | 5D | 96 | 81 | 50 |
| C120 | 25 | 0C | B6 | 28 | 00 | 2B | FB | 86 | 0C | B7 | 28 | 00 | 20 | 28 | 81 | 28 |
| C130 | 25 | 02 | 8B | 18 | 34 | 02 | B6 | 28 | 00 | 2B | FB | 86 | 02 | B7 | 28 | 00 |
| C140 | B6 | 28 | 00 | 2B | FB | 35 | 02 | 8A | 80 | B7 | 28 | 00 | B6 | 28 | 00 | 2B |
| C150 | FB | 86 | 0E | B7 | 28 | 00 | 35 | 96 | 64 | 0A | 01 | 34 | 36 | 8E | 50 | 4A |
| C160 | 3A | 10 | 8E | C1 | 58 | 5F | A1 | A4 | 25 | 05 | 5C | A0 | A4 | 20 | F7 | 5D |
| C170 | 27 | 04 | CB | 30 | E7 | 80 | 5F | 31 | 21 | A1 | A4 | 25 | 05 | 5C | A0 | A4 |
| C180 | 20 | F7 | CB | 30 | E7 | 80 | 5F | 31 | 21 | A1 | A4 | 26 | 05 | 5C | A0 | A4 |
| C190 | 20 | F7 | CB | 30 | E7 | 84 | 35 | B6 | 34 | 26 | 10 | 8E | C1 | B0 | 44 | 44 |
| C1A0 | 44 | 44 | A6 | A6 | A7 | 80 | A6 | E4 | 84 | 0F | A6 | A6 | A7 | 80 | 35 | A6 |
| C1B0 | 30 | 31 | 32 | 33 | 34 | 35 | 36 | 37 | 38 | 39 | 41 | 42 | 43 | 44 | 45 | 46 |
| C1C0 | 34 | 16 | 81 | 63 | 22 | 24 | 5F | 81 | 0A | 25 | 05 | 5C | 80 | 0A | 20 | F7 |
| C1D0 | 34 | 02 | 7F | 5D | 8B | 5D | 27 | 08 | 1F | 98 | 8E | 5D | 8B | BD | C1 | F7 |
| C1E0 | 35 | 02 | 8E | 5D | 8C | BD | C1 | F7 | 20 | 08 | 86 | 40 | B7 | 5D | 8B | B7 |
| C1F0 | 5D | 8C | BD | C2 | 15 | 35 | 96 | 34 | 10 | 8E | C2 | 05 | 84 | 0F | A6 | 86 |
| C200 | 35 | 10 | A7 | 84 | 39 | 3F | 06 | 5B | 4F | 66 | 6D | 7D | 07 | 7F | 6F | 77 |
| C210 | 7C | 58 | 5E | 79 | 71 | 34 | 06 | FC | 5D | 8B | 84 | 7F | 7D | 5D | C7 | 27 |
| C220 | 05 | 7A | 5D | C7 | 8A | 80 | C4 | 7F | 7D | 5D | C8 | 27 | 05 | 7A | 5D | C8 |
| C230 | CA | 08 | FD | 5D | 8B | 43 | 53 | FD | 30 | 00 | B6 | 5D | 88 | 43 | B7 | 30 |
| C240 | 02 | F6 | 5D | 89 | F4 | 5D | 83 | 34 | 04 | B6 | 5D | 97 | 27 | 0B | B6 | 5D |
| C250 | 89 | 43 | 32 | 61 | B7 | 30 | 03 | 35 | 86 | B6 | 5D | 89 | BA | 5D | 83 | 43 |
| C260 | A8 | E0 | B7 | 30 | 03 | 35 | 86 | 34 | 16 | B6 | 52 | 86 | 27 | 0E | 81 | 01 |
| C270 | 27 | 05 | F6 | 52 | 94 | 20 | 08 | F6 | 52 | 92 | 20 | 03 | F6 | 52 | 90 | 26 |
| C280 | 02 | 35 | 96 | 5A | 4F | 58 | 49 | 30 | 8B | EC | 84 | 8D | 02 | 35 | 96 | 34 |
| C290 | 10 | 81 | 64 | 25 | 0E | 80 | 64 | 34 | 02 | 8E | 50 | 4A | A6 | 86 | BD | C3 |
| C2A0 | 7D | 35 | 02 | 34 | 06 | 86 | 01 | C1 | 01 | 26 | 02 | 86 | FF | 34 | 02 | 8D |
| C2B0 | 2A | EC | 61 | 8E | 50 | 9A | 30 | 86 | A6 | E4 | A7 | 80 | 5A | 26 | FB | 32 |
| C2C0 | 61 | 35 | 96 | 34 | 06 | 8D | 2A | CC | 01 | 01 | FD | 50 | 9A | 20 | 12 | 34 |
| C2D0 | 06 | 8D | 1E | CC | 01 | 01 | FD | 50 | E7 | 20 | 06 | 34 | 06 | 8D | 12 | 86 |
| C2E0 | 01 | B7 | 5D | 98 | 7F | 5D | 97 | FC | 52 | C6 | 8B | 03 | FD | 5D | 99 | 35 |
| C2F0 | 86 | 34 | 16 | 4F | C6 | 50 | 8E | 50 | 9A | A7 | 80 | 5A | 26 | FB | 35 | 96 |
| C300 | B6 | 5D | 98 | 26 | 01 | 39 | FC | 52 | C6 | 10 | B3 | 5D | 99 | 22 | 01 | 39 |
| C310 | B6 | 5D | 97 | 26 | 15 | 7C | 5D | 97 | BD | C0 | 9C | BD | C2 | 15 | FC | 52 |
| C320 | C6 | C3 | 01 | 04 | C4 | 80 | FD | 5D | 99 | 39 | 7F | 5D | 97 | BD | C0 | 9C |
| C330 | BD | C2 | 15 | FC | 52 | C6 | C3 | 02 | 09 | C4 | 80 | FD | 5D | 99 | 39 | FC |
| C340 | 52 | C6 | 10 | B3 | 5D | 99 | 22 | 0C | B6 | 5D | C7 | BA | 5D | C8 | 27 | 03 |
| C350 | BD | C2 | 15 | 39 | B6 | 5D | 97 | 26 | 12 | 7C | 5D | 97 | BD | C2 | 15 | FC |
| C360 | 52 | C6 | C3 | 01 | 04 | C4 | 80 | FD | 5D | 99 | 39 | 7F | 5D | 97 | BD | C2 |
| C370 | 15 | FC | 52 | C6 | C3 | 02 | 09 | C4 | 80 | FD | 5D | 99 | 39 | 34 | 06 | B7 |
| C380 | 50 | 98 | 80 | 20 | C6 | 48 | BD | C1 | 5B | CC | 20 | 3D | FD | 50 | 94 | CC |
| C390 | 20 | 22 | FD | 50 | 96 | F7 | 50 | 99 | 35 | 86 | 6E | 9F | 50 | 1B | 4F | 34 |
| C3A0 | 02 | F6 | 00 | 00 | 2A | 5C | 6C | E4 | C5 | 02 | 27 | 25 | BE | 52 | CB | BC |
| C3B0 | 52 | CD | 27 | 1D | A6 | 80 | B7 | 00 | 01 | 8C | 53 | 4F | 25 | 03 | 8E | 52 |
| C3C0 | CF | BF | 52 | CB | 7C | 52 | CA | BC | 52 | CD | 26 | 05 | 86 | 95 | B7 | 00 |
| C3D0 | 00 | C5 | 70 | 27 | 0D | B6 | 00 | 01 | C4 | 7C | FA | 5D | C3 | F7 | 5D | C3 |
| C3E0 | 20 | 20 | C5 | 01 | 27 | 1C | B6 | 5D | C7 | 4C | 27 | 03 | B7 | 5D | C7 | B6 |
| C3F0 | 00 | 01 | BE | 54 | E0 | A7 | 80 | 8C | 55 | E2 | 25 | 03 | 8E | 54 | E2 | BF |
| C400 | 54 | E0 | F6 | 08 | 00 | 2A | 5C | 6C | E4 | C5 | 02 | 27 | 25 | BE | 53 | 50 |
| C410 | BC | 53 | 52 | 27 | 1D | A6 | 80 | B7 | 08 | 01 | 8C | 53 | D4 | 25 | 03 | 8E |
| C420 | 53 | 54 | BF | 53 | 50 | 7C | 53 | 4F | BC | 53 | 52 | 26 | 05 | 86 | 95 | B7 |
| C430 | 08 | 00 | C5 | 70 | 27 | 0D | B6 | 08 | 01 | C4 | 7C | FA | 5D | C3 | F7 | 5D |
| C440 | C3 | 20 | 20 | C5 | 01 | 27 | 1C | B6 | 5D | C8 | 4C | 27 | 03 | B7 | 5D | C8 |
| C450 | B6 | 08 | 01 | BE | 55 | E4 | A7 | 80 | 8C | 56 | E6 | 25 | 03 | 8E | 55 | E6 |
| C460 | BF | 55 | E4 | B6 | 10 | 00 | 2A | 22 | 6C | E4 | BE | 53 | D5 | A6 | 80 | B7 |
| C470 | 10 | 01 | 8C | 54 | 59 | 25 | 03 | 8E | 53 | D9 | BF | 53 | D5 | 7C | 53 | D4 |
| C480 | BC | 53 | D7 | 26 | 05 | 86 | 15 | B7 | 10 | 00 | B6 | 18 | 00 | 2A | 22 | 6C |
| C490 | E4 | BE | 54 | 5A | A6 | 80 | B7 | 18 | 01 | 8C | 54 | DE | 25 | 03 | 8E | 54 |
| C4A0 | 5E | BF | 54 | 5A | 7C | 54 | 59 | BC | 54 | 5C | 26 | 05 | 86 | 15 | B7 | 18 |
| C4B0 | 00 | A6 | E0 | 26 | 08 | B6 | 20 | 00 | 8A | 80 | B7 | 5D | D8 | 3B | 34 | 77 |
| C4C0 | CE | C4 | C5 | 37 | 80 | C4 | CF | C5 | 45 | C5 | BB | C6 | 31 | C6 | A5 | 34 |
| C4D0 | 22 | 7D | 52 | CA | 26 | 05 | BD | D5 | D8 | 20 | F6 | 1A | 10 | BE | 52 | CD |
| C4E0 | 20 | 48 | 34 | 22 | B6 | 52 | CA | 81 | 02 | 24 | 05 | BD | D5 | D8 | 20 | F4 |
| C4F0 | 1A | 10 | BE | 52 | CD | 20 | 22 | 34 | 22 | B6 | 52 | CA | 81 | 03 | 24 | 05 |
| C500 | BD | D5 | D8 | 20 | F4 | 1A | 10 | BE | 52 | CD | A6 | A0 | A7 | 80 | 8C | 53 |
| C510 | 4F | 25 | 03 | 8E | 52 | CF | 7A | 52 | CA | A6 | A0 | A7 | 80 | 8C | 53 | 4F |
| C520 | 25 | 03 | 8E | 52 | CF | 7A | 52 | CA | A6 | A0 | A7 | 80 | 8C | 53 | 4F | 25 |
| C530 | 03 | 8E | 52 | CF | 7A | 52 | CA | BF | 52 | CD | 86 | B5 | B7 | 00 | 00 | 35 |
| C540 | 22 | 1C | EF | 37 | 80 | 34 | 22 | 7D | 53 | 4F | 26 | 05 | BD | D5 | D8 | 20 |
| C550 | F6 | 1A | 10 | BE | 53 | 52 | 20 | 48 | 34 | 22 | B6 | 53 | 4F | 81 | 02 | 24 |
| C560 | 05 | BD | D5 | D8 | 20 | F4 | 1A | 10 | BE | 53 | 52 | 20 | 22 | 34 | 22 | B6 |
| C570 | 53 | 4F | 81 | 03 | 24 | 05 | BD | D5 | D8 | 20 | F4 | 1A | 10 | BE | 53 | 52 |
| C580 | A6 | A0 | A7 | 80 | 8C | 53 | D4 | 25 | 03 | 8E | 53 | 54 | 7A | 53 | 4F | A6 |
| C590 | A0 | A7 | 80 | 8C | 53 | D4 | 25 | 03 | 8E | 53 | 54 | 7A | 53 | 4F | A6 | A0 |
| C5A0 | A7 | 80 | 8C | 53 | D4 | 25 | 03 | 8E | 53 | 54 | 7A | 53 | 4F | BF | 53 | 52 |
| C5B0 | 86 | B5 | B7 | 08 | 00 | 35 | 22 | 1C | EF | 37 | 80 | 34 | 22 | 7D | 53 | D4 |
| C5C0 | 26 | 05 | BD | D5 | D8 | 20 | F6 | 1A | 10 | BE | 53 | D7 | 20 | 48 | 34 | 22 |
| C5D0 | B6 | 53 | D4 | 81 | 02 | 24 | 05 | BD | D5 | D8 | 20 | F4 | 1A | 10 | BE | 53 |
| C5E0 | D7 | 20 | 22 | 34 | 22 | B6 | 53 | D4 | 81 | 03 | 24 | 05 | BD | D5 | D8 | 20 |
| C5F0 | F4 | 1A | 10 | BE | 53 | D7 | A6 | A0 | A7 | 80 | 8C | 54 | 59 | 25 | 03 | 8E |
| C600 | 53 | D9 | 7A | 53 | D4 | A6 | A0 | A7 | 80 | 8C | 54 | 59 | 25 | 03 | 8E | 53 |
| C610 | D9 | 7A | 53 | D4 | A6 | A0 | A7 | 80 | 8C | 54 | 59 | 25 | 03 | 8E | 53 | D9 |
| C620 | 7A | 53 | D4 | BF | 53 | D7 | 86 | 35 | B7 | 10 | 00 | 35 | 22 | 1C | EF | 37 |

-continued

| | | | | | | | | | | | | | | | | |
|---|---|---|---|---|---|---|---|---|---|---|---|---|---|---|---|---|
| C630 | 80 | 34 | 22 | 7D | 54 | 59 | 26 | 05 | BD | D5 | D8 | 20 | F6 | 1A | 10 | BE |
| C640 | 54 | 5C | 20 | 48 | 34 | 22 | B6 | 54 | 59 | 81 | 02 | 24 | 05 | BD | D5 | D8 |
| C650 | 20 | F4 | 1A | 10 | BE | 54 | 5C | 20 | 22 | 34 | 22 | B6 | 54 | 59 | 81 | 03 |
| C660 | 24 | 05 | BD | D5 | D8 | 20 | F4 | 1A | 10 | BE | 54 | 5C | A6 | A0 | A7 | 80 |
| C670 | 8C | 54 | DE | 25 | 03 | 8E | 54 | 5E | 7A | 54 | 59 | A6 | A0 | A7 | 80 | 8C |
| C680 | 54 | DE | 25 | 03 | 8E | 54 | 5E | 7A | 54 | 59 | A6 | A0 | A7 | 80 | 8C | 54 |
| C690 | DE | 25 | 03 | 8E | 54 | 5E | 7A | 54 | 59 | BF | 54 | 5C | 86 | 35 | B7 | 18 |
| C6A0 | 00 | 35 | 22 | 1C | EF | 35 | F7 | 8D | 03 | 7E | C7 | 3C | 1A | 10 | BE | 54 |
| C6B0 | DE | BC | 54 | E0 | 26 | 03 | 1C | EF | 39 | A6 | 80 | 8C | 55 | E2 | 25 | 03 |
| C6C0 | 8E | 54 | E2 | BF | 54 | DE | 8E | C6 | E9 | BF | 50 | 1D | 10 | FF | 5A | 86 |
| C6D0 | 10 | FE | 5A | 88 | 20 | 2A | BE | 50 | 1D | 8C | C6 | E9 | 10 | 26 | 00 | 86 |
| C6E0 | 10 | CE | 5D | 1B | BD | C6 | E9 | 20 | F7 | 1A | 10 | BE | 54 | DE | BC | 54 |
| C6F0 | E0 | 27 | 3E | A6 | 80 | 8C | 55 | E2 | 25 | 03 | 8E | 54 | E2 | BF | 54 | DE |
| C700 | 1C | EF | 4D | 2B | 01 | 39 | 81 | F0 | 24 | 23 | 10 | CE | 5D | 1B | B7 | 50 |
| C710 | 21 | 7D | 52 | 87 | 2B | 07 | 84 | 0F | B1 | 52 | 87 | 26 | C3 | F6 | 50 | 21 |
| C720 | C4 | 70 | 54 | 54 | 54 | 8E | 50 | 24 | B6 | 50 | 21 | 6E | 95 | 6E | 9F | 50 |
| C730 | 32 | 10 | FF | 5A | 88 | 10 | FE | 5A | 86 | 1C | EF | 39 | 1A | 10 | BE | 55 |
| C740 | E2 | BC | 55 | E4 | 26 | 03 | 1C | EF | 39 | A6 | 80 | 8C | 56 | E6 | 25 | 03 |
| C750 | 8E | 55 | E6 | BF | 55 | E2 | 8E | C7 | 6F | BF | 50 | 1D | 10 | FF | 5A | 86 |
| C760 | 10 | FE | 5A | 8A | 20 | 20 | 10 | CE | 5D | 5B | BD | C7 | 6F | 20 | F7 | 1A |
| C770 | 10 | BE | 55 | E2 | BC | 55 | E4 | 27 | 3E | A6 | 80 | 8C | 56 | E6 | 25 | 03 |
| C780 | 8E | 55 | E6 | BF | 55 | E2 | 1C | EF | 4D | 2B | 01 | 39 | 81 | F0 | 24 | 23 |
| C790 | 10 | CE | 5D | 5B | B7 | 50 | 22 | 7D | 52 | 88 | 2B | 07 | 84 | 0F | B1 | 52 |
| C7A0 | 88 | 26 | C3 | F6 | 50 | 22 | C4 | 70 | 54 | 54 | 54 | 8E | 50 | 34 | B6 | 50 |
| C7B0 | 22 | 6E | 95 | 6E | 9F | 50 | 42 | 10 | FF | 5A | 8A | 10 | FE | 5A | 86 | 1C |
| C7C0 | EF | 39 | B7 | 50 | 44 | BD | C6 | E9 | B7 | 50 | 45 | BD | C6 | E9 | B7 | 50 |
| C7D0 | 46 | 8E | 50 | 44 | BD | C8 | 41 | 20 | EC | B7 | 50 | 47 | BD | C7 | 6F | B7 |
| C7E0 | 50 | 48 | BD | C7 | 6F | B7 | 50 | 49 | 8E | 50 | 47 | BD | C8 | 68 | 20 | EC |
| C7F0 | AD | 9F | 50 | 1D | 81 | 64 | 24 | F8 | B7 | 52 | 98 | 20 | F3 | B7 | 50 | 44 |
| C800 | BD | C6 | E9 | B7 | 50 | 45 | 8E | 50 | 44 | BD | C8 | 41 | 20 | F2 | B7 | 50 |
| C810 | 47 | BD | C7 | 6F | B7 | 50 | 48 | 8E | 50 | 47 | BD | C8 | 68 | 20 | F2 | B7 |
| C820 | 50 | 44 | BD | C6 | E9 | B7 | 50 | 45 | 8E | 50 | 44 | BD | C8 | 41 | 20 | F2 |
| C830 | B7 | 50 | 47 | BD | C7 | 6F | B7 | 50 | 48 | 8E | 50 | 47 | BD | C8 | 68 | 20 |
| C840 | F2 | B6 | 50 | 17 | 85 | 08 | 27 | 16 | B6 | 52 | 87 | 84 | 0F | 34 | 02 | B6 |
| C850 | 50 | 21 | A0 | E0 | 84 | 0F | 81 | 07 | 22 | 03 | BD | C8 | 82 | 39 | 4F | BD |
| C860 | C8 | 82 | 4C | 81 | 07 | 23 | F8 | 39 | B6 | 50 | 17 | 85 | 10 | 27 | EF | B6 |
| C870 | 52 | 88 | 84 | 0F | 34 | 02 | B6 | 50 | 22 | A0 | E0 | 84 | 0F | 81 | 07 | 23 |
| C880 | D9 | 39 | 34 | 36 | 10 | 8E | D2 | 0D | F6 | 50 | 15 | 53 | F4 | 5D | 88 | E5 |
| C890 | A6 | 26 | 02 | 35 | B6 | B7 | 52 | 83 | 8B | 40 | 1F | 8B | A6 | 84 | 84 | F0 |
| C8A0 | 81 | CO | 10 | 27 | 00 | C4 | 81 | DO | 10 | 27 | 00 | A5 | 81 | B0 | 10 | 24 |
| C8B0 | 00 | 88 | E6 | 01 | C0 | 15 | 10 | 2B | 00 | 7E | BD | D9 | 77 | 10 | 25 | 00 |
| C8C0 | 77 | 0D | 78 | 27 | 04 | D6 | 79 | 20 | 04 | DB | 21 | 2B | 6B | A6 | 84 | 0D |
| C8D0 | 1E | 2A | 04 | 84 | F0 | 9A | 3B | FD | 52 | BF | E6 | 02 | 84 | F0 | 81 | A0 |
| C8E0 | 27 | 49 | 81 | 90 | 26 | 03 | 5D | 27 | 13 | 10 | 9E | 66 | E6 | A5 | C4 | 7F |
| C8F0 | 81 | 90 | 26 | 1C | D1 | 6D | 22 | 40 | D1 | 6E | 25 | 3C | F7 | 52 | C1 | BD |
| C900 | D0 | CA | 10 | 9E | 64 | F6 | 52 | C0 | 31 | A5 | 6C | A9 | 00 | 80 | 35 | B6 |
| C910 | F7 | 52 | C1 | BD | D0 | CA | 10 | 9E | 64 | F6 | 52 | C0 | 31 | A5 | A6 | A9 |
| C920 | 00 | 80 | 27 | 14 | 4A | A7 | A9 | 00 | 80 | 35 | B6 | 10 | 9E | 68 | E6 | A5 |
| C930 | C4 | 7F | F7 | 52 | C1 | BD | D0 | CA | 35 | B6 | EC | 84 | 0D | 1E | 2A | 04 |
| C940 | 84 | F0 | 9A | 3B | FD | 52 | BF | A6 | 02 | B7 | 52 | C1 | BD | D0 | CA | 35 |
| C950 | B6 | EC | 84 | 0D | 1E | 2A | 04 | 84 | F0 | 9A | 3B | 10 | 9E | 68 | E6 | A5 |
| C960 | C4 | 7F | FD | 52 | BF | BD | D0 | BE | 35 | B6 | 96 | 1E | 85 | 40 | 27 | 10 |
| C970 | EC | 84 | 0D | 1E | 2A | 04 | 84 | F0 | 9A | 3B | FD | 52 | BF | BD | D0 | BE |
| C980 | 35 | B6 | 84 | 0F | 48 | 8E | C9 | 96 | 6E | 96 | 84 | 0F | 10 | 27 | FD | 46 |
| C990 | 48 | 8E | C9 | 96 | 6E | 96 | C9 | D1 | C6 | D6 | C6 | D6 | C6 | D6 | C6 | D6 |
| C9A0 | C6 | D6 | C9 | CD | C6 | D6 | C9 | CD | C9 | CD | C9 | B6 | C9 | B6 | C9 | B6 |
| C9B0 | C9 | CD | C9 | CD | C9 | CD | 44 | 8A | F0 | F6 | 52 | 8D | BE | 50 | 1D | 8C |
| C9C0 | C6 | E9 | 27 | 03 | F6 | 52 | 8E | 5D | 27 | 03 | BD | C4 | BE | 35 | 10 | 6E |
| C9D0 | 1D | AD | 9F | 50 | 1D | 81 | 7E | 27 | 30 | 4D | 26 | 4C | AD | 9F | 50 | 1D |
| C9E0 | 4D | 26 | 45 | AD | 9F | 50 | 1D | 81 | 24 | 26 | 3D | AD | 9F | 50 | 1D | 81 |
| C9F0 | 01 | 26 | 35 | B7 | 5D | C5 | AD | 9F | 50 | 1D | BD | CB | FA | 81 | 0A | 10 |
| CA00 | 22 | FC | D3 | 48 | 8E | CA | 51 | 6E | 96 | AD | 9F | 50 | 1D | AD | 9F | 50 |
| CA10 | 1D | 81 | 06 | 26 | 10 | AD | 9F | 50 | 1D | 81 | 01 | 26 | 08 | 10 | 8E | 81 |
| CA20 | 1F | 4F | BD | 8D | 94 | 16 | FC | AE | 8E | 6E | 00 | BD | CC | 04 | A7 | 80 |
| CA30 | BF | 5D | C9 | AD | 9F | 50 | 1D | BE | 5D | C9 | 8C | 6F | FF | 25 | 08 | 86 |
| CA40 | 01 | B7 | 5D | C4 | 16 | FC | 8F | BD | CC | 04 | A7 | 80 | BF | 5D | C9 | 20 |
| CA50 | E2 | CB | 72 | CA | 67 | CC | E6 | CB | 05 | CC | A7 | CA | CC | CD | 35 | CB |
| CA60 | 3B | CC | 90 | C6 | D6 | CD | 72 | 7F | 5D | C9 | AD | 9F | 50 | 1D | BD | CB |
| CA70 | FA | 81 | 63 | 10 | 22 | FC | 5F | BD | 8B | 98 | 6D | A8 | 17 | 10 | 2B | FC |
| CA80 | 55 | B7 | 5D | CB | BD | CB | E2 | 34 | 02 | B6 | 5D | CB | BD | 8B | 98 | F6 |
| CA90 | 5D | C9 | 4F | 31 | AB | 35 | 02 | A7 | A4 | 5C | F7 | 5D | C9 | 26 | E5 | BD |
| CAA0 | CB | E2 | 34 | 02 | B6 | 5D | CB | BD | 8B | BE | F6 | 5D | C9 | 35 | 02 | A7 |
| CAB0 | A5 | 5C | F7 | 5D | C9 | C1 | 1F | 23 | E6 | AD | 9F | 50 | 1D | C6 | 01 | B1 |
| CAC0 | 5D | C5 | 27 | 02 | C6 | FF | F7 | 5D | C4 | 7E | C6 | D6 | AD | 9F | 50 | 1D |
| CAD0 | BD | CB | FA | 81 | 0C | 10 | 22 | FB | FD | C6 | 03 | 3D | 8E | CB | 82 | 30 |
| CAE0 | 8B | EC | 84 | FD | 5D | C9 | E6 | 02 | F7 | 5D | CB | AD | 9F | 50 | 1D | BD |
| CAF0 | CB | FA | BD | CC | 04 | BE | 5D | C9 | A7 | 80 | BF | 5D | C9 | F6 | 5D | CB |
| CB00 | 5A | 26 | E5 | 20 | B4 | AD | 9F | 50 | 1D | BD | CB | FA | 81 | 12 | 10 | 22 |
| CB10 | FB | C4 | C6 | 03 | 3D | 8E | CB | A9 | 30 | 8B | EC | 84 | FD | 5D | C9 | E6 |
| CB20 | 02 | F7 | 5D | CB | BD | CB | E2 | BD | CC | 04 | BE | 5D | C9 | A7 | 80 | BF |
| CB30 | 5D | C9 | F6 | 5D | CB | 5A | 26 | E9 | 16 | FF | 7E | AD | 9F | 50 | 1D | BD |
| CB40 | CB | FA | 34 | 02 | 86 | 70 | BD | 8B | 98 | 35 | 02 | 84 | 1F | C6 | 18 | 3D |

-continued

| | | | | | | | | | | | | | | | | |
|---|---|---|---|---|---|---|---|---|---|---|---|---|---|---|---|---|
| CB50 | 31 | AB | 10 | BF | 5D | C9 | C6 | 18 | F7 | 5D | CB | BD | CB | E2 | BD | CC |
| CB60 | 04 | BE | 5D | C9 | A7 | 80 | BF | 5D | C9 | F6 | 5D | CB | 5A | 26 | E9 | 16 |
| CB70 | FF | 47 | AD | 9F | 50 | 1D | 81 | 63 | 10 | 22 | FB | 5A | BD | CC | 62 | 16 |
| CB80 | FB | 54 | 56 | E6 | 64 | 50 | EA | 08 | 50 | F2 | 08 | 50 | FA | 08 | 51 | 02 |
| CB90 | 80 | 51 | 82 | 80 | 52 | 02 | 80 | 50 | 4A | 50 | 52 | 8F | 07 | 52 | 98 | 01 |
| CBA0 | 52 | C2 | 01 | 5D | A6 | 06 | 5D | 9D | 06 | 57 | 4A | 03 | 67 | 00 | 00 | 50 |
| CBB0 | 00 | 18 | 40 | 00 | 00 | 41 | 00 | 00 | 42 | 00 | 00 | 43 | 00 | 00 | 44 | 00 |
| CBC0 | 00 | 45 | 00 | 00 | 46 | 00 | 00 | 47 | 00 | 00 | 6D | 00 | 6E | 6D | 80 | 64 |
| CBD0 | 50 | 9A | 50 | 5D | 88 | 05 | 52 | 87 | 06 | 57 | 4D | 18 | 5D | DD | 00 | 5E |
| CBE0 | DD | 00 | AD | 9F | 50 | 1D | 8D | 12 | 84 | 0F | B7 | 5D | CC | AD | 9F | 50 |
| CBF0 | 1D | 8D | 07 | 48 | 84 | F0 | BA | 5D | CC | 39 | 34 | 02 | BB | 5D | C5 | B7 |
| CC00 | 5D | C5 | 35 | 82 | 34 | 02 | B6 | 5D | 81 | 8A | 03 | B7 | 5D | 81 | B7 | 30 |
| CC10 | 28 | 35 | 82 | 34 | 02 | 86 | F0 | BD | C4 | BE | 4F | BD | C4 | BE | BD | C4 |
| CC20 | BE | 86 | 24 | BD | C4 | BE | 86 | 01 | BD | C4 | BE | B7 | 5D | C6 | A6 | E4 |
| CC30 | 84 | 7F | 8D | 13 | 35 | 82 | 34 | 02 | B6 | 5D | C6 | 84 | 7F | BD | C4 | BE |
| CC40 | 86 | F7 | BD | C4 | BE | 35 | 82 | BD | C4 | BE | B8 | 5D | C6 | B7 | 5D | C6 |
| CC50 | 39 | 34 | 02 | 84 | 0F | BD | CC | 47 | A6 | E4 | 44 | 84 | 78 | BD | CC | 47 |
| CC60 | 35 | 82 | 34 | 36 | BD | 8B | 98 | 86 | 01 | BD | CC | 13 | A6 | E4 | 84 | 7F |
| CC70 | BD | CC | 47 | 5F | A6 | A0 | BD | CC | 51 | 5A | 26 | F8 | C6 | 20 | A6 | E4 |
| CC80 | BD | 8B | BE | A6 | A0 | BD | CC | 51 | 5A | 26 | F8 | BD | CC | 36 | 35 | B6 |
| CC90 | 86 | 09 | BD | CC | 13 | 8E | 80 | 8D | C6 | 28 | A6 | 80 | 84 | 7F | BD | CC |
| CCA0 | 47 | 5A | 26 | F6 | 16 | FF | 8F | AD | 9F | 50 | 1D | 81 | 0C | 10 | 22 | FA |
| CCB0 | 25 | 8D | 04 | 16 | FA | 20 | 4F | 34 | 02 | 86 | 05 | BD | CC | 13 | A6 | E4 |
| CCC0 | 84 | 7F | BD | CC | 47 | 35 | 02 | 84 | 7F | C6 | 03 | 3D | 8E | CB | 82 | 30 |
| CCD0 | 8B | 10 | AE | 84 | E6 | 02 | BD | CC | 04 | A6 | A0 | 84 | 7F | BD | CC | 47 |
| CCE0 | 5A | 26 | F6 | 16 | FF | 50 | AD | 9F | 50 | 1D | 81 | 12 | 10 | 22 | F9 | E6 |
| CCF0 | 8D | 05 | 16 | F9 | E1 | 86 | 0C | 34 | 02 | 86 | 03 | BD | CC | 13 | A6 | E4 |
| CD00 | 84 | 7F | BD | CC | 47 | 35 | 02 | 84 | 7F | C6 | 03 | 3D | 8E | CB | A9 | 30 |
| CD10 | 8B | 10 | AE | 84 | E6 | 02 | BD | CC | 04 | A6 | A0 | BD | CC | 51 | 5A | 26 |
| CD20 | F8 | 16 | FF | 12 | 34 | 36 | 4C | 34 | 02 | BD | CC | B7 | 35 | 02 | 8B | 03 |
| CD30 | BD | CC | B7 | 35 | B6 | AD | 9F | 50 | 1D | BD | CB | FA | 81 | 1F | 10 | 22 |
| CD40 | F9 | 94 | 8D | 03 | 16 | F9 | 8F | 34 | 36 | 86 | 07 | BD | CC | 13 | A6 | E4 |
| CD50 | 84 | 1F | BD | CC | 47 | 86 | 70 | BD | 8B | 98 | A6 | E4 | 84 | 1F | C6 | 18 |
| CD60 | 3D | 31 | AB | C6 | 18 | A6 | A0 | BD | CC | 51 | 5A | 26 | F8 | BD | CC | 36 |
| CD70 | 35 | B6 | AD | 9F | 50 | 1D | BA | 5D | 8E | B7 | 5D | 8E | AD | 9F | 50 | 1D |
| CD80 | 48 | BA | 5D | 8E | B7 | 5D | 8E | AD | 9F | 50 | 1D | BA | 5D | 8F | B7 | 5D |
| CD90 | 8F | 16 | F9 | 42 | 34 | 76 | B7 | 52 | 99 | 20 | 08 | 34 | 76 | B7 | 52 | 99 |
| CDA0 | BD | 8B | 35 | B6 | 5D | C2 | 27 | 0B | 86 | 64 | BD | 88 | 70 | B6 | 52 | 85 |
| CDB0 | B7 | 52 | 84 | B6 | 52 | 99 | 84 | 7F | B7 | 52 | 99 | B7 | 52 | 85 | BD | C1 |
| CDC0 | C0 | B6 | 52 | 99 | BD | 8B | BE | 1F | 23 | B6 | 52 | 99 | BD | 8B | 98 | 8E |
| CDD0 | 50 | 00 | C6 | 18 | BD | 81 | 32 | B6 | 50 | 13 | B7 | 5D | 88 | 4F | BD | 8B |
| CDE0 | FB | BD | 89 | 3B | 1F | B8 | 5F | 1F | 01 | C6 | 1D | BD | 81 | 32 | BD | 89 |
| CDF0 | 48 | C6 | 04 | A6 | C0 | A7 | 80 | 5A | 26 | F9 | BD | D1 | 72 | B6 | 52 | 83 |
| CE00 | 4C | 81 | 07 | 23 | D9 | 86 | 65 | BD | 88 | 70 | 35 | F6 | 7F | 5D | DA | B6 |
| CE10 | 5D | 88 | B4 | 50 | 15 | B7 | 52 | 82 | B7 | 5A | 8C | BD | C2 | 15 | B6 | 50 |
| CE20 | 11 | BD | D2 | 21 | B7 | 5D | 78 | B6 | 50 | 12 | BD | D2 | 21 | B7 | 5D | 79 |
| CE30 | BD | D2 | B0 | B6 | 50 | 14 | 43 | B7 | 30 | 10 | BD | D2 | DF | 8E | 50 | 24 |
| CE40 | B6 | 52 | 89 | 2A | 40 | 85 | 01 | 27 | 05 | CE | C7 | F0 | EF | 08 | 85 | 02 |
| CE50 | 27 | 05 | CE | C7 | FD | EF | 08 | CE | C7 | C2 | B6 | 50 | 16 | 10 | 8E | D2 |
| CE60 | 0D | A5 | A4 | 27 | 04 | EF | 84 | EF | 02 | 5F | A5 | 22 | 27 | 01 | 5C | F7 |
| CE70 | 52 | 8D | A5 | 21 | 27 | 04 | EF | 06 | EF | 0C | A5 | 23 | 27 | 07 | EF | 04 |
| CE80 | CE | C8 | 1F | EF | 0A | 8E | 50 | 34 | B6 | 52 | 8A | 2A | 40 | 85 | 01 | 27 |
| CE90 | 05 | CE | C7 | F0 | EF | 08 | 85 | 02 | 27 | 05 | CE | C8 | 0E | EF | 08 | CE |
| CEA0 | C7 | D9 | B6 | 50 | 16 | 10 | 8E | D2 | 11 | A5 | A4 | 27 | 04 | EF | 84 | EF |
| CEB0 | 02 | 5F | A5 | 22 | 27 | 01 | 5C | F7 | 52 | 8E | A5 | 21 | 27 | 04 | EF | 06 |
| CEC0 | EF | 0C | A5 | 23 | 27 | 07 | EF | 04 | CE | C8 | 30 | EF | 0A | 4F | BD | 8B |
| CED0 | FB | 8E | D2 | 0D | E6 | 86 | D7 | 6C | 1F | B8 | 5F | DD | 64 | C3 | 08 | 00 |
| CEE0 | DD | 66 | C3 | 00 | 80 | DD | 68 | 96 | 77 | 43 | 97 | 77 | C6 | 23 | 4F | D3 |
| CEF0 | 64 | DD | 6A | 8E | 5D | B8 | 96 | 0B | 91 | 0C | 22 | 06 | D6 | 0C | D7 | 0B |
| CF00 | 97 | 0C | 10 | 8E | 00 | 00 | 6F | 84 | 96 | 0A | A4 | A9 | D2 | 0D | 27 | 12 |
| CF10 | B6 | 50 | 14 | 43 | A4 | A9 | D2 | 15 | A1 | A9 | D2 | 15 | 27 | 04 | 86 | 01 |
| CF20 | A7 | 84 | 31 | 21 | 30 | 01 | 10 | 8C | 00 | 04 | 25 | DA | DE | 6A | B6 | 5D |
| CF30 | B8 | 27 | 10 | CC | C4 | F7 | ED | C8 | 10 | CC | C4 | E2 | ED | 48 | CC | C4 |
| CF40 | CF | ED | C1 | B6 | 5D | B9 | 27 | 10 | CC | C5 | 6D | ED | C8 | 10 | CC | C5 |
| CF50 | 58 | ED | 48 | CC | C5 | 45 | ED | C1 | B6 | 5D | BA | 27 | 10 | CC | C5 | E3 |
| CF60 | ED | C8 | 10 | CC | C5 | CE | ED | 48 | CC | C5 | BB | ED | C1 | B6 | 5D | BB |
| CF70 | 26 | 0C | CC | C6 | A5 | ED | C4 | ED | 48 | ED | C8 | 10 | 20 | 10 | CC | C6 |
| CF80 | 59 | ED | C8 | 10 | CC | C6 | 44 | ED | 48 | CC | C6 | 31 | ED | C4 | DE | 64 |
| CF90 | C6 | 3C | 4F | 33 | CB | B6 | 50 | 17 | 85 | 20 | 10 | 27 | 00 | B2 | 10 | 9E |
| CFA0 | 64 | 4F | C6 | 17 | 31 | AB | 5F | A6 | A5 | 81 | 86 | 24 | 53 | 81 | 79 | 25 |
| CFB0 | 38 | 81 | 80 | 27 | 1F | 81 | 84 | 25 | 47 | B7 | 5F | E1 | 8E | D2 | 0D | A6 |
| CFC0 | 85 | 8E | DA | 86 | 95 | 1D | 27 | 03 | 8E | DA | 8A | B6 | 5F | E1 | AF | C1 |
| CFD0 | ED | C1 | 20 | 2C | 8E | D2 | 0D | A6 | 85 | 8E | DA | 58 | 95 | 1D | 27 | 03 |
| CFE0 | 8E | DA | 5C | AF | C1 | E7 | C0 | 20 | 17 | 8E | D2 | 0D | 34 | 02 | A6 | 85 |
| CFF0 | 8E | DA | 29 | 95 | 1D | 27 | 03 | 8E | DA | 2D | 35 | 02 | AF | C1 | ED | C1 |
| D000 | 5C | C1 | 05 | 23 | A2 | 10 | 9E | 64 | 4F | C6 | 14 | 31 | AB | 5F | A6 | A5 |
| D010 | 81 | E8 | 24 | 2E | 81 | C8 | 25 | 05 | 8E | D9 | FD | 20 | 21 | 81 | 84 | 24 |
| D020 | 21 | 81 | 80 | 27 | 1D | 81 | 79 | 27 | 0D | 81 | 7A | 23 | 0E | 81 | 7F | 23 |
| D030 | 05 | 8E | D9 | D8 | 20 | 08 | 8E | D9 | B1 | 20 | 03 | 8E | D9 | 85 | AF | C1 |
| D040 | ED | C1 | 5C | C1 | 02 | 23 | C7 | 96 | 73 | 27 | 05 | 8E | DA | C3 | AF | C1 |
| D050 | 8E | D8 | 0C | AF | C4 | 96 | 6F | B8 | 5D | 7E | 97 | 7D | 86 | 15 | 9B | 12 |
| D060 | BB | 50 | 10 | 97 | 21 | 86 | 3C | 9B | 12 | 97 | 79 | 96 | 20 | 84 | 7F | D6 |

-continued

| | | | | | | | | | | | | | | | | |
|---|---|---|---|---|---|---|---|---|---|---|---|---|---|---|---|---|
| D070 | 1F | C4 | 7F | DD | 7E | 9E | 66 | 96 | 71 | 84 | 0F | BD | D2 | 4D | 9E | 68 |
| D080 | 96 | 70 | 84 | 0F | BD | D2 | 31 | 96 | 72 | 26 | 09 | 96 | 6C | 43 | B4 | 5A |
| D090 | 8C | B7 | 5A | 8C | B6 | 52 | 83 | 4C | 81 | 07 | 10 | 23 | FE | 30 | B6 | 38 |
| D0A0 | 05 | 43 | B7 | 5D | C1 | C6 | 08 | 8E | 52 | 9F | 10 | 8E | 52 | AF | A6 | 80 |
| D0B0 | 8B | 40 | A7 | A0 | 5A | 26 | F7 | 39 | 34 | 77 | DE | 6A | 37 | 80 | 34 | 77 |
| D0C0 | 10 | 8E | 52 | BF | DE | 6A | 33 | 48 | 37 | 80 | 34 | 77 | 10 | 8E | 52 | BF |
| D0D0 | DE | 6A | 33 | C8 | 10 | 37 | 80 | 34 | 36 | 1F | B8 | 5F | 1F | 01 | D6 | 70 |
| D0E0 | 58 | 58 | 58 | 58 | D7 | 70 | 58 | 96 | 6D | 49 | 10 | 8E | 00 | 08 | E6 | 84 |
| D0F0 | 58 | 48 | 56 | E7 | 80 | 31 | 3F | 26 | F5 | 96 | 6E | 10 | 8E | 00 | 07 | 48 |
| D100 | E6 | 84 | 58 | 48 | 56 | E7 | 80 | 31 | 3F | 26 | F5 | 96 | 71 | 48 | 48 | 48 |
| D110 | 48 | 10 | 8E | 00 | 04 | E6 | 84 | 58 | 48 | 56 | E7 | 80 | 31 | 3F | 26 | F5 |
| D120 | 96 | 6F | 48 | 48 | 48 | 84 | 70 | 34 | 02 | 96 | 0A | 84 | 8F | AA | E0 | 97 |
| D130 | 0A | 96 | 70 | 84 | 70 | 34 | 02 | 96 | 0D | 84 | 80 | 9A | 3B | AA | E0 | 97 |
| D140 | 0D | D6 | 1D | CA | C0 | C4 | BF | 96 | 78 | 26 | 02 | C4 | 7F | D7 | 1D | 1F |
| D150 | B9 | C0 | 40 | 58 | 8E | 50 | 00 | 3A | A6 | 84 | 84 | 7F | D6 | 72 | 27 | 02 |
| D160 | 8A | 80 | A7 | 80 | A6 | 84 | 84 | 7F | D6 | 73 | 27 | 02 | 8A | 80 | A7 | 84 |
| D170 | 35 | B6 | 34 | 36 | 1F | B8 | 5F | 1F | 01 | 10 | 8E | 00 | 08 | 5F | A6 | 84 |
| D180 | 48 | 59 | 44 | A7 | 80 | 31 | 3F | 26 | F5 | 4F | 54 | 46 | D7 | 6D | 84 | 80 |
| D190 | 97 | 70 | 10 | 8E | 00 | 07 | 4F | E6 | 84 | 58 | 49 | 54 | E7 | 80 | 31 | 3F |
| D1A0 | 26 | F5 | 97 | 6E | 10 | 8E | 00 | 04 | 4F | E6 | 84 | 58 | 49 | 54 | E7 | 80 |
| D1B0 | 31 | 3F | 26 | F5 | 97 | 71 | 96 | 0A | 84 | 70 | 44 | 44 | 44 | 97 | 6F | 96 |
| D1C0 | 0A | 84 | 0F | 97 | 0A | 96 | 0D | 84 | 0F | 97 | 3B | 96 | 0D | 84 | 70 | 9A |
| D1D0 | 70 | 44 | 44 | 44 | 44 | 97 | 70 | 96 | 12 | 85 | 40 | 27 | 04 | 8A | 80 | 97 |
| D1E0 | 12 | 5F | 96 | 1D | 48 | 59 | D7 | 78 | 96 | 1D | 84 | 3F | 97 | 1D | 1F | B9 |
| D1F0 | C0 | 40 | 58 | 8E | 50 | 00 | 3A | 5F | A6 | 84 | 48 | 59 | 44 | A7 | 80 | D7 |
| D200 | 72 | 5F | A6 | 84 | 48 | 59 | 44 | D7 | 73 | A7 | 84 | 35 | B6 | 01 | 02 | 04 |
| D210 | 08 | 10 | 20 | 40 | 80 | 03 | 0C | 30 | C0 | 02 | 01 | 08 | 04 | 20 | 10 | 80 |
| D220 | 40 | 34 | 04 | C6 | 05 | 3D | 44 | 56 | 4D | 27 | 02 | C6 | FF | 1F | 98 | 35 |
| D230 | 84 | 34 | 36 | D6 | 0E | 2A | 04 | C6 | 7F | D7 | 0E | F7 | 5D | B0 | D6 | 0F |
| D240 | D1 | 0E | 23 | 04 | D6 | 0E | D7 | 0F | F7 | 5D | AF | 20 | 28 | 34 | 36 | D6 |
| D250 | 10 | 2A | 04 | C6 | 7F | D7 | 10 | 5D | 26 | 04 | C6 | 01 | D7 | 10 | F7 | 5D |
| D260 | B0 | D6 | 11 | D1 | 10 | 23 | 04 | D6 | 10 | D7 | 11 | 5D | 26 | 04 | C6 | 01 |
| D270 | D7 | 11 | F7 | 5D | AF | 34 | 02 | 84 | 07 | 48 | 10 | 8E | D3 | 20 | 10 | AE |
| D280 | A6 | C6 | 80 | 35 | 02 | 34 | 04 | 5F | 84 | 08 | 27 | 02 | C6 | 7F | 34 | 04 |
| D290 | A6 | A0 | A8 | E4 | B1 | 5D | AF | 24 | 03 | B6 | 5D | AF | B1 | 5D | B0 | 23 |
| D2A0 | 03 | B6 | 5D | B0 | 84 | 7F | A7 | 80 | 6A | 61 | 26 | E4 | 32 | 62 | 35 | B6 |
| D2B0 | 34 | 07 | 1C | EF | FC | 52 | CD | 10 | B3 | 52 | CB | 26 | F7 | FC | 53 | 52 |
| D2C0 | 10 | B3 | 53 | 50 | 26 | F7 | FC | 53 | D7 | 10 | B3 | 53 | D5 | 26 | F7 | FC |
| D2D0 | 54 | 5C | 10 | B3 | 54 | 5A | 26 | F7 | C6 | 81 | 5A | 26 | FD | 35 | 87 | 34 |
| D2E0 | 76 | 8E | 50 | 24 | 10 | 8E | 50 | 34 | C6 | 08 | CE | C6 | E0 | EF | 81 | CE |
| D2F0 | C7 | 66 | EF | A1 | 5A | 26 | F3 | B6 | 52 | 8B | F6 | 52 | 89 | 2A | 0D | 8E |
| D300 | C9 | 82 | 81 | 01 | 27 | 03 | 8E | C9 | 8A | BF | 50 | 32 | F6 | 52 | 8A | 2A |
| D310 | 0D | 8E | C9 | 82 | 81 | 02 | 27 | 03 | 8E | C9 | 8A | BF | 50 | 42 | 35 | F6 |
| D320 | D3 | D8 | D4 | D8 | D4 | 58 | D5 | 58 | D3 | 58 | 51 | 02 | 51 | 82 | 52 | 02 |
| D330 | 45 | 58 | 50 | 4F | 2D | 31 | 20 | 20 | 52 | 41 | 44 | 49 | 41 | 4C | 20 | 20 |
| D340 | 41 | 46 | 54 | 52 | 20 | 54 | 43 | 48 | 4C | 4F | 20 | 4C | 45 | 56 | 45 | 4C |
| D350 | 4C | 49 | 4E | 45 | 41 | 52 | 20 | 20 | 00 | 01 | 02 | 03 | 04 | 05 | 06 | 07 |
| D360 | 08 | 09 | 0A | 0B | 0C | 0D | 0E | 0F | 10 | 11 | 12 | 13 | 14 | 15 | 16 | 17 |
| D370 | 18 | 19 | 1A | 1B | 1C | 1D | 1E | 1F | 20 | 21 | 22 | 23 | 24 | 25 | 26 | 27 |
| D380 | 28 | 29 | 2A | 2B | 2C | 2D | 2E | 2F | 30 | 31 | 32 | 33 | 34 | 35 | 36 | 37 |
| D390 | 38 | 39 | 3A | 3B | 3C | 3D | 3E | 3F | 40 | 41 | 42 | 43 | 44 | 45 | 46 | 47 |
| D3A0 | 48 | 49 | 4A | 4B | 4C | 4D | 4E | 4F | 50 | 51 | 52 | 53 | 54 | 55 | 56 | 57 |
| D3B0 | 58 | 59 | 5A | 5B | 5C | 5D | 5E | 5F | 60 | 61 | 62 | 63 | 64 | 65 | 66 | 67 |
| D3C0 | 68 | 69 | 6A | 6B | 6C | 6D | 6E | 6F | 70 | 71 | 72 | 73 | 74 | 75 | 76 | 77 |
| D3D0 | 78 | 79 | 7A | 7B | 7C | 7D | 7E | 7F | 00 | 01 | 01 | 01 | 01 | 01 | 01 | 01 |
| D3E0 | 01 | 01 | 01 | 02 | 02 | 02 | 02 | 02 | 02 | 02 | 02 | 02 | 02 | 02 | 02 | 02 |
| D3F0 | 02 | 03 | 03 | 03 | 03 | 03 | 03 | 03 | 03 | 04 | 04 | 04 | 04 | 04 | 04 | 04 |
| D400 | 05 | 05 | 05 | 05 | 05 | 06 | 06 | 06 | 06 | 06 | 07 | 07 | 07 | 08 | 08 | 08 |
| D410 | 08 | 09 | 09 | 09 | 0A | 0A | 0B | 0B | 0B | 0C | 0C | 0D | 0D | 0E | 0E | 0F |
| D420 | 10 | 10 | 11 | 11 | 12 | 13 | 14 | 14 | 15 | 16 | 17 | 18 | 19 | 1A | 1B | 1C |
| D430 | 1D | 1E | 1F | 20 | 21 | 23 | 24 | 25 | 27 | 28 | 2A | 2C | 2D | 2F | 31 | 33 |
| D440 | 35 | 37 | 39 | 3B | 3E | 40 | 42 | 45 | 48 | 4A | 4D | 50 | 53 | 57 | 5A | 5E |
| D450 | 61 | 65 | 69 | 6D | 71 | 76 | 7A | 7F | 00 | 00 | 00 | 00 | 00 | 00 | 00 | 00 |
| D460 | 00 | 00 | 00 | 00 | 00 | 00 | 00 | 00 | 00 | 00 | 00 | 00 | 00 | 00 | 00 | 00 |
| D470 | 00 | 00 | 00 | 00 | 00 | 00 | 00 | 00 | 00 | 00 | 00 | 00 | 00 | 00 | 00 | 00 |
| D480 | 00 | 00 | 00 | 00 | 00 | 00 | 00 | 00 | 00 | 00 | 00 | 00 | 00 | 00 | 00 | 00 |
| D490 | 00 | 00 | 00 | 00 | 00 | 00 | 00 | 00 | 00 | 00 | 00 | 00 | 00 | 00 | 00 | 00 |
| D4A0 | 00 | 00 | 00 | 00 | 00 | 00 | 00 | 00 | 00 | 00 | 00 | 00 | 00 | 00 | 00 | 00 |
| D4B0 | 00 | 00 | 00 | 00 | 00 | 00 | 00 | 00 | 00 | 00 | 00 | 00 | 00 | 00 | 00 | 00 |
| D4C0 | 00 | 00 | 00 | 00 | 00 | 00 | 00 | 00 | 00 | 00 | 00 | 03 | 09 | 11 | 2E | 3A |
| D4D0 | 45 | 4F | 57 | 5F | 67 | 6F | 77 | 7F | 00 | 00 | 00 | 00 | 00 | 00 | 00 | 00 |
| D4E0 | 00 | 00 | 00 | 00 | 01 | 01 | 01 | 01 | 01 | 01 | 01 | 01 | 02 | 02 | 02 | 02 |
| D4F0 | 02 | 02 | 03 | 03 | 03 | 03 | 04 | 04 | 04 | 04 | 05 | 05 | 05 | 06 | 06 | 06 |
| D500 | 06 | 07 | 07 | 08 | 08 | 08 | 09 | 09 | 09 | 0A | 0A | 0B | 0B | 0C | 0C | 0D |
| D510 | 0D | 0E | 0E | 0F | 0F | 10 | 10 | 11 | 11 | 12 | 12 | 13 | 14 | 14 | 15 | 16 |
| D520 | 16 | 17 | 18 | 19 | 19 | 1A | 1B | 1C | 1C | 1D | 1E | 1F | 20 | 21 | 22 | 22 |
| D530 | 23 | 24 | 25 | 26 | 27 | 29 | 2A | 3B | 2C | 2D | 2E | 2F | 31 | 32 | 33 | 35 |
| D540 | 36 | 38 | 39 | 3B | 3C | 3E | 40 | 41 | 43 | 45 | 47 | 49 | 4B | 4E | 50 | 53 |
| D550 | 55 | 58 | 5C | 5F | 64 | 69 | 6F | 7F | 00 | 01 | 01 | 01 | 01 | 01 | 01 | 01 |
| D560 | 01 | 01 | 01 | 01 | 01 | 01 | 01 | 01 | 01 | 01 | 01 | 01 | 01 | 01 | 01 | 01 |
| D570 | 01 | 01 | 01 | 01 | 01 | 01 | 01 | 01 | 01 | 01 | 01 | 01 | 01 | 01 | 01 | 01 |
| D580 | 01 | 01 | 01 | 01 | 01 | 01 | 01 | 01 | 01 | 01 | 01 | 01 | 01 | 01 | 01 | 01 |

-continued

| | | | | | | | | | | | | | | | | |
|---|---|---|---|---|---|---|---|---|---|---|---|---|---|---|---|---|
| D590 | 01 | 01 | 01 | 01 | 01 | 01 | 01 | 01 | 01 | 01 | 01 | 01 | 01 | 01 | 01 | 01 |
| D5A0 | 01 | 01 | 01 | 01 | 01 | 01 | 01 | 01 | 01 | 01 | 01 | 01 | 01 | 01 | 01 | 01 |
| D5B0 | 01 | 01 | 01 | 01 | 01 | 01 | 01 | 01 | 01 | 01 | 01 | 01 | 01 | 01 | 01 | 01 |
| D5C0 | 01 | 01 | 01 | 01 | 01 | 01 | 01 | 01 | 01 | 03 | 06 | 0A | 0F | 15 | 1C | 24 |
| D5D0 | 2D | 37 | 42 | 4E | 5B | 69 | 78 | 7F | 34 | 06 | B6 | 5D | 78 | B7 | 30 | 18 |
| D5E0 | F6 | 5D | 7B | C4 | 0F | F7 | 30 | 08 | CA | 30 | F7 | 30 | 08 | BF | 5D | 79 |
| D5F0 | B7 | 30 | 18 | C4 | 0F | CA | 10 | F7 | 30 | 08 | CA | 30 | F7 | 30 | 08 | B6 |
| D600 | 5D | 7A | B7 | 30 | 18 | C4 | 0F | CA | 20 | F7 | 30 | 08 | CA | 30 | F7 | 30 |
| D610 | 08 | F7 | 5D | 7B | 35 | 86 | B6 | 5D | 7B | 8A | 08 | B7 | 30 | 08 | B6 | 38 |
| D620 | 04 | 39 | 8E | 52 | 9F | F6 | 5D | 7B | C4 | 07 | 3A | C6 | B8 | B6 | 38 | 04 |
| D630 | 3D | 80 | 1B | AB | 08 | 81 | 7F | 23 | 09 | 81 | C0 | 22 | 04 | 86 | 7F | 20 |
| D640 | 01 | 4F | 7D | 5D | 84 | 26 | 07 | 8C | 52 | A4 | 26 | 02 | 8D | 3D | A7 | 84 |
| D650 | F6 | 5D | 7B | C4 | F0 | CA | 07 | F7 | 30 | 08 | 39 | 8D | 1E | 34 | 06 | F6 |
| D660 | 5D | 7B | C4 | 07 | 5C | C1 | 05 | 23 | 01 | 5F | 34 | 04 | F6 | 5D | 7B | C4 |
| D670 | F0 | EA | E0 | F7 | 5D | 7B | F7 | 30 | 08 | 35 | 86 | 34 | 06 | C6 | 1D | 34 |
| D680 | 04 | BD | C6 | A7 | 35 | 04 | 5A | 26 | F6 | 35 | 86 | 34 | 10 | 81 | 30 | 25 |
| D690 | 0B | 81 | 4F | 22 | 07 | 8E | D6 | 9E | 80 | 30 | A6 | 86 | 35 | 90 | 30 | 32 |
| D6A0 | 33 | 35 | 37 | 38 | 3A | 3C | 3D | 3F | 40 | 40 | 40 | 40 | 40 | 40 | 40 | 40 |
| D6B0 | 40 | 40 | 40 | 40 | 40 | 41 | 43 | 44 | 46 | 48 | 49 | 4B | 4D | 4E | 8E | 5A |
| D6C0 | 8D | F6 | 52 | C5 | C1 | 58 | 25 | 1E | C6 | 57 | F7 | 52 | C5 | 4F | B7 | 5D |
| D6D0 | 7F | B7 | 52 | 83 | 8B | 40 | 1F | 8B | 96 | 7A | 97 | 7B | 0F | 7A | B6 | 52 |
| D6E0 | 83 | 4C | 81 | 07 | 23 | 3B | A6 | 85 | 26 | 78 | B7 | 5D | 7F | 5A | 2B | 6C |
| D6F0 | A6 | 85 | 26 | 6E | 5A | 2B | 65 | A6 | 85 | 26 | 67 | 5A | 2B | 5E | A6 | 85 |
| D700 | 26 | 60 | 5A | 2B | 57 | A6 | 85 | 26 | 59 | 5A | 2B | 50 | A6 | 85 | 26 | 52 |
| D710 | 5A | 2B | 49 | A6 | 85 | 26 | 4B | 5A | 2B | 42 | A6 | 85 | 26 | 44 | 5A | 2B |
| D720 | 3B | A6 | 85 | 26 | 3D | 5A | 2B | 34 | A6 | 85 | 26 | 36 | 5A | 2B | 2D | A6 |
| D730 | 85 | 26 | 2F | 5A | A6 | 85 | 26 | 3A | 5A | 2B | 21 | A6 | 85 | 26 | 23 | 5A |
| D740 | 2B | 1A | A6 | 85 | 26 | 1C | 5A | 2B | 13 | A6 | 85 | 26 | 15 | 5A | 2B | 0C |
| D750 | A6 | 85 | 26 | 0E | 5A | 2B | 05 | A6 | 85 | 26 | 07 | 5A | C4 | 7F | F7 | 52 |
| D760 | C5 | 39 | B6 | 5D | 7F | 26 | F7 | 86 | FF | B7 | 30 | 20 | B7 | 5D | 7C | C4 |
| D770 | 7F | 8E | 5D | 5D | 10 | 8E | BF | 92 | 4F | B7 | 52 | 83 | 8B | 40 | 1F | 8B |
| D780 | 96 | 73 | 27 | 13 | 96 | 6C | B5 | 52 | 82 | 27 | 0C | BD | D9 | 77 | 25 | 07 |
| D790 | 1F | B8 | A7 | 80 | 10 | AF | 81 | B6 | 52 | 83 | 4C | 81 | 07 | 23 | DA | A7 |
| D7A0 | 80 | 10 | 8E | BF | 78 | 10 | AF | 81 | F7 | 52 | C5 | CA | 80 | F7 | 5D | 80 |
| D7B0 | F7 | 30 | 20 | 39 | B6 | 38 | 05 | 34 | 02 | B8 | 5D | C1 | B7 | 5D | C0 | 35 |
| D7C0 | 02 | B7 | 5D | C1 | 8E | 52 | 9F | A6 | 84 | A1 | 88 | 10 | 24 | 07 | A6 | 88 |
| D7D0 | 10 | A0 | 84 | 20 | 03 | A0 | 88 | 10 | A7 | 88 | 18 | 81 | 02 | 23 | 05 | A6 |
| D7E0 | 84 | A7 | 88 | 10 | 20 | 01 | 8C | 52 | A4 | 23 | DC | 4F | 8E | D2 | 0D | E6 |
| D7F0 | 86 | F5 | 52 | 82 | 26 | 06 | 4C | 81 | 07 | 23 | F1 | 39 | B7 | 52 | 83 | 8B |
| D800 | 40 | 1F | 8B | DE | 64 | 4F | C6 | 3C | 33 | CB | 37 | 80 | B6 | 52 | 83 | 4C |
| D810 | 81 | 07 | 23 | D8 | 39 | 8E | 00 | 00 | A6 | 89 | 5B | 4D | 26 | 16 | B6 | 5A |
| D820 | 8C | 27 | 09 | A6 | 89 | 5A | 8D | 27 | 03 | BD | D9 | 24 | 40 | 01 | 8C | 00 |
| D830 | 58 | 23 | E5 | 39 | 81 | 10 | 25 | 0A | 8B | 1F | A6 | 89 | 5B | 4D | 84 | 0F |
| D840 | 27 | D6 | BD | D8 | C4 | 1A | 40 | A6 | 89 | 5B | 4D | 26 | 08 | 6F | 89 | 5A |
| D850 | 8D | 1C | BF | 20 | C3 | 1C | BF | 20 | BD | 1A | 40 | A6 | 89 | 5B | 4D | 80 |
| D860 | 10 | A7 | 89 | 5B | 4D | 1C | BF | 4F | 10 | 8E | D2 | OD | E6 | A6 | F5 | 52 |
| D870 | 82 | 26 | 06 | 4C | 81 | 07 | 23 | F0 | 39 | B7 | 52 | 83 | 8B | 40 | 1F | 8B |
| D880 | BD | D9 | 75 | 25 | 36 | 96 | 3B | 8A | 90 | 0D | 78 | 27 | 04 | D6 | 79 | 20 |
| D890 | 04 | DB | 21 | 2B | 26 | FD | 52 | BF | A6 | 89 | 5A | 8D | 44 | 10 | 9E | 66 |
| D8A0 | A6 | A6 | 84 | 7F | 91 | 6D | 22 | 13 | 91 | 6E | 25 | 0F | B7 | 52 | C1 | BD |
| D8B0 | D0 | CA | 10 | 9E | 64 | 31 | A5 | 6C | A9 | 00 | 80 | B6 | 52 | 83 | 4C | 81 |
| D8C0 | 07 | 23 | A5 | 39 | 6A | 89 | 5B | 4D | 4F | 10 | 8E | D2 | 0D | E6 | A6 | F5 |
| D8D0 | 52 | 82 | 26 | 06 | 4C | 81 | 07 | 23 | F0 | 39 | B7 | 52 | 83 | 8B | 40 | 1F |
| D8E0 | 8B | BD | D9 | 75 | 25 | 35 | 96 | 3B | 8A | 80 | 0D | 78 | 27 | 04 | D6 | 79 |
| D8F0 | 20 | 04 | BD | 21 | 2B | 25 | FD | 52 | BF | A6 | 89 | 5A | ED | 44 | 10 | 9E |
| D900 | 66 | A6 | A6 | 84 | 7F | B7 | 52 | C1 | 10 | 9E | 64 | 31 | A5 | A6 | A9 | 00 |
| D910 | 80 | 27 | 08 | 4A | A7 | A9 | 00 | 80 | BD | D0 | CA | B6 | 52 | 83 | 4C | 8A |
| D920 | 07 | 23 | A6 | 39 | A6 | 89 | 5B | AD | A1 | 89 | 5C | 05 | 26 | 01 | 39 | A7 |
| D930 | 89 | 5C | 05 | 4F | BD | 8B | FB | 96 | 6C | B5 | 5A | 8C | 27 | 2E | BD | D9 |
| D940 | 75 | 25 | 29 | 96 | 3B | 8A | A0 | 0D | 78 | 27 | 04 | D6 | 79 | 20 | 04 | DB |
| D950 | 21 | 2B | 19 | FD | 52 | BF | E6 | 89 | 5B | AD | 2B | 01 | 5F | C4 | 7F | 10 |
| D960 | 9E | 68 | A6 | A6 | 84 | 7F | B7 | 52 | C1 | BD | D0 | CA | B6 | 52 | 83 | 4C |
| D970 | 81 | 07 | 23 | C0 | 39 | 1F | 10 | D1 | 0C | 25 | 07 | D1 | 0B | 22 | 03 | 1C |
| D980 | FE | 39 | A1 | 01 | 39 | 96 | 3B | 8A | B0 | 37 | 04 | FD | 52 | BF | 7F | 52 |
| D990 | C1 | 37 | 04 | 10 | 8E | D2 | 0E | B6 | 5D | C0 | A4 | A5 | 27 | 11 | B6 | 5D |
| D9A0 | C1 | 98 | 7D | A4 | A5 | 26 | 05 | 86 | 75 | B7 | 52 | C1 | BD | D0 | CA | 37 |
| D9B0 | 80 | 96 | 3B | 8A | B0 | 37 | 04 | FD | 52 | BF | 7F | 52 | C1 | 37 | 04 | 10 |
| D9C0 | 8E | D2 | 0E | B6 | 5D | C0 | A4 | A5 | 27 | 0C | B6 | 5D | C1 | 98 | 7D | A4 |
| D9D0 | A5 | 26 | 03 | BD | D0 | CA | 37 | 80 | 37 | 02 | 8B | 79 | B7 | 52 | BF | 37 |
| D9E0 | 04 | 10 | 8E | D2 | 0E | B6 | 5D | C0 | A4 | A5 | 27 | 0F | BF | 5D | C1 | 98 |
| D9F0 | 7D | A4 | A5 | 26 | 06 | B6 | 52 | BF | BD | D0 | B8 | 37 | 80 | 86 | 70 | BD |
| DA00 | 8B | 98 | 37 | 02 | 80 | C8 | 84 | 1F | C6 | 18 | 3D | 31 | AB | 37 | 04 | 8E |
| DA10 | D2 | 0E | B6 | 5D | C0 | A4 | 85 | 27 | 0E | B6 | 5D | C1 | 98 | 7D | A4 | 85 |
| DA20 | 26 | 05 | DC | 7E | BD | 8D | B1 | 37 | 80 | 0F | 75 | 20 | 04 | 86 | FF | 97 |
| DA30 | 75 | 96 | 3B | 8A | B0 | 37 | 04 | FD | 52 | BF | 37 | 04 | 10 | 8E | 52 | B7 |
| DA40 | A6 | A5 | 81 | 02 | 23 | 10 | 10 | 8E | 52 | 9F | A6 | A5 | 98 | 75 | 84 | 7F |
| DA50 | B7 | 52 | C1 | BD | D0 | CA | 37 | 80 | 0F | 75 | 20 | 04 | 86 | FF | 97 | 75 |
| DA60 | 96 | 3B | 8A | E0 | 5F | FD | 52 | BF | 37 | 04 | 10 | 8E | 52 | B7 | A6 | A5 |
| DA70 | 81 | 02 | 23 | 10 | 10 | 8E | 52 | 9F | A6 | A5 | 98 | 75 | 84 | 7F | B7 | 52 |
| DA80 | C1 | BD | D0 | CA | 37 | 80 | 0F | 75 | 20 | 04 | C6 | FF | D7 | 75 | 10 | 8E |
| DA90 | 5F | DF | 9E | 64 | C6 | 7E | 3A | 37 | 04 | C4 | 01 | 31 | A5 | 34 | 20 | 3A |
| DAA0 | 37 | 04 | 10 | 8E | 52 | B7 | A6 | A5 | 81 | 02 | 23 | 13 | 10 | 8E | 52 | 9F |

-continued

| | | | | | | | | | | | | | | | | |
|---|---|---|---|---|---|---|---|---|---|---|---|---|---|---|---|---|
| DAB0 | A6 | A5 | 98 | 75 | 84 | 7F | A7 | 84 | AE | E4 | A7 | 84 | 7C | 5F | E1 | 32 |
| DAC0 | 62 | 37 | 80 | 96 | 7B | 2B | 01 | 4F | 84 | 7F | 10 | 9E | 68 | E6 | A6 | C4 |
| DAD0 | 7F | D1 | 77 | 27 | OC | D7 | 77 | 96 | 3B | 8A | D0 | FD | 52 | BF | BD | D0 |
| DAE0 | BE | 37 | 80 | B6 | 5D | 8A | 8A | E0 | 84 | BF | B7 | 30 | 04 | 8A | E0 | 84 |
| DAF0 | DF | 34 | 02 | BD | D5 | D8 | 35 | 02 | F6 | 38 | 03 | C4 | 0F | 34 | 04 | B7 |
| DB00 | 30 | 04 | 8A | E0 | 84 | 7F | F6 | 38 | 03 | 58 | 58 | 58 | 58 | EA | E0 | 53 |
| DB10 | F7 | 5D | 92 | 34 | 04 | F8 | 5D | 90 | E4 | E4 | F7 | 5D | 8E | 35 | 04 | F7 |
| DB20 | 5D | 90 | B7 | 30 | 04 | 8A | E0 | 12 | F6 | 38 | 03 | C4 | 0F | 34 | 04 | B7 |
| DB30 | 30 | 04 | B7 | 5D | 8A | F6 | 38 | 03 | 58 | 58 | 58 | 58 | EA | E0 | 53 | C5 |
| DB40 | 0C | 27 | 28 | B6 | 5D | 95 | 4C | 84 | 07 | B7 | 5D | 95 | 26 | 25 | B6 | 5D |
| DB50 | 94 | 4A | 27 | 05 | B7 | 5D | 94 | 20 | 1A | 86 | 0B | B7 | 5D | 94 | 1F | 98 |
| DB60 | 84 | 0C | 43 | B4 | 5D | 91 | B7 | 5D | 91 | 20 | 08 | 86 | 4B | B7 | 5D | 94 |
| DB70 | 7F | 5D | 95 | 34 | 04 | F8 | 5D | 91 | E4 | E4 | F7 | 5D | 8F | 35 | 04 | F7 |
| DB80 | 5D | 91 | B6 | 38 | 05 | B8 | 5D | 7E | 84 | 01 | 34 | 02 | B7 | 5D | 7C | B8 |
| DB90 | 5D | 7D | 85 | 01 | 27 | 08 | 86 | 80 | BA | 5D | 7C | B7 | 5D | 7C | 35 | 02 |
| DBA0 | B7 | 5D | 7D | 39 | 80 | 20 | 8D | 16 | 4D | 2A | 01 | 4F | 81 | 60 | 25 | 02 |
| DBB0 | 86 | 5F | 8B | 20 | 39 | 34 | 36 | 86 | 01 | B7 | 5D | AC | 20 | 05 | 34 | 36 |
| DBC0 | 7F | 5D | AC | B6 | 5D | 8B | 85 | 04 | 26 | 08 | 85 | 08 | 27 | 0D | 86 | FF |
| DBD0 | 20 | 02 | 86 | 01 | 7F | 5D | AE | AB | E0 | 35 | B4 | B6 | 5D | AE | 26 | 10 |
| DBE0 | B6 | 52 | A3 | B0 | 5D | BC | 2A | 01 | 40 | 81 | 0F | 25 | 24 | 7C | 5D | AE |
| DBF0 | B6 | 52 | A3 | B1 | 5D | BC | 27 | 19 | 1F | 89 | B0 | 5D | BC | F7 | 5D | BC |
| DC00 | 7D | 5D | AC | 27 | 08 | 32 | 61 | 1F | 98 | 44 | 44 | 35 | B4 | AB | E0 | 35 |
| DC10 | B4 | B6 | 5D | 65 | 27 | 19 | 81 | 10 | 24 | 08 | 7F | 5B | 65 | 7F | 5D | 87 |
| DC20 | 20 | 0D | 86 | FF | B7 | 5D | 87 | B6 | 5B | 65 | 84 | 0F | B7 | 5B | 65 | 8E |
| DC30 | 5B | 67 | 4F | 10 | 8E | DC | C7 | E6 | 84 | C1 | 10 | 24 | 0A | E6 | A0 | 3A |
| DC40 | 4C | 81 | 0C | 23 | F2 | 20 | 16 | C4 | 0F | E7 | 84 | C6 | 0A | 3D | 1F | 98 |
| DC50 | 7D | 5D | 87 | 27 | 01 | 40 | 7F | 5D | AE | 32 | 61 | 35 | B4 | 86 | FF | 8E |
| DC60 | 5B | 7D | 10 | 8E | DC | C6 | E6 | 84 | C1 | 10 | 24 | 0A | E6 | A0 | 3A | 4C |
| DC70 | 81 | 09 | 23 | F2 | 35 | B6 | C4 | 07 | E7 | 84 | 7F | 5D | AE | 4D | 26 | 04 |
| DC80 | 32 | 61 | 35 | B4 | 7D | 5D | 87 | 27 | 01 | 40 | AB | E0 | 35 | B4 | B6 | 5B |
| DC90 | 4D | 81 | 10 | 24 | 1B | B6 | 5B | 4F | 81 | 10 | 24 | 09 | B6 | 5B | 50 | 81 |
| DCA0 | 10 | 24 | 18 | 4F | 39 | 7F | 5D | AE | 84 | 0F | B7 | 5B | 4F | 86 | 01 | 39 |
| DCB0 | 7F | 5D | AE | 84 | 0F | B7 | 5B | 4D | 86 | FF | 39 | 7F | 5D | AE | 84 | 0F |
| DCC0 | B7 | 5B | 50 | 86 | C1 | 39 | 02 | 01 | 02 | 02 | 01 | 02 | 02 | 02 | 01 | 02 |
| DCD0 | 02 | 01 | 02 | 8E | E7 | 1D | BD | C0 | 54 | BD | E0 | 8C | 25 | 79 | BD | E0 |
| DCE0 | 40 | B6 | 57 | 4E | 48 | 10 | 8E | DC | E9 | 6E | B6 | DC | FD | DD | A0 | DD |
| DCF0 | 2E | DD | 57 | DD | 3D | DD | 29 | DD | 58 | DD | 33 | DD | 18 | B6 | 52 | 99 |
| DD00 | BD | 8B | 98 | 1F | 21 | BD | DD | 8A | B6 | 52 | 99 | BD | 8B | BE | 1F | 21 |
| DD10 | BD | DD | 8A | 25 | 42 | 7E | DE | 4C | 8E | 5D | DD | 8D | 6D | 25 | 38 | 8E |
| DD20 | 5E | DD | 8D | 66 | 25 | 31 | 7E | DE | 4C | 8E | 67 | 00 | 20 | 08 | 8E | 6D |
| DD30 | 00 | 20 | 03 | 8E | 6D | 80 | 8D | 4F | 25 | 1D | 7E | DE | 4C | 86 | 70 | BD |
| DD40 | 8B | 98 | 1F | 21 | 10 | 8E | 00 | 03 | 8D | 40 | 25 | 0B | 30 | 89 | 01 | 00 |
| DD50 | 31 | 3F | 26 | F4 | BD | DE | 4C | 39 | 8E | 57 | 65 | 10 | 8E | 50 | EA | C6 |
| DD60 | 18 | BD | 81 | 32 | C6 | 68 | 4F | A7 | 80 | 5A | 26 | FB | 10 | 8E | 51 | 02 |
| DD70 | C6 | 80 | BD | 81 | 32 | 8E | 57 | 65 | 8D | 10 | 25 | 0A | 8E | 51 | 82 | 8D |
| DD80 | 09 | 25 | 03 | BD | DE | 4C | 39 | BD | CC | 04 | BD | EO | 5C | 25 | F7 | 7E |
| DD90 | E6 | 1A | A6 | A0 | BD | D3 | 24 | 25 | 04 | 5A | 26 | F6 | 39 | 32 | 62 | 39 |
| DDA0 | 8E | 8F | 41 | 10 | 8E | 50 | 5A | C6 | 07 | BD | 81 | 3D | 8E | 57 | 65 | BF |
| DDB0 | 5D | B1 | 4F | B7 | 5D | CD | C6 | 18 | BD | C1 | 5C | BD | C0 | 9C | BD | 8B |
| DDC0 | 98 | 5F | 8D | CE | B6 | 5D | CD | BD | 8B | BE | C6 | 20 | 8D | C4 | B6 | 5D |
| DDD0 | CD | 4C | 81 | 63 | 23 | DD | 10 | 8E | 56 | E6 | C6 | 64 | 8D | B4 | C6 | 1C |
| DDE0 | 8D | 2B | 10 | 8E | 50 | EA | C6 | 18 | 8D | A8 | 10 | 8E | 6D | 80 | C6 | 64 |
| DDF0 | 8D | A0 | C6 | 04 | 8D | 17 | 10 | 8E | 51 | 02 | 8E | 01 | 80 | 8D | 17 | 86 |
| DE00 | 70 | BD | 8B | 98 | 8E | 03 | 00 | 8D | 0D | BD | DE | 4C | 39 | 4F | 8D | 14 |
| DE10 | 25 | 0F | 5A | 26 | F9 | 39 | A6 | A0 | 8D | 0A | 25 | 05 | 30 | 1F | 26 | F6 |
| DE20 | 39 | 32 | 62 | 39 | 34 | 16 | BE | 5D | B1 | A7 | 80 | 8C | 58 | 65 | 24 | 07 |
| DE30 | BF | 5D | B1 | 1C | FE | 35 | 96 | 8E | 57 | 65 | BF | 5D | B1 | BD | E0 | 5C |
| DE40 | 25 | 05 | BD | E6 | 1A | 24 | 03 | 32 | 64 | 39 | 35 | 96 | 34 | 36 | BD | E0 |
| DE50 | 40 | BD | E0 | 5C | 25 | 05 | BD | E3 | F4 | 20 | F6 | 8D | 07 | 25 | 02 | 35 |
| DE60 | B6 | 32 | 66 | 39 | 34 | 36 | 86 | 68 | BD | 8B | 98 | 1F | 21 | 4F | 5F | BD |
| DE70 | E6 | 1A | 25 | 17 | 5C | 30 | 89 | 01 | 00 | BD | E6 | 1A | 25 | 0D | 8E | 58 |
| DE80 | 65 | FC | 59 | 65 | BD | E6 | 1A | 25 | 02 | 35 | B6 | 8E | E9 | A2 | 32 | 66 |
| DE90 | 39 | 34 | 16 | CC | 00 | 40 | FD | 5A | 7C | B7 | 5D | DA | B7 | 5A | 7B | B7 |
| DEA0 | 5A | 77 | B7 | 5D | B3 | 10 | 8E | 48 | 00 | C6 | 02 | FD | 59 | 65 | B7 | 59 |
| DEB0 | 67 | BD | E4 | 29 | 25 | 2D | 8E | 58 | 65 | BD | E5 | 82 | 25 | 25 | 8D | 7C |
| DEC0 | A6 | 84 | 27 | 27 | B6 | 59 | 67 | 8B | 40 | B7 | 59 | 57 | 26 | F0 | 4F | F6 |
| DED0 | 59 | 66 | 5C | F7 | 59 | 66 | C1 | 40 | 25 | DC | 86 | 01 | B7 | 5D | DA | 1C |
| DEE0 | FE | 35 | 96 | 7F | 52 | 90 | 32 | 64 | 1A | 01 | 39 | 7C | 5A | 77 | B6 | 5D |
| DEF0 | B3 | 27 | 29 | 2B | 1D | B6 | 5A | 7B | 81 | 40 | 24 | 29 | 7C | 5A | 7B | 8D |
| DF00 | 3B | C6 | 18 | 34 | 20 | BD | 81 | 3D | 35 | 20 | FC | 59 | 65 | ED | 23 | 31 |
| DF10 | A8 | 18 | 8D | 28 | E6 | 07 | CB | 80 | EC | 05 | F9 | 5A | 7D | B9 | 5A | 7C |
| DF20 | FD | 5A | 7C | 20 | 9F | 86 | FF | B7 | 5D | B3 | 20 | E6 | B6 | 5A | 79 | 4C |
| DF30 | B1 | 5A | 77 | 26 | DD | 86 | 01 | B7 | 5D | B3 | 20 | B9 | 34 | 06 | 8E | 58 |
| DF40 | 65 | F6 | 59 | 67 | 4F | 30 | 8B | 35 | 86 | 34 | 06 | B6 | 52 | 9A | 81 | 63 |
| DF50 | 22 | 07 | C6 | 18 | BD | C1 | 5B | 20 | 06 | CC | 2D | 2D | FD | 50 | 62 | BD |
| DF60 | C0 | 9C | 6D | E4 | 27 | 09 | BD | E0 | 5C | 25 | 1B | 6A | E4 | 20 | F3 | BD |
| DF70 | E0 | 5C | 15 | 12 | 8E | 57 | 65 | BD | E5 | 82 | 25 | 0A | 8E | 57 | 65 | 35 |
| DF80 | 06 | 30 | 8B | 1C | FE | 39 | 32 | 62 | 39 | 8D | 0B | 25 | 06 | A7 | A0 | 5A |
| DF90 | 26 | F7 | 39 | 32 | 62 | 39 | 34 | 14 | BE | 5D | B1 | 8C | 58 | 65 | 24 | 09 |
| DFA0 | A6 | 80 | BF | 5D | B1 | 1C | FE | 35 | 94 | 8E | 57 | 65 | BF | 5D | B1 | BD |
| DFB0 | E0 | 5C | 25 | 05 | BD | E5 | 82 | 24 | DF | 32 | 63 | 39 | 34 | 36 | BD | E0 |
| DFC0 | 12 | 25 | 47 | EC | 03 | FD | 59 | 65 | 10 | 83 | 00 | 40 | 24 | 3C | BD | E0 |

-continued

| | | | | | | | | | | | | | | | | |
|---|---|---|---|---|---|---|---|---|---|---|---|---|---|---|---|---|
| DFD0 | 2E | BD | E4 | 77 | 25 | 37 | FC | 59 | 65 | 8E | 58 | 65 | BD | E5 | 82 | 25 |
| DFE0 | 2C | 7F | 59 | 67 | F6 | 59 | 67 | 4F | 8E | 58 | 65 | 30 | 8B | 10 | 8E | 57 |
| DFF0 | 4D | C6 | 18 | A6 | 80 | A1 | A0 | 26 | 07 | 5A | 26 | F7 | 1C | FE | 35 | B6 |
| E000 | B6 | 59 | 67 | 8B | 40 | B7 | 59 | 67 | 26 | DA | 8E | EA | A1 | 32 | 66 | 1A |
| E010 | 01 | 39 | 34 | 06 | B6 | 5A | 7A | B0 | 5A | 79 | 81 | 3F | 22 | 0C | C6 | 18 |
| E020 | 3D | 83 | 48 | 00 | 30 | 8B | 1C | FE | 35 | 86 | 1A | 01 | 35 | 86 | 34 | 36 |
| E030 | 10 | 8E | 57 | 4D | C6 | 18 | BD | 81 | 3D | 4F | 5F | ED | A8 | EB | 35 | B6 |
| E040 | 34 | 06 | CE | 58 | 7D | 8E | 58 | 65 | F6 | 59 | 67 | 4F | 33 | CB | 30 | 8B |
| E050 | E6 | C0 | F7 | 59 | 6B | EC | C1 | FD | 59 | 69 | 35 | 86 | B6 | 59 | 6B | 27 |
| E060 | 19 | FC | 59 | 69 | 34 | 06 | C3 | 00 | 01 | FD | 59 | 69 | 7A | 59 | 6B | 35 |
| E070 | 06 | 10 | 83 | 00 | 40 | 25 | 0E | 1C | FE | 39 | E6 | C0 | F7 | 59 | 6B | 27 |
| E080 | 04 | EC | C1 | 20 | DF | 8E | EA | B0 | 4F | 1A | 01 | 39 | 34 | 36 | BD | E1 |
| E090 | F4 | FD | 59 | 6C | BD | E4 | 29 | 10 | 25 | 01 | 54 | CC | 00 | 02 | FD | 59 |
| E0A0 | 65 | 8E | 58 | 65 | BD | E5 | 82 | 10 | 25 | 01 | 44 | 5F | 4F | F7 | 59 | 67 |
| E0B0 | 6D | 8B | 26 | 15 | CB | 40 | 26 | F5 | FC | 59 | 65 | 5C | F7 | 59 | 66 | C1 |
| E0C0 | 40 | 25 | DE | 8E | E9 | BD | 16 | 01 | 26 | 8E | 57 | 4D | 10 | 8E | 58 | 65 |
| E0D0 | 4F | 31 | AB | C6 | 18 | BD | 81 | 3D | 4F | C6 | 28 | A7 | A0 | 5A | 26 | FB |
| E0E0 | 7F | 59 | 68 | CC | 00 | 40 | FD | 59 | 69 | FC | 59 | 69 | 7F | 59 | 6B | 10 |
| E0F0 | 83 | 0A | 00 | 25 | 06 | 8E | E9 | D4 | 16 | 00 | F4 | BD | E3 | EC | 27 | 08 |
| E100 | C3 | 00 | 01 | FD | 59 | 69 | 20 | E7 | B6 | 59 | 6B | 4C | 27 | 10 | B7 | 59 |
| E110 | 6B | FC | 59 | 69 | FB | 59 | 6B | 89 | 00 | BD | E3 | EC | 27 | EA | 7C | 59 |
| E120 | 68 | FC | 59 | 6C | 4D | 26 | 07 | F1 | 59 | 6B | 10 | 23 | 00 | 9F | 8E | 58 |
| E130 | 7A | B6 | 59 | 68 | C6 | 03 | 3D | FB | 59 | 67 | 30 | 8B | B6 | 59 | 6B | A7 |
| E140 | 84 | FC | 59 | 69 | ED | 01 | 4F | F6 | 59 | 6B | 34 | 06 | FC | 59 | 6C | A3 |
| E150 | E1 | FD | 59 | 6C | F6 | 59 | 6B | 4F | F3 | 59 | 69 | FD | 59 | 69 | B6 | 59 |
| E160 | 68 | 81 | 0C | 25 | 84 | 7F | 5D | CD | 7F | 5D | CE | 86 | FF | B7 | 5D | CF |
| E170 | 8E | 58 | 7D | F6 | 5D | CD | 3A | F6 | 59 | 67 | 4F | 30 | 8B | A6 | 84 | 27 |
| E180 | 18 | B1 | 5D | CF | 24 | 09 | B7 | 5D | CF | B6 | 5D | CD | B7 | 5D | CE | B6 |
| E190 | 5D | CD | 8B | 03 | B7 | 5D | CD | 20 | D7 | C6 | 27 | F0 | 5D | CE | 2F | 28 |
| E1A0 | 4F | 1F | 02 | 8E | 58 | 7D | F6 | 5D | CE | 3A | F6 | 59 | 67 | 4F | 30 | 8B |
| E1B0 | A6 | 03 | A7 | 80 | 31 | 3F | 26 | F8 | 7A | 59 | 68 | 4F | F6 | 5D | CF | F3 |
| E1C0 | 59 | 6C | FD | 59 | 6C | 16 | FF | 21 | 8E | E9 | E1 | 20 | 22 | 8E | 58 | 7A |
| E1D0 | B6 | 59 | 68 | C6 | 03 | 3D | FB | 59 | 67 | 30 | 8B | B6 | 59 | 6D | A7 | 84 |
| E1E0 | FC | 59 | 69 | ED | 01 | 4F | 5F | ED | 03 | ED | 05 | 1C | FE | 35 | B6 | 1A |
| E1F0 | 01 | 32 | 66 | 39 | FC | 57 | 52 | 7D | 57 | 54 | 27 | 03 | C3 | 00 | 01 | 39 |
| E200 | 34 | 43 | 8E | E7 | 29 | BD | CO | 54 | BD | E4 | 77 | 25 | 57 | CC | 00 | 02 |
| E210 | FD | 59 | 65 | B7 | 59 | 67 | 8E | 58 | 65 | BD | E5 | 82 | 25 | 46 | 5F | 4F |
| E220 | F7 | 59 | 67 | 6D | 8B | 27 | 14 | CB | 40 | 26 | F5 | FC | 59 | 65 | 5C | F7 |
| E230 | 59 | 66 | C1 | 40 | 25 | E0 | 4F | 1C | FE | 35 | B4 | 30 | 8B | A6 | 01 | B1 |
| E240 | 57 | 4E | 26 | 17 | 30 | 08 | 10 | 8E | 57 | 55 | C6 | 10 | A6 | 80 | A1 | A0 |
| F250 | 26 | 09 | 5A | 26 | F7 | 86 | 01 | 1C | FE | 35 | B4 | 4F | F6 | 59 | 67 | 8E |
| E260 | 58 | 65 | 20 | C3 | 32 | 65 | 39 | BD | E0 | 40 | BD | E3 | 31 | BD | D0 | 8C |
| E270 | 10 | 25 | 00 | 9D | 8E | 92 | 84 | BD | C0 | 54 | BD | D1 | F4 | FD | 5D | B3 |
| E280 | BD | E0 | 40 | FC | 5D | B3 | 10 | 27 | 00 | 81 | BD | E3 | 3E | 7F | 5D | B5 |
| E290 | B6 | 5D | D7 | BD | E3 | 62 | 25 | 79 | 8E | 48 | 00 | BD | D5 | D8 | BD | E0 |
| E2A0 | 5C | 25 | 6E | BD | E5 | 82 | 25 | 69 | 30 | 89 | 01 | 00 | 7C | 5D | B5 | FC |
| E2B0 | 5D | B3 | 83 | 00 | 01 | FD | 5D | B3 | 27 | 07 | B6 | 5D | B5 | 81 | 08 | 25 |
| E2C0 | DA | CC | 20 | 20 | FD | 50 | 67 | FC | 5D | B3 | C3 | 00 | 03 | 44 | 56 | 44 |
| E2D0 | 56 | 1F | 98 | C6 | 1C | BD | C1 | 5B | 86 | 4B | B7 | 50 | 69 | BD | C0 | 9C |
| E2E0 | 8D | 4F | B6 | 5D | D6 | BD | E3 | 62 | 25 | 27 | 8E | 48 | 00 | B6 | 5D | B5 |
| E2F0 | 27 | 19 | BD | D5 | D8 | BD | 30 | 5C | 25 | 17 | BD | E6 | A1 | 25 | 12 | 30 |
| E300 | 89 | 01 | 00 | 7A | 5D | B5 | 26 | EA | 16 | FF | 78 | BD | D5 | D8 | BD | DE |
| E310 | 4C | 20 | 2B | 34 | 36 | FF | 59 | 6C | 8E | 58 | 65 | 10 | 8E | 59 | 63 | A6 |
| E320 | 84 | E6 | A4 | A7 | A0 | E7 | 80 | 8C | 59 | 6D | 23 | F3 | FE | 59 | 6C | 35 |
| E330 | B6 | 34 | 03 | B6 | 20 | 01 | B7 | 5D | D7 | B6 | 5D | D5 | 20 | 0B | 34 | 03 |
| E340 | B6 | 20 | 01 | B7 | 5D | D6 | B6 | 5D | D4 | B7 | 5D | D3 | 7F | 5D | D9 | 8D |
| E350 | C2 | 35 | 83 | B6 | 5D | D3 | 84 | 01 | B7 | 5D | D4 | 43 | 84 | 01 | B7 | 5D |
| E360 | D5 | 39 | 34 | 16 | BD | E5 | 32 | A6 | E4 | B7 | 20 | 01 | BD | E6 | F5 | 8E |
| E370 | 5D | 9D | 86 | C4 | BD | E9 | 10 | B6 | 38 | 05 | 2B | 1B | FC | 52 | C6 | 10 |
| E380 | 83 | 0F | 42 | 10 | 22 | 01 | 52 | B6 | 38 | 03 | 85 | 01 | 10 | 27 | 01 | 56 |
| E390 | B6 | 5D | D8 | 27 | E2 | 20 | 29 | 1A | 40 | B6 | 20 | 03 | A7 | 80 | 8C | 5D |
| E3A0 | A2 | 23 | D4 | 1C | BF | B6 | 5D | D8 | 26 | 0B | FC | 52 | C6 | 10 | 83 | 0F |
| E3B0 | 42 | 25 | F0 | 20 | 0B | 1A | 40 | B6 | 5D | 9D | A1 | E4 | 10 | 27 | 01 | 62 |
| E3C0 | 35 | 16 | 16 | 00 | B2 | 34 | 36 | BD | E4 | 29 | 25 | 1D | BD | DF | BC | 25 |
| E3D0 | 18 | BD | E0 | 40 | 86 | FF | A7 | 84 | BD | E0 | 5C | 25 | 05 | BD | E3 | FE |
| E3E0 | 20 | F6 | BD | DE | 64 | 25 | 02 | 35 | B6 | 32 | 66 | 39 | 34 | 36 | 8D | 1B |
| E3F0 | A5 | 85 | 35 | B6 | 34 | 36 | 8D | 13 | AA | 85 | A7 | A4 | 35 | B6 | 34 | 36 |
| E400 | 8D | 09 | A6 | 85 | 43 | A4 | A4 | A7 | A4 | 35 | B6 | 86 | 68 | BD | 8B | 98 |
| E410 | EC | 62 | 44 | 56 | 44 | 56 | 44 | 56 | 84 | 01 | C3 | 00 | C0 | 31 | AB | E6 |
| E420 | 63 | C4 | 07 | A6 | A4 | 8E | D2 | 0D | 39 | 34 | 36 | BD | E4 | 77 | 25 | 42 |
| E430 | 86 | 68 | BD | 8B | 98 | 10 | BF | 5D | AF | 1F | 21 | 4F | 5F | BD | E5 | 82 |
| E440 | 25 | 2D | 30 | 89 | 01 | 00 | CC | 00 | 01 | BD | E5 | 82 | 25 | 21 | 86 | FF |
| E450 | A7 | 89 | 01 | 00 | BE | 5D | AF | 10 | 8E | 80 | 65 | C6 | 0B | A6 | 80 | A1 |
| E460 | A0 | 26 | 07 | 5A | 26 | F7 | 1C | FE | 35 | B6 | 8E | EA | 01 | 20 | 03 | 8E |
| E470 | EA | 5D | 1A | 01 | 32 | 66 | 39 | 34 | 16 | B6 | 5D | D9 | 10 | 26 | 00 | A2 |
| E480 | 4F | B7 | 5D | AF | B7 | 5D | D1 | B7 | 5D | D2 | BD | E5 | 32 | 1A | 50 | 86 |
| E490 | 7F | B7 | 30 | 20 | 86 | FF | B7 | 52 | C5 | B7 | 5D | 80 | B6 | 38 | 02 | BD |
| E4A0 | D2 | B0 | BD | E5 | 58 | BD | E6 | F5 | 1C | AF | 86 | 00 | BD | E9 | 10 | B6 |
| E4B0 | 38 | 05 | 84 | 40 | B7 | 5D | B0 | B6 | 5D | D8 | 26 | 3D | BD | D5 | D8 | B6 |
| E4C0 | 38 | 05 | 84 | 40 | B8 | 5D | B0 | 26 | 22 | B6 | 38 | 03 | 85 | 01 | 27 | 16 |
| E4D0 | FC | 52 | C6 | 10 | 83 | 0F | 42 | 23 | DE | 8E | EA | 11 | 86 | D0 | BD | E9 |
| E4E0 | 10 | 32 | 64 | 1A | 01 | 39 | 8E | F4 | 63 | 20 | F1 | FC | 52 | C6 | 10 | 83 |

-continued

| | | | | | | | | | | | | | | | | |
|---|---|---|---|---|---|---|---|---|---|---|---|---|---|---|---|---|
| E4F0 | 14 | 58 | 22 | E5 | B6 | 5D | D8 | 27 | F2 | BD | E6 | F5 | FC | 52 | C6 | 10 |
| E500 | 83 | 07 | A1 | 22 | 28 | 8D | 5A | 25 | F3 | BD | E6 | F5 | FC | 52 | C6 | 10 |
| E510 | 83 | 01 | 12 | 22 | 18 | 8D | 4A | 25 | F3 | FC | 52 | C6 | 10 | 83 | 00 | F7 |
| E520 | 23 | 0B | 86 | 01 | B7 | 5D | D9 | 1A | 40 | 1C | FE | 35 | 96 | 8E | EA | 22 |
| E530 | 20 | AF | BD | F3 | 60 | C6 | 10 | B6 | 5D | D3 | 27 | 02 | C6 | 20 | 34 | 04 |
| E540 | B6 | 5D | 81 | 84 | 03 | B7 | 30 | 28 | C6 | 13 | 5A | 26 | FD | 8A | 04 | AA |
| E550 | E0 | B7 | 30 | 28 | B7 | 5D | 81 | 39 | 34 | 02 | 86 | 15 | BD | 8C | E6 | 35 |
| E560 | 82 | B6 | 38 | 05 | 1F | 89 | B8 | 5D | AF | B4 | 5D | AF | 84 | 40 | 26 | 06 |
| E570 | F7 | 5D | AF | 1A | 01 | 39 | F7 | 5D | AF | 1C | FE | 39 | 34 | 16 | 86 | 02 |
| E580 | 20 | 09 | 34 | 16 | BD | E6 | B6 | 25 | 7A | 86 | 0A | B7 | 5D | D0 | E6 | 61 |
| E590 | C4 | 0F | F7 | 20 | 02 | AE | 62 | 86 | 80 | BD | E9 | 10 | 5F | B6 | 38 | 05 |
| E5A0 | 2B | 1A | B6 | 38 | 05 | 2B | 15 | B6 | 38 | 05 | 2B | 10 | B6 | 38 | 05 | 2B |
| E5B0 | 0B | 85 | 10 | 26 | 53 | B6 | 5D | D8 | 27 | E3 | 20 | 14 | B6 | 20 | 03 | A7 |
| E5C0 | 80 | 5A | 26 | D9 | B6 | 38 | 05 | 85 | 10 | 26 | 3D | B6 | 5D | D8 | 27 | F4 |
| E5D0 | 7A | 5D | D0 | 84 | 3C | 27 | 0C | 85 | 10 | 26 | 0C | 85 | 08 | 26 | 12 | 85 |
| E5E0 | 04 | 26 | 18 | 1C | FE | 35 | 96 | 7D | 5D | D0 | 26 | A2 | 8E | EA | 31 | 20 |
| E5F0 | 12 | 7D | 5D | D0 | 26 | 98 | 8E | EA | 42 | 20 | 08 | 7D | 5D | D0 | 26 | 8E |
| E600 | 8E | EA | 53 | 32 | 64 | 1A | 01 | 39 | 86 | D0 | BD | E9 | 10 | 4F | 5F | FD |
| E610 | 59 | 65 | F7 | 59 | 67 | 8E | EA | C5 | 20 | E9 | 34 | 16 | BD | E6 | B6 | 10 |
| E620 | 25 | 00 | 8E | 86 | 0A | B7 | 5D | D0 | E6 | 61 | C4 | 0F | F7 | 20 | 02 | AE |
| E630 | 62 | 86 | 02 | E6 | E4 | C1 | 05 | 25 | 01 | 4F | 8A | A0 | BD | E9 | 10 | 5F |
| E640 | B6 | 38 | 05 | 2B | 1A | B6 | 38 | 05 | 2B | 15 | B6 | 38 | 05 | 2B | 10 | B6 |
| E650 | 38 | 05 | 2B | 0B | 85 | 10 | 26 | B0 | B6 | 5D | D8 | 27 | E3 | 20 | 14 | A6 |
| E660 | 80 | B7 | 20 | 03 | 5A | 26 | D9 | B6 | 38 | 05 | 85 | 10 | 26 | 9A | B6 | 5D |
| E670 | D8 | 27 | F4 | 7A | 5D | D0 | 84 | 7C | 27 | 10 | 85 | 40 | 26 | 10 | 85 | 10 |
| E680 | 26 | 11 | 85 | 08 | 26 | 17 | 85 | 04 | 26 | 1D | 1C | FE | 35 | 96 | 8E | EA |
| E690 | 73 | 20 | 1E | 7D | 5D | D0 | 26 | 90 | 8E | EA | 31 | 20 | 14 | 7D | 5D | D0 |
| E6A0 | 26 | 86 | 8E | EA | 42 | 20 | 0A | 7D | 5D | D0 | 10 | 26 | FF | 7A | 8E | EA |
| E6B0 | 53 | 32 | 64 | 1A | 01 | 39 | 34 | 06 | B6 | 5D | 81 | 84 | F7 | B7 | 5D | 81 |
| E6C0 | 54 | C4 | 08 | FA | 5D | 81 | F7 | 5D | 81 | F7 | 30 | 28 | EC | E4 | 58 | 49 |
| E6D0 | 58 | 49 | 58 | 49 | 84 | 7F | B7 | 20 | 03 | 86 | 10 | BD | E9 | 10 | B6 | 38 |
| E6E0 | 05 | 85 | 10 | 26 | 09 | B6 | 5D | D8 | 27 | F4 | 1C | FE | 35 | 86 | 1A | 01 |
| E6F0 | 8E | EA | C5 | 35 | 86 | 34 | 06 | 4F | 5F | FD | 52 | C6 | 35 | 86 | 20 | 20 |
| E700 | 46 | 4F | 52 | 4D | 41 | 54 | 54 | 49 | 4E | 47 | 20 | 54 | 52 | 41 | 43 | 4B |
| E710 | 20 | 20 | 20 | 30 | 31 | 20 | 20 | 2F | 20 | 31 | 36 | 30 | FF | 53 | 41 | 56 |
| E720 | 49 | 4E | 47 | 20 | 46 | 49 | 4C | 45 | FF | 43 | 48 | 45 | 43 | 4B | 49 | 4E |
| E730 | 47 | 20 | 44 | 49 | 52 | 45 | 43 | 54 | 4F | 52 | 59 | FF | 8E | E6 | FE | BD |
| E740 | C0 | 54 | 86 | 68 | BD | 8B | 98 | 8E | 80 | 65 | C6 | 50 | BD | 81 | 3D | 4F |
| E750 | C6 | 70 | A7 | A0 | 5A | 26 | FB | C6 | 08 | 86 | FF | A7 | A0 | 5A | 26 | FB |
| E760 | 8E | 01 | 38 | 4F | A7 | A0 | 30 | 1F | 26 | FA | BD | E4 | 77 | 24 | 01 | 39 |
| E770 | 4F | 5F | FD | 5A | 84 | B7 | 50 | 1A | 10 | 8E | E9 | 80 | BD | E8 | 1F | 10 |
| E780 | 25 | 00 | 98 | A6 | A0 | BD | E8 | 44 | 10 | 25 | 00 | 8F | 10 | 8C | E9 | 90 |
| E790 | 25 | F1 | BD | E8 | B2 | 10 | 8E | E9 | 80 | FC | 5A | 84 | C4 | F0 | EA | A0 |
| E7A0 | 8E | 57 | 65 | BD | E5 | 7C | 24 | 15 | FC | 5A | 84 | 10 | 83 | 00 | 40 | 25 |
| E7B0 | 6A | BD | E3 | F4 | B6 | 50 | 1A | 4C | 27 | 03 | B7 | 50 | 1A | 10 | 8C | E9 |
| E7C0 | 90 | 25 | D6 | B6 | 5D | D1 | 4C | B7 | 5D | D1 | C6 | 1E | BD | C1 | 5B | BD |
| E7D0 | C0 | 9C | BD | D5 | D8 | FC | 5A | 84 | C3 | 00 | 10 | FD | 5A | 84 | B6 | 5D |
| E7E0 | D1 | 81 | A0 | 24 | 20 | 85 | 01 | 26 | 8F | 86 | 50 | BD | E9 | 10 | 1C | EF |
| E7F0 | B6 | 38 | 05 | 85 | 10 | 26 | 08 | B6 | 5D | D8 | 27 | F4 | 16 | FF | 79 | 8E |
| E800 | EA | C5 | 1A | 01 | 39 | 86 | 68 | BD | 8B | 98 | 1F | 21 | 4F | 5F | BD | E6 |
| E810 | 1A | 25 | 0B | 5C | 30 | 89 | 01 | 00 | 7E | E6 | 1A | 8E | EA | 8B | 39 | B6 |
| E820 | 5D | 81 | 84 | F7 | F6 | 5D | D1 | 54 | 24 | 02 | 8A | 08 | B7 | 5D | 81 | B7 |
| E830 | 30 | 28 | 86 | F6 | C1 | 28 | 25 | 02 | 84 | FD | BD | E9 | 10 | C6 | 20 | 8E |
| E840 | E9 | 60 | 20 | 7B | B7 | 5D | CD | C6 | 10 | 8E | E9 | 50 | BD | E8 | BF | 25 |
| E850 | 60 | B6 | 5D | D1 | 44 | BD | E8 | EA | 25 | 57 | B6 | 5D | D1 | 84 | 01 | BD |
| E860 | E8 | EA | 25 | 4D | B6 | 5D | CD | BD | E8 | EA | 25 | 45 | 86 | 01 | BD | E8 |
| E870 | EA | 25 | 3E | 86 | F7 | BD | E8 | EA | 25 | 37 | C6 | 16 | 8E | E9 | 60 | BD |
| E880 | E8 | BF | 25 | 2D | C6 | 0F | 8E | E9 | 50 | BD | E8 | BF | 25 | 23 | 86 | FB |
| E890 | BD | E8 | EA | 25 | 1C | 8E | 01 | 00 | 86 | E5 | BD | E8 | EA | 25 | 12 | 30 |
| E8A0 | 1F | 26 | F5 | 86 | F7 | BD | E8 | EA | 25 | 07 | C6 | 18 | 8E | E9 | 60 | 20 |
| E8B0 | 0E | 39 | C6 | 20 | 8E | E9 | 60 | BD | E8 | BF | 24 | F6 | 1C | FE | 39 | B6 |
| E8C0 | 38 | 05 | 2B | 1B | B6 | 38 | 05 | 2B | 16 | B6 | 38 | 05 | 2B | 11 | B6 | 38 |
| E8D0 | 05 | 2B | 0C | 85 | 10 | 26 | 05 | B6 | 5D | D8 | 27 | E3 | 1A | 01 | 39 | A6 |
| E8E0 | 80 | B7 | 20 | 03 | 5A | 26 | D8 | 1C | FE | 39 | F6 | 38 | 05 | 2B | 1B | F6 |
| E8F0 | 38 | 05 | 2B | 16 | F6 | 38 | 05 | 2B | 11 | F6 | 38 | 05 | 2B | 0C | C5 | 10 |
| E900 | 26 | 05 | F6 | 5D | D8 | 27 | E3 | 1A | 01 | 39 | B7 | 20 | 03 | 1C | FE | 39 |
| E910 | 34 | 02 | 7F | 5D | D8 | B7 | 20 | 00 | 86 | 05 | 4A | 26 | FD | 35 | 82 | 34 |
| E920 | 03 | BD | 8C | F3 | 8D | 11 | 86 | FF | B7 | 30 | 20 | B7 | 5D | 80 | 7F | 5D |
| E930 | D9 | 35 | 01 | 1C | AF | 35 | 82 | 34 | 06 | B6 | 5D | 81 | 84 | 03 | B7 | 30 |
| E940 | 28 | C6 | 13 | 5A | 26 | FD | 8A | 04 | B7 | 30 | 28 | B7 | 5D | 81 | 35 | 86 |
| E950 | 00 | 00 | 00 | 00 | 00 | 00 | 00 | 00 | 00 | 00 | 00 | 00 | F5 | F5 | F5 | FE |
| E960 | 4E | 4E | 4E | 4E | 4E | 4E | 4E | 4E | 4E | 4E | 4E | 4E | 4E | 4E | 4E | 4E |
| E970 | 4E | 4E | 4E | 4E | 4E | 4E | 4E | 4E | 4E | 4E | 4E | 4E | 4E | 4E | 4E | 4E |
| E980 | 00 | 0B | 06 | 01 | 0C | 07 | 02 | 0D | 08 | 03 | 0E | 09 | 04 | 0F | 0A | 05 |
| E990 | 55 | 4E | 4B | 4E | 4F | 57 | 4E | 20 | 46 | 49 | 4C | 45 | 20 | 54 | 59 | 50 |
| E9A0 | 45 | FF | 55 | 4E | 41 | 42 | 4C | 45 | 20 | 54 | 4F | 20 | 55 | 50 | 44 | 41 |
| E9B0 | 54 | 45 | 20 | 44 | 49 | 52 | 45 | 43 | 54 | 4F | 52 | 59 | FF | 54 | 4F | 4F |
| E9C0 | 20 | 4D | 41 | 4E | 59 | 20 | 46 | 49 | 4C | 45 | 53 | 20 | 4F | 4E | 20 | 44 |
| E9D0 | 49 | 53 | 4B | FF | 44 | 49 | 53 | 4B | 20 | 49 | 53 | 20 | 46 | 55 | 4C | 4C |
| E9E0 | FF | 46 | 49 | 4C | 45 | 20 | 52 | 45 | 51 | 55 | 49 | 52 | 45 | 53 | 20 | 54 |
| E9F0 | 4F | 4F | 20 | 4D | 41 | 4E | 59 | 20 | 53 | 45 | 47 | 4D | 45 | 4E | 54 | 53 |
| EA00 | FF | 4E | 4F | 54 | 20 | 41 | 20 | 47 | 5A | 2D | 44 | 49 | 53 | 4B | 20 | 21 |

-continued

| | | | | | | | | | | | | | | | | |
|---|---|---|---|---|---|---|---|---|---|---|---|---|---|---|---|---|
| EA10 | FF | 4E | 4F | 20 | 44 | 49 | 53 | 4B | 20 | 49 | 4E | 20 | 44 | 52 | 49 | 56 |
| EA20 | 45 | FF | 52 | 4F | 54 | 41 | 54 | 49 | 4F | 4E | 20 | 53 | 50 | 45 | 45 | 44 |
| EA30 | FF | 52 | 45 | 43 | 4F | 52 | 44 | 20 | 4E | 4F | 54 | 20 | 46 | 4F | 55 | 4E |
| EA40 | 44 | FF | 42 | 41 | 44 | 20 | 44 | 41 | 54 | 41 | 20 | 4F | 4E | 20 | 44 | 49 |
| EA50 | 53 | 4B | FF | 4C | 4F | 53 | 54 | 20 | 44 | 41 | 54 | 41 | FF | 44 | 49 | 53 |
| EA60 | 4B | 20 | 49 | 53 | 20 | 4E | 4F | 54 | 20 | 47 | 5A | 20 | 46 | 4F | 52 | 4D |
| EA70 | 41 | 54 | FF | 44 | 49 | 53 | 4B | 20 | 49 | 53 | 20 | 57 | 52 | 49 | 54 | 45 |
| EA80 | 2D | 50 | 52 | 4F | 54 | 45 | 43 | 54 | 45 | 44 | FF | 55 | 4E | 41 | 42 | 4C |
| EA90 | 45 | 20 | 54 | 4F | 20 | 46 | 4F | 52 | 4D | 41 | 54 | 20 | 44 | 49 | 53 | 4B |
| EAA0 | FF | 46 | 49 | 4C | 45 | 20 | 4E | 4F | 54 | 20 | 46 | 4F | 55 | 4E | 44 | FF |
| EAB0 | 49 | 4E | 54 | 45 | 52 | 4E | 41 | 4C | 20 | 4C | 4F | 47 | 49 | 43 | 20 | 45 |
| EAC0 | 52 | 52 | 4F | 52 | FF | 44 | 49 | 53 | 4B | 20 | 44 | 52 | 49 | 56 | 45 | 20 |
| EAD0 | 4E | 4F | 54 | 20 | 52 | 45 | 41 | 44 | 59 | FF | BD | DF | BC | 25 | 1A | BD |
| EAE0 | E0 | 40 | A6 | 01 | 27 | 0E | BD | C0 | 9C | 81 | 09 | 22 | 07 | 48 | 10 | 8E |
| EAF0 | EA | F8 | 6E | B6 | 8E | E9 | 90 | 1A | 01 | 39 | EB | 0C | EC | 3B | EB | 2F |
| EB00 | ED | A8 | EB | 3E | EC | 0E | EB | 94 | EC | 1D | EC | 2C | B6 | 52 | 99 | BD |
| EB10 | 8B | 98 | 1F | 21 | BD | E0 | 5C | 25 | 15 | BD | E5 | 82 | 25 | 10 | BD | EE |
| EB20 | 35 | 25 | 0B | B6 | 52 | 99 | BD | 8B | BE | C6 | 20 | BD | 81 | 3D | 39 | BD |
| EB30 | EE | 35 | 25 | 09 | 10 | 8E | 6D | 00 | C6 | 6E | BD | 81 | 3D | 39 | F6 | 52 |
| EB40 | 9A | 2B | 2B | C4 | 1F | 86 | 18 | 3D | BD | DF | 49 | 25 | 20 | BF | 5D | B1 |
| EB50 | 86 | 70 | BD | 8B | 98 | B6 | 52 | 9B | 84 | 1F | C6 | 18 | 3D | 31 | AB | C6 |
| EB60 | 18 | BD | DF | 96 | 25 | 07 | A7 | A0 | 5A | 26 | F6 | 1C | FE | 39 | 86 | 70 |
| EB70 | 34 | 02 | BD | 8B | 98 | 1F | 21 | BD | E0 | 5C | 25 | 13 | BD | E5 | 82 | 25 |
| EB80 | 0E | A6 | E4 | 4C | A7 | E4 | 81 | 72 | 23 | E8 | 32 | 61 | 1C | FE | 39 | 32 |
| EB90 | 61 | 1A | 01 | 39 | F6 | 52 | 9A | 2B | 4F | BD | EE | 35 | 25 | 49 | F6 | 52 |
| EBA0 | 9A | C4 | 03 | 58 | 58 | 58 | 3A | 10 | 8E | 50 | EA | B6 | 52 | 9B | 84 | 03 |
| EBB0 | 48 | 48 | 48 | 31 | A6 | C6 | 08 | BD | 81 | 3D | B6 | 52 | 9A | 27 | 08 | BD |
| EBC0 | EE | 35 | 25 | 23 | B6 | 52 | 9A | 4A | 84 | 01 | C6 | 80 | 3D | 8E | 57 | 65 |
| EBD0 | 30 | 8B | 10 | 8E | 51 | 02 | F6 | 52 | 9B | C4 | 03 | 86 | 80 | 3D | 31 | AB |
| EBE0 | C6 | 80 | BD | 81 | 3D | 1C | FE | 39 | BD | EE | 35 | 25 | 20 | 10 | 8E | 50 |
| EBF0 | EA | C6 | 18 | BD | 81 | 3D | 8E | 57 | E5 | 10 | 8E | 51 | 02 | C6 | 80 | BD |
| EC00 | 81 | 3D | BD | E0 | 5C | 25 | 06 | 8E | 51 | 82 | BD | E5 | 82 | 39 | BD | E0 |
| EC10 | 5C | 25 | 09 | BD | CC | 04 | 8E | 67 | 00 | BD | E5 | 82 | 39 | BD | EE | 35 |
| EC20 | 25 | 09 | 10 | 8E | 6D | 80 | C6 | 64 | BD | 81 | 3D | 39 | 8E | 5D | DD | BD |
| EC30 | EE | 3B | 25 | 06 | 8E | 5E | DD | BD | EE | 3B | 39 | F6 | 52 | 9A | 10 | 2B |
| EC40 | 00 | DB | C1 | 64 | 10 | 25 | 00 | 96 | 10 | 27 | 00 | 67 | C1 | 65 | 27 | 36 |
| EC50 | C1 | 67 | 27 | 73 | CC | 73 | 00 | BD | DF | 49 | 25 | C0 | 86 | 70 | BD | 8B |
| EC60 | 98 | 5F | BD | 81 | 3D | 86 | 71 | 34 | 02 | BD | 8B | 98 | 1F | 21 | BD | E0 |
| EC70 | 5C | 25 | 10 | BD | E5 | 82 | 25 | 0B | A6 | E4 | 4C | A7 | E4 | 81 | 72 | 23 |
| EC80 | E8 | 1C | FE | 32 | 61 | 39 | CC | 71 | 00 | BD | DF | 49 | 25 | 24 | C6 | 18 |
| EC90 | 10 | 8E | 50 | EA | BD | 81 | 3D | 8E | 57 | E5 | 10 | 8E | 51 | 02 | C6 | 80 |
| ECA0 | BD | 81 | 3D | BD | EE | 35 | 25 | 0A | 10 | 8E | 51 | 82 | 5F | BD | 81 | 3D |
| ECB0 | 1C | FE | 39 | CC | 70 | 80 | BD | DF | 49 | 25 | F7 | C6 | 64 | 10 | 8E | 56 |
| ECC0 | E6 | BD | 81 | 3D | 1C | FE | 39 | BD | CC | 04 | CC | 71 | 18 | BD | DF | 49 |
| ECD0 | 25 | E0 | C6 | 64 | 10 | 8E | 6D | 80 | BD | 81 | 3D | 1C | FE | 39 | 86 | 20 |
| ECE0 | 3D | BB | 52 | 9A | BD | DF | 49 | 25 | C9 | BF | 5D | B1 | B6 | 52 | 9B | BD |
| ECF0 | 8B | 98 | A6 | A8 | 17 | 2A | 06 | 8E | 88 | DA | 1A | 01 | 39 | 5F | BD | DF |
| ED00 | 96 | 25 | AF | A7 | A0 | 5A | 26 | F6 | B6 | 52 | 9B | BD | 8B | BE | C6 | 20 |
| ED10 | BD | DF | 96 | 25 | 9D | A7 | A0 | 5A | 26 | F6 | 1C | FE | 39 | 8E | 57 | 65 |
| ED20 | BF | 5D | B1 | BD | EE | 3B | 25 | 7F | 4F | B7 | 5D | CD | C6 | 19 | BD | C1 |
| ED30 | 5B | BD | C0 | 9C | B6 | 5D | CD | BD | 8B | 98 | 5F | BD | DF | 89 | B6 | 5D |
| ED40 | CD | BD | 8B | BE | C6 | 20 | BD | DF | 89 | B6 | 5D | CD | 4C | 81 | 63 | 23 |
| ED50 | D8 | 10 | 8E | 56 | E6 | C6 | 64 | BD | DF | 89 | C6 | 1C | BD | DF | 96 | 25 |
| ED60 | 46 | 5A | 26 | F8 | 10 | 8E | 50 | EA | C6 | 18 | BD | DF | 89 | 10 | 8E | 6D |
| ED70 | 80 | C6 | 64 | BD | DF | 89 | C6 | 04 | BD | DF | 96 | 25 | 2A | 5A | 26 | F8 |
| ED80 | 10 | 8E | 51 | 02 | 8E | 01 | 80 | BD | DF | 96 | 25 | 1B | A7 | A0 | 30 | 1F |
| ED90 | 26 | F5 | 86 | 70 | BD | 8B | 98 | 8E | 03 | 00 | BD | DF | 96 | 25 | 08 | A7 |
| EDA0 | A0 | 30 | AF | 26 | F5 | 1C | FE | 39 | 34 | 10 | 8E | 8E | 84 | BD | C0 | 54 |
| EDB0 | BD | F3 | 60 | 35 | 10 | A6 | 05 | B7 | 5A | 7E | EC | 06 | FD | 5A | 7F | BD |
| EDC0 | D2 | B0 | BD | E5 | 58 | BD | EE | 35 | 25 | 15 | BD | EE | 58 | 5F | B6 | 38 |
| EDD0 | 03 | 43 | 44 | 25 | 05 | 8D | 6D | 25 | 07 | 39 | 8E | F4 | 63 | 1A | 01 | 39 |
| EDE0 | A6 | 80 | 7D | 50 | 23 | 27 | 08 | 81 | FE | 27 | 22 | 81 | F8 | 27 | 1E | BD |
| EDF0 | C4 | BE | 81 | F7 | 26 | 17 | 34 | 07 | 1C | BF | 8D | 5C | BD | D2 | B0 | FC |
| EE00 | 52 | C6 | C3 | 00 | 14 | 10 | B3 | 52 | C6 | 26 | FA | 35 | 07 | BD | D5 | D8 |
| EE10 | B6 | 5A | 80 | 4A | B7 | 5A | 80 | 81 | FF | 26 | 12 | B6 | 5A | 7F | 4A | B7 |
| EE20 | 5A | 7F | 81 | FF | 26 | 07 | B6 | 5A | 7E | 4A | B7 | 5A | 7E | 5A | 26 | 9E |
| EE30 | 8D | 12 | 25 | 8B | 39 | BD | CC | 04 | 8E | 57 | 65 | BD | E0 | 5C | 25 | 03 |
| EE40 | BD | E5 | 82 | 39 | 34 | 06 | FC | 5A | 7F | 26 | 09 | B6 | 5A | 7E | 26 | 04 |
| EE50 | 1C | FE | 35 | 86 | 1A | 01 | 35 | 86 | 34 | 36 | 8E | 50 | 61 | 10 | 8E | 5A |
| EE60 | 7E | C6 | 03 | A6 | A0 | BD | C1 | 98 | 5A | 26 | F8 | BD | C0 | 9C | 35 | B6 |
| EE70 | BD | CC | 04 | B6 | 52 | C2 | 10 | 27 | 00 | 80 | B6 | 52 | 90 | 81 | 11 | 22 |
| EE80 | 10 | 8E | F3 | 71 | BD | 95 | 0B | BD | 95 | A6 | 86 | 36 | BD | A0 | 86 | 20 |
| EE90 | 60 | 8E | F3 | 8B | BD | C0 | 24 | 81 | 12 | 26 | 0E | 8E | F3 | EB | BD | C0 |
| EEA0 | 4C | B6 | 5D | B7 | C6 | 38 | BD | C1 | 5B | BD | BF | F4 | FC | 5F | DD | C4 |
| EEB0 | FC | 26 | 02 | C6 | 04 | FD | 5F | DD | 10 | 83 | 03 | FC | 23 | 03 | CC | 03 |
| EEC0 | FC | 44 | 56 | 44 | 56 | F7 | 5D | AF | 1F | 98 | C6 | 23 | BD | C1 | 5B | B6 |
| EED0 | 52 | 90 | 81 | 12 | 27 | 1B | 8E | 6D | 00 | 10 | 8E | 50 | 88 | A6 | 84 | 2B |
| EEE0 | 08 | 81 | 20 | 25 | 04 | C6 | 0A | 20 | 05 | 8E | F3 | FB | C6 | 04 | BD | 81 |
| EEF0 | 55 | 8E | 9F | 21 | BD | C2 | 67 | BD | C0 | 99 | 86 | 14 | BD | 95 | 3A | 81 |
| EF00 | 13 | 27 | 20 | 81 | 12 | 27 | 16 | 81 | 14 | 27 | 42 | 81 | 01 | 10 | 26 | AF |
| EF10 | F6 | BD | 95 | 2A | 86 | 13 | B7 | 52 | 90 | 7C | 52 | C2 | 39 | 8E | 5D | B7 |
| EF20 | 7E | 9B | D5 | B6 | 5D | AF | BD | DB | BE | B1 | 5D | AF | 26 | 01 | 39 | 4D |

-continued

| | | | | | | | | | | | | | | | | |
|---|---|---|---|---|---|---|---|---|---|---|---|---|---|---|---|---|
| EF30 | 26 | 0D | B6 | 5D | AF | 81 | C0 | 22 | 04 | 86 | FF | 20 | 02 | 86 | 01 | 1F |
| EF40 | 89 | 4F | 58 | 49 | 58 | 49 | FD | 5F | DD | 7C | 52 | C2 | 39 | BD | 95 | 2A |
| EF50 | 7F | 52 | 90 | 7C | 52 | C2 | B6 | 52 | 8B | 84 | 03 | 26 | 06 | 8E | F3 | FF |
| EF60 | 7E | 89 | DF | 85 | 01 | 26 | 07 | B6 | 52 | 8A | 2B | 07 | 20 | EF | B6 | 52 |
| EF70 | 89 | 2A | EA | 86 | 04 | B7 | 57 | 4E | FC | 5F | DD | FD | 57 | 52 | 7F | 57 |
| EF80 | 54 | 5F | F7 | 52 | 90 | 86 | 01 | B7 | 52 | C2 | B7 | 57 | 4F | F7 | 57 | 4D |
| EF90 | F7 | 57 | 50 | F7 | 57 | 51 | BD | E2 | 00 | 25 | 11 | 4D | 27 | 1C | BD | 9F |
| EFA0 | 49 | 24 | 12 | 86 | 02 | B7 | 52 | 90 | 7C | 52 | C2 | 39 | BD | E9 | 1F | 7A |
| EFB0 | 52 | 90 | 7E | 89 | DF | BD | 9F | 6A | 25 | F2 | 8E | E7 | 29 | BD | C0 | 54 |
| EFC0 | BD | E0 | 8C | 25 | E7 | 10 | 8E | 6D | 00 | A6 | A4 | 2B | 0C | 81 | 20 | 25 |
| EFD0 | 08 | B6 | 5D | B7 | 84 | 7F | BD | 8D | 94 | BD | D2 | B0 | 4F | 5F | FD | 5A |
| EFE0 | 7E | B7 | 5A | 90 | FD | 52 | C6 | 1A | 10 | 8E | 54 | DE | B6 | 52 | 8B | 85 |
| EFF0 | 01 | 26 | 03 | 8E | 55 | E2 | EC | 81 | FD | 55 | E2 | EC | 84 | FD | 55 | E4 |
| F000 | B3 | 55 | E2 | 24 | 03 | C3 | 00 | 80 | FD | 5A | 84 | 10 | 8E | 48 | 00 | 10 |
| F010 | BF | 54 | DE | 31 | AB | 10 | BF | 54 | E0 | BD | E5 | 58 | 86 | FF | B7 | 30 |
| F020 | 20 | 5F | F7 | 5D | C3 | B6 | 52 | 8B | 85 | 01 | 26 | 02 | C6 | 08 | 1F | 9B |
| F030 | CC | F3 | 27 | FD | 50 | 1B | 86 | 95 | 97 | 00 | 1C | AF | 10 | BE | 54 | DE |
| F040 | BE | 55 | E2 | BC | 55 | E4 | 27 | 03 | A6 | 80 | A7 | A0 | 8C | 56 | E6 | 25 |
| F050 | F2 | 8E | 55 | E6 | 20 | ED | BD | F3 | 60 | 8E | F3 | D5 | BD | C0 | 54 | BD |
| F060 | E0 | 40 | 1C | AF | BD | E0 | 5C | 24 | 06 | 8E | F4 | 38 | 7E | F2 | 42 | FD |
| F070 | 5D | BE | BD | E6 | B6 | 10 | 25 | 01 | C9 | FC | 5A | 84 | 10 | 83 | 01 | 00 |
| F080 | 10 | 24 | 00 | 90 | FC | 52 | C6 | 10 | 83 | 98 | 96 | 10 | 24 | 01 | D6 | B6 |
| F090 | 38 | 03 | 85 | 01 | 10 | 27 | 01 | CD | B6 | 38 | 05 | B8 | 5D | 7E | 84 | 01 |
| F0A0 | 10 | 26 | 01 | C1 | BD | D5 | D8 | 8E | 50 | 72 | 86 | C0 | BD | E9 | 10 | C6 |
| F0B0 | 05 | B6 | 38 | 05 | 2A | 25 | 1A | 50 | B6 | 20 | 03 | A7 | 80 | 86 | 15 | 97 |
| F0C0 | 00 | 1C | EF | B6 | 38 | 05 | 2A | 0C | B6 | 20 | 03 | A7 | 80 | 5A | 26 | 04 |
| F0D0 | 86 | 95 | 97 | 00 | B6 | 5D | D8 | 27 | EA | 20 | 05 | B6 | 5D | D8 | 27 | D1 |
| F0E0 | 1C | AF | 86 | 95 | 97 | 00 | 8E | 50 | 72 | A6 | 02 | 84 | 0F | 34 | 12 | CC |
| F0F0 | 20 | 10 | A7 | 80 | 5A | 26 | FB | 35 | 12 | C6 | 7E | E7 | 86 | B6 | 52 | C2 |
| F100 | 4A | 27 | 06 | B7 | 52 | C2 | 16 | FF | 70 | 86 | 03 | B7 | 52 | C2 | BD | C0 |
| F110 | 9C | 16 | FF | 65 | 1A | 40 | FC | 5D | BE | C4 | 0F | F7 | 20 | 02 | 10 | BE |
| F120 | 54 | DE | C6 | 02 | 81 | 05 | 25 | 01 | 5F | 1F | 98 | 8A | A0 | BD | E9 | 10 |
| F130 | C6 | 15 | 1C | EF | B6 | 38 | 05 | 2B | 31 | B6 | 38 | 05 | 2B | 2C | B6 | 38 |
| F140 | 05 | 2B | 27 | B6 | 38 | 05 | 2B | 22 | B6 | 38 | 05 | 2B | 1D | 1A | 10 | 85 |
| F150 | 10 | 26 | 11 | B6 | 5D | D8 | 10 | 26 | 00 | E6 | B6 | 38 | 03 | 85 | 01 | 26 |
| F160 | D1 | 16 | 01 | 01 | 8E | EA | C5 | 16 | 00 | D8 | 1A | 10 | D7 | 00 | 1C | EF |
| F170 | A6 | A0 | B7 | 20 | 03 | D6 | 00 | C5 | 01 | 26 | 29 | B6 | 38 | 05 | 2B | F0 |
| F180 | B6 | 38 | 05 | 2B | EB | B6 | 38 | 05 | 2B | E6 | B6 | 38 | 05 | 2B | E1 | B6 |
| F190 | 38 | 05 | 2B | DC | B6 | 38 | 05 | 2B | D7 | 85 | 10 | 26 | C7 | B6 | 5D | D8 |
| F1A0 | 27 | D3 | 20 | 6A | C5 | 70 | 27 | 20 | B6 | 38 | 05 | 2A | 05 | A6 | A0 | B7 |
| F1B0 | 20 | 03 | C4 | 7C | FA | 5D | C3 | F7 | 5D | C3 | 96 | 01 | B6 | 38 | 05 | 2A |
| F1C0 | B4 | A6 | A0 | B7 | 20 | 03 | 20 | AD | B6 | 38 | 05 | 2A | 05 | A6 | A0 | B7 |
| F1D0 | 20 | 03 | 96 | 01 | BE | 54 | E0 | A7 | 80 | F6 | 38 | 05 | 2A | 05 | E6 | A0 |
| F1E0 | F7 | 20 | 03 | 8C | 50 | 00 | 25 | 03 | 8E | 48 | 00 | BF | 54 | E0 | F6 | 38 |
| F1F0 | 05 | 2A | 05 | E6 | A0 | F7 | 20 | 03 | FC | 5A | 84 | C3 | 00 | 01 | FD | 5A |
| F200 | 84 | F6 | 38 | 05 | 2A | C0 | E6 | A0 | F7 | 20 | 03 | 7E | F1 | 75 | C6 | 95 |
| F210 | D7 | 00 | 1C | AF | 84 | 7C | 26 | 28 | 10 | 8C | 50 | 00 | 25 | 04 | 10 | 8E |
| F220 | 48 | 00 | 10 | BF | 54 | DE | 1A | 10 | B6 | 5A | 84 | 4A | B7 | 5A | 84 | 1C |
| F230 | EF | FC | 5A | 7E | C3 | 00 | 01 | FD | 5A | 7E | BD | E6 | F5 | 16 | FE | 22 |
| F240 | 8D | 13 | 1A | 50 | 34 | 10 | BD | 8C | A0 | BD | E9 | 1F | 4F | BD | 8B | FB |
| F250 | 35 | 10 | 16 | 97 | 8A | 8E | F4 | 56 | 34 | 16 | C6 | 01 | F7 | 5D | D0 | B6 |
| F260 | 5D | D8 | 7E | E6 | 73 | 1A | 50 | 86 | 15 | 97 | 00 | FC | 5A | 84 | 10 | 83 |
| F270 | 00 | FF | 23 | 07 | 4F | 5F | FD | 5A | 84 | 20 | 0F | BE | 54 | DE | FC | 5D |
| F280 | BE | 1C | EF | BD | E6 | 1A | 10 | 25 | FF | B8 | BD | E0 | 40 | F6 | 5A | 85 |
| F290 | 4F | F3 | 5A | 7F | FD | 5A | 7F | ED | 06 | FD | 57 | 53 | B6 | 5A | 7E | 89 |
| F2A0 | 00 | B7 | 5A | 7E | A7 | 05 | B7 | 57 | 52 | FC | 5A | 7E | 7D | 5A | 80 | 27 |
| F2B0 | 03 | C3 | 00 | 01 | FD | 5A | 7E | 27 | 0D | BD | E0 | 5C | 25 | 1A | FC | 5A |
| F2C0 | 7E | 83 | 00 | 01 | 20 | EE | F6 | 59 | 6B | 27 | 07 | E6 | 5D | F0 | 59 | 6B |
| F2D0 | E7 | 5D | 4F | 5F | A7 | C4 | ED | 41 | 1C | EF | 8E | F4 | 27 | FC | 57 | 52 |
| F2E0 | 26 | 07 | B6 | 57 | 54 | 10 | 27 | FF | 59 | BD | DE | 4C | 10 | 25 | FF | 52 |
| F2F0 | BD | 8C | A0 | BD | E9 | 1F | BD | 8B | FB | 8E | F4 | 6D | BD | C0 | 24 | C6 |
| F300 | 03 | 10 | 8E | 57 | 52 | 8E | 50 | 91 | A6 | A0 | BD | C1 | 98 | 5A | 26 | F8 |
| F310 | FC | 57 | 52 | C3 | 00 | 04 | FD | 5F | DD | 44 | 56 | 44 | 56 | 1F | 98 | C6 |
| F320 | 14 | BD | C1 | 5B | 7E | 8A | 30 | D6 | 00 | 2B | 03 | 16 | D1 | 87 | C5 | 01 |
| F330 | 26 | 03 | 16 | D1 | 80 | C5 | 70 | 27 | 0B | 96 | 01 | C4 | 7C | FA | 5D | C3 |
| F340 | F7 | 5D | C3 | 3B | 96 | 01 | BE | 54 | E0 | A7 | 80 | 8C | 50 | 00 | 25 | 03 |
| F350 | 8E | 48 | 00 | BF | 54 | E0 | FC | 5A | 84 | C3 | 00 | 01 | FD | 5A | 84 | 3B |
| F360 | 34 | 02 | B6 | 5D | 8A | 84 | IF | 8A | 60 | B7 | 30 | 04 | B7 | 5D | 8A | 35 |
| F370 | 82 | 52 | 45 | 43 | 4F | 52 | 44 | 20 | 49 | 4E | 43 | 4F | 4D | 49 | 4E | 47 |
| F380 | 20 | 4D | 49 | 44 | 49 | 20 | 44 | 41 | 54 | 41 | FF | 52 | 45 | 43 | 4F | 52 |
| F390 | 44 | 20 | 4D | 49 | 44 | 49 | 20 | 54 | 4F | 20 | 44 | 49 | 53 | 4B | 3A | 20 |
| F3A0 | 44 | 41 | 54 | 41 | 20 | 4C | 45 | 4E | 47 | 54 | 48 | 20 | 3D | 20 | 20 | 20 |
| F3B0 | 20 | 4B | 20 | 44 | 41 | 54 | 41 | 20 | 52 | 45 | 51 | 55 | 45 | 53 | 54 | 20 |
| F3C0 | 4D | 45 | 53 | 53 | 41 | 47 | 45 | 3A | 5B | 20 | 20 | 20 | 20 | 20 | 20 | 20 |
| F3D0 | 20 | 20 | 20 | 5D | FF | 57 | 41 | 49 | 54 | 59 | 4E | 47 | 20 | 46 | 4F | 52 |
| F3E0 | 20 | 4D | 49 | 44 | 49 | 20 | 44 | 41 | 54 | 41 | FF | 50 | 41 | 52 | 41 | 4D |
| F3F0 | 45 | 54 | 45 | 52 | 20 | 28 | 58 | 29 | 20 | 3D | FF | 4E | 4F | 4E | 45 | 4D |
| F400 | 49 | 44 | 49 | 20 | 49 | 4E | 50 | 55 | 54 | 20 | 53 | 59 | 53 | 54 | 45 | 4D |
| F410 | 20 | 45 | 58 | 43 | 4C | 55 | 53 | 59 | 56 | 45 | 20 | 4E | 4F | 54 | 20 | 45 |
| F420 | 4E | 41 | 42 | 4C | 45 | 44 | FF | 4E | 4F | 20 | 44 | 41 | 54 | 41 | 20 | 52 |
| F430 | 45 | 43 | 45 | 49 | 56 | 45 | 44 | FF | 46 | 49 | 4C | 45 | 20 | 4F | 56 | 45 |
| F440 | 52 | 4C | 4F | 41 | 44 | 20 | 2D | 20 | 54 | 4F | 4F | 20 | 4D | 55 | 43 | 48 |

-continued

| | | | | | | | | | | | | | | | | |
|---|---|---|---|---|---|---|---|---|---|---|---|---|---|---|---|---|
| F450 | 20 | 44 | 41 | 54 | 41 | FF | 4D | 49 | 44 | 49 | 20 | 52 | 45 | 43 | 45 | 49 |
| F460 | 56 | 45 | 20 | 43 | 41 | 4E | 43 | 45 | 4C | 4C | 45 | 44 | FF | 4F | 50 | 45 |
| F470 | 52 | 41 | 54 | 49 | 4F | 4E | 20 | 43 | 4F | 4D | 50 | 4C | 45 | 54 | 45 | 3A |
| F480 | 20 | 20 | 20 | 20 | 4B | 20 | 42 | 59 | 54 | 45 | 53 | 20 | 52 | 45 | 43 | 45 |
| F490 | 49 | 56 | 45 | 44 | 2E | FF | 53 | 45 | 43 | 52 | 45 | 54 | 45 | 4E | 54 | 45 |
| F4A0 | 52 | 20 | 43 | 4F | 44 | 45 | 3A | 20 | 20 | 20 | 20 | 20 | 5B | 20 | 20 | 20 |
| F4B0 | 20 | 20 | 20 | 5D | FF | 53 | 45 | 4C | 45 | 43 | 54 | 20 | 53 | 45 | 43 | 52 |
| F4C0 | 45 | 54 | 20 | 41 | 43 | 43 | 45 | 53 | 53 | 20 | 43 | 4F | 44 | 45 | 20 | 2D |
| F4D0 | 20 | 20 | 52 | 45 | 4D | 45 | 4D | 42 | 45 | 52 | 20 | 49 | 54 | FF | 20 | 20 |
| F4E0 | 20 | 20 | 20 | 20 | 20 | 20 | 20 | 20 | 4E | 4F | 54 | 48 | 49 | 4E | 47 | 20 |
| F4F0 | 48 | 41 | 50 | 50 | 45 | 4E | 45 | 44 | 2E | FF | 4D | 45 | 4D | 4F | 52 | 59 |
| F500 | 20 | 44 | 52 | 4F | 50 | 20 | 2D | 20 | 43 | 48 | 45 | 43 | 4B | 20 | 42 | 41 |
| F510 | 54 | 54 | 45 | 52 | 59 | FF | FC | 5D | A4 | 10 | 83 | AB | CD | 27 | 2A | 8E |
| F520 | 89 | F1 | BD | C0 | 2E | 8E | F4 | FA | BD | C0 | 4C | BD | C0 | 9C | BD | 8A |
| F530 | 8A | CC | AB | CD | FD | 5D | A4 | 7F | 5D | A3 | 8E | F4 | 96 | 10 | 8E | 5D |
| F540 | A6 | C6 | 06 | BD | 81 | 3D | 7F | 67 | 00 | B6 | 5D | A3 | 84 | 80 | B7 | 5D |
| F550 | A3 | 2B | 01 | 39 | BD | D2 | DF | B6 | 52 | 8B | 81 | 01 | 27 | 0A | 81 | 02 |
| F560 | 27 | 06 | CC | C9 | 82 | FD | 50 | 32 | BD | F6 | 45 | BD | D2 | B0 | 4F | B7 |
| F570 | 30 | 10 | 8E | 5D | A6 | 10 | 8E | 5D | A6 | C6 | 06 | BD | 81 | 55 | 86 | 01 |
| F580 | B7 | 52 | C2 | 7F | 5D | AF | CC | 40 | 40 | FD | 5D | 8B | 86 | 1E | B7 | 5D |
| F590 | 8A | B7 | 30 | 04 | BD | C2 | 15 | FC | 52 | C6 | C3 | 00 | 41 | FD | 5D | 9B |
| F5A0 | B6 | 52 | A4 | B7 | 5D | BD | BD | 8D | 3E | BD | F6 | 54 | BD | F8 | A0 | B6 |
| F5B0 | 52 | C2 | 27 | 12 | BD | C2 | BD | 8E | 80 | 3C | BD | C0 | 2E | B6 | 5D | AF |
| F5C0 | BD | 58 | 77 | BD | C0 | 99 | BD | DC | 8E | 27 | 1D | BB | 5D | AF | 2A | 01 |
| F5D0 | 4F | 81 | 05 | 23 | 02 | 86 | 05 | B7 | 5D | AF | 7C | 52 | C2 | 8D | 23 | 10 |
| F5E0 | 25 | FF | C3 | 7F | 5D | A3 | 20 | 5D | 8E | 5D | 9D | F6 | 5D | AF | 3A | A6 |
| F5F0 | 84 | BD | DB | A4 | A1 | 84 | 10 | 27 | FF | AC | A7 | 84 | 7C | 52 | C2 | 16 |
| F600 | FF | A4 | 34 | 36 | C6 | 06 | 8E | 5D | A6 | 10 | 8E | 5D | 9D | A6 | 80 | 81 |
| F610 | 2A | 27 | 2E | A1 | A0 | 26 | 07 | 5A | 26 | F3 | 1C | FE | 35 | B6 | C6 | 05 |
| F620 | 8E | F8 | D9 | 10 | 8E | 5D | 9D | A6 | 80 | A8 | 05 | A1 | A0 | 26 | 0E | 5A |
| F630 | 26 | F5 | 8E | F4 | DE | BD | 8A | 38 | 7C | 52 | C2 | 20 | DD | 1A | 01 | 35 |
| F640 | B6 | 31 | 21 | 20 | D2 | 34 | 16 | CC | 20 | 06 | 8E | 5D | 9D | A7 | 80 | 5A |
| F650 | 26 | FB | 35 | 96 | FC | 52 | C6 | 10 | B3 | 5D | 9B | 22 | 01 | 39 | C3 | 00 |
| F660 | 64 | FD | 5D | 9B | B6 | 5D | B0 | 4C | 84 | 1F | B7 | 5D | B0 | 8E | F6 | 8D |
| F670 | 10 | 8E | D2 | 0D | E6 | 86 | E6 | A5 | 53 | F7 | 30 | 02 | 57 | 5D | 88 | 8B |
| F680 | 08 | E6 | 86 | E6 | A5 | 53 | F7 | 30 | 03 | F7 | 5D | 89 | 39 | 04 | 04 | 05 |
| F690 | 05 | 06 | 06 | 07 | 07 | 07 | 07 | 07 | 06 | 06 | 05 | 05 | 04 | 03 | 03 | 02 |
| F6A0 | 02 | 01 | 01 | 00 | 00 | 00 | 00 | 00 | 01 | 01 | 02 | 02 | 03 | 04 | 04 | 05 |
| F6B0 | 05 | 06 | 06 | 07 | 07 | 07 | 07 | 07 | 06 | 06 | 05 | 05 | 04 | 20 | 20 | 4B |
| F6C0 | 45 | 59 | 42 | 4F | 41 | 52 | 44 | 20 | 4C | 4F | 43 | 4B | 20 | 3D | FF | 20 |
| F6D0 | 20 | 20 | 20 | 20 | 28 | 50 | 52 | 45 | 53 | 53 | 20 | 22 | 57 | 52 | 49 | 54 |
| F6E0 | 45 | 22 | 20 | 41 | 47 | 41 | 49 | 4E | 20 | 54 | 4F | 20 | 45 | 58 | 49 | 54 |
| F6F0 | 29 | 29 | 29 | 29 | 29 | 29 | 29 | 59 | 4C | 45 | 41 | 53 | 45 | 20 | 57 | 52 |
| F700 | 49 | 54 | 45 | 20 | 44 | 4F | 57 | 4E | 20 | 59 | 4F | 55 | 52 | 20 | 4E | 45 |
| F710 | 57 | 20 | 43 | 4F | 44 | 45 | 3A | 22 | 20 | 20 | 20 | 20 | 20 | 20 | 22 | FF |
| F720 | B6 | 5D | A3 | 84 | 7F | 27 | 10 | 81 | 01 | 27 | 1C | 81 | 02 | 10 | 27 | 00 |
| F730 | A8 | 81 | 03 | 10 | 27 | 01 | 0A | B6 | 5D | A3 | 84 | 80 | 8A | 01 | B7 | 5D |
| F740 | A3 | B7 | 52 | C2 | 16 | FE | FE | B6 | 52 | C2 | 27 | 2F | 8E | F6 | BD | BD |
| F750 | 95 | 0B | B6 | 52 | 90 | 81 | 02 | 25 | 08 | 80 | 02 | BD | C2 | DB | BD | F8 |
| F760 | 77 | B6 | 5D | A3 | 84 | 80 | C6 | 15 | BD | BF | E2 | B6 | 52 | 90 | 81 | 01 |
| F770 | 26 | 06 | CC | 15 | 03 | BD | C2 | 8F | BD | C0 | 99 | 86 | 07 | BD | 95 | 3A |
| F780 | 81 | 01 | 27 | 2D | 8E | 5D | 9B | F6 | 52 | 90 | 3A | A6 | 84 | BD | DB | A4 |
| F790 | A1 | 84 | 27 | 05 | A7 | 84 | 7C | 52 | C2 | BD | F6 | 02 | 25 | 12 | 7C | 5D |
| F7A0 | A3 | 7F | 5D | AF | 10 | 8E | 5D | 9D | 8E | 5D | A6 | C6 | 0F | BD | 81 | 3D |
| F7B0 | 39 | B6 | 5D | A3 | 48 | 49 | 84 | 01 | 34 | 02 | BD | DB | B5 | A1 | EO | 26 |
| F7C0 | 01 | 39 | 2B | 09 | 27 | 07 | 86 | 80 | BA | 5D | A3 | 20 | 05 | B6 | 5D | A3 |
| F7D0 | 84 | 7F | B7 | 5D | A3 | 7C | 52 | C2 | 39 | B6 | 52 | C2 | 27 | 28 | 8E | F4 |
| F7E0 | B5 | BD | C0 | 2E | 8E | F4 | 9C | BD | C0 | 4C | BD | C2 | BD | B6 | 5D | AF |
| F7F0 | BD | F8 | 77 | BD | C0 | 99 | B6 | 5D | 8F | 85 | 10 | 26 | 2F | BD | DC | 8E |
| F800 | 27 | 13 | BB | 5D | AF | 2A | 01 | 4F | 81 | 05 | 23 | 02 | 86 | 05 | B7 | 5D |
| F810 | AF | 7C | 52 | C2 | 39 | 8E | 5D | 9D | F6 | 5D | AF | 3A | A6 | 84 | BD | DB |
| F820 | A4 | A1 | 84 | 26 | 01 | 39 | A7 | 84 | 7C | 52 | C2 | 39 | 8E | 5D | 9D | 10 |
| F830 | 8E | 5D | A6 | C6 | 06 | BD | 81 | 3D | 7C | 5D | A3 | 7C | 52 | C2 | 16 | FE |
| F840 | 04 | B6 | 52 | C2 | 27 | 18 | BD | C2 | F1 | 8E | F6 | CF | BD | C0 | 24 | 8E |
| F850 | 5D | A6 | 10 | 8E | 50 | 93 | C6 | 06 | BD | 81 | 3D | BD | C0 | 99 | B6 | 5D |
| F860 | 8F | 85 | 10 | 26 | 01 | 39 | B6 | 5D | A3 | 84 | 80 | B7 | 5D | A3 | 7F | 52 |
| F870 | 90 | 7C | 52 | C2 | 16 | FD | CE | 34 | 36 | 8E | F4 | 9C | BD | C0 | 4C | 8E |
| F880 | 5D | 9D | 10 | 8E | 50 | 83 | 5F | E1 | E4 | 26 | 0A | A6 | 84 | BD | C3 | 7D |
| F890 | 86 | FF | A7 | A8 | 50 | A6 | 80 | A7 | A0 | 5C | C1 | 05 | 23 | E9 | 35 | B6 |
| F8A0 | B6 | 5D | 98 | 26 | 01 | 39 | FC | 52 | C6 | 10 | B3 | 5D | 99 | 22 | 01 | 39 |
| F8B0 | B6 | 5D | 97 | 26 | 12 | 7C | 5D | 97 | BD | C0 | 9C | FC | 52 | C6 | C3 | 01 |
| F8C0 | 04 | C4 | 80 | FD | 5D | 99 | 39 | 7F | 5D | 97 | BD | C0 | 9C | FC | 52 | C6 |
| F8D0 | C3 | 02 | 09 | C4 | 80 | FD | 5D | 99 | 39 | 86 | 99 | 4A | 26 | FD | 39 | DE |
| F8E0 | C0 | 10 | 7C | A4 | B6 | 52 | C2 | 27 | 12 | 8E | FD | C6 | BD | 95 | 0B | BD |
| F8F0 | BF | F4 | 8E | 98 | A7 | BD | C2 | 67 | BD | C0 | 99 | 86 | 01 | BD | 95 | 3A |
| F900 | BD | 95 | 2A | 7F | 5D | 85 | 86 | 01 | B7 | 5D | 84 | B7 | 5D | 8E | 7F | 52 |
| F920 | 5D | 85 | C4 | 07 | F7 | 5D | 85 | B6 | 5D | 92 | 81 | 54 | 27 | 6F | B6 | 5D |
| F930 | 8E | 27 | 2E | C6 | 07 | 8E | D2 | 0D | A5 | 85 | 26 | 03 | 5A | 2A | F9 | BD |
| F940 | FD | AC | B6 | 5D | 8A | 84 | FE | B7 | 5D | 8A | B7 | 30 | 04 | A6 | 85 | 43 |
| F950 | B7 | 30 | 02 | F7 | 5D | 85 | 4F | 5F | FD | 5D | B3 | FD | 5D | B5 | 7C | 52 |
| F960 | C2 | F6 | 5D | 85 | 8E | F9 | BB | 58 | AE | 85 | AD | 84 | B6 | 52 | C7 | 2A |
| F970 | 08 | 86 | 01 | B7 | 52 | C2 | B7 | 52 | C7 | B6 | 5D | 7C | 2A | 04 | 84 | 01 |

-continued

| | | | | | | | | | | | | | | | | |
|---|---|---|---|---|---|---|---|---|---|---|---|---|---|---|---|---|
| F980 | 26 | 12 | B6 | 5D | 85 | 81 | 02 | 10 | 27 | FF | 8B | B6 | 5D | 8F | 85 | 01 |
| F990 | 10 | 27 | FF | 82 | 7F | 5D | 84 | 7C | 52 | C2 | 16 | 04 | 0F | 8E | 80 | B6 |
| F9A0 | BD | C0 | 24 | BD | C0 | 99 | 7F | 5D | AF | BD | 8C | 53 | 7C | 5D | AF | B6 |
| F9B0 | 5D | AF | 81 | 14 | 25 | F3 | 7F | 5D | 8E | 20 | B1 | F9 | CB | FA | 7A | FA |
| F9C0 | F6 | FB | DD | FB | 46 | FC | 52 | FD | 3B | FD | 2B | B6 | 52 | C2 | 10 | 27 |
| F9D0 | 00 | 5B | 8E | FD | D8 | BD | C0 | 24 | B6 | 5D | B3 | C6 | 05 | BD | C1 | 5B |
| F9E0 | B6 | 5D | B5 | 27 | 05 | C6 | 15 | BD | C1 | 5B | B6 | 5D | B6 | 27 | 05 | C6 |
| F9F0 | 25 | BD | C1 | 5B | 4F | BD | 8B | FB | 96 | 7B | B1 | 5D | CF | 25 | 03 | B7 |
| FA00 | 5D | CF | C6 | 05 | 3D | BD | FD | A1 | 86 | 2A | 10 | 8E | 50 | 72 | 5D | 27 |
| FA10 | 05 | A7 | A0 | 5A | 26 | FB | 86 | 20 | 10 | 8C | 50 | 9A | 24 | 04 | A7 | A0 |
| FA20 | 20 | F6 | B6 | 5D | CF | C6 | 28 | BD | C1 | 5B | BD | C0 | 99 | 8E | 00 | 00 |
| FA30 | A6 | 89 | 5B | 4D | 26 | 08 | 30 | 01 | 8C | 00 | 58 | 23 | F3 | 39 | 7C | 52 |
| FA40 | C2 | 34 | 02 | 1F | 10 | 5C | F7 | 5D | B3 | 35 | 02 | 81 | 10 | 25 | 1C | 1A |
| FA50 | 40 | A6 | 89 | 5B | 4D | 80 | 10 | A7 | 89 | 5B | 4D | 1C | BF | A6 | 89 | 5A |
| FA60 | 8D | B7 | 5D | B5 | 7F | 5D | B6 | 7F | 5D | CF | 39 | 6A | 89 | 5B | 4D | A6 |
| FA70 | 89 | 5A | ED | B7 | 5D | B6 | 7F | 5D | B5 | 39 | B6 | 52 | C2 | 27 | 4D | 8E |
| FA80 | B7 | 56 | BD | C0 | 2E | 8E | FE | 01 | BD | C0 | 4C | CC | 5B | 5D | B7 | 50 |
| FA90 | 5C | F7 | 50 | 5F | 8E | 52 | 9F | 10 | 8E | FA | EF | E6 | A0 | 27 | 07 | A6 |
| FAA0 | 80 | BD | C1 | 5B | 20 | F5 | 8E | 50 | 4A | C6 | 7E | 81 | 3F | 25 | 0E | C6 |
| FAB0 | 7F | 81 | 40 | 22 | 08 | CC | 7E | 7F | ED | 88 | 13 | 20 | 0C | 34 | 04 | C6 |
| FAC0 | 0A | 3D | BD | FD | A1 | 35 | 02 | A7 | 85 | BD | C0 | 99 | B6 | 5D | 8F | 85 |
| FAD0 | 10 | 27 | 14 | B6 | 5D | 8A | 84 | EF | B7 | 30 | 04 | BD | FD | 87 | B6 | 5D |
| FAE0 | 8A | 8A | 10 | B7 | 30 | 04 | 39 | 85 | 02 | 27 | 03 | BD | FD | 95 | 39 | 30 |
| FAF0 | 34 | 28 | 3C | 49 | 4D | 00 | B6 | 52 | C2 | 27 | 4A | 86 | FF | B7 | 30 | 04 |
| FB00 | 8E | FE | 22 | BD | C0 | 24 | B6 | 38 | 03 | 43 | 84 | 01 | C6 | 7F | F7 | 30 |
| FB10 | 04 | C6 | 32 | BD | BF | E2 | C6 | 3A | B6 | 38 | 03 | 43 | B7 | 5D | B3 | 84 |
| FB20 | 01 | BD | BF | E2 | C6 | 36 | B6 | 5D | B3 | 84 | 02 | BD | BF | E2 | C6 | 3E |
| FB30 | B6 | 5D | B3 | 84 | 08 | BD | BF | E2 | C6 | 42 | B6 | 5D | B3 | 84 | 04 | BD |
| FB40 | BF | E2 | BD | C0 | 99 | 39 | B6 | 52 | C2 | 26 | 01 | 39 | B6 | 5D | B3 | 27 |
| FB50 | 08 | 4A | B7 | 5D | B3 | 7F | 52 | C2 | 39 | 86 | 02 | B7 | 5D | B3 | B6 | 5D |
| FB60 | B5 | 81 | 28 | 23 | 04 | 4F | B7 | 5D | B5 | 81 | 25 | 23 | 07 | BD | FD | AC |
| FB70 | 7C | 5D | B5 | 39 | 8E | FE | 40 | BD | C0 | 24 | BD | C0 | 99 | 8E | D2 | OD |
| FB80 | F6 | 5D | B5 | C1 | 07 | 22 | 07 | 8D | 4D | B7 | 30 | 02 | 20 | E2 | C0 | 08 |
| FB90 | C1 | 07 | 22 | 07 | 8D | 50 | B7 | 30 | 03 | 20 | D5 | C0 | 08 | C1 | 07 | 22 |
| FBA0 | 07 | 8D | 33 | B7 | 30 | 00 | 20 | C8 | C0 | 08 | C1 | 07 | 22 | 07 | 8D | 26 |
| FBB0 | B7 | 30 | 01 | 20 | BB | C0 | 08 | C1 | 04 | 22 | B5 | BD | FD | AC | B6 | 5D |
| FBC0 | 8A | 84 | E0 | B7 | 5D | 8A | A6 | 85 | 43 | 84 | 1F | BA | 5D | 8A | B7 | 5D |
| FBD0 | 8A | B7 | 30 | 04 | 20 | 9A | BD | FD | AC | A6 | 85 | 43 | 39 | B6 | 52 | C2 |
| FBE0 | 26 | 01 | 39 | 4F | BD | FD | AE | 86 | E0 | B4 | 5D | 8A | BD | FD | BF | FC |
| FBF0 | 5D | B3 | 27 | 07 | 83 | 00 | 01 | FD | 5D | B3 | 39 | CC | 01 | 0E | FD | 5D |
| FC00 | B3 | B6 | 5D | B5 | 4C | 84 | 03 | B7 | 5D | B5 | 27 | 0C | 81 | 01 | 27 | 3E |
| FC10 | 8E | FE | 57 | BD | C0 | 24 | 20 | 0C | 86 | 20 | C6 | 50 | 8E | 50 | 4A | A7 |
| FC20 | 80 | 5A | 26 | FB | 8E | 50 | 4A | C6 | 50 | B6 | 28 | 00 | 2B | FB | 86 | 02 |
| FC30 | B7 | 28 | 00 | B6 | 28 | 00 | 2B | FB | A6 | 80 | B7 | 28 | 01 | 5A | 26 | F3 |
| FC40 | B6 | 28 | 00 | 2B | FB | 86 | 0C | B7 | 28 | 00 | 7F | 52 | C2 | 39 | 86 | FF |
| FC50 | 20 | C8 | B6 | 5D | B3 | 81 | 40 | 25 | 04 | 81 | DF | 23 | 05 | 86 | 40 | B7 |
| FC60 | 5D | B3 | B6 | 52 | C2 | 27 | 50 | 8E | FE | 77 | BD | CO | 24 | B6 | 5D | B3 |
| FC70 | 8E | 50 | 63 | BD | C1 | 98 | 4F | BD | C1 | 98 | B6 | 5D | B3 | 81 | 60 | 25 |
| FC80 | 05 | 86 | 35 | B7 | 50 | 5A | B6 | 5D | B5 | 27 | 29 | 8E | FE | 89 | BD | C0 |
| FC90 | 4C | B6 | 5D | B5 | 81 | 01 | 27 | 0C | 86 | 55 | B7 | 50 | 82 | 86 | 7C | C6 |
| FCA0 | 39 | BD | C1 | 5B | 85 | 02 | 27 | 0C | 86 | 55 | B7 | 50 | 88 | 86 | 7D | C6 |
| FCB0 | 3F | BD | C1 | 5D | BD | C0 | 99 | B6 | 5D | B3 | 81 | 60 | 25 | 0C | 80 | 60 |
| FCD0 | 00 | 86 | FF | B7 | 30 | 20 | B6 | 38 | 02 | 1A | 50 | E6 | 84 | 4F | A7 | 84 |
| FCE0 | 12 | 12 | A6 | 84 | 26 | 32 | 86 | AA | A7 | 84 | 12 | 12 | A6 | 84 | 81 | AA |
| FCF0 | 26 | 26 | 86 | 55 | A7 | 84 | 12 | 12 | A6 | 84 | 81 | 55 | 26 | 1A | 86 | FF |
| FD00 | A7 | 84 | 12 | 12 | A6 | 84 | 81 | FF | 26 | 0E | E7 | 80 | 1C | AF | 31 | 3F |
| FD10 | 26 | C7 | 7C | 5D | B3 | 1C | AF | 39 | E7 | 84 | B6 | 5D | B3 | 48 | 49 | 48 |
| FD20 | 49 | 84 | 03 | BA | 5D | B5 | B7 | 5D | B5 | 20 | E7 | B6 | 52 | C2 | 26 | 01 |
| FD30 | 29 | 8E | FE | 92 | BD | C0 | 24 | BD | C0 | 99 | 39 | B6 | 52 | C2 | 27 | F0 |
| FD40 | 8E | FE | 9F | BD | C0 | 24 | 8E | FF | F2 | 4F | 5F | EB | 80 | 89 | 00 | 8C |
| FD50 | 00 | 00 | 26 | F7 | 8E | 80 | 00 | EB | 80 | 89 | 00 | 8C | FF | F0 | 25 | F7 |
| FD60 | 34 | 06 | 8E | 50 | 5F | BD | C1 | 98 | A6 | 61 | BD | C1 | 98 | 35 | 06 | 8E |
| FD70 | FE | B3 | 10 | B3 | FF | F0 | 27 | 03 | 8E | EA | 42 | 10 | 8E | 50 | 65 | C6 |
| FD80 | 04 | BD | 81 | 3D | 73 | C0 | 99 | 8D | 0C | BD | 8C | 53 | C6 | 40 | F0 | 52 |
| FD90 | A4 | F7 | 52 | AC | 39 | 4F | C6 | 05 | 8E | 52 | A7 | A7 | 85 | 5A | 2A | FB |
| FDA0 | 39 | 44 | 56 | 44 | 56 | 44 | 56 | 44 | 56 | 44 | 56 | 39 | 86 | FF | B7 | 30 |
| FDB0 | 02 | B7 | 30 | 03 | B7 | 30 | 00 | B7 | 30 | 01 | 86 | 1F | BA | 5D | 8A | B7 |
| FDC0 | 5D | 8A | B7 | 30 | 04 | 39 | 20 | 45 | 4E | 54 | 45 | 52 | 20 | 54 | 45 | 53 |
| FDD0 | 54 | 20 | 4D | 4F | 44 | 45 | 3A | FF | 4E | 4F | 54 | 45 | 20 | 38 | 38 | 3A |
| FDE0 | 20 | 20 | 20 | 4F | 4E | 20 | 56 | 45 | 4C | 4F | 20 | 3D | 20 | 20 | 20 | 20 |
| FDF0 | 2C | 20 | 4F | 46 | 46 | 20 | 56 | 45 | 4C | 4F | 20 | 3D | 20 | 20 | 20 | 20 |
| FE00 | FF | 50 | 45 | 44 | 51 | 4C | 53 | 3A | 20 | 20 | 20 | 20 | 20 | 20 | 20 | 20 |
| FE10 | 20 | 20 | 20 | 20 | 20 | 20 | 20 | 20 | 20 | 20 | 57 | 48 | 45 | 45 | 4C | 53 |
| FE20 | 3A | FF | 53 | 57 | 49 | 54 | 43 | 48 | 45 | 53 | 3A | 20 | 57 | 52 | 20 | 20 |
| FE30 | 50 | 41 | 4C | 20 | 45 | 44 | 20 | 20 | 4E | 4F | 20 | 20 | 59 | 45 | 53 | FF |
| FE40 | 54 | 45 | 53 | 54 | 20 | 35 | 20 | 2D | 20 | 52 | 4F | 54 | 41 | 54 | 49 | 4E |
| FE50 | 47 | 20 | 4C | 45 | 44 | 53 | FF | 54 | 45 | 53 | 54 | 20 | 34 | 20 | 2D | 20 |
| FE60 | 4C | 43 | 44 | 20 | 54 | 45 | 53 | 54 | 20 | 2F | 20 | 41 | 4C | 4C | 20 | 4C |
| F270 | 45 | 44 | 53 | 20 | 4F | 4E | FF | 54 | 45 | 53 | 54 | 49 | 4E | 47 | 20 | 52 |
| FE80 | 41 | 4D | 3A | 20 | 55 | 31 | 32 | 34 | FF | 45 | 52 | 52 | 4F | 52 | 20 | 49 |
| FE90 | 4E | FF | 4E | 4F | 20 | 54 | 45 | 53 | 54 | 20 | 48 | 45 | 52 | 45 | FF | 45 |
| FEA0 | 50 | 52 | 4F | 4D | 20 | 43 | 48 | 45 | 43 | 4B | 53 | 55 | 4D | 20 | 54 | 45 |

-continued

| | | | | | | | | | | | | | | | | |
|---|---|---|---|---|---|---|---|---|---|---|---|---|---|---|---|---|
| FEB0 | 53 | 54 | FF | 47 | 4F | 4F | 44 | 42 | C1 | 53 | C9 | 43 | A0 | 53 | C5 | 54 |
| FEC0 | D5 | 50 | A0 | 20 | A0 | 20 | A0 | 00 | 0F | 1E | FF | FF | FF | FF | 20 | CF |
| FED0 | 01 | 00 | FF | 40 | FF | FF | 07 | FF | FF | FF | 01 | 80 | CF | D0 | C5 | D2 |
| FEF0 | C1 | D4 | CF | 52 | 20 | 32 | 72 | 57 | 00 | 21 | FF | 00 | 7F | 01 | 00 | FF |
| FF00 | 40 | FF | FF | 07 | FF | FF | FF | 01 | 80 | CF | D0 | C5 | D2 | C1 | D4 | CF |
| FF10 | 52 | 20 | 33 | 74 | 57 | 00 | 22 | FF | 00 | 7F | 01 | 00 | FF | 40 | FF | FF |
| FF20 | 07 | FF | FF | FF | 01 | 80 | CF | D0 | C5 | D2 | C1 | D4 | CF | 52 | 20 | 34 |
| FF30 | 78 | 57 | 00 | 23 | FF | 00 | 7F | 01 | 00 | FF | 40 | FF | FF | 07 | FF | FF |
| FF40 | FF | 01 | 80 | CF | D0 | C5 | D2 | C1 | D4 | CF | 52 | 20 | 35 | 71 | 57 | 00 |
| FF50 | 24 | FF | 00 | 7F | 01 | 00 | FF | 40 | FF | FF | 07 | FF | FF | FF | 01 | 80 |
| FF60 | CF | D0 | C5 | D2 | C1 | D4 | CF | 52 | 20 | 36 | 72 | 57 | 00 | 25 | FF | 00 |
| FF70 | 7F | 01 | 00 | FF | 40 | FF | FF | 07 | FF | FF | FF | 01 | 80 | CF | D0 | C5 |
| FF80 | D2 | C1 | D4 | CF | 52 | 20 | 37 | 74 | 57 | 00 | 26 | FF | 00 | 7F | 01 | 00 |
| FF90 | FF | 40 | FF | FF | 07 | FF | FF | FF | 01 | 08 | CF | D0 | C5 | D2 | C1 | D4 |
| FFA0 | CF | 52 | 20 | 38 | 78 | 57 | 00 | 27 | FF | 00 | 7F | 01 | 00 | FF | 40 | FF |
| FFB0 | FF | 07 | FF | FF | FF | 01 | 80 | 00 | 10 | 80 | 00 | 00 | A0 | 80 | 00 | 00 |
| FFC0 | A0 | 80 | 00 | 00 | A0 | 80 | 00 | 00 | A0 | 80 | 00 | 00 | A0 | 80 | 00 | 00 |
| FFD0 | A0 | 80 | 00 | 00 | A0 | 80 | 00 | FF | FF | FF | FF | FF | FF | FF | FF | FF |
| FFE0 | FF | FF | FF | FF | FF | FF | FF | FF | FF | FF | FF | FF | FF | FF | FF | FF |
| FFF0 | 10 | F4 | 81 | E1 | 81 | E1 | BF | 05 | C3 | 9A | 81 | E1 | BF | 49 | 81 | E1 |

While the apparatus and methods of the present invention have been summarized and explained by an illustrative embodiment of an improved percussive action electronic keyboard for controlling musical synthesis and sound generation equipment, it will be readily apparent to those skilled in the art that many widely varying embodiments and applications are within the teaching and scope of the present invention, and that the examples presented herein are by way of illustration only and should not be construed as limiting of the scope of the present invention.

We claim:

1. An improved percussive action keyboard for play as a musical instrument of the type having pivoted playing keys having camming surfaces distal from finger contact surfaces thereof, pivoted hammers having cam follower surfaces for following the playing key camming surfaces, hammer stop means for stopping the swing of the hammer in response to depression of its associated key, the improvement comprising:

an action rail for aligning the cam follower surfaces of the pivoted hammers relative to the camming surfaces of the playing keys, each camming surface and cam follower surface having a first positional relationship which establishes a continuously following action arrangement and having a second positional relationship which establishes a discontinuous following action arrangement providing kerchunk, the action rail being adjustable to position the pivoted hammers between the first positional relationship and the second positional relationship.

2. An improved percussive action keyboard for play as a musical instrument of the type having pivoted playing keys having camming surfaces distal from finger contact surfaces thereof, pivoted hammers having cam follower surfaces for following the playing key camming surfaces, hammer stop means for stopping the swing of the hammer in response to depression of its associated key, the improvement comprising:

an action rail for aligning the cam follower surfaces of the pivoted hammers relative to the camming surfaces of the playing keys, the action rail defining a longitudinal slot for receiving at least one preformed hammer flange in snap locking arrangement therein, at least one preformed hammer flange, each flange defining a plurality of hammer stations adapted to receive a hammer in snap locking arrangement therewith, and wherein each of the pivoted hammers includes a journal adapted to snap lock into any one of the hammer stations of the hammer flange.

3. The improved keyboard set forth in claim 2 wherein each of the pivoted hammers includes a tapered web region radially extending from the journal and wherein each hammer station includes a pair of blades facing the tapered web region, the blades contacting the web when the hammer is located in a rest position and the blades not contacting the web when the hammer has moved to a striking position.

4. The improved keyboard set forth in claim 2 wherein the hammer flange includes an adjustable hammer locus adjustment screw, and wherein each pivoted hammer includes a radially extending shelf adapted to contact the screw when the hammer is in a rest position, the screw enabling adjustment of the rest position of the pivoted hammer.

5. The improved keyboard set forth in claim 6 wherein the hammer flange is formed of moldable material, wherein the hammer locus adjustment screw is formed of a material which is dissimilar to the material of the hammer flange and wherein the screw is integrally molded into the flange during the manufacturing process.

6. The improved keyboard set forth in claim 2 wherein the hammer flange includes an adjustable hammer locus adjustment screw, and wherein each pivoted hammer includes a radially extending shelf adapted to contact the screw when the hammer is in a rest position, and further comprising for each hammer a leaf spring connected thereto by a bridle strap, the bridle strap including an end extension adapted to cover and thereby provide padding to said shelf for damping the contact between said adjustment screw and said shelf as the hammer returns to its rest position following actuation during play.

7. The improved keyboard set forth in claim 2 wherein the camming surfaces of the playing keys are provided with a fabric material and wherein each hammer includes a plurality of knife edges in the cam follower surface thereof for engagement with the fabric material of the corresponding playing key as the hammer reaches a striking position, so as to dampen hammer vibration at the striking position.

8. An improved percussive action keyboard for play as a musical instrument of the type having pivoted playing keys having camming surfaces distal from finger contact surfaces thereof, pivoted hammers having cam follower surfaces for following the playing key camming surfaces, hammer stop means for stopping the swing of the hammer in response to depression of its associated key, the improvement comprising: leaf spring means connected to each pivotal hammer by bridle strap means, leaf spring pivot rail means for mounting the leaf spring means and for enabling common rotational adjustment of all of the leaf spring means, leaf spring pivot rail bushing means for enabling the leaf spring pivot rail means to be set at a predetermined distance relative to said pivoted hammers, and wherein the bridle strap means is factory adjustable in length to accommodate the predetermined relative distance between the leaf spring means and the pivoted hammer to which it is attached.

9. An improved percussive action keyboard for play as a musical instrument of the type having pivoted playing keys having camming surfaces distal from finger contact surfaces thereof, pivoted hammers having cam follower surfaces for following the playing key camming surfaces, hammer stop means for stopping the swing of the hammer in response to depression of its associated key, an improved hammer comprising:

a hammer shank having a top rail with hammer weight holding and positioning means, a hammer head positioned at a free end of the hammer for engagement with the hammer stop means, a hammer journal end with means for mounting the hammer on a flange for pivoted action; and a user adjustable hammer weight having engagement means for engaging said hammer weight holding and positioning means at a position selectable by the user thereby to set the weight of the hammer.

* * * * *

UNITED STATES PATENT AND TRADEMARK OFFICE

CERTIFICATE OF CORRECTION

PATENT NO. : 5,003,859

DATED : April 2, 1991

INVENTOR(S) : Charles Monte, et al

It is certified that error appears in the above-identified patent and that said Letters Patent is hereby corrected as shown below:

The drawing sheet, consisting of Fig. 21, should be added as shown on the attached page.

Drawing sheet 15 of 39 should be deleted.

Signed and Sealed this

Thirteenth Day of July, 1993

*Attest:*

Michael K. Kirk

MICHAEL K. KIRK

*Attesting Officer*

*Acting Commissioner of Patents and Trademarks*